US011149328B2

(12) United States Patent
Conner et al.

(10) Patent No.: US 11,149,328 B2
(45) Date of Patent: Oct. 19, 2021

(54) METHOD OF LEACHING ARSENIC FROM ORE COMPRISING COPPER

(71) Applicant: Colorado School of Mines, Golden, CO (US)

(72) Inventors: Kimberly D. Conner, Golden, CO (US); Corby G. Anderson, Golden, CO (US)

(73) Assignee: COLORADO SCHOOL OF MINES, Golden, CO (US)

( * ) Notice: Subject to any disclaimer, the term of this patent is extended or adjusted under 35 U.S.C. 154(b) by 0 days.

(21) Appl. No.: 14/531,770

(22) Filed: Nov. 3, 2014

(65) Prior Publication Data

US 2015/0123030 A1 May 7, 2015

Related U.S. Application Data

(60) Provisional application No. 61/898,781, filed on Nov. 1, 2013.

(51) Int. Cl.

| | |
|---|---|
| ***C22B 15/00*** | (2006.01) |
| ***C22B 1/11*** | (2006.01) |
| ***C22B 30/04*** | (2006.01) |
| ***C22B 3/08*** | (2006.01) |

(52) U.S. Cl.

CPC ..... *C22B 15/0008* (2013.01); *C22B 1/11* (2013.01); *C22B 3/08* (2013.01); *C22B 15/0067* (2013.01); *C22B 15/0071* (2013.01); *C22B 30/04* (2013.01)

(58) Field of Classification Search

CPC ..... C22B 30/04; C22B 1/11; C22B 15/0008; C22B 15/0071

USPC ..... 423/47, 87; 75/711

See application file for complete search history.

(56) References Cited

U.S. PATENT DOCUMENTS

| | | | | |
|---|---|---|---|---|
| 5,002,748 | A * | 3/1991 | Jones | C01G 28/02 423/42 |
| 2008/0173132 | A1* | 7/2008 | Dunn | C22B 15/0008 75/399 |
| 2009/0293680 | A1* | 12/2009 | Ritchie | C22B 1/00 75/744 |
| 2012/0164041 | A1* | 6/2012 | Smith | C01G 28/02 423/87 |
| 2012/0279357 | A1* | 11/2012 | Dixon | C22B 3/24 75/743 |

OTHER PUBLICATIONS

Ackerman, J. B., and C. S. Bucans. 1986. "Plant and Process Startup of the Sunshine Silver Refinery." Minerals and Metallurgical Processing, Feb: 20-32.

Anderson, C. G. 2003. "Treatment of Copper Ores and Concentrates with Industrial Nitrogen Species Catalyzed Pressure Leaching and Non-cyanide Precious Metals Recovery," JOM Journal of the Minerals, Metals and Materials Society 55 (4): 32-36.

Anderson, C. G. 2005. "The Treatment of Arsenic Bearing Ores, Concentrates and Materials with Alkaline Sulfide Hydrometallurgy." In Arsenic Metallurgy, 255-263. San Francisco, CA: TMS.

Anderson, C. G., and L. G. Twidwell. 2008. "Hydrometallurgical Processing of Gold-Bearing Copper Enargite Concentrates." Canadian Metallurgical Quarterly 47 (3): 337-346.

Baláz, P., and M. Achimovicová. 2006. "Selective Leaching of Antimony and Arsenic from Mechanically Activated Tetrahedrite, Jamesonite and Enargite." International Journal of Mineral Processing 81 (1): 44-50.

Bartlett, R. W. 1992. "Upgrading Copper Concentrate by Hydrothermally Converting Chalcopyrite to Digenite." Metallurgical and Materials Transactions B 23 (3): 241-248.

Bartlett, R. W., D. B. Willson, B. J. Savage, and R. J. Wesely. 1986. "A Process for Enriching Chalcopyrite Concentrates." Hydrometallurgical Reactor Design and Kinetics: 227-246.

Chase, Clement K., and wj Sehlitt. 1980. "The Ammonia Leach for Copper Recovery." In Leaching and Recovering Copper Asmined Material Processing Las Vegas Symposium, AIME, New York, 95-103.

Curreli, L., C. Garbarino, M. Ghiani, and G. Orrụ. 2009. "Arsenic Leaching from a Gold Bearing Enargite Flotation Concentrate." Hydrometallurgy 96 (3): 258-263.

Curreli, L., M. Ghiani, M. Surracco, and G. Orrụ. 2005. "Beneficiation of a Gold Bearing Enargite Ore by Flotation and as Leaching with Na-hypochlorite." Minerals Engineering 18 (8): 849-854.

Dixon, D. G., D. D. Mayne, and K. G. Baxter. 2008. "GalvanoxTM—a Novel Galvanically-assisted Atmospheric Leaching Technology for Copper Concentrates." Canadian Metallurgical Quarterly 47 (3): 327-336.

Dutrizac, J. E., and R. J. C. MacDonald. 1972. "The Kinetics of Dissolution of Enargite in Acidified Ferric Sulphate Solutions." Canadian Metallurgical Quarterly 11 (3): 469-476.

Escobar, B., E. Huenupi, and J. V Wiertz. 1997. "Chemical and Biological Leaching of Enargite." Biotechnology Letters 19 (8): 719-722.

Fornasiero, D., D. Fullston, C. Li, and J. Ralston. 2001. "Separation of Enargite and Tennantite from Non-arsenic Copper Sulfide Minerals by Selective Oxidation or Dissolution." International Journal of Mineral Processing 61 (2): 109-119.

(Continued)

*Primary Examiner* — Steven J Bos

(74) *Attorney, Agent, or Firm* — Dorsey & Whitney LLP

(57) ABSTRACT

Disclosed herein is a treated ore solid comprising a reduced amount of a contaminant, for example arsenic, compared to the ore solid prior to treatment. Also disclosed are temperature and pressure modifications, parameters, and methods for treating an ore solid by pressure oxidation leaching of enargite concentrates. The disclosed methods and processes may be applied to copper sulfide orebodies and concentrates containing arsenic. In some cases, the disclosed methods and systems extract, remove, or reduce contaminants, for example arsenic, from an ore containing solution at moderately increased temperature, pressure, and oxygen concentration, and in the presence of an acid.

18 Claims, 114 Drawing Sheets

(56) References Cited

OTHER PUBLICATIONS

Figure 1:
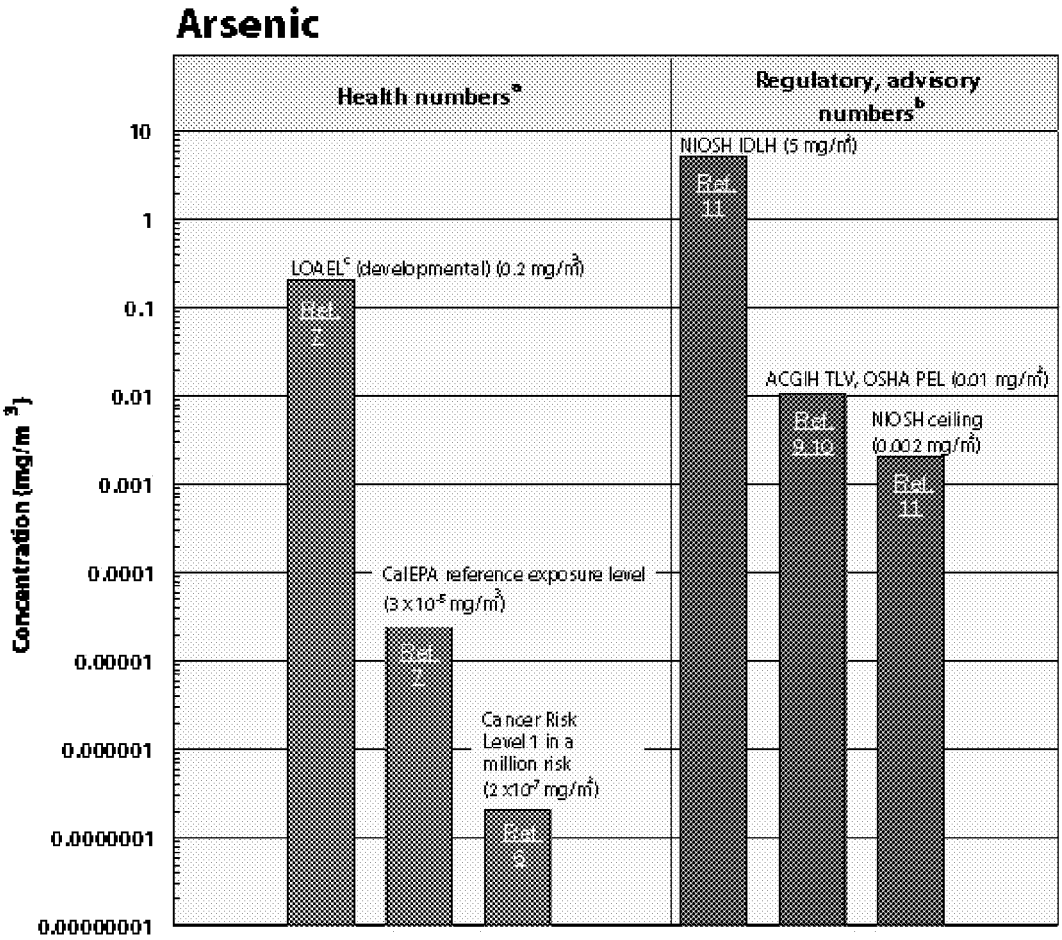

Fuentes, G., J. Vinals, and O. Herreros. 2009a. "Hydrothermal Purification and Enrichment of Chilean Copper Concentrates:: Part 1: The Behavior of Bornite, Covellite and Pyrite." Hydrometallurgy 95 (1-2): 104-112.
Fuentes, G., J. Vinals, and O. Herreros. 2009b. "Hydrothermal Purification and Enrichment of Chilean Copper Concentrates. Part 2: The Behavior of the Bulk Concentrates." Hydrometallurgy 95 (1-2): 113-120.
Fullston, D., D. Fornasiero, and J. Ralston. 1999a. "Oxidation of Synthetic and Natural Samples of Enargite and Tennantite: 1. Dissolution and Zeta Potential Study." Langmuir 15 (13): 4524-4529.
Fullston, D., D. Fornasiero, and J. Ralston. 1999b. "Oxidation of Synthetic and Natural Samples of Enargite and Tennantite: 2. X-ray Photoelectron Spectroscopic Study." Langmuir 15 (13): 4530-4536.
Gajam, S., and S. Raghavan. 1983. "A Kinetic Study of Enargite Dissolution in Ammoniacal Solutions." International Journal of Mineral Processing 10 (2): 113-129.
Lattanzi, P., S. Da Pelo, E. Musu, D. Atzei, B. Elsener, M. Fantauzzi, and A. Rossi. 2008. "Enargite Oxidation: A Review." Earth-Science Reviews 86 (1-4): 62-88.
Marsden, J. O, R. E Brewer, and N. Hazen. 2003. "Copper Concentrate Leaching Developments by Phelps Dodge Corporation." In Hydrometallurgy 2003: 5 Th International Symposium Honoring Professor Ian M. Ritchie, 1429-1446.
Marsden, J. O., J. C. Wilmot, and N. Hazen. 2007a. "Medium-temperature Pressure Leaching of Copper concentrates—Part I—Chemistry and Initial Process Development." Minerals and Metallurgical Processing 24 (4): 193-204.
Marsden, J. O., J. C. Wilmot, and N. Hazen. 2007b. "Medium-temperature Pressure Leaching of Copper concentrates—Part II—Development of Direct Electrowinning and an Acid-autogenous Process." Minerals and Metallurgical Processing 24 (4): 205-217.
Marsden, John O., and Robert E. Brewer. 2003. "Hydrometallurgical Processing of Copper Concentrates by Phelps Dodge at the Bagdad Mine in Arizona." ALTA Copper-8, Perth, WA, pp. 1-18.
Nadkarni, R.M. and Kusik, C.L., 1988. "Hydrometallurgical Removal of Arsenic from Copper Concentrates." In Arsenic Metallurgy Fundamentals and Applications, 263-286. Phoenix, AZ: TMS.
Outotec Oyj Press Release, "Outotec Launches a New Partial Roasting Process to Purify Contaminated Copper and Gold Concentrates.", Dec. 27, 2011. from outotec.com downloaded Mar. 23, 2017.
Padilla, R., C. A. Rivas, and M. C. Ruiz. 2008. "Kinetics of Pressure Dissolution of Enargite in Sulfate-Oxygen Media." Metallurgical and Materials Transactions B 39 (3): 399-407.
Padilla, R., D. Giron, and M. C. Ruiz. 2005. "Leaching of Enargite in $H_2SO_4$—NaCl—$O_2$ Media." Hydrometallurgy 80 (4): 272-279.
Peacey, John G., Mark Z. Gupta, and Kevan J.R. Ford. 2010. "Review of Process Options to Treat Enargite Concentrates." In Proceedings of Copper 2010, 3:1035-1050. Hamburg, Germany: GDMB.
Riveros, P. A., and J. E. Dutrizac. 2008. "The Leaching of Tennantite, Tetrahedrite and Enargite in Acidic Sulphate and Chloride Media." Canadian Metallurgical Quarterly 47 (3): 235-244.
Ruiz, M.C., M.V. Vera, and R. Padilla. 2011. "Mechanism of Enargite Pressure Leaching in the Presence of Pyrite." Hydrometallurgy 105 (3-4) (January): 290-295.
Safarzadeh, M. Sadegh, Michael S. Moats, and Jan D. Miller. 2012a. "Acid Bake-leach Process for the Treatment of Enargite Concentrates." Hydrometallurgy. 119-120 (2012) 30-39.
Safarzadeh, M. Sadegh, Michael S. Moats, and Jan D. Miller. 2012b. "Recent Trends in the Processing of Enargite Concentrates." Mineral Processing and Extractive Metallurgy Review. 35: 283-367, 2014.
Sasaki, K., K. Takatsugi, T. Hirajima, N. Kozai, T. Ohnuki, and O. H Tuovinen. 2009. "Bioleaching of Enargite by Arsenic-Tolerant Acidithiobacillus Ferrooxidans." Advanced Materials Research 71: 485-488.
Welham, N. J. 2001. "Mechanochemical Processing of Enargite ($Cu_3AsS_4$)." Hydrometallurgy 62 (3): 165-173.

* cited by examiner

FIGURE 1. Cymet process steps.

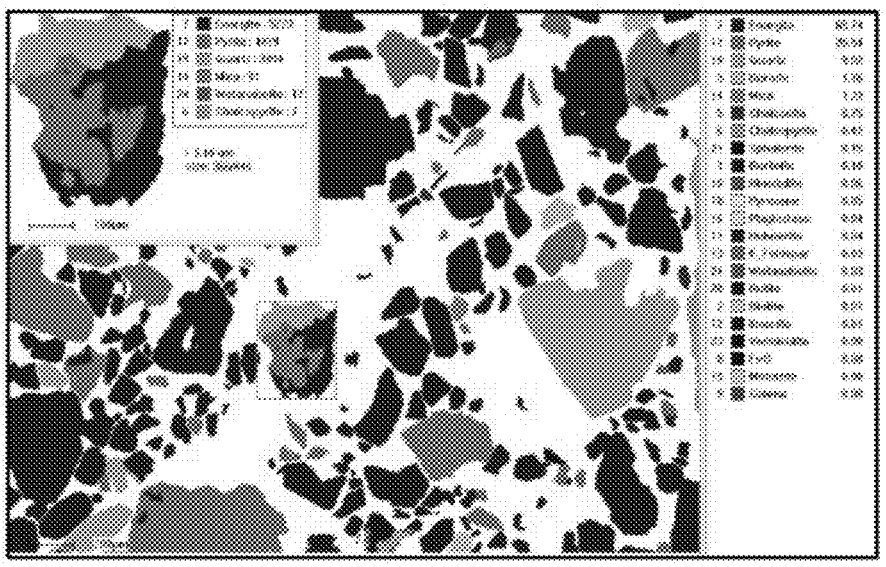
Figure 40
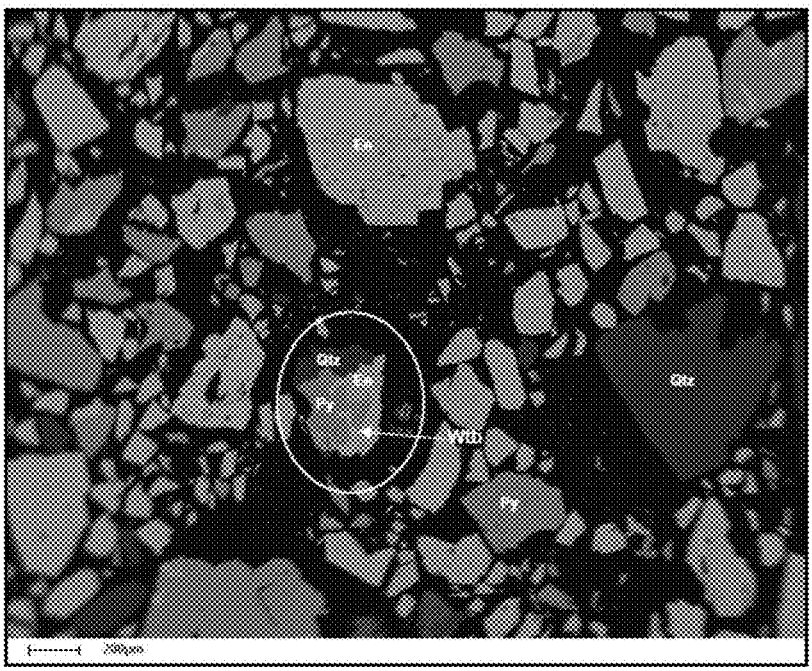
Qtz
Qtz
Qtz

The BSE image shows the pyrite particle with a quartz inclusion in

| ELEMENTS | Molality | Pressure |
|---|---|---|
| Cu | 1.000E-01 | 1.000E+00 |
| S | 1.000E-01 | 1.000E+00 |

| ELEMENTS | Molality | Pressure |
|---|---|---|
| Cu | 1.000E-01 | 1.000E+00 |
| S | 1.000E-01 | 1.000E+00 |

| ELEMENTS | Molality | Pressure |
|---|---|---|
| Cu | 1.000E-01 | 1.000E+00 |
| S | 1.000E-01 | 1.000E+00 |

| ELEMENTS | Molality | Pressure |
|---|---|---|
| Cu | 1.000E-01 | 1.000E+00 |
| S | 1.000E-01 | 1.000E+00 |

| ELEMENTS | Molality | Pressure |
|---|---|---|
| Cu | 1.000E-01 | 2.247E+00 |
| S | 1.000E-01 | 2.247E+00 |

| ELEMENTS | Molality | Pressure |
|---|---|---|
| Cu | 1.000E-01 | 4.625E+00 |
| S | 1.000E-01 | 4.625E+00 |

| ELEMENTS | Molality | Pressure |
|---|---|---|
| Cu | 1.000E-01 | 8.742E+00 |
| S | 1.000E-01 | 8.742E+00 |

| ELEMENTS | Molality | Pressure |
|---|---|---|
| As | 1.000E-01 | 1.000E+00 |

| ELEMENTS | Molality | Pressure |
|---|---|---|
| S | 1.000E-01 | 8.742E+00 |

| ELEMENTS | Molality | Pressure |
|---|---|---|
| Cu | 1.000E-01 | 1.000E+00 |
| S | 1.000E-01 | 1.000E+00 |

| ELEMENTS | Molality | Pressure |
|---|---|---|
| Cu | 3.000E-01 | 1.000E+00 |
| S | 3.000E-01 | 1.000E+00 |

| ELEMENTS | Molality | Pressure |
|---|---|---|
| Cu | 5.000E-01 | 1.000E+00 |
| S | 5.000E-01 | 1.000E+00 |

| ELEMENTS | Molality | Pressure |
|---|---|---|
| Cu | 7.000E-01 | 1.000E+00 |
| S | 7.000E-01 | 1.000E+00 |

| ELEMENTS | Molality | Pressure |
|---|---|---|
| As | 1.000E-01 | 1.000E+00 |

Design-Expert® Software
Factor Coding: Actual
Original Scale
(median estimates)
As Extraction Actual Factors
A: Time = 0.75
B: Temperature = 122.50
C: Cu2+ = 25.00
D: Acid = 20.00
E: Solids = 10.00
*F: O2 Pressure = 50.00

Factors not in Model
F

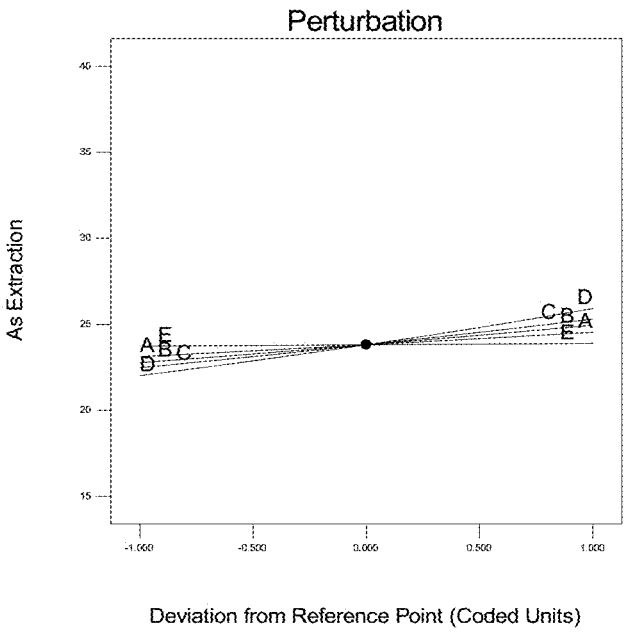

Figure 213

Design-Expert® Software
Factor Coding: Actual
Original Scale
(median estimates)
As Extraction — CI Bands X1 = E: Solids Actual Factors
A: Time = 0.75
B: Temperature = 122.50
C: Cu2+ = 25.00
D: Acid = 20.00
F: O2 Pressure = 50.00

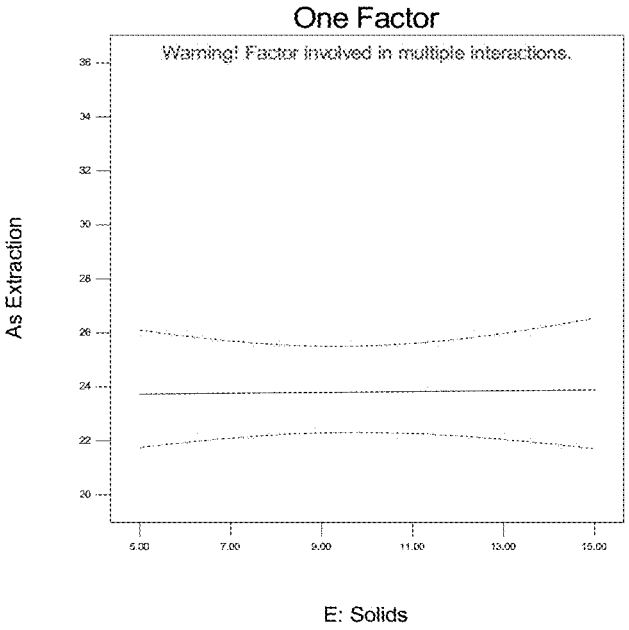

Figure 214

METHOD OF LEACHING ARSENIC FROM ORE COMPRISING COPPER

CROSS REFERENCE TO RELATED APPLICATIONS

This application claims benefit of priority pursuant to 35 U.S.C. § 119(e) of U.S. provisional patent application No. 61/898,781 filed Nov. 1, 2013, which is incorporated herein by reference in its entirety.

FIELD

The disclosed methods, systems, and compositions are directed to extraction of elements, metals, minerals, and compounds from ore solids.

BACKGROUND

Chapter 1—Introduction

Most of the copper produced worldwide comes from sulfide minerals, and a majority of production is through pyrometallurgy as opposed to the use of hydrometallurgical methods.

As easily-accessed sulfide mineral deposits are depleted, producers should mine the more complex sulfides, which are more difficult to process. The concentrates from these sulfides contain various impurities, like arsenic, in copper minerals such as enargite and tennantite. These minerals are evermore present in many copper orebodies.

Copper producers worldwide are required to meet increasingly stringent environmental regulations for gaseous, aqueous and solid waste emissions to the atmosphere. As a result of these regulations, difficulties may be encountered with conventional smelting technology when treating minerals with elements such as arsenic. Conventional smelting/converting technology has a limited capacity and capability to treat arsenic-contaminated concentrates because of the risk of atmospheric pollution and copper cathode quality.

When treated pyrometallurgically, arsenic minerals tend to react easily forming volatile oxides or sulfides or an impure copper product. Many globally significant copper properties have copper sulfide mineralogy high in arsenic present as enargite, $Cu_3AsS_4$. The enargite may contain significant amounts of contained precious metals.

Development of a selective hydrometallurgical approach to efficiently treat copper concentrates containing large amounts of arsenic would mitigate the issue of atmospheric pollution and may be relatively easily integrated into existing pyrometallurgical operations. In order to evaluate an economic hydrometallurgical process to treat enargite, a background understanding of copper processing, arsenic behavior and enargite mineralogy is essential and follows in this dissertation.

1.1 EPA Position on Arsenic

Arsenic occurs naturally throughout the environment but most exposures of arsenic to people are through food. Acute (short-term) high-level inhalation exposure to arsenic dust or fumes has resulted in gastrointestinal effects (nausea, diarrhea, abdominal pain); central and peripheral nervous system disorders have occurred in workers acutely exposed to inorganic arsenic. Chronic (long-term) inhalation exposure to inorganic arsenic in humans is associated with irritation of the skin and mucous membranes. Chronic oral exposure has resulted in gastrointestinal effects, anemia, peripheral neuropathy, skin lesions, hyperpigmentation, and liver or kidney damage in humans. Inorganic arsenic exposure in humans, by the inhalation route, has been shown to be strongly associated with lung cancer, while ingestion of inorganic arsenic in humans has been linked to a form of skin cancer and also to bladder, liver, and lung cancer. The EPA has classified inorganic arsenic as a Group A, human carcinogen.

Arsine, $AsH_3$, is a gas consisting of arsenic and hydrogen. It is extremely toxic to humans, with headaches, vomiting, and abdominal pains occurring within a few hours of exposure. The EPA has not classified arsine for carcinogenicity. The following FIG. 1 shows regulatory values for inhalation exposure to arsenic ("Arsenic Compounds|Technology Transfer Network Air Toxics Web Site|US EPA" 2012).

1.2 Copper Smelting

Because copper smelters deal with a variety of feed materials from a variety of locations, they should develop a method of evaluating the value of what they are processing, also known as a smelter schedule. A smelter schedule from FMI Miami is shown below and again in Chapter 10. Of note is the low acceptable arsenic limit and substantial unit penalties if the concentrate is accepted by the smelter at all.

TABLE 1.1

FMI Miami Copper Smelter Schedule

| Element | Symbol | Penalty Formula | |
|---|---|---|---|
| Alumina | Al2O3 | $0.50 ea 0.1% > 5% | |
| Iron | Fe | >15% = increased treatment charge for more flux needed | |
| Arsenic | As | $0.50/lb > 1% (20 lb) OR 2$/dt ea 0.1% > 0.1% Max 0.2% | |
| Barium | Ba | 0.5 to 1% limit | |
| Beryllium | Be | <10 ppm limit | |
| Bismuth | Bi | ($1.10 to $7.50)/dt ea 0.1% > (0.1% to 0.4%) Max 0.4% | |
| Cyanide | CN | <10 ppm! | |
| Cadmium | Cd | ($2.20 to $7.50)/dt ea 0.1% > (0.05% to 0.2%) Max 0.4% | |
| Chloride | Cl | BAD PLAYER, DO NOT WANT ANY | 5$/dt ea 0.1% > 2% |
| Cobalt | Co | 0.5% limit | |
| Chromium | Cr | $0.50 dt ea 0. 1% > 3% no hex chrome, 5% max on tri v Cr | NO Cu CHROMATE! |
| Fluoride | F | $5 dt ea 0.1% > 0.2% 0.5% max | |
| Mercury | Hg | ($1.85 to $2)/dt ea 10 ppm > 10 ppm | |
| Magnesium Ox | MgO | Normally 10% limit, desirable element in feed??? | |
| Manganese | Mn | 2.0% limit | |
| Sodium | Na | 5.0% limit | |
| Nickel | Ni | $2 dt ea 0.1% > 2% | |
| Phosphorus | P | 3.0% limit | |

TABLE 1.1-continued

| FMI Miami Copper Smelter Schedule | | | |
|---|---|---|---|
| Lead | Pb | $1 dt ea 0.1& > 1% OR $1/lb > 0.5% (more severe) | |
| Antimony | Sb | BAD PLAYER, DO NOT WANT ANY | ($2 to $2.20) dt ea 0.1% > 0.3% |
| Selenium | Se | 0.1% limit | |
| Tin | Sn | ($1.10 to $3) dt ea 0.1% > (0.2 to 3%) Max 3% | |
| Tellurium | Te | 0.01% limit | |
| Thallium | Tl | 0.01% limit | |
| Zinc | Zn | $0.50 dt ea 0.1% > 3% 4.0% limit | |
| Moisture | H2O | $2.50 Wt ea 1% > (15% to 50%) what is the material? | |
| Manifest | | $30 ea | |
| Bag containers | | $20 ea | |
| Liners | | ? # & size? | |

| | | |
|---|---|---|
| Refining Fees Cu = 12¢ to 14¢ per pound paid | Recovery Rates | Cu = 96.5% |
| Au = $6.50 to $7.50 per oz paid | | Au = 90%+ |
| Ag = 50¢ per oz paid | | As = 90%+ |
| 10,000 g or ppm = 1% | | |
| 1,000 = 0.1% | ppm = opt | gmt = # ÷ 31.103481 = opt |
| 100 = 0.01% | 31.103481 | |
| 10 = 0.001% | | 453 gr = 1 lb. |
| 31.1035 gr = 1 troy oz | 14.583 troy oz = 1 pound | Kg/Mt = # × 32.151 = opt |

This smelter schedule shows that this smelter would accept a maximum of 0.2% arsenic before penalties occur. For an orebody processing an enargite ore with high arsenic, sending their concentrate to a smelter can be extremely costly.

BRIEF DESCRIPTIONS OF THE DRAWINGS

The patent or application file contains at least one drawing executed in color. Copies of this patent or patent application publication with color drawing(s) will be provided by the Office upon request and payment of the necessary fee.

FIG. 1: Health Data from Inhalation Exposure (Inorganic Arsenic); ACGIH TLV—American Conference of Governmental and Industrial Hygienists' threshold limit value expressed as a time-weighted average; the concentration of a substance to which most workers can be exposed without adverse effects; NIOSH IDLH—National Institute of Occupational Safety and Health's immediately dangerous to life or health concentration; NIOSH recommended exposure limit to ensure that a worker can escape from an exposure condition that is likely to cause death or immediate or delayed permanent adverse health effects or prevent escape from the environment; NIOSH REL ceiling value—NIOSH's recommended exposure limit ceiling; the concentration that should not be exceeded at any time; OSHA PEL—Occupational Safety and Health Administration's permissible exposure limit expressed as a time-weighted average; the concentration of a substance to which most workers can be exposed without adverse effect averaged over a normal 8-h workday or a 40-h workweek ("Arsenic Compounds|Technology Transfer Network Air Toxics Web Site|US EPA" 2012).

Figure 2:
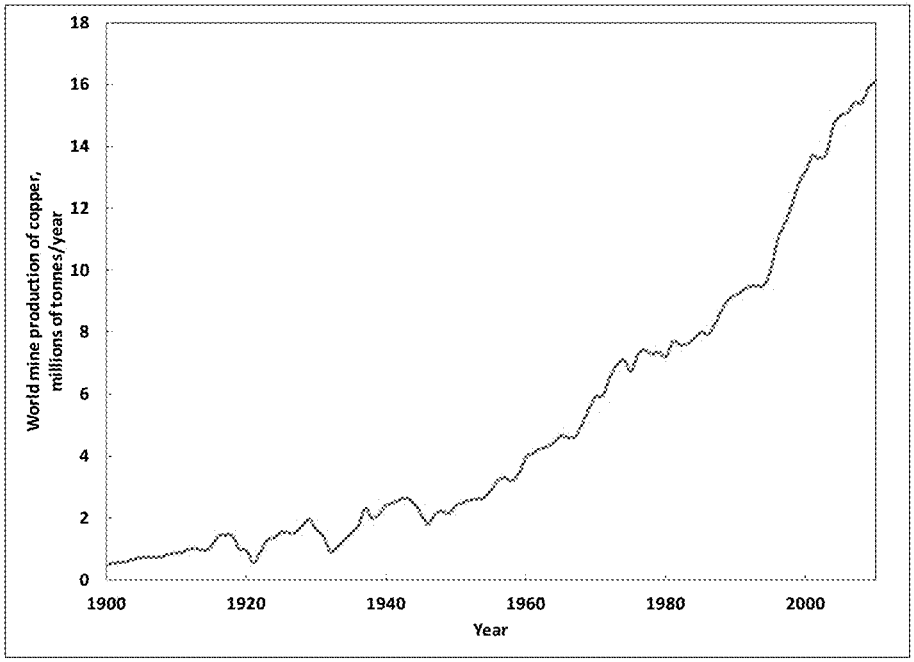

FIG. 2: World mine production of copper in the 20th and 21st centuries through November 2011 (Kelly and Matos 2011).

Figure 3:
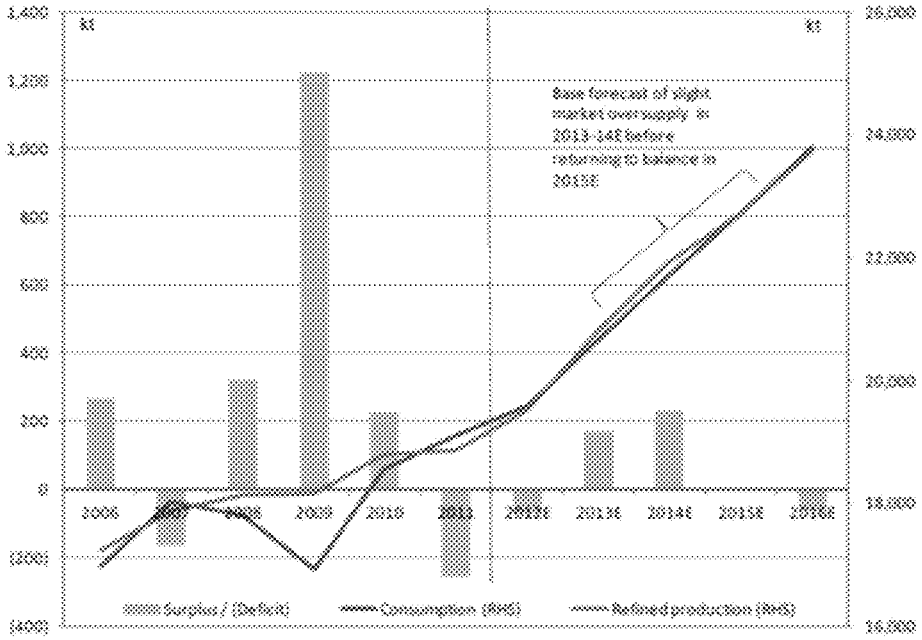

FIG. 3: Goldman Sachs copper supply/demand balance ("Europe: Metals & Mining: Base Metals" 2012).

Figure 4:
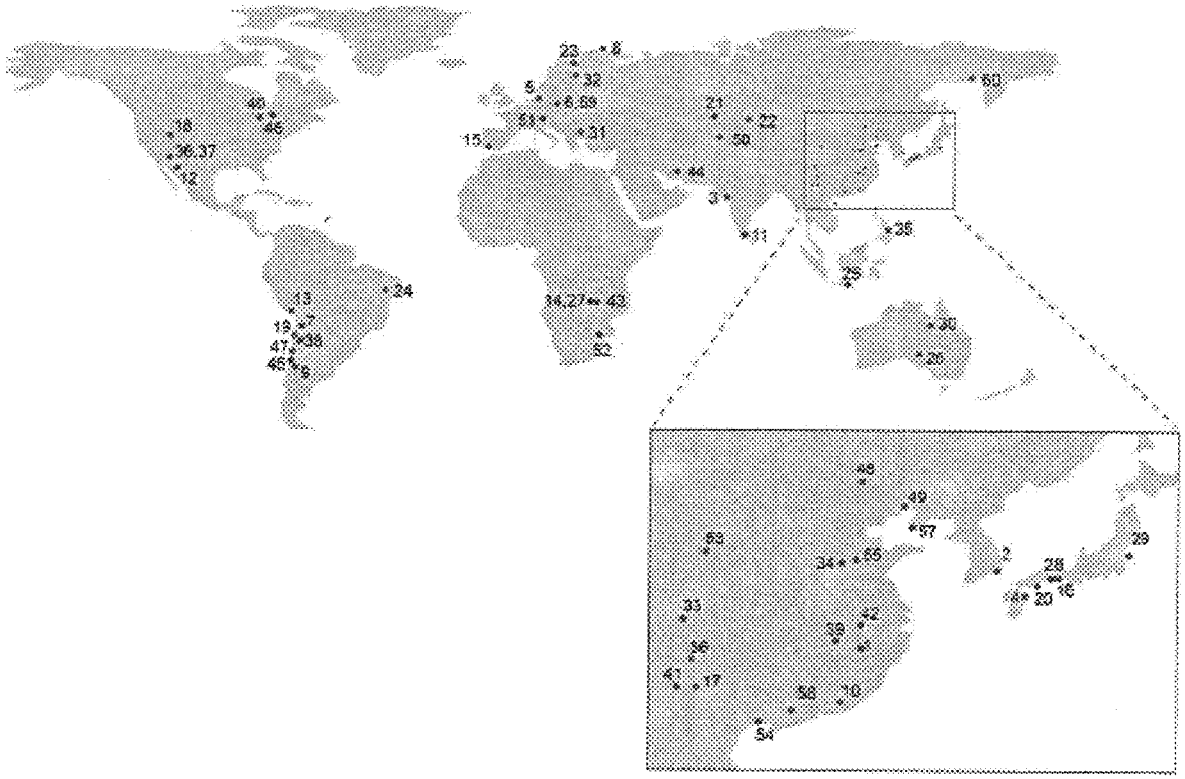

FIG. 4: Primary copper concentrate smelters of the world in 2010 (Schlesinger et al. 2011).

Figure 5:
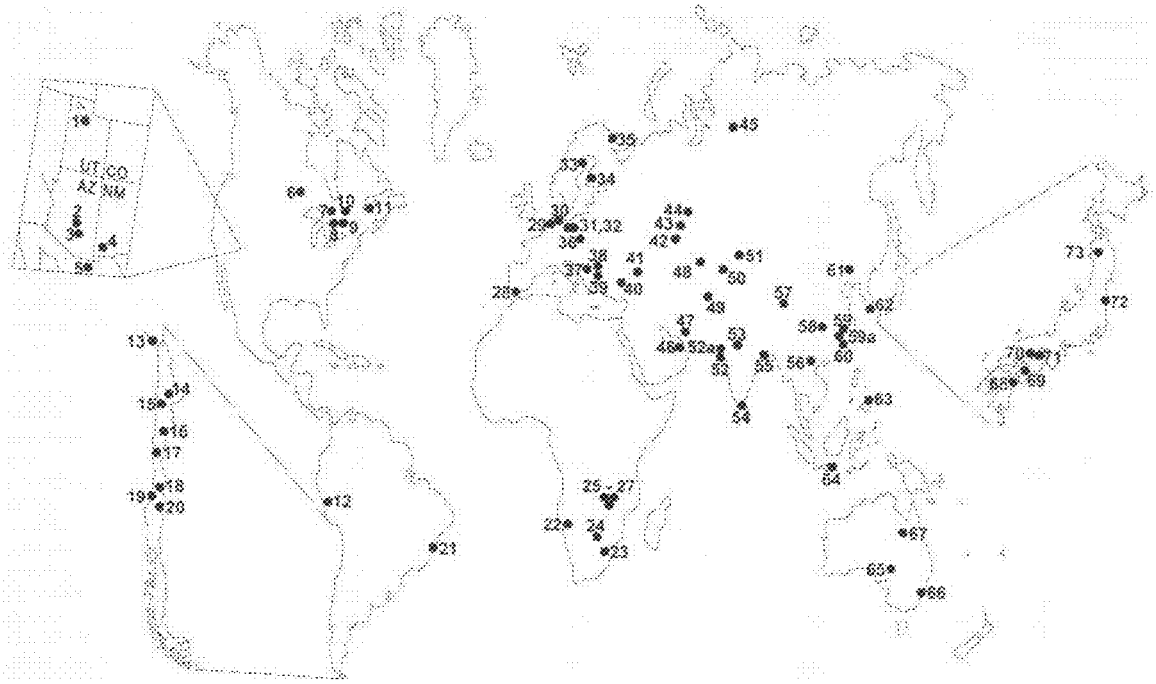

FIG. 5: Primary copper concentrate smelters of the world circa 2002 (Davenport et al. 2002).

Figure 6:
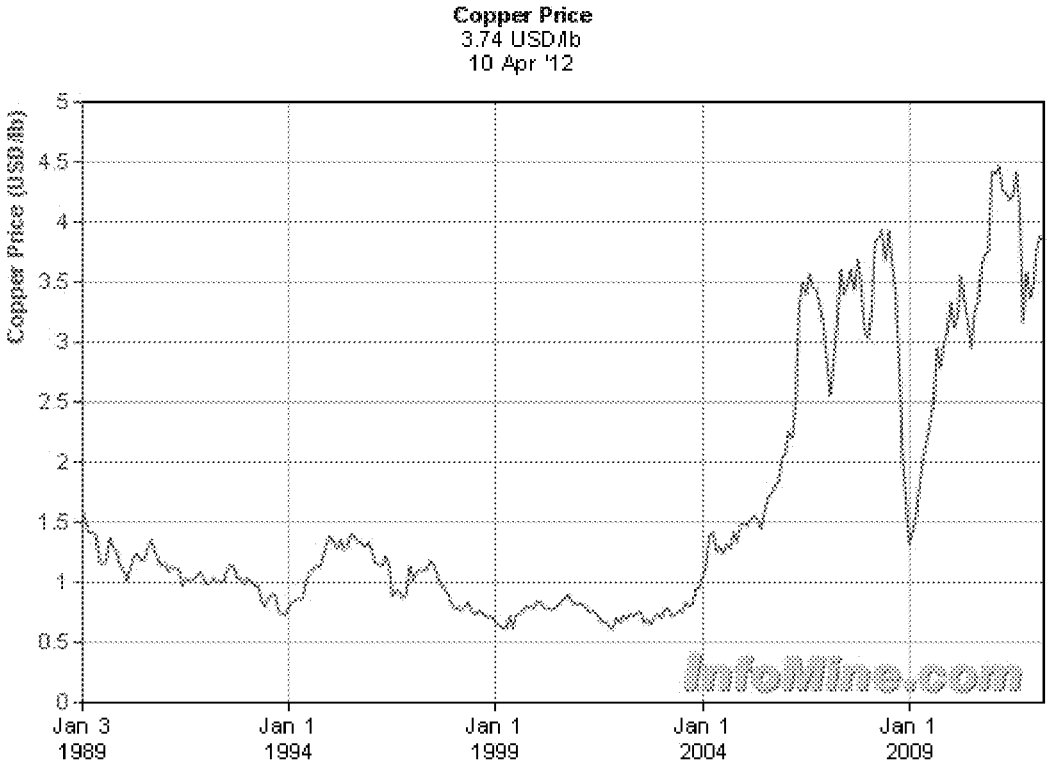

FIG. 6: Historical price of copper (23 years) ("Chart Builder|Charts & DataMine" 2012).

Figure 7:
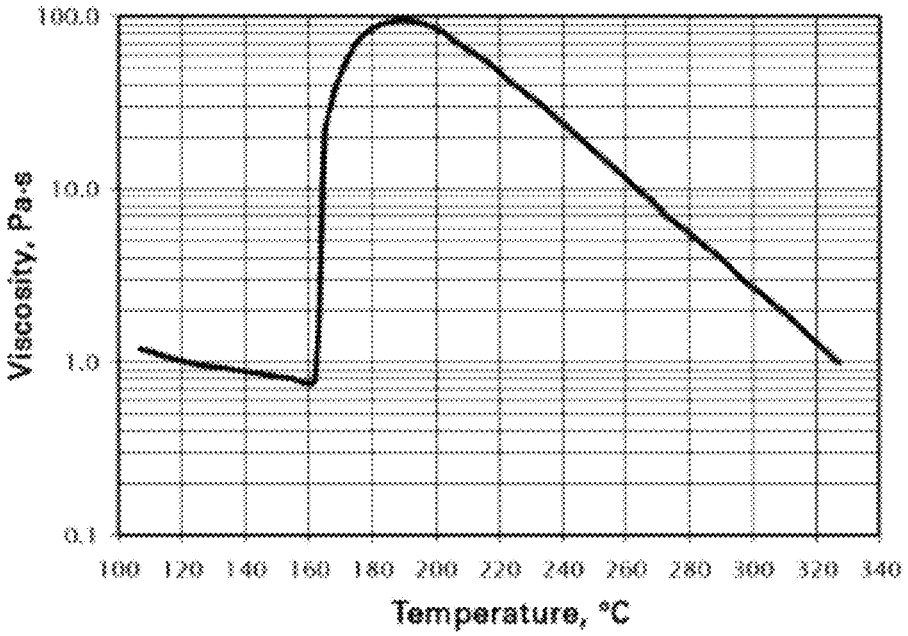

FIG. 7: Viscosity of molten sulfur as a function of temperature (Bacon and Fanelli 1943), (J. O. Marsden, Wilmot, and Hazen 2007a). The sulfur tends to wet sulfide surfaces and may agglomerate to form "prills" (J. O. Marsden, Wilmot, and Hazen 2007a).

Figure 8:
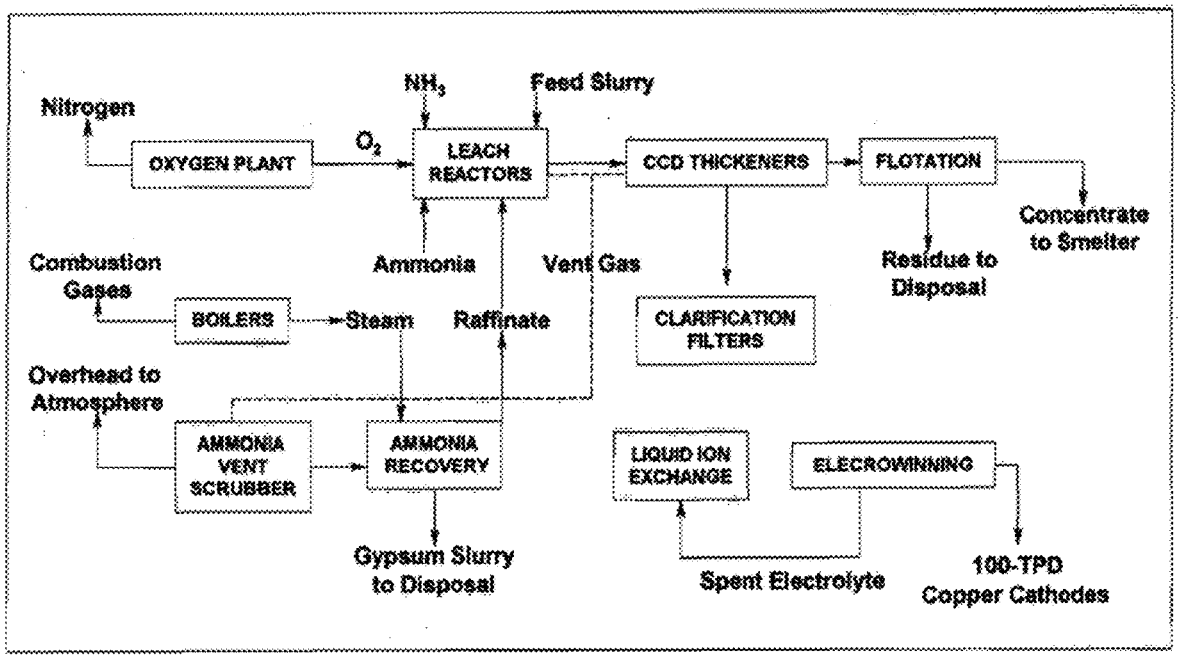

FIG. 8: Anaconda Arbiter process flowsheet (Arbiter and McNulty 1999).

Figure 9:
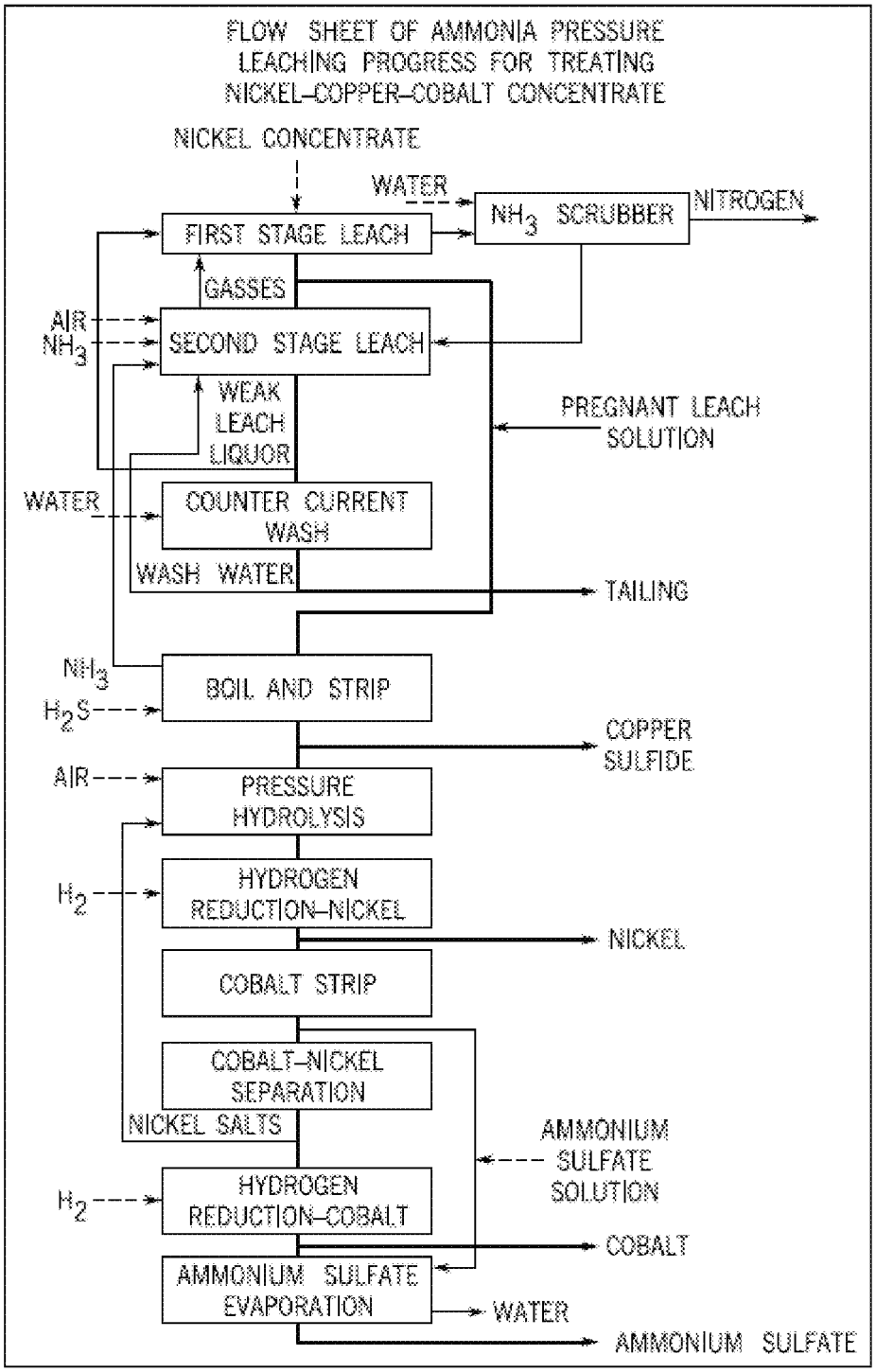

FIG. 9: Sherritt Gordon process flowsheet ("Uses Ammonia Leach for Lynn Lake Ni—Cu—Co Sulphides" 1953).

Figure 10:
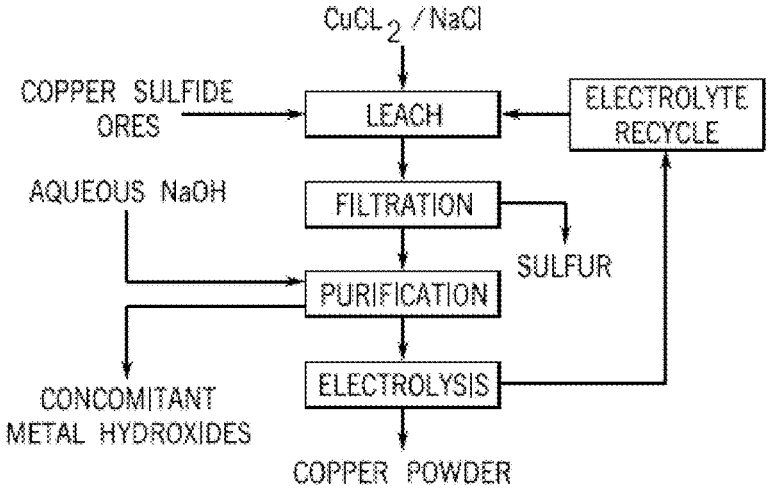

FIG. 10: Generalized flowsheet for the processing of copper sulfide ores by cupric chloride leaching.

Figure 11:
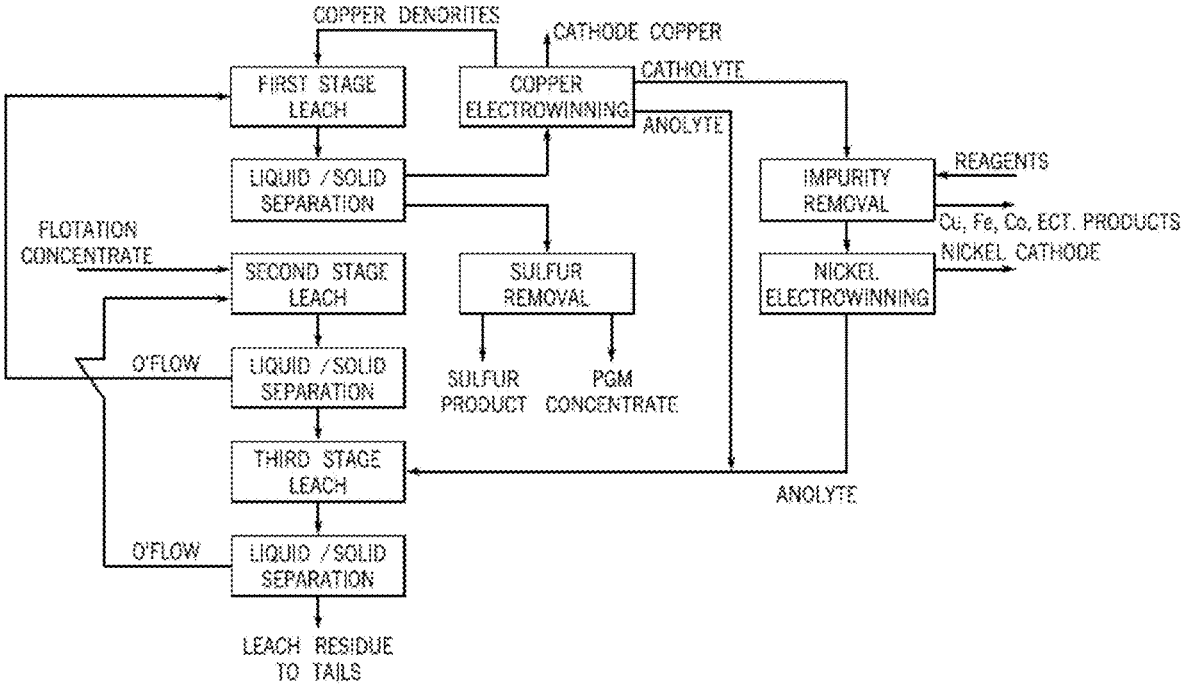

FIG. 11: Intec process flowsheet (Milbourne et al. 2003).

Figure 12:
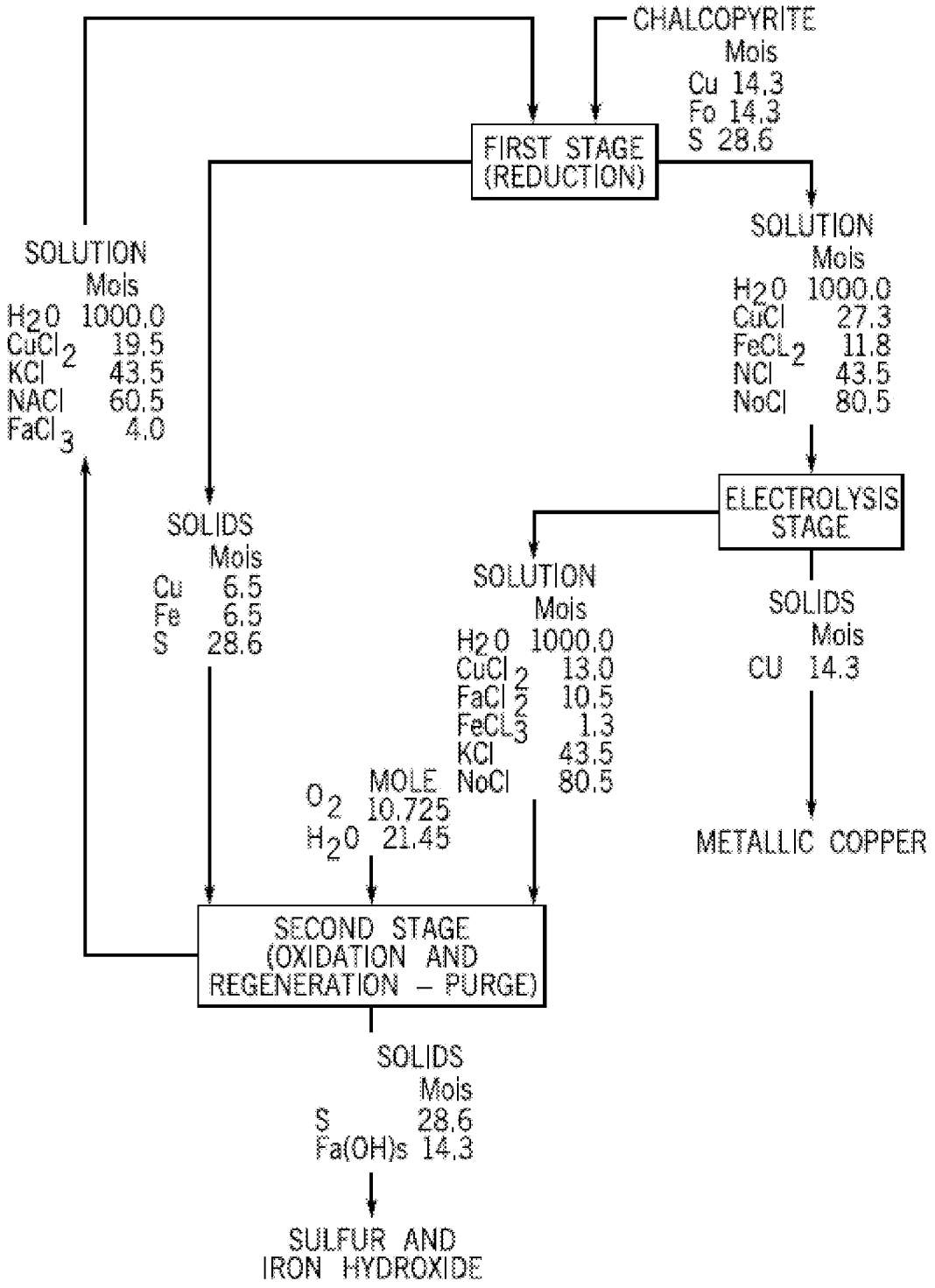

FIG. 12: CLEAR process flowsheet (Atwood and Livingston 1980).

Figure 13:
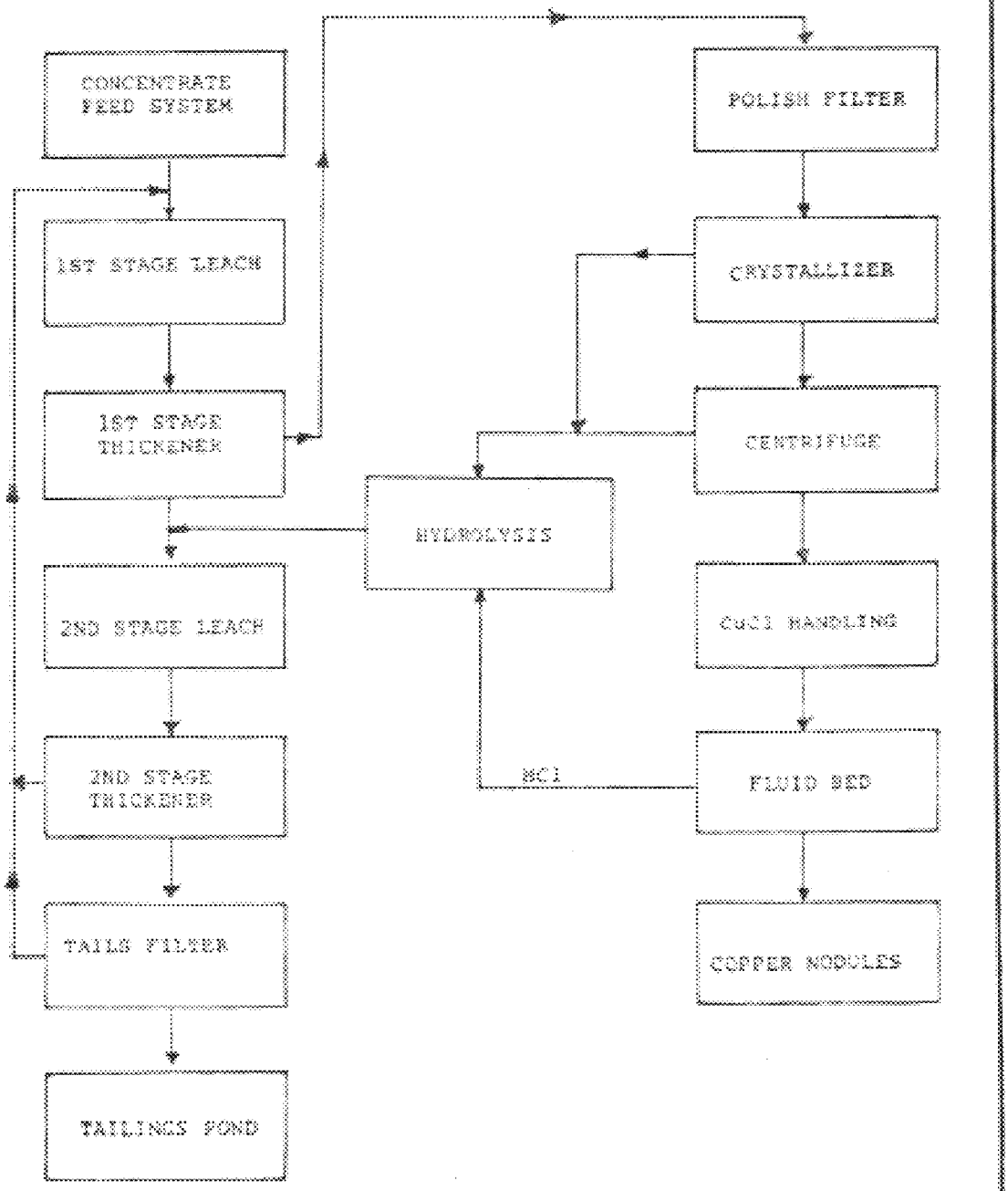

FIG. 13: Cymet process flowsheet (McNamara, Ahrens, and Franek 1978).

Figure 14:
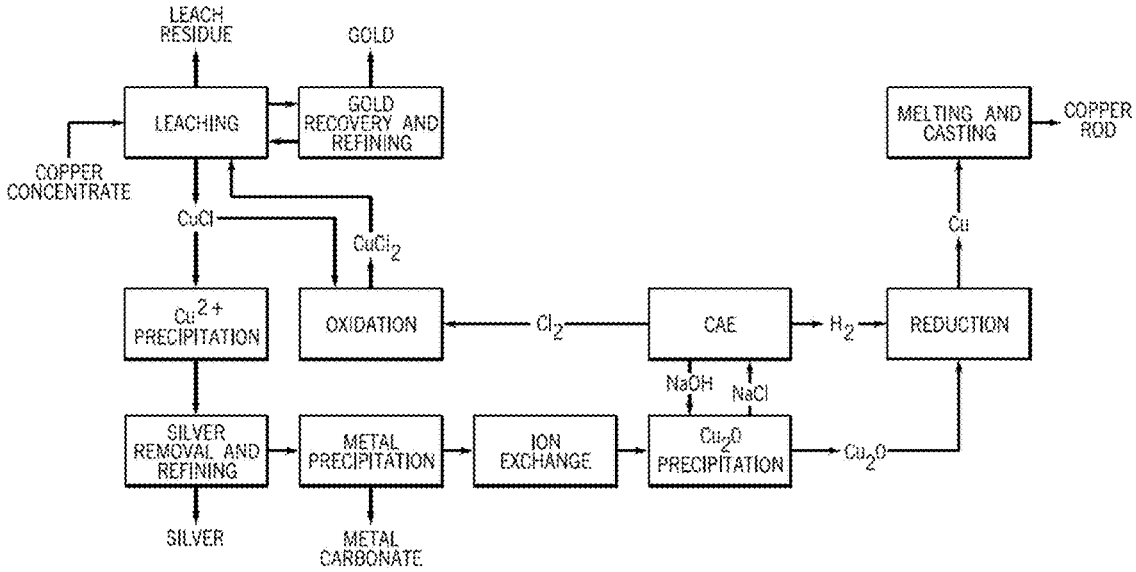

FIG. 14: Outotec's HydroCopper process flowsheet ("Outotec—Application—HydroCopper®" 2012).

Figure 15:
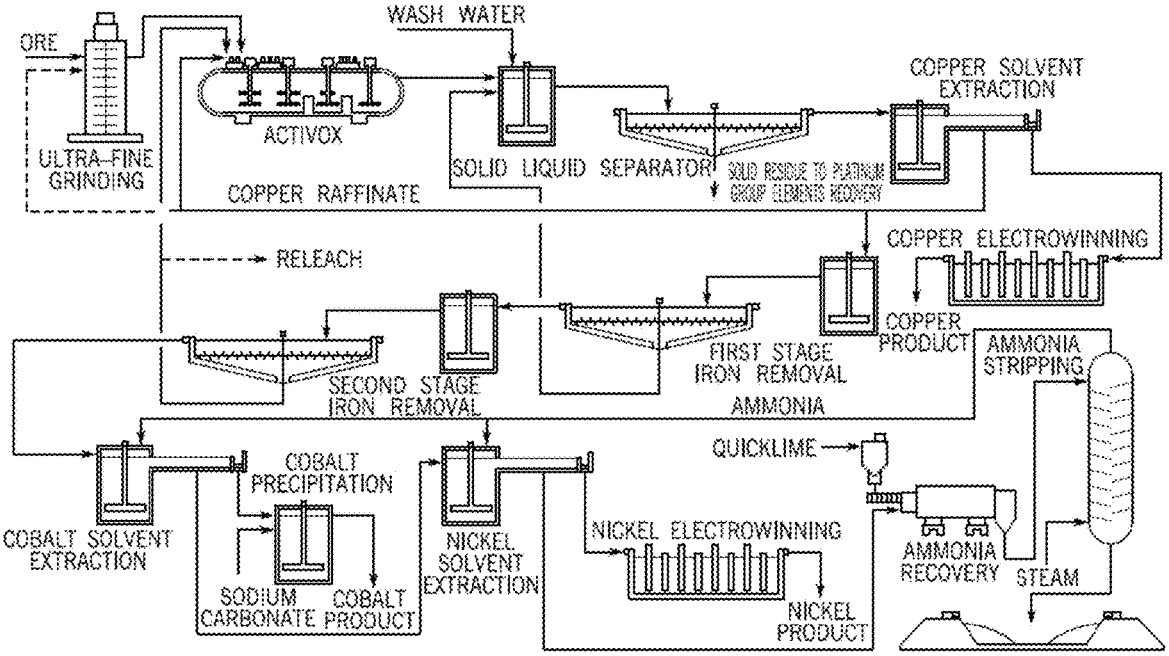

FIG. 15: Activox process flowsheet (Palmer and Johnson 2005).

Figure 16:
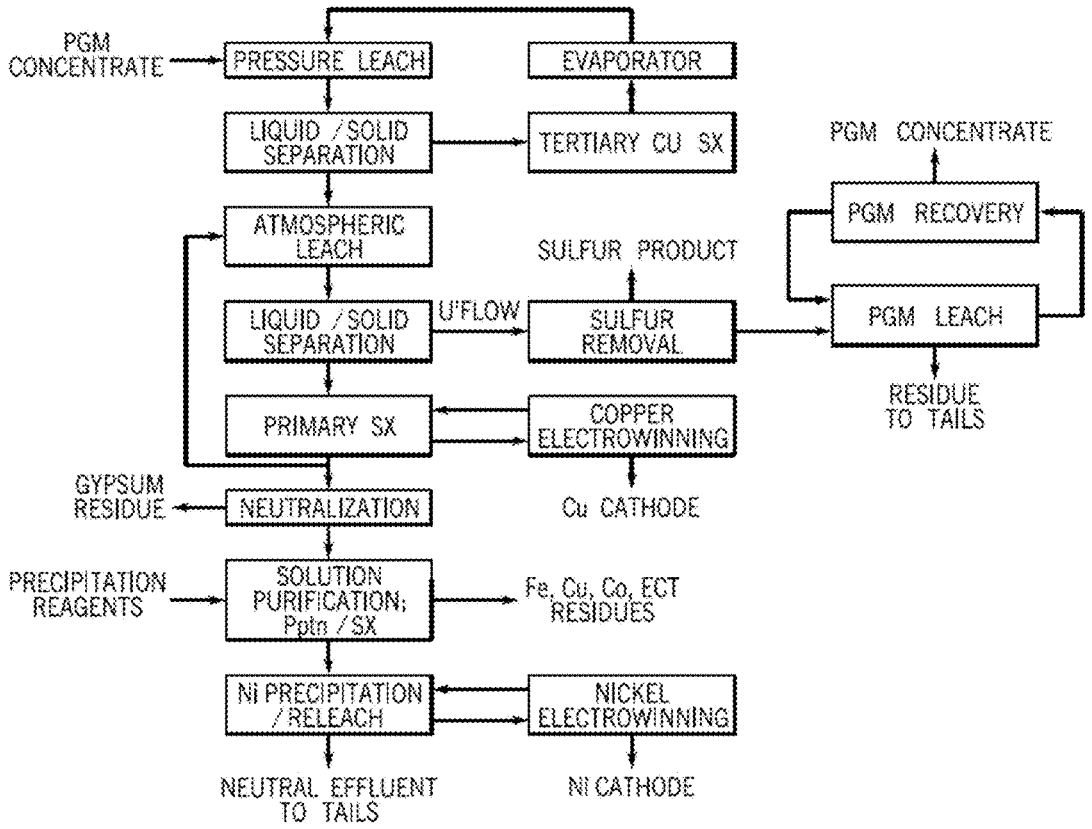

FIG. 16: CESL process flowsheet (Milbourne et al. 2003).

Figure 17:
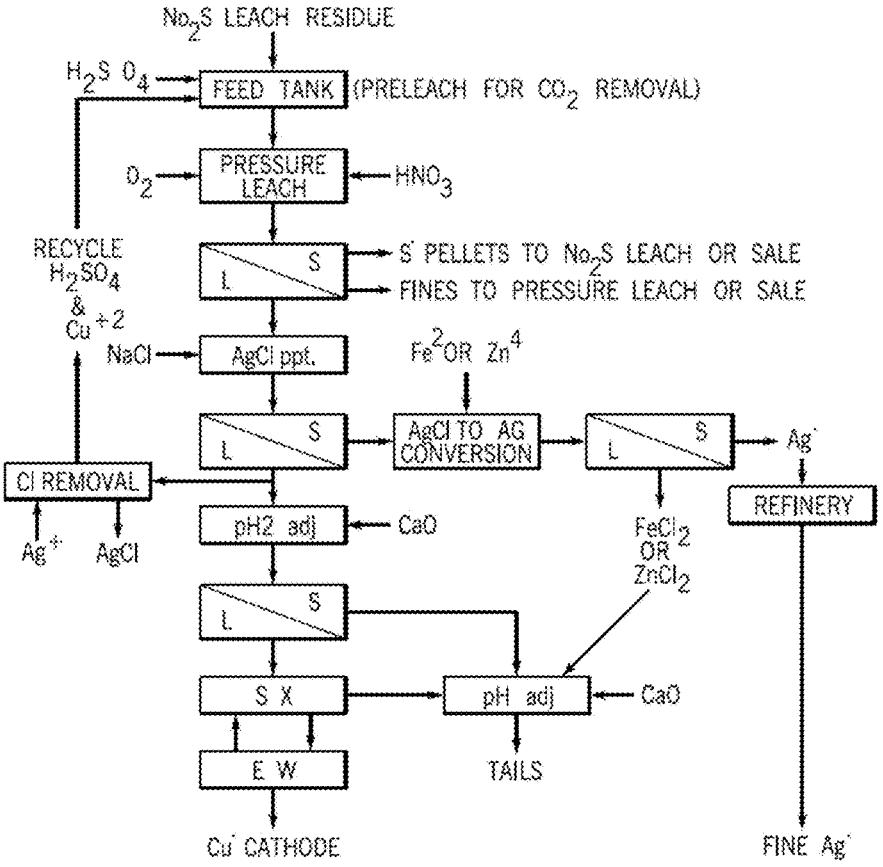

FIG. 17: NSC process flowsheet from Sunshine (Ackerman and Bucans 1986).

Figure 18:
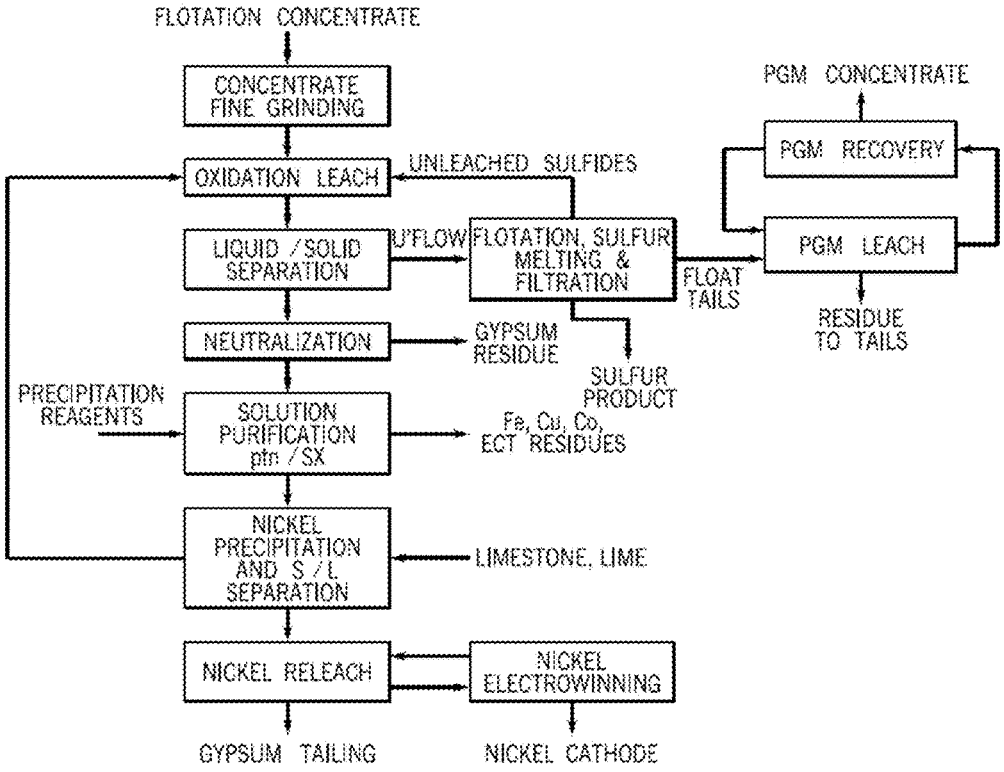

FIG. 18: Dynatec process flowsheet (Milbourne et al. 2003).

Figure 19:
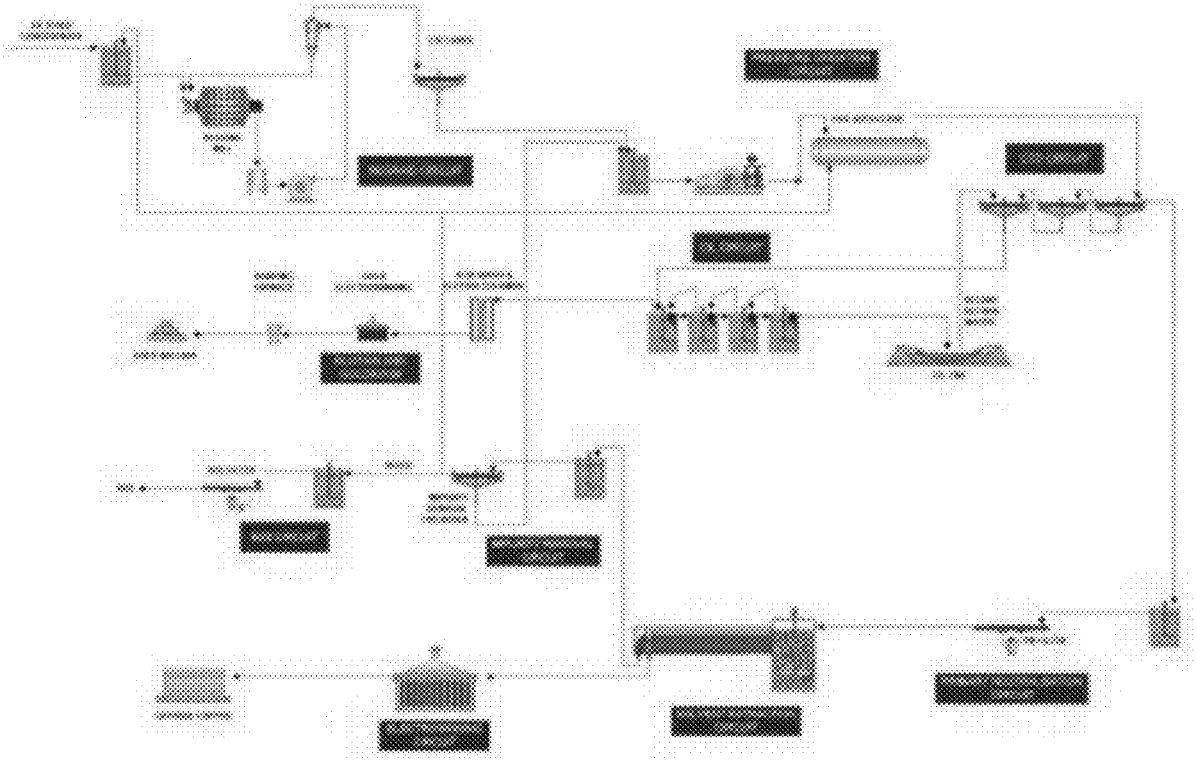

FIG. 19: Proposed Chelopech PDX process flowsheet (Chadwick 2006).

Figure 20:
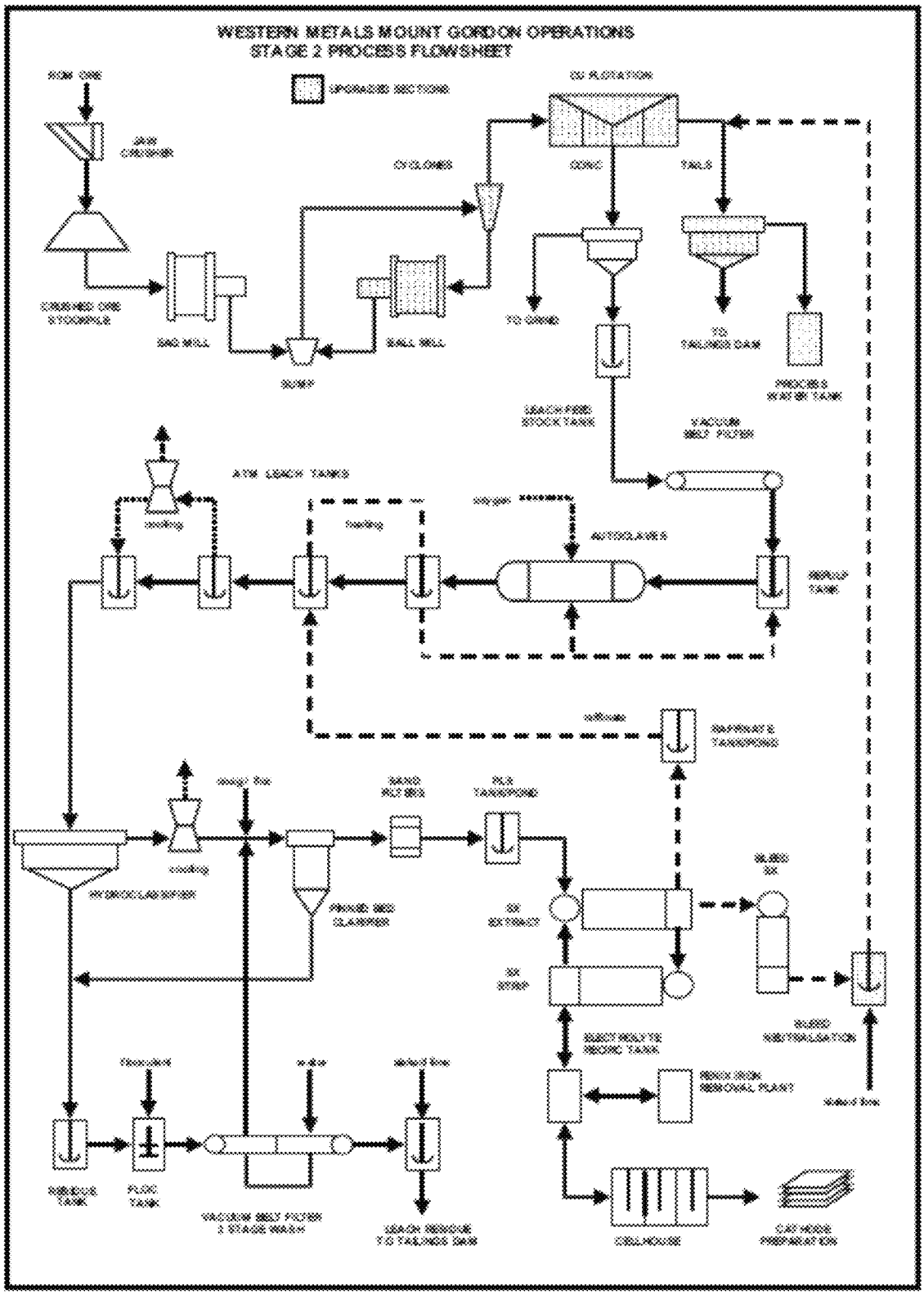

FIG. 20: Mt. Gordon process flowsheet (Arnold, Glen, and Richmond 2003).

Figure 21:
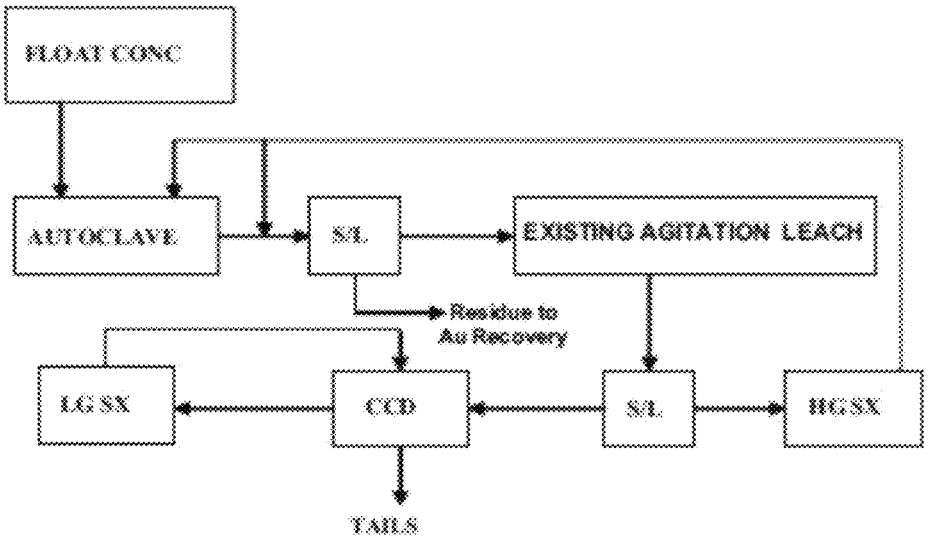

FIG. 21: Kansanshi process flowsheet (Mwale and Megaw).

Figure 22:
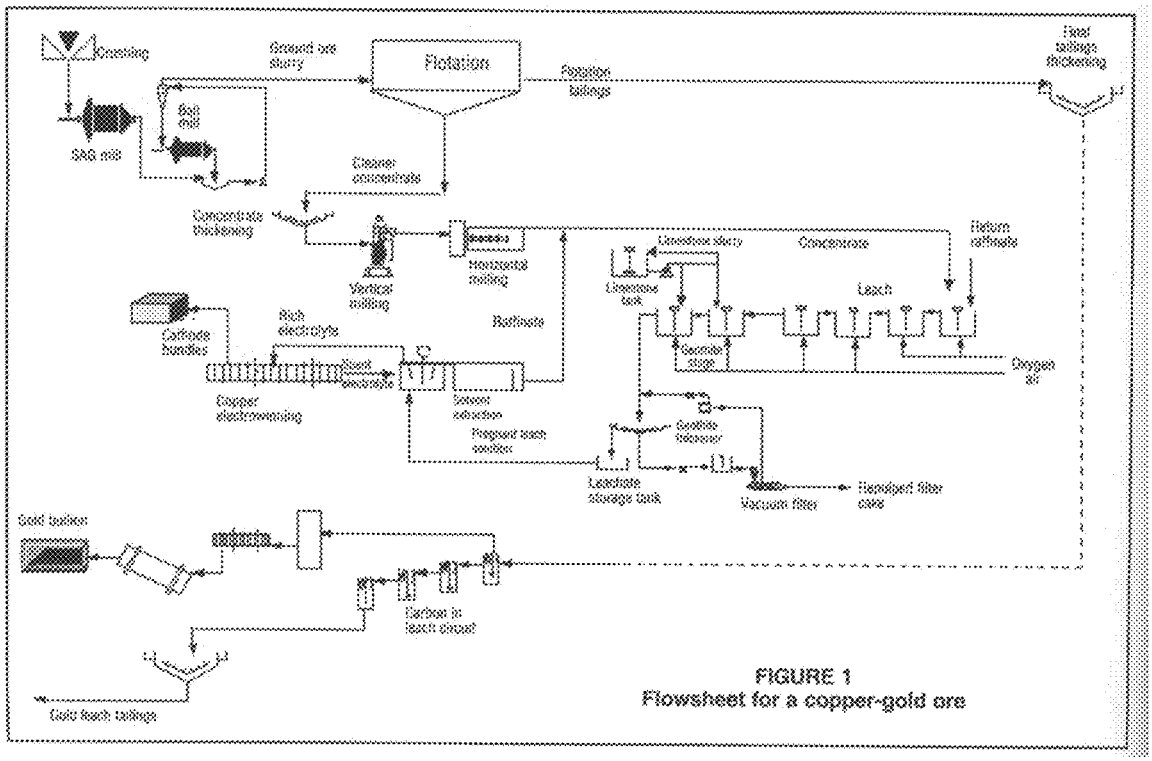

FIG. 22: NENATECH process flowsheet.

Figure 23:
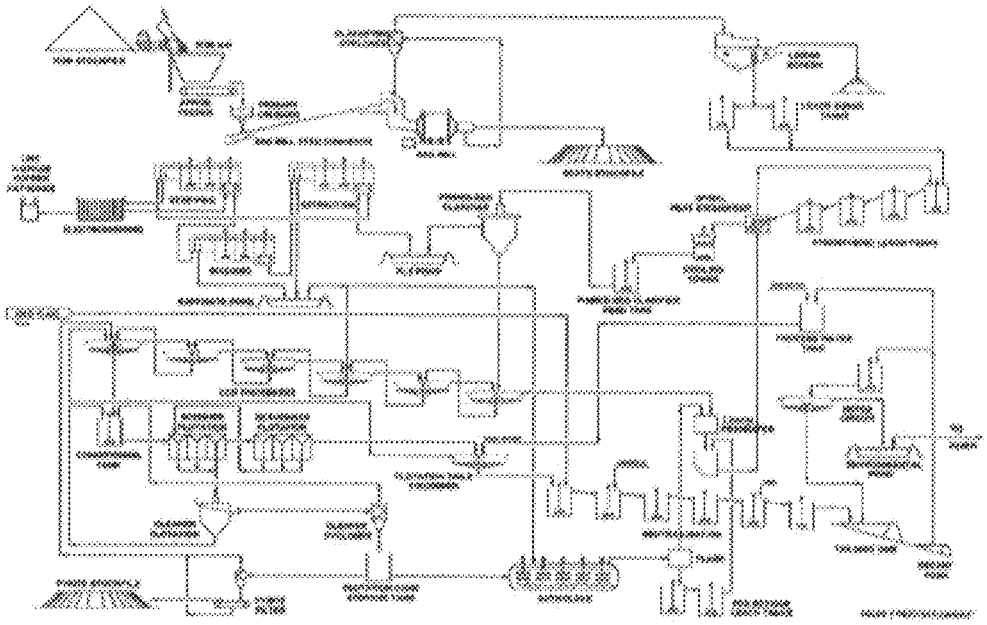

FIG. 23: Sepon process flowsheet (Baxter, Dreisinger, and Pratt 2003).

Figure 24:
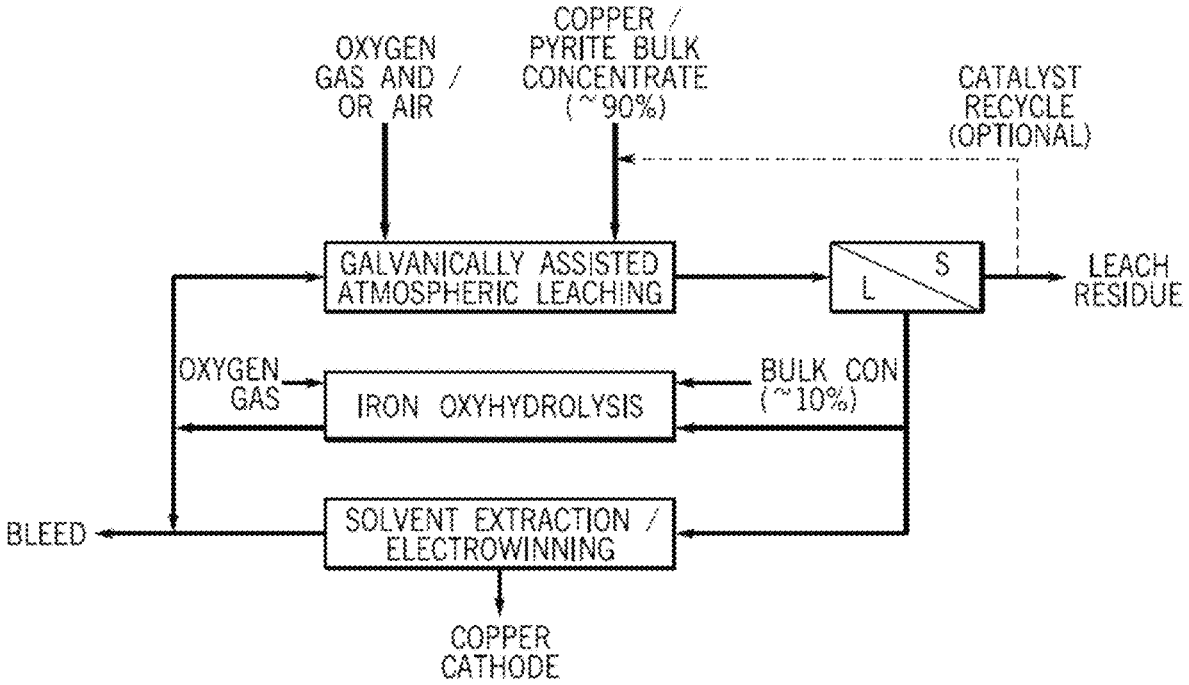

FIG. 24: Galvanox process flowsheet (Dixon, Mayne, and Baxter 2008).

Figure 25:
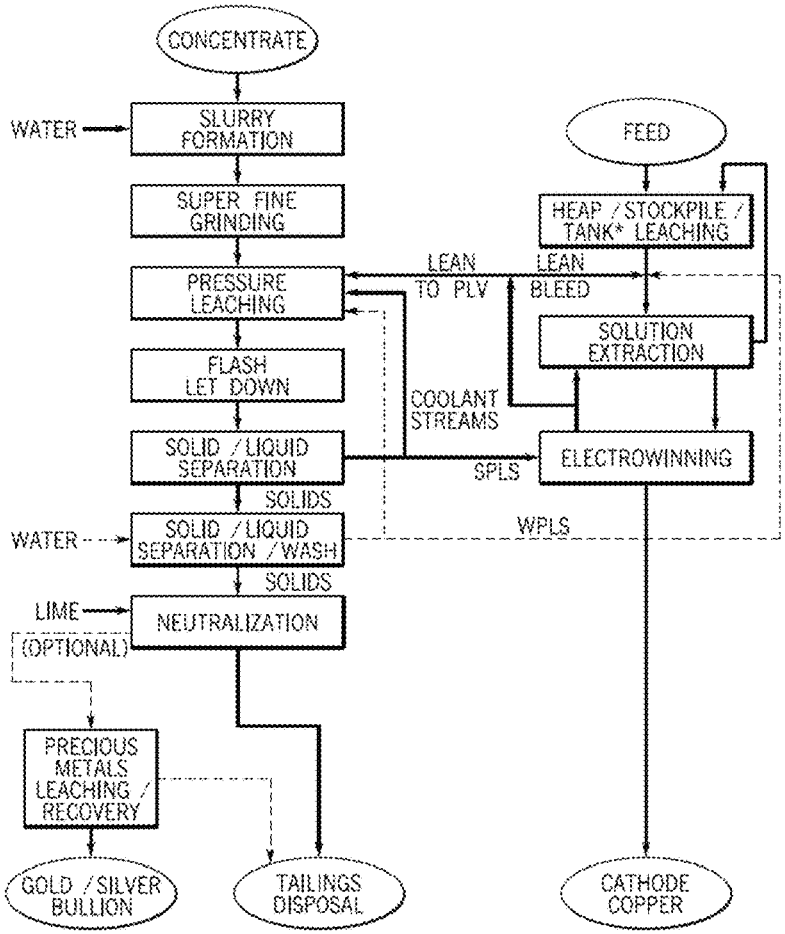

FIG. 25: Phelps Dodge Morenci PDX flowsheet (Cole and Wilmot 2009).

Figure 26:
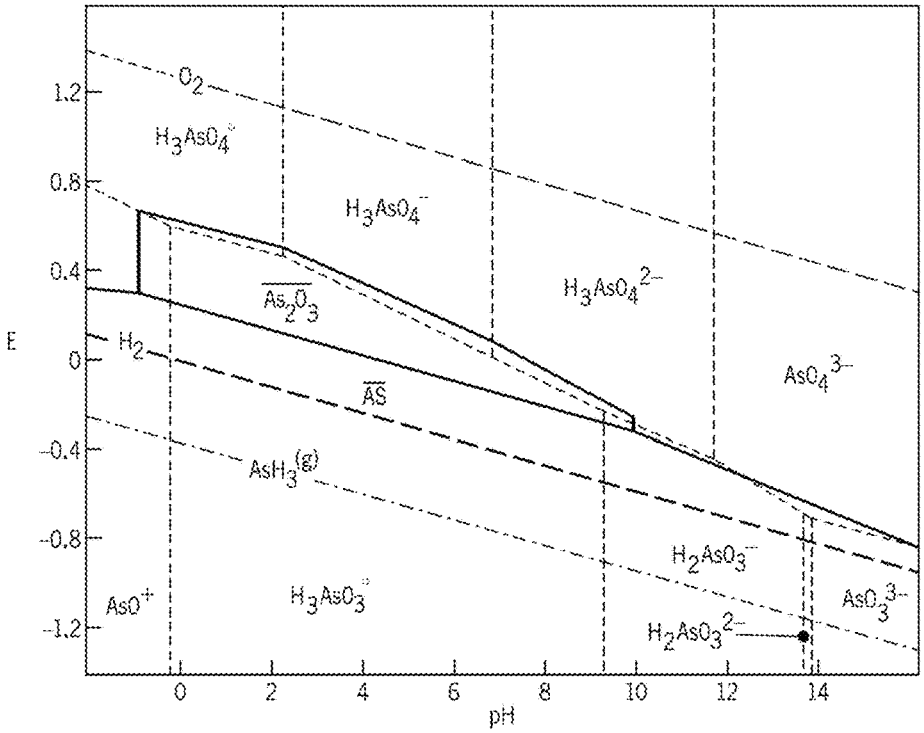

FIG. 26: Eh-pH equilibrium diagram for the As—H2O system at 25° C. and unit activity of all species (Robins 1988).

Figure 27:
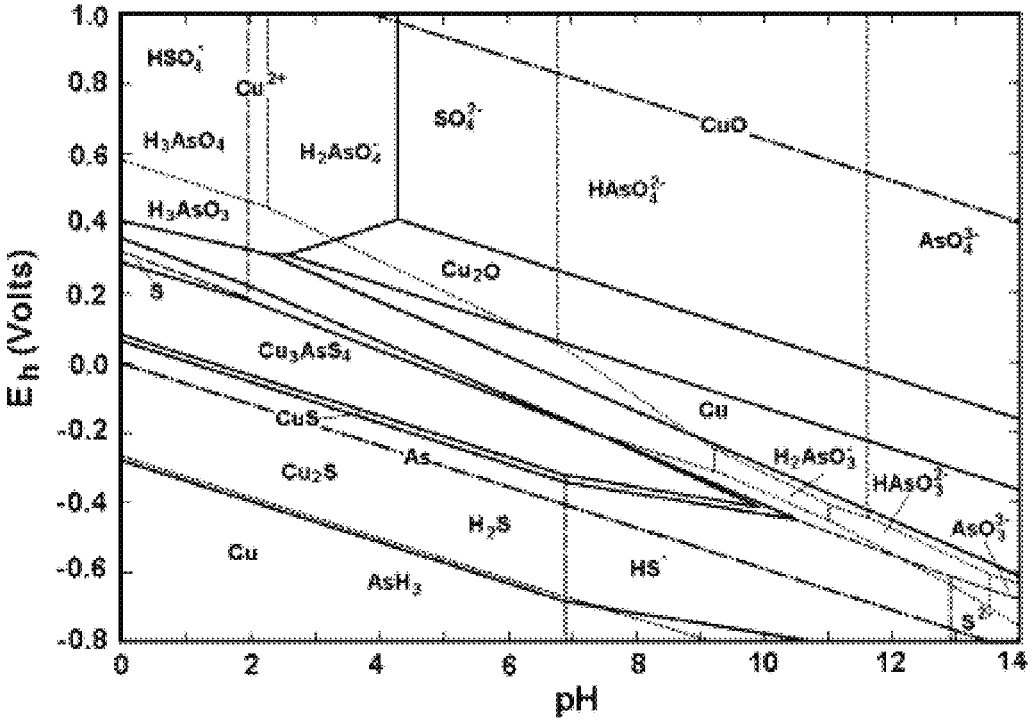

FIG. 27: Eh-pH diagram of the Cu3AsS4-H2O system at 25° C. where the activities of soluble Cu, As and S are equal to 0.1. The dashed lines represent S—H2O equilibria and short dashed lines are As—H2O equilibria (Padilla, Rivas, and Ruiz 2008).

Figure 28:
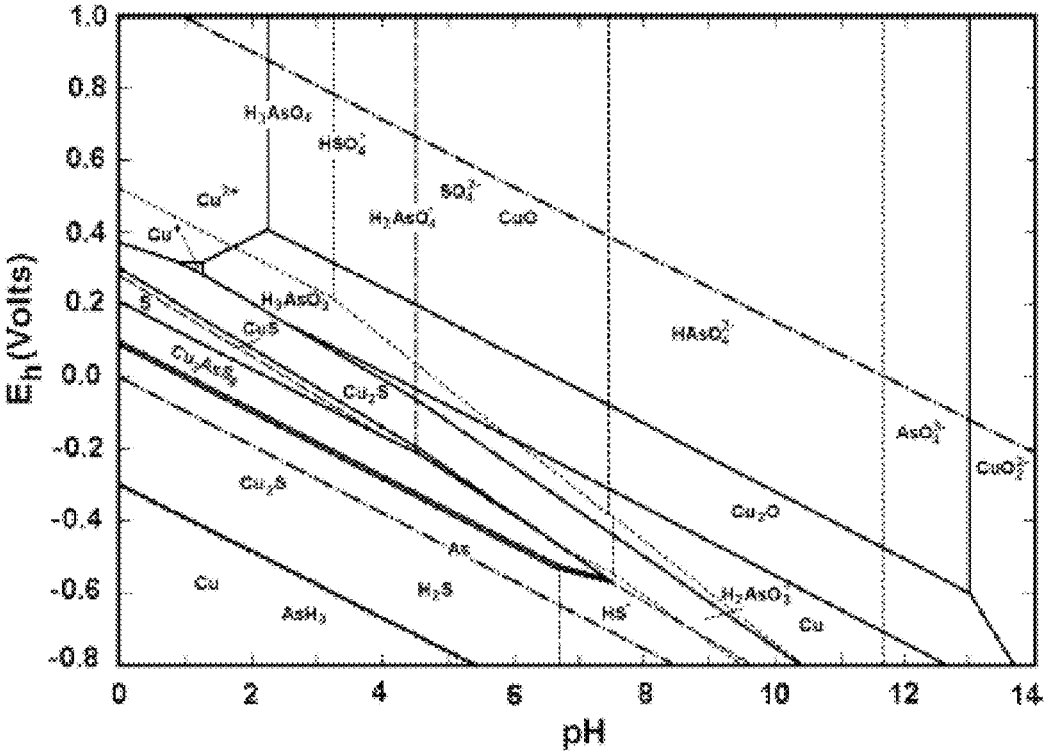

FIG. 28: Eh-pH diagram of the Cu3AsS4-H2O system at 200° C. where the activities of soluble Cu, As and S are equal to 0.1. The dashed lines represent S—H2O equilibria and short dashed lines are As—H2O equilibria (Padilla, Rivas, and Ruiz 2008).

Figure 29:
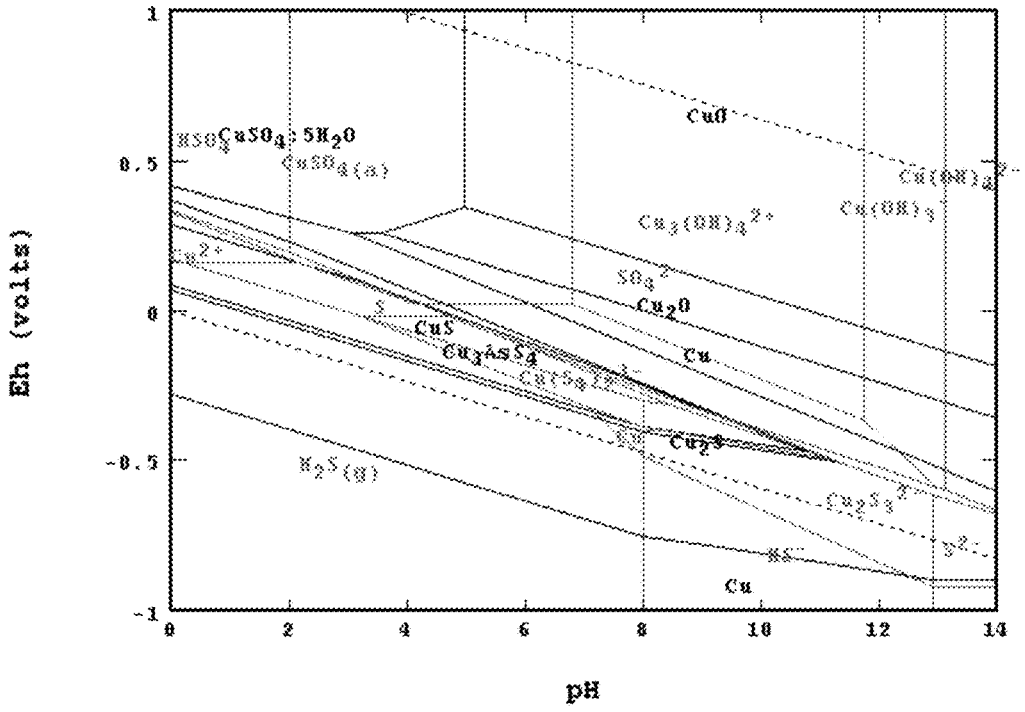

FIG. 29: Stabcal Eh-pH diagram of the Cu3AsS4-H2O system at 25° C. where the activities of soluble Cu, As and S are equal to 0.1. The blue lines represent S—H2O equilibria and As—H2O equilibria.

Figure 30:
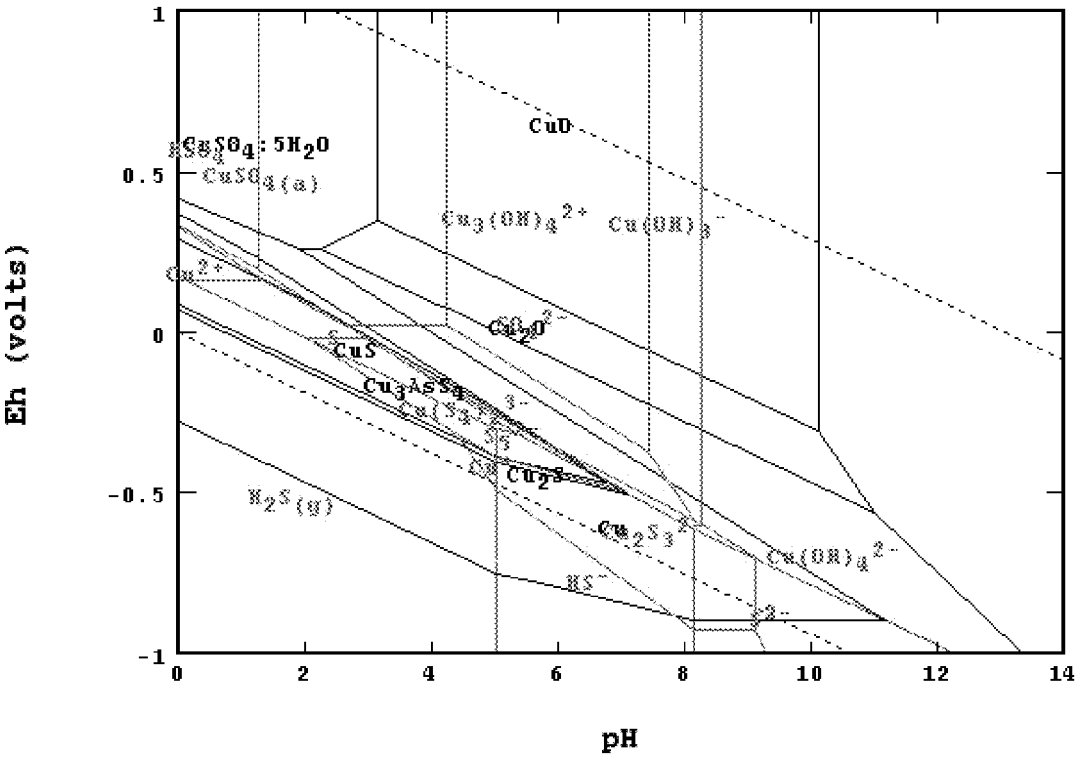

FIG. 30: Stabcal Eh-pH diagram of the Cu3AsS4-H2O system at 200° C. where the activities of soluble Cu, As and S are equal to 0.1. The blue lines represent S—H2O equilibria and As—H2O equilibria.

Figure 31:
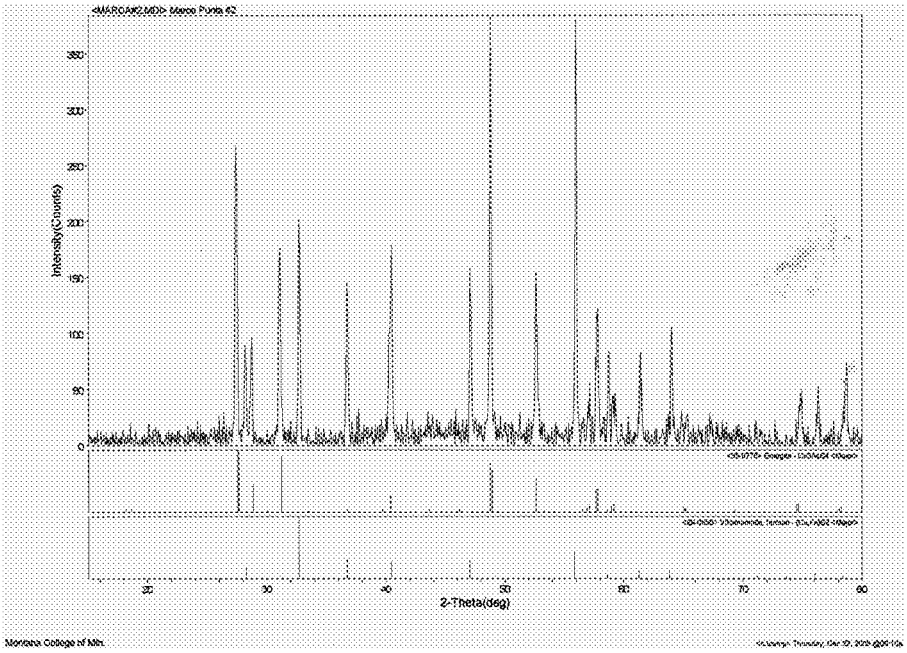

FIG. 31: XRD qualitative analysis on Marca Punta indicates that the primary minerals are enargite, Cu3AsS4 and Villamaninite, Cu, FeS2.

Figure 32:
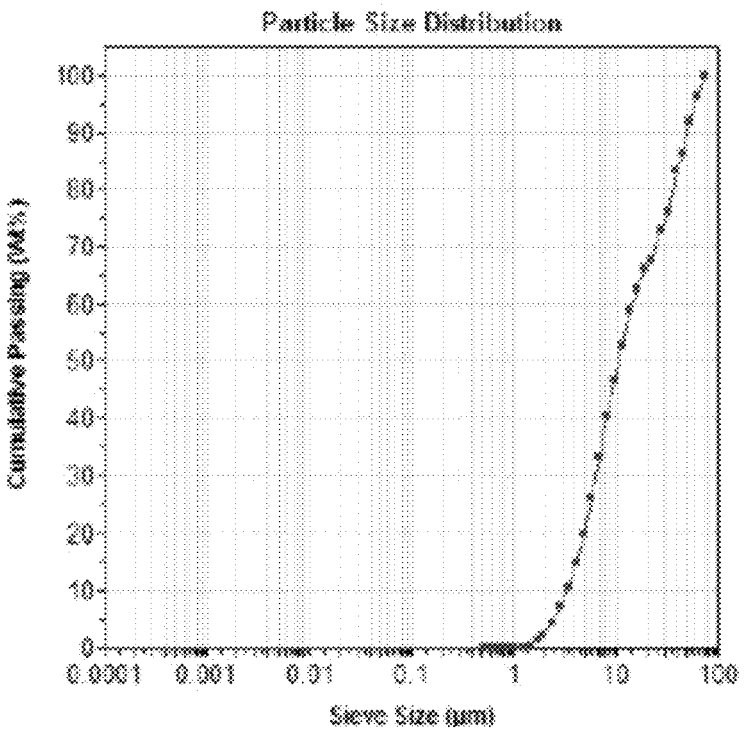

FIG. 32: MLA-determined particle size distribution for the Marca Punta Sample.

Figure 33:
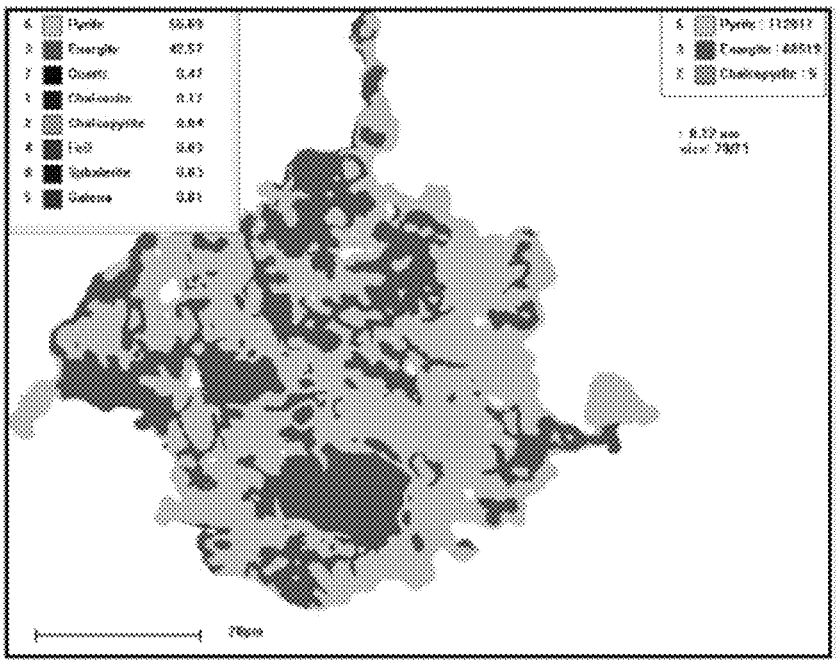

FIG. 33: Classified MLA false color image of Marca Punta Sample. Particle inset units are in pixels (upper right) and concentration palette values are in surface area percentage for the overall sample (upper left).

Figure 34:
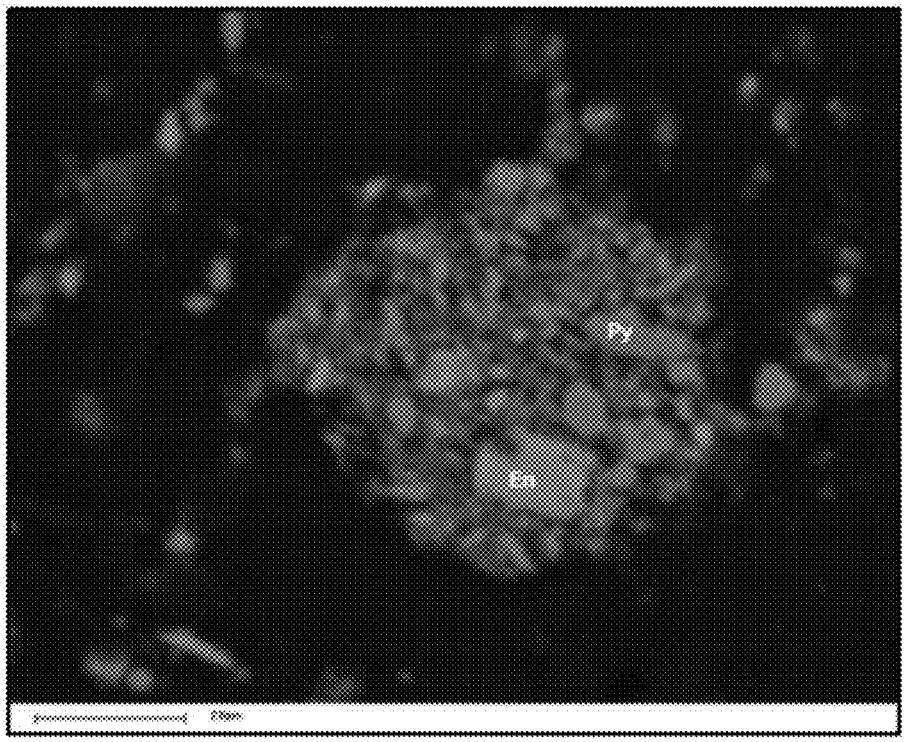

FIG. 34: BSE image of the Marca Punta Sample with enargite (En) and pyrite (Py) grains in the agglomerate.

Figure 35:
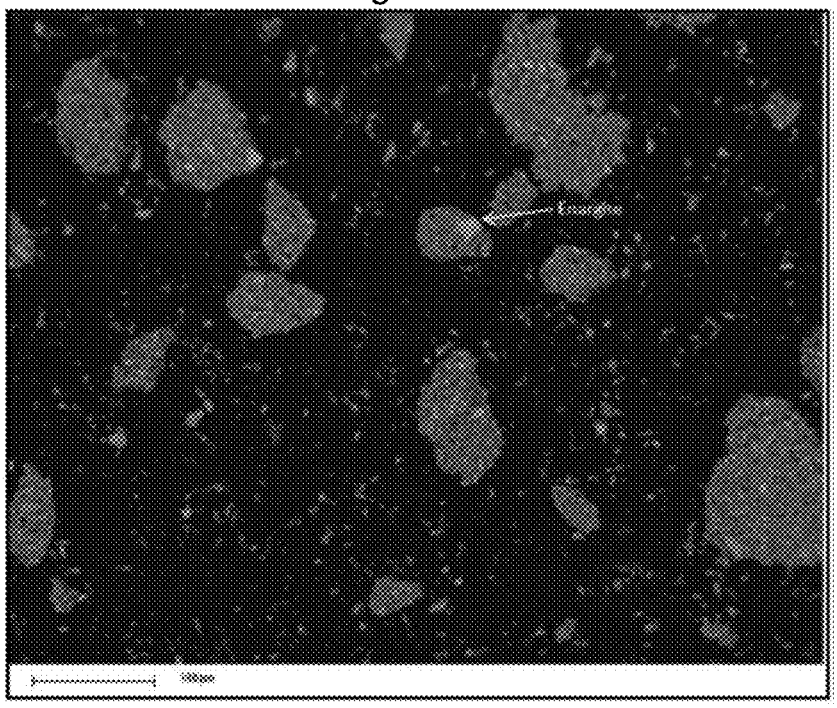

FIG. 35: BSE image of the Marca Punta Sample.

Figure 36:
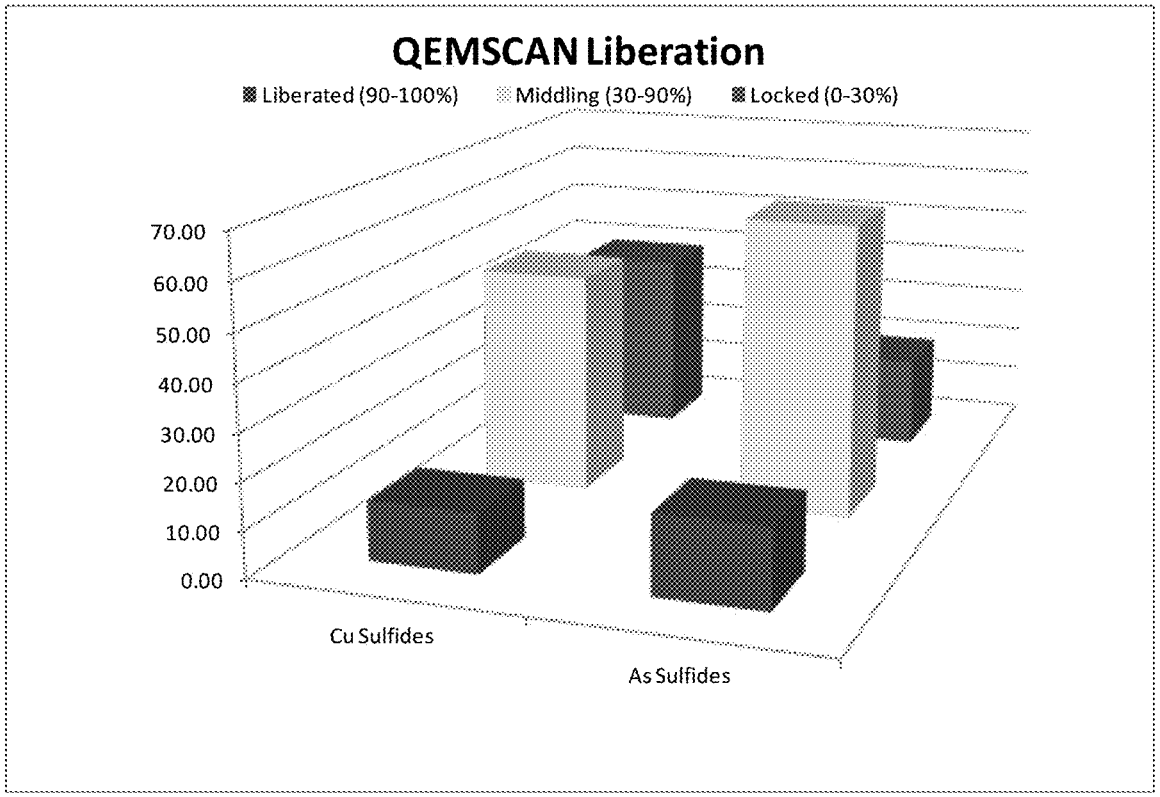

FIG. 36: Marca Punta FMI QEMSCAN Liberation.

Figure 37:
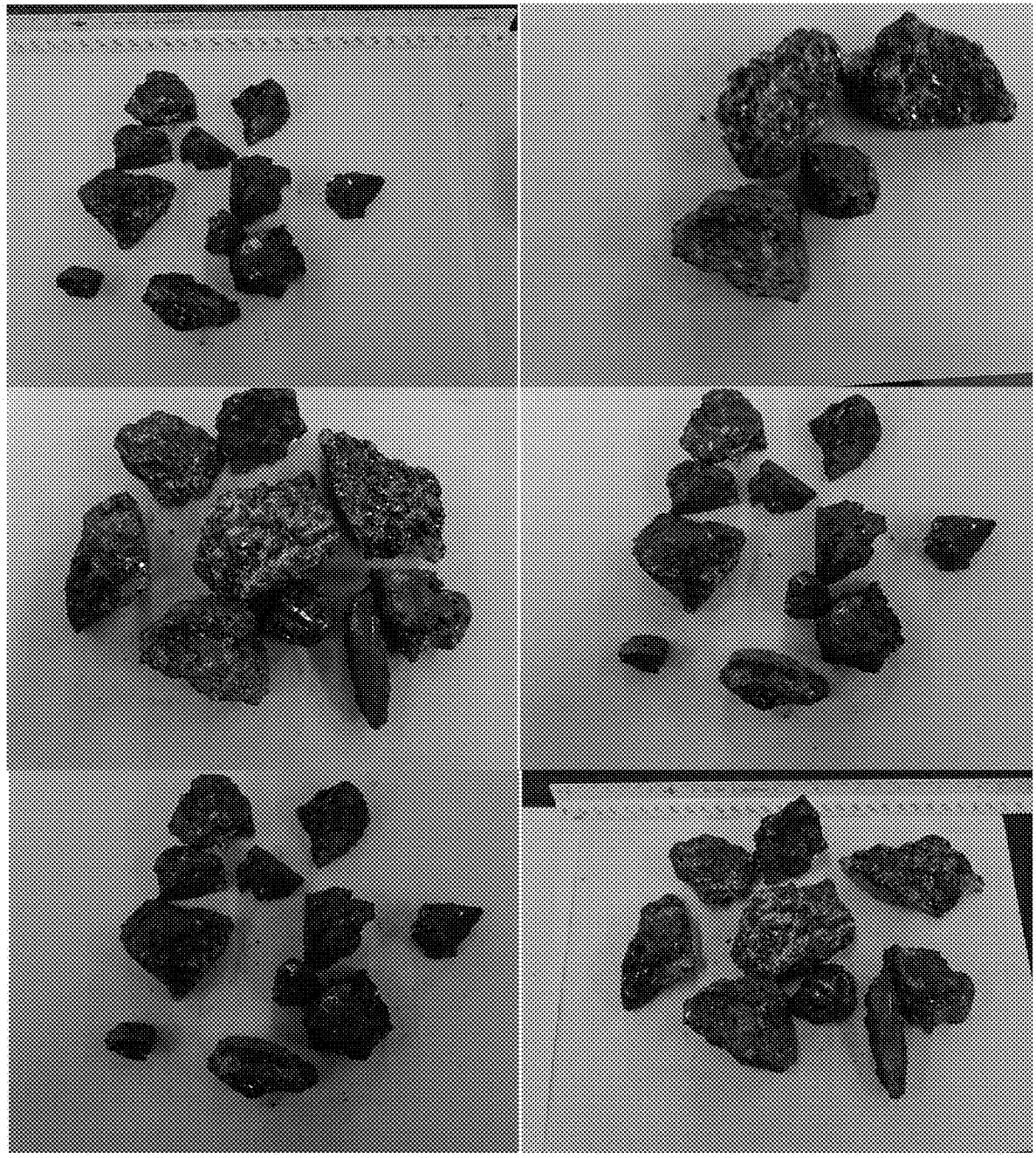

FIG. 37: High grade enargite specimens from Butte, Mont.

Figure 38:
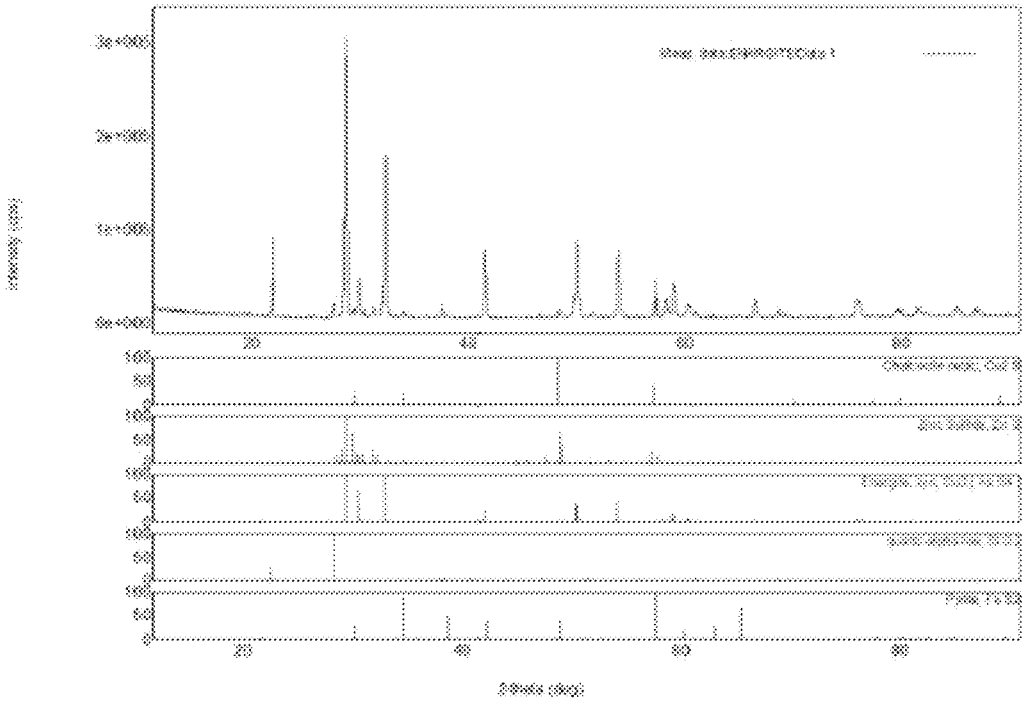

FIG. 38: XRD qualitative analysis on High Grade Enargite Sample indicated the presence of enargite, quartz, sphalerite and pyrite.

Figure 39:
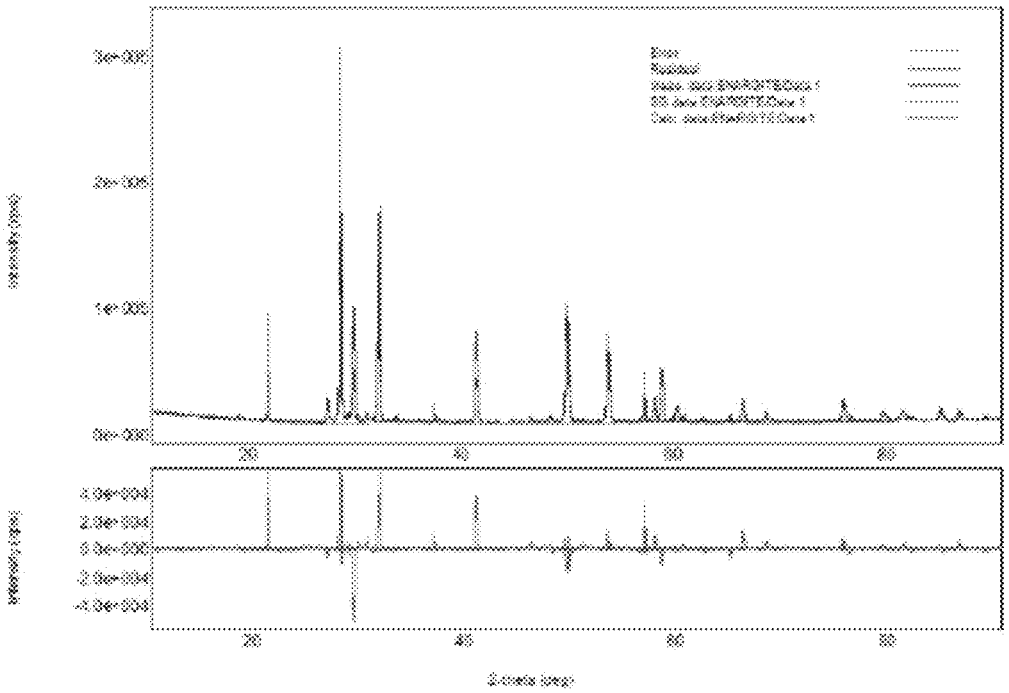

FIG. 39: Measured and WPPF-calculated diffractograms and residual plot for the High Grade Enargite Sample.

FIG. 40: Classified MLA image of the High Grade Enargite Sample. Particle inset units are in pixels and concentration palette values are in surface area percentage.

FIG. 41: BSE image of the High Grade Enargite Sample.

Figure 42:
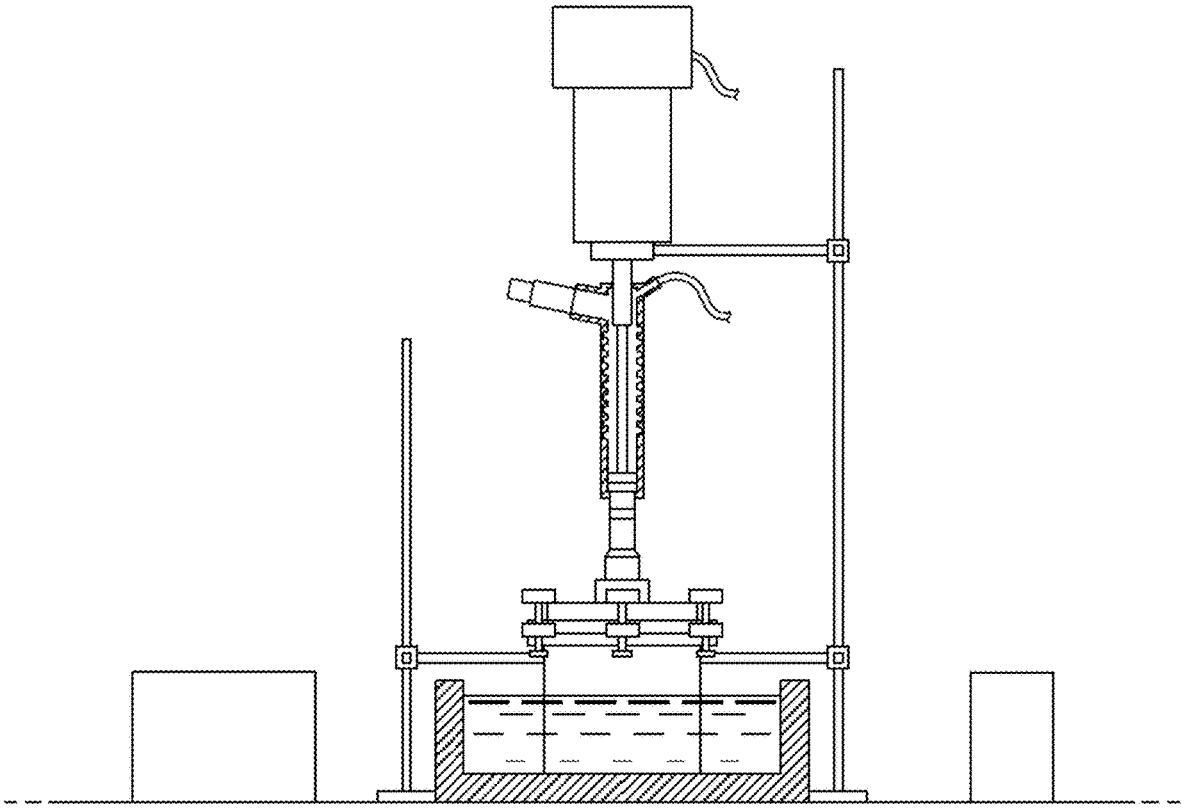

FIG. 42: Atmospheric pressure agitated leach experimental equipment setup.

Figure 43:
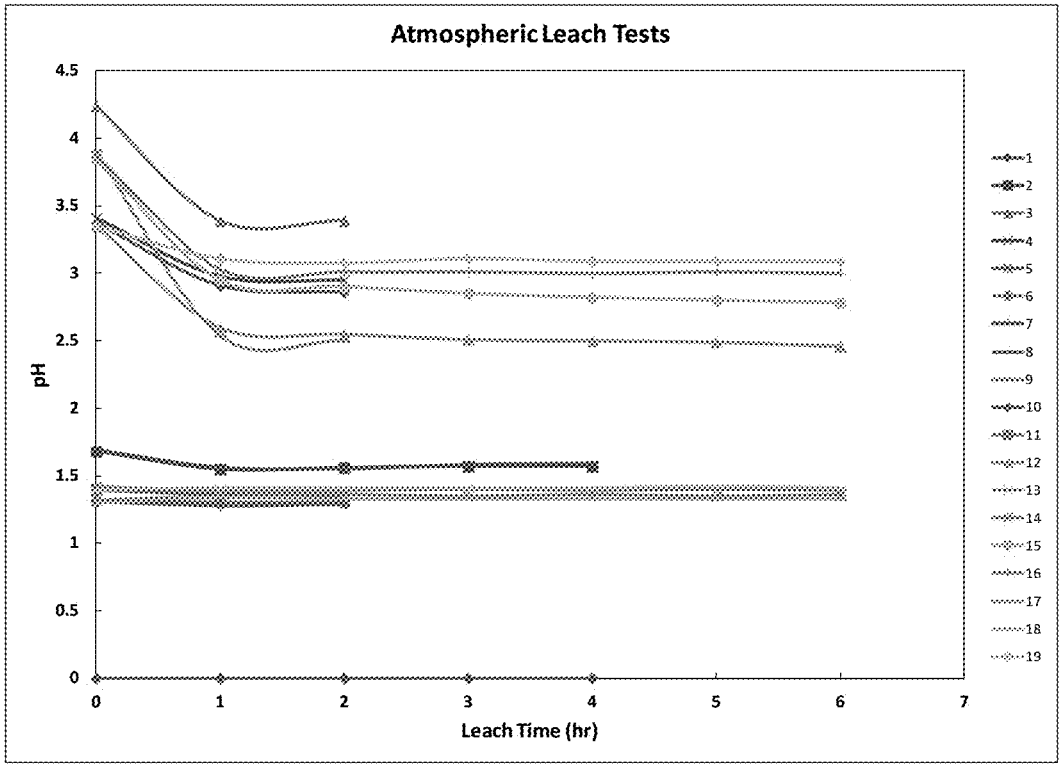

FIG. 43: Plot of hourly pH readings on PLS samples from Tests 1-19.

Figure 44:
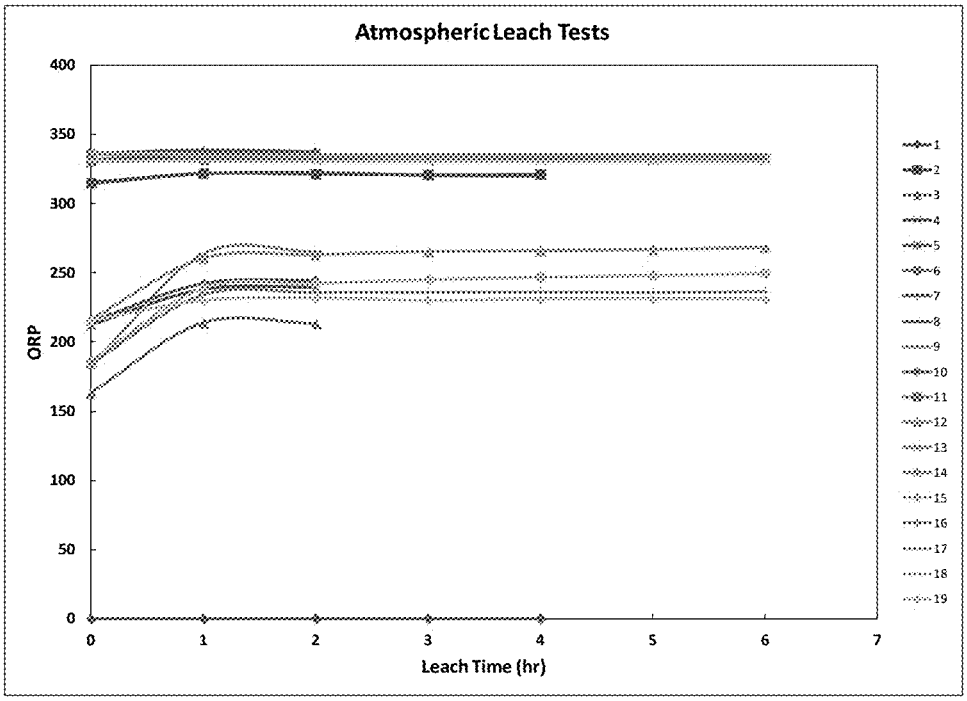

FIG. 44: Plot of hourly ORP readings on PLS samples from Tests 1-19.

Figure 45:
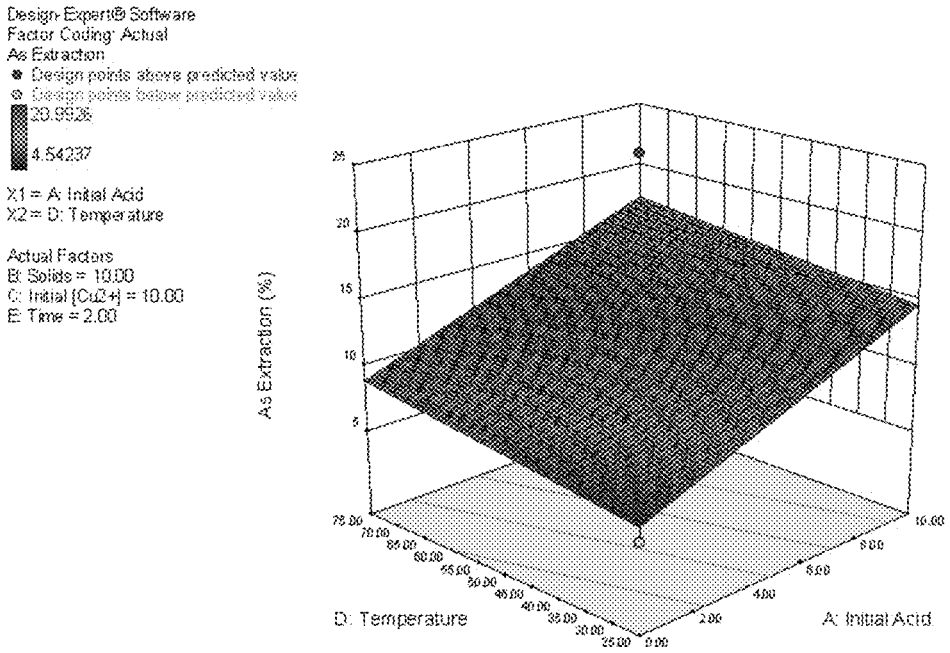

FIG. 45: Stat-Ease Design Expert 3-D surface plot of arsenic extraction as a function of initial acid concentration and temperature.

Figure 46:
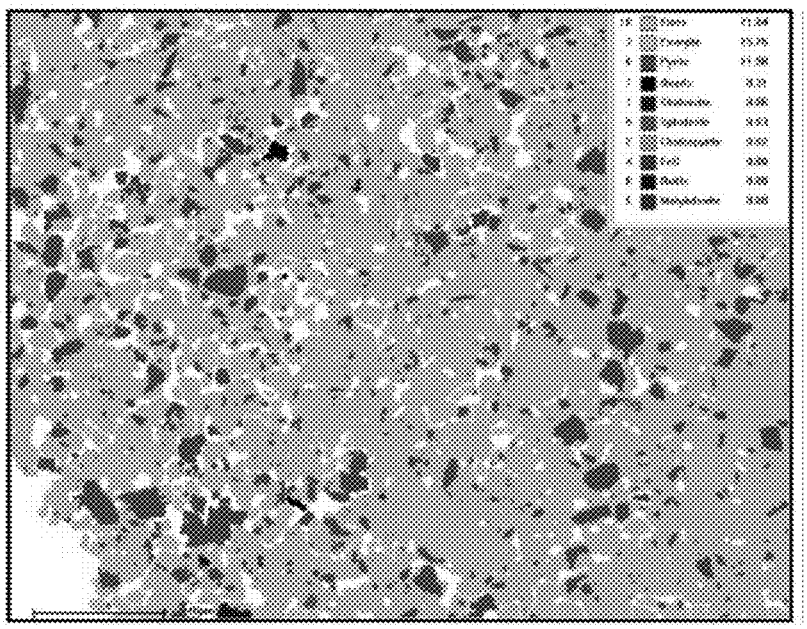

FIG. 46: Classified MLA false color image from the #7 residue sample. Concentration palette values are in surface area percentage.

Figure 47:
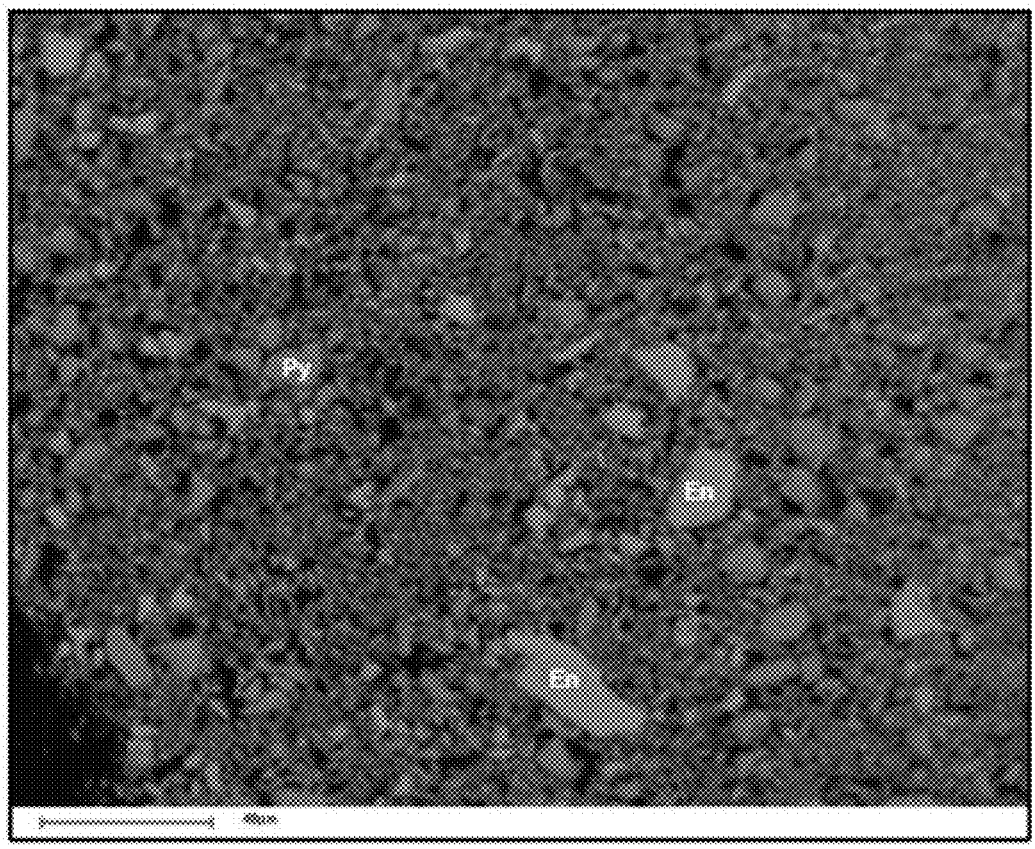

FIG. 47: BSE image from the #7 leach residue sample.

Figure 48:
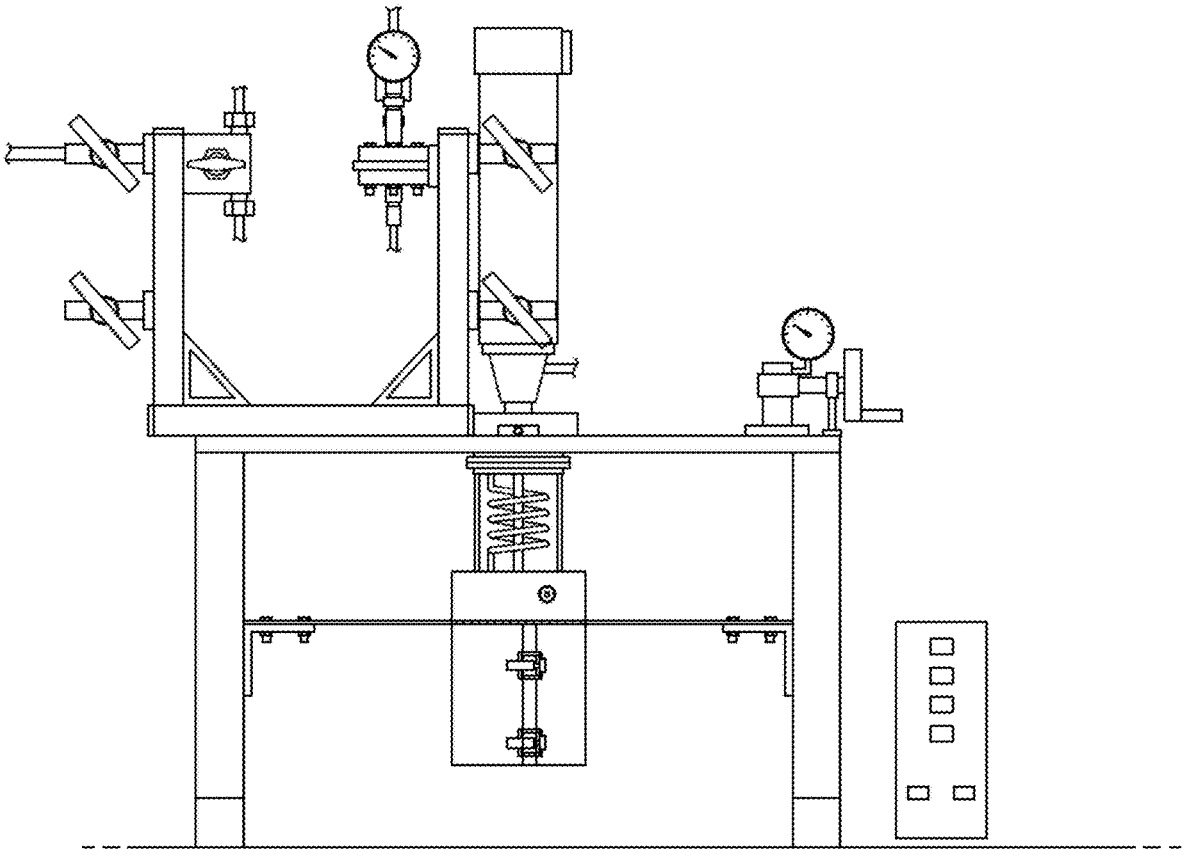

FIG. 48: Pressure oxidation autoclave experimental equipment setup.

Figure 49:
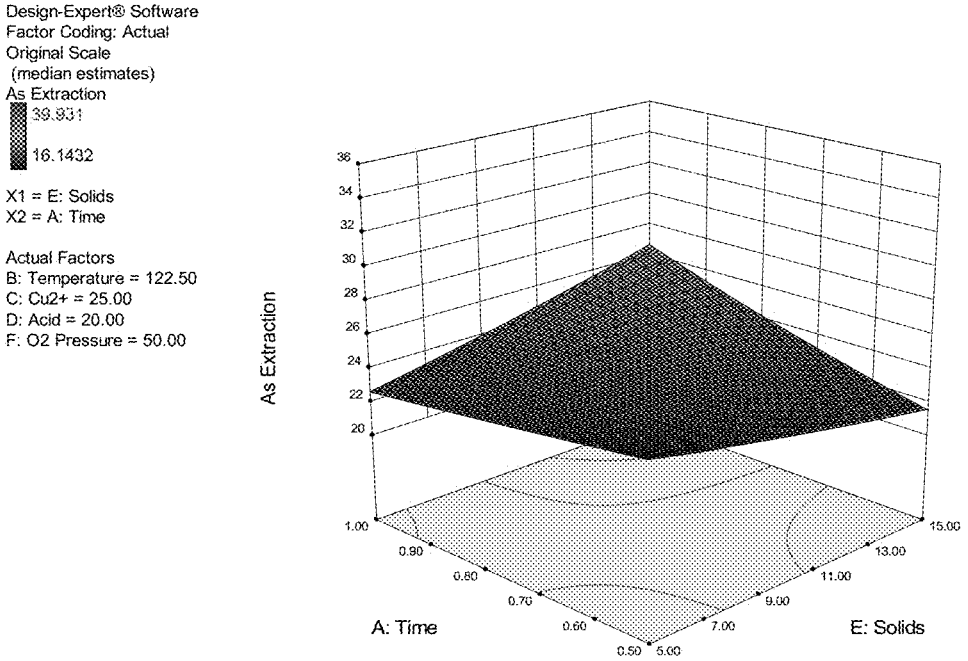

FIG. 49: Stat-Ease Design Expert 3-D surface plot of arsenic extraction as a function of time and solids.

Figure 50:
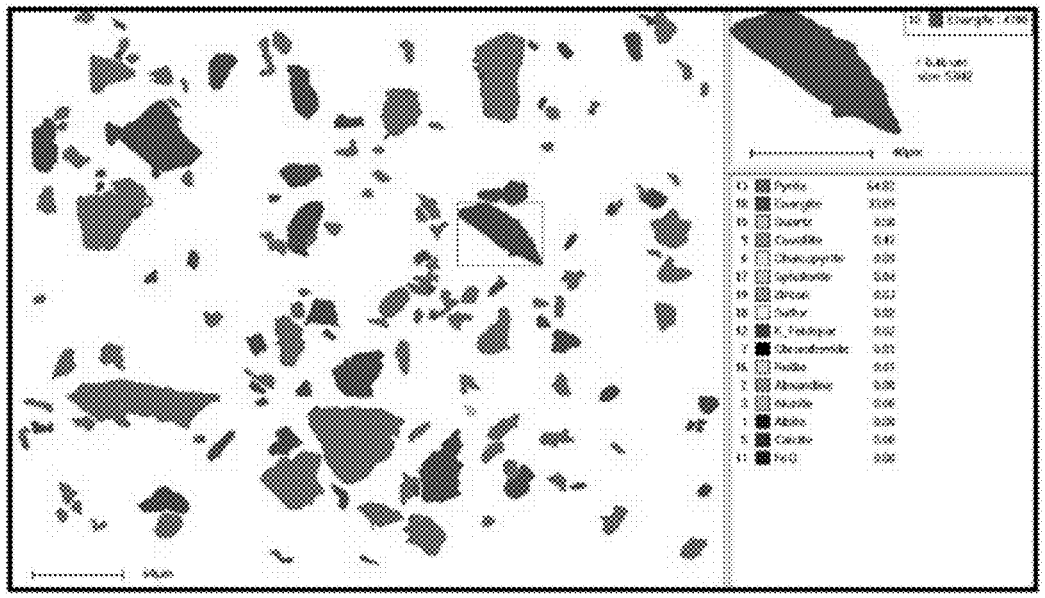

FIG. 50: Classified MLA false color image from the #33 composite leach residue. Particle inset units are in pixels (upper right) and concentration palette values are in surface area percentage for the overall sample.

Figure 51:
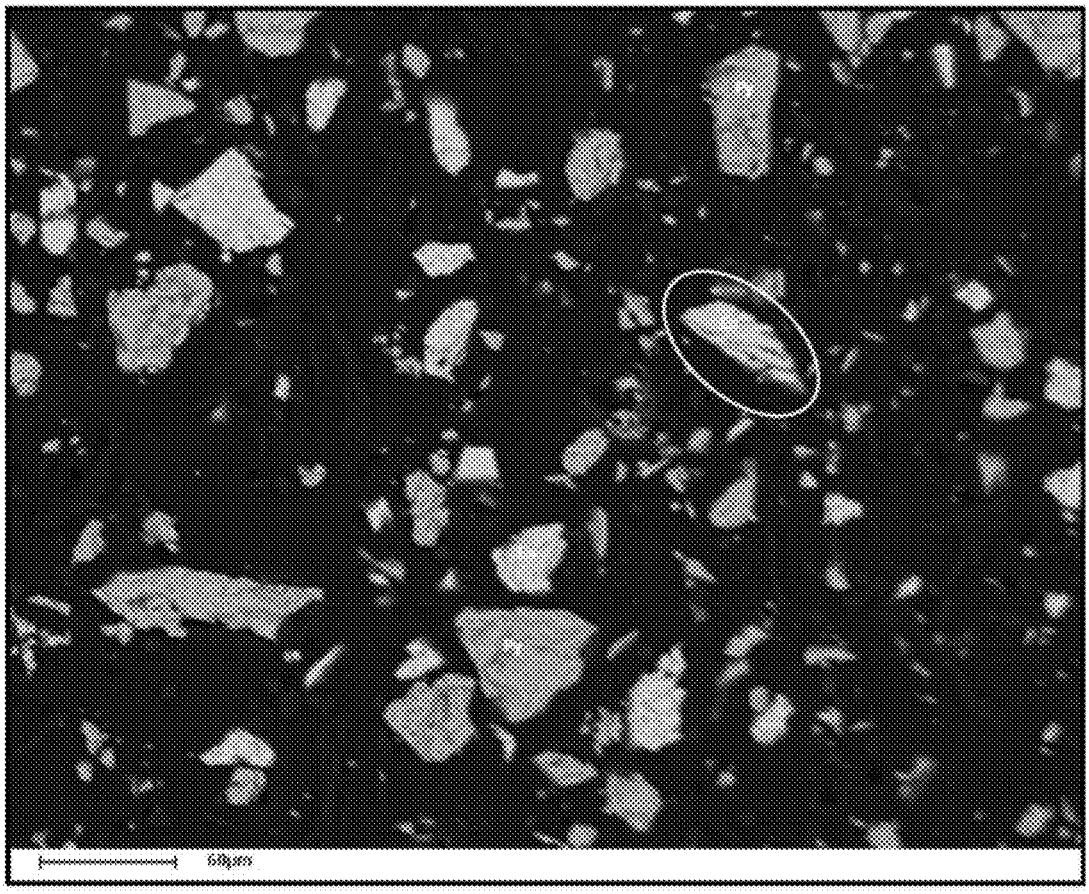

FIG. 51: BSE image from the #33 composite leach residue with enargite (En) and pyrite (Py).

Figure 52:
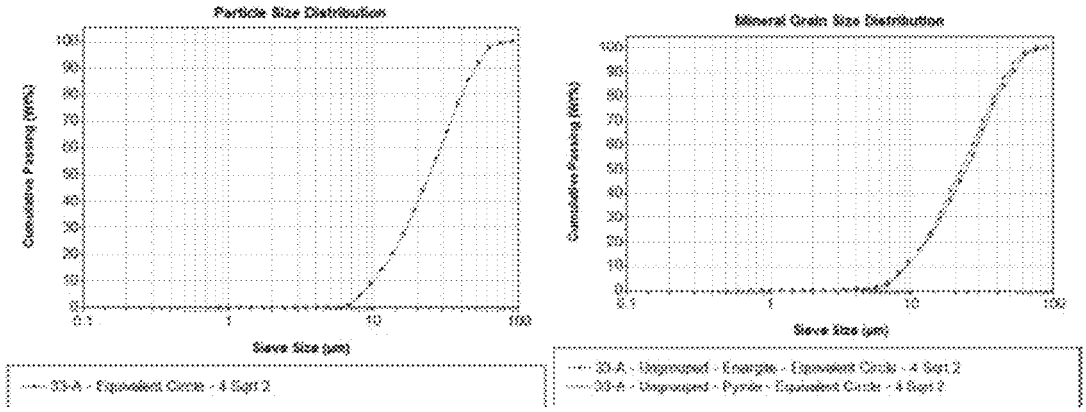

FIG. 52: Particle size distribution (left) and mineral grain size distributions (right) of enargite and pyrite for the #33 composite leach residue.

Figure 53:
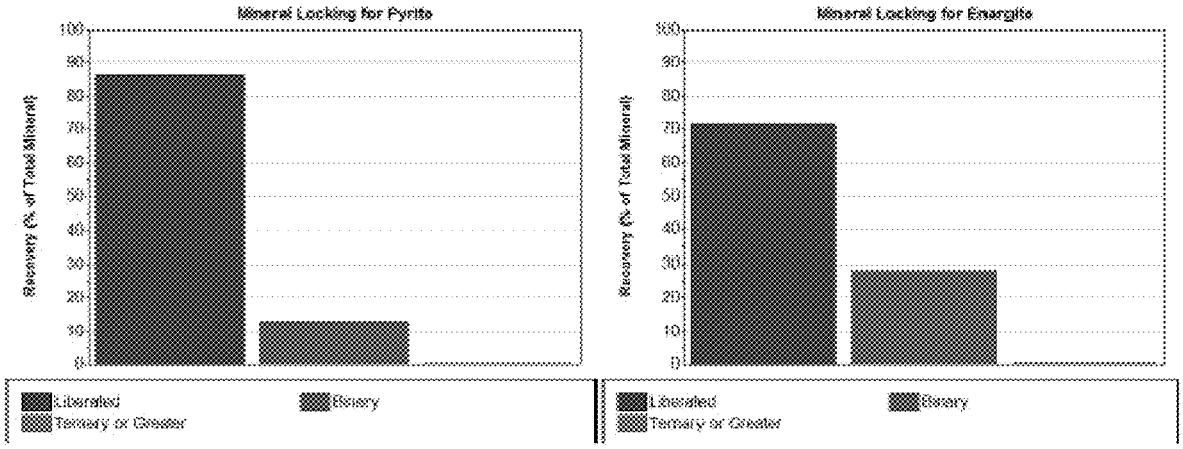

FIG. 53: Mineral locking for pyrite and enargite for the #33 composite leach residue.

Figure 54:
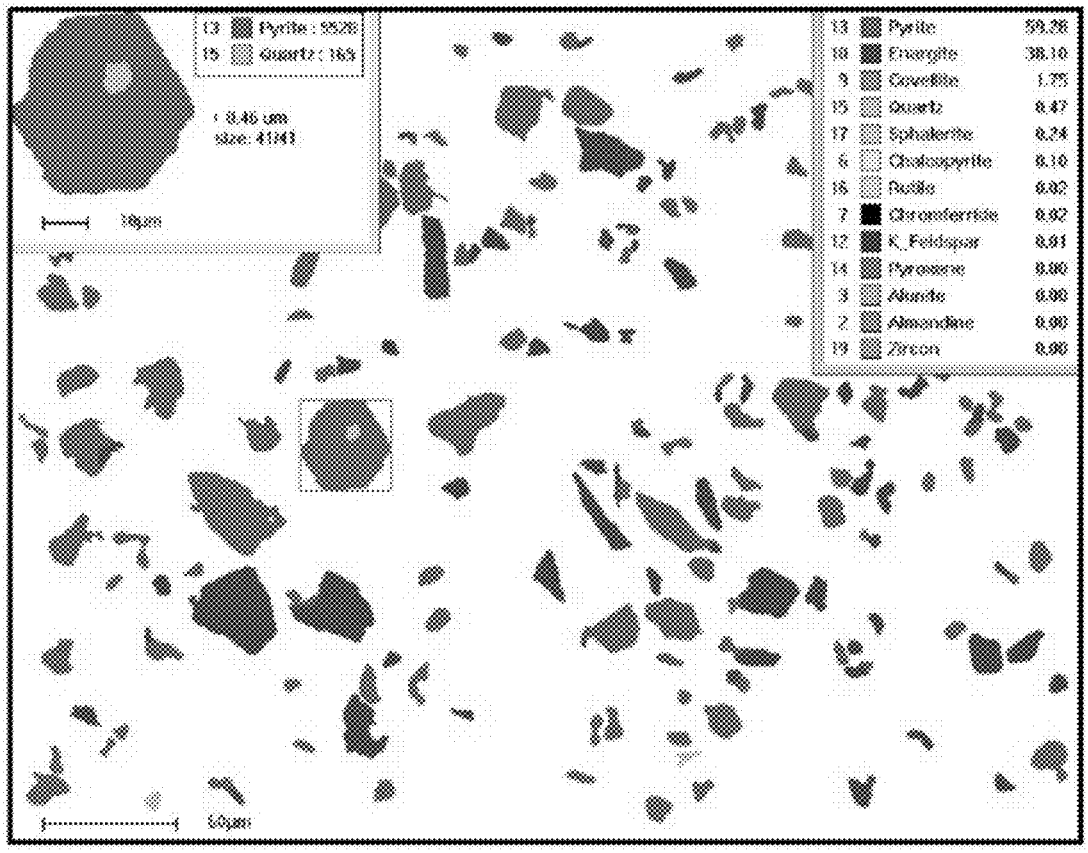

FIG. 54: Classified MLA image from the K-1 leach residue.

Figure 55:
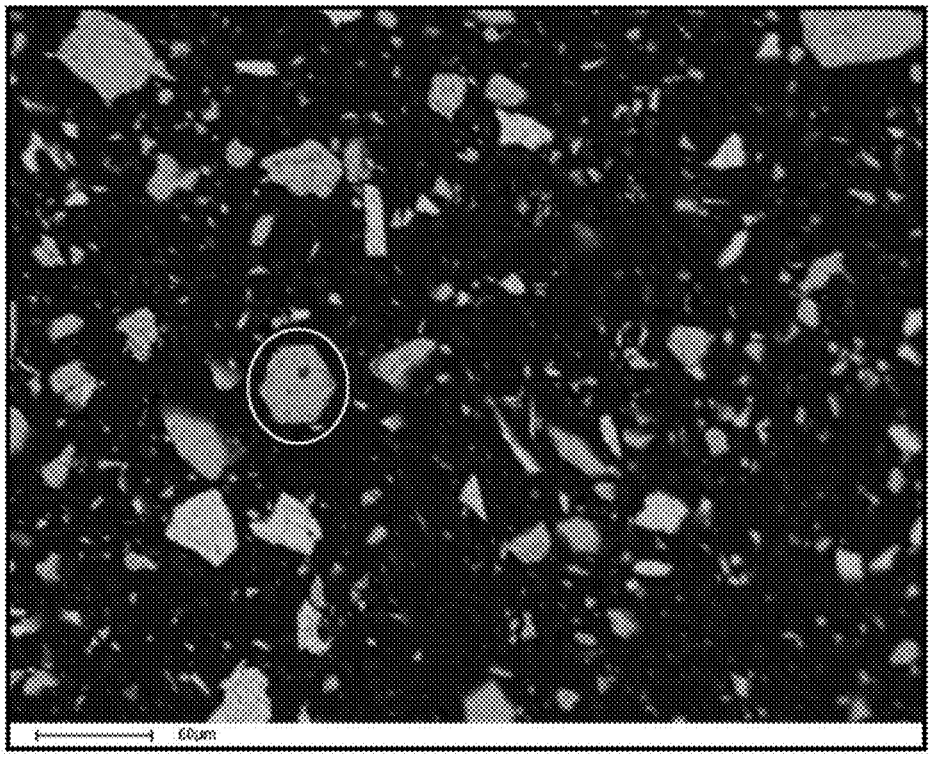

FIG. 55: BSE image from the K-1 leach residue.

Figure 56:
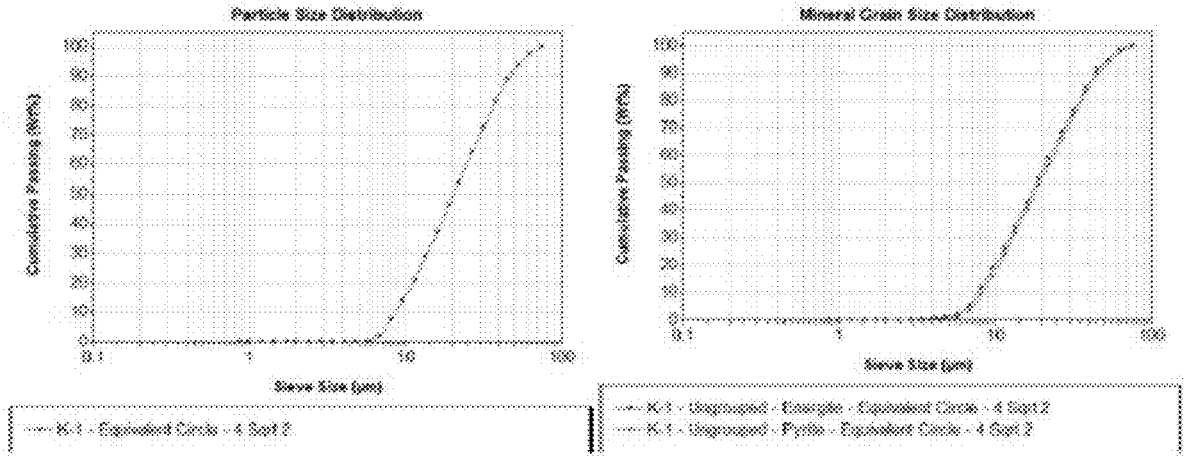

FIG. 56: Particle size distribution (left) and mineral grain size distributions (right) of enargite and pyrite for the K-1 leach residue.

Figure 57:
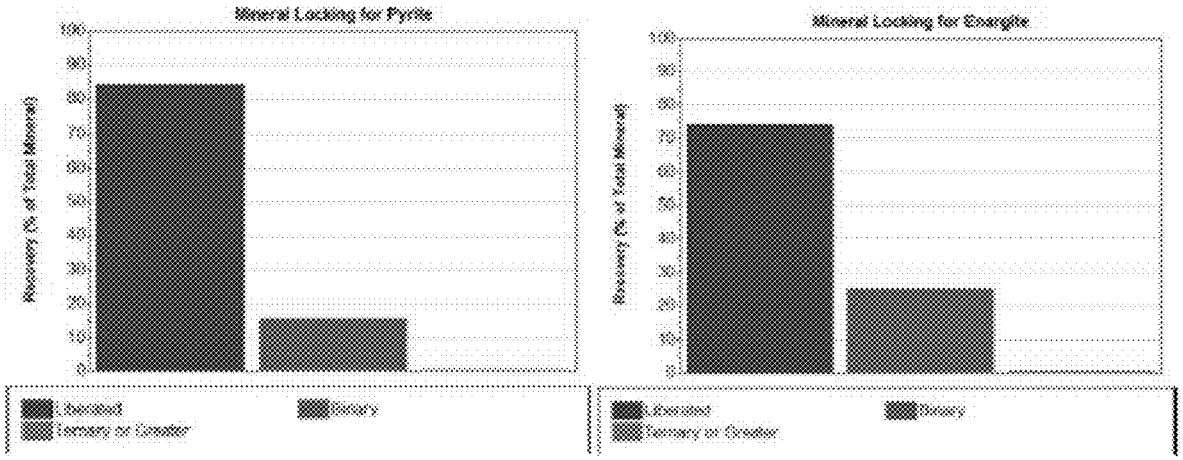

FIG. 57: Mineral locking for pyrite and enargite for the K-1 leach residue.

Figure 58:
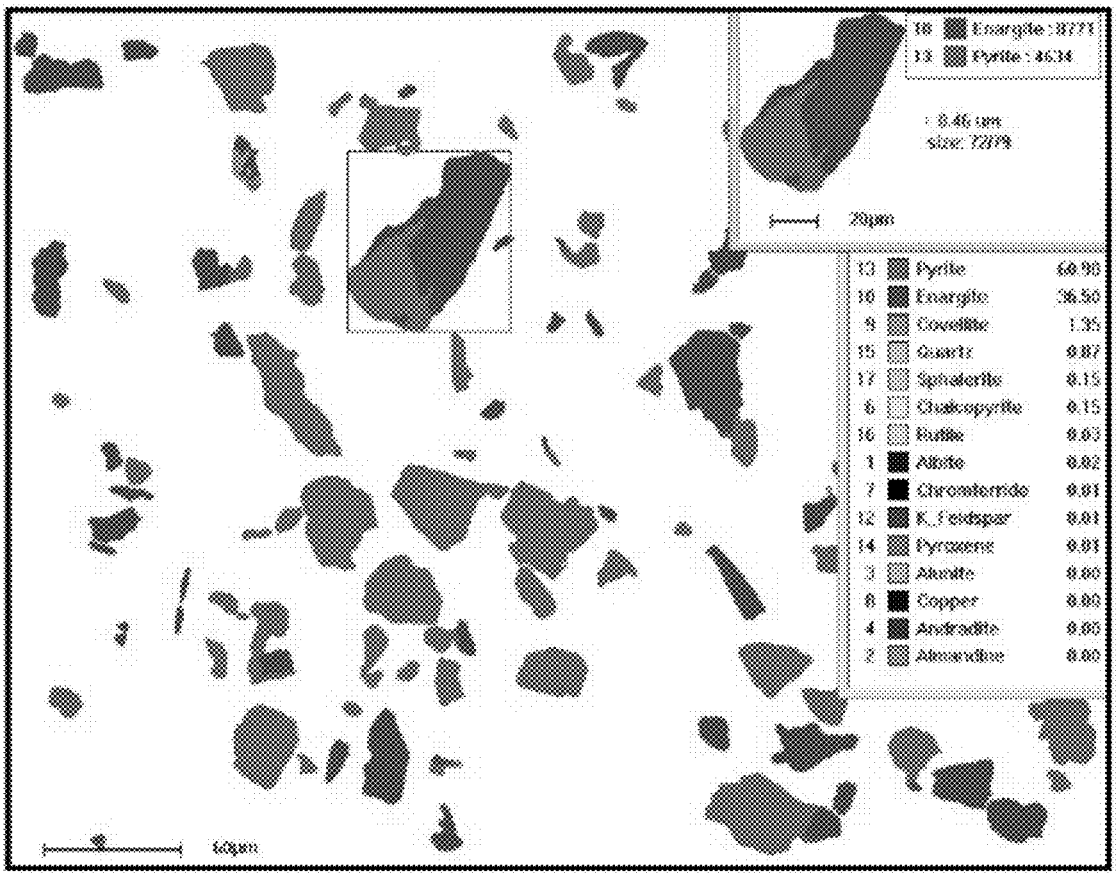

FIG. 58: Classified MLA image from the K-2 leach residue.

Figure 59:
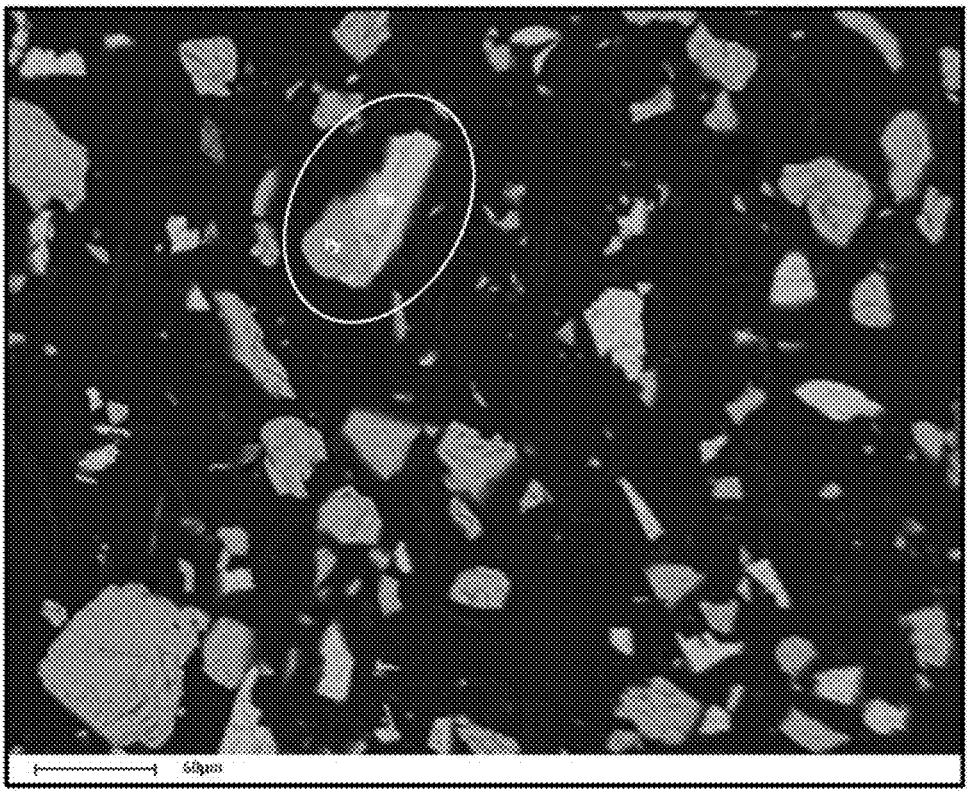

FIG. 59: BSE image from the K-2 leach residue.

Figure 60:
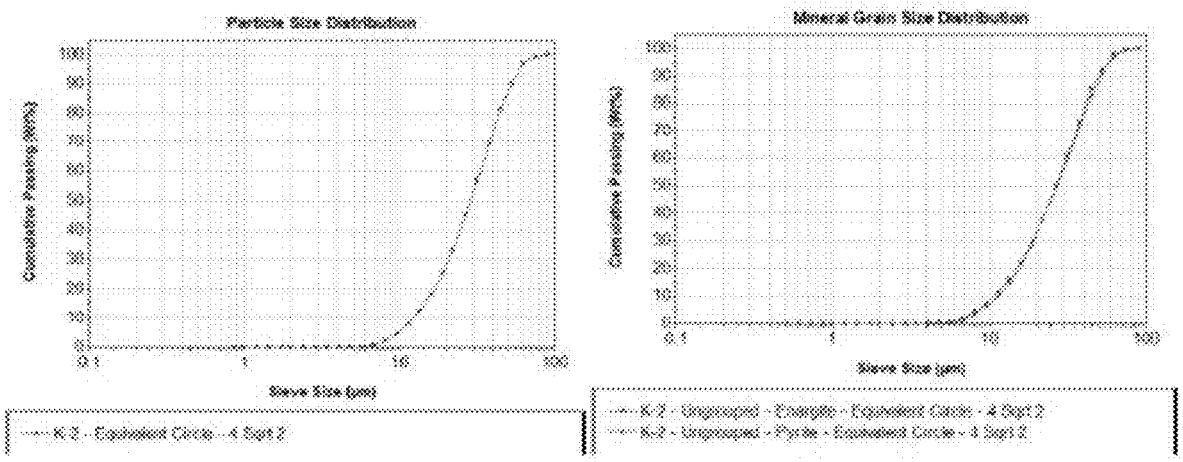

FIG. 60: Particle size distribution (left) and mineral grain size distributions (right) of enargite and pyrite for the K-2 leach residue.

Figure 61:
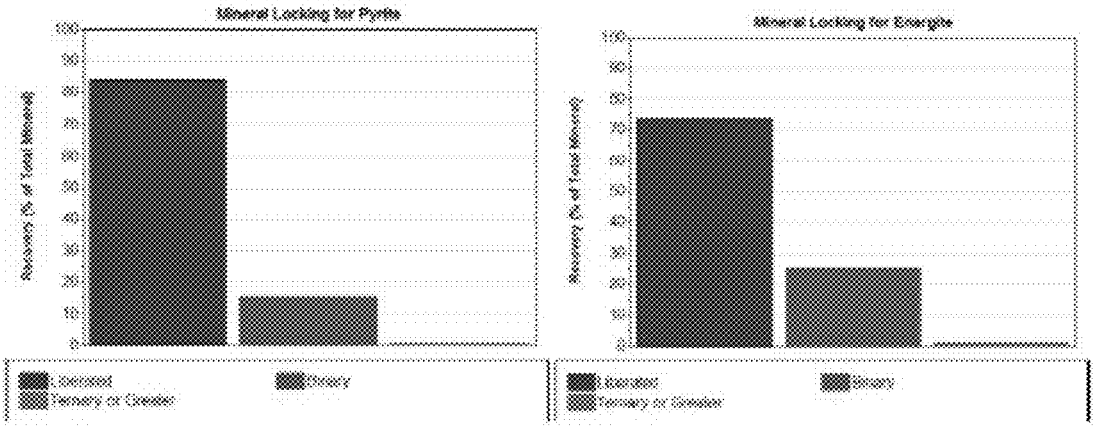

FIG. 61: Mineral locking for pyrite and enargite for the K-2 leach residue.

Figure 62:
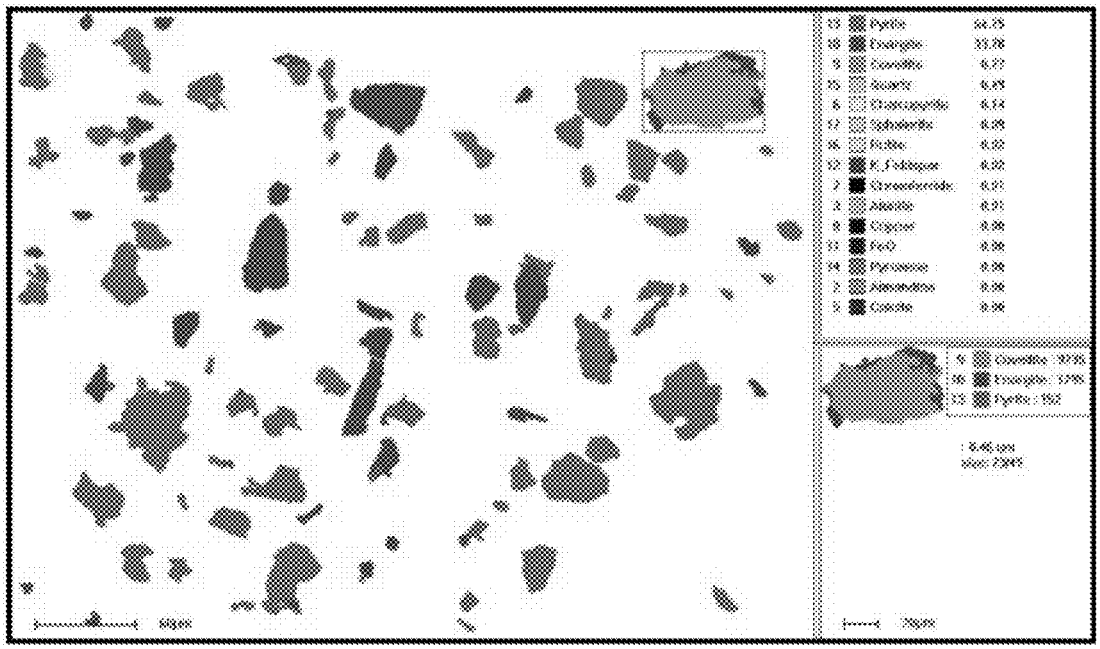

FIG. 62: Covellite is highlighted in the MLA image from the K-3 leach residue.

Figure 63:
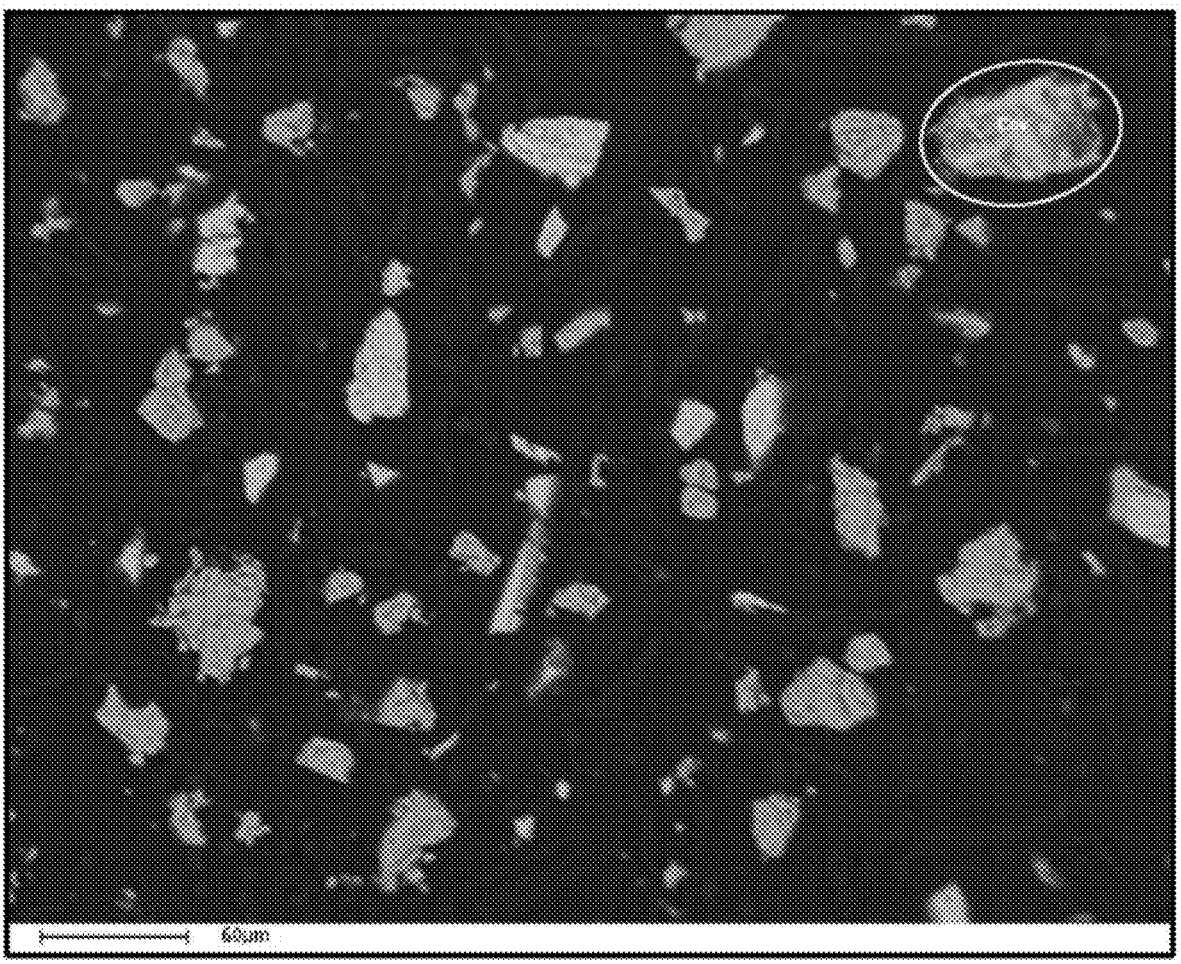

FIG. 63: BSE image from the K-3 leach residue.

Figure 64:
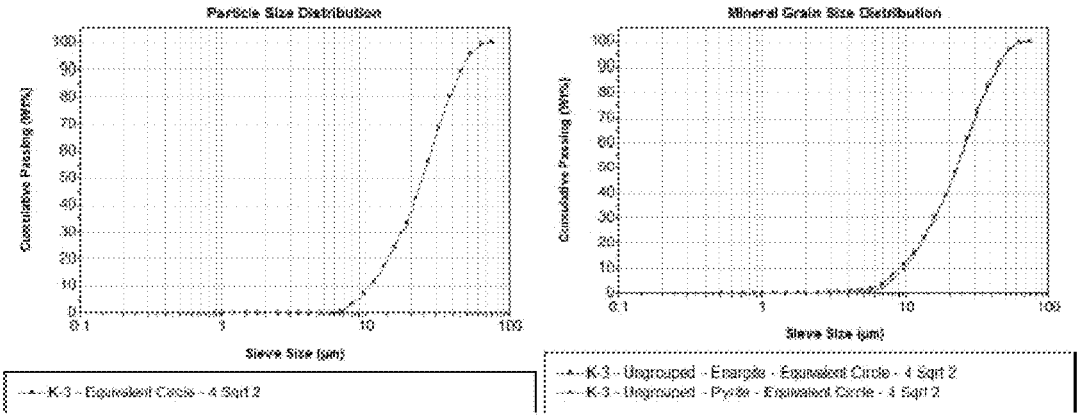

FIG. 64: Particle size distribution (left) and mineral grain size distributions (right) of enargite and pyrite for the K-3 leach residue.

Figure 65:
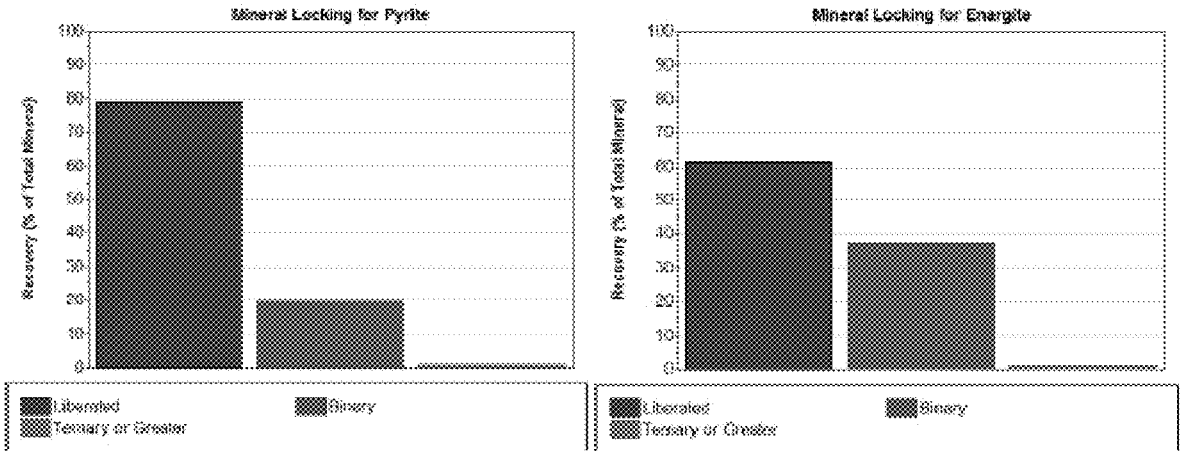

FIG. 65: Mineral locking for pyrite and enargite for the K-3 leach residue.

Figure 66:
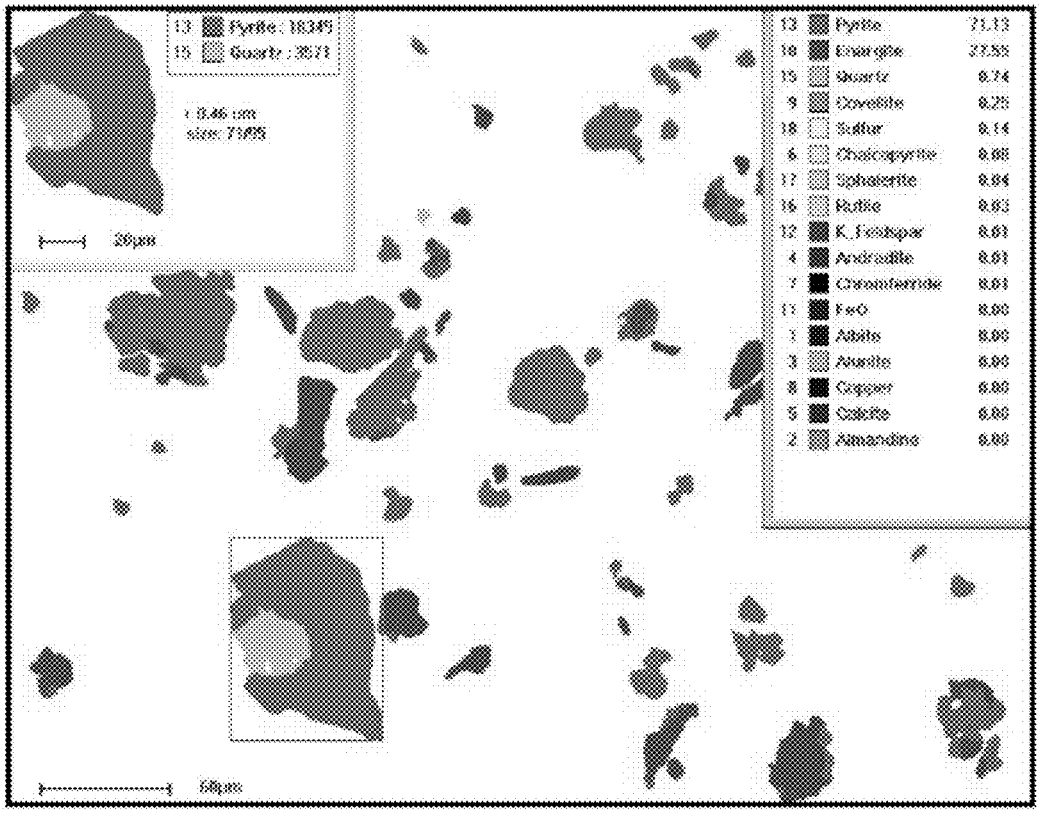

FIG. 66: MLA image from the K-4 leach residue with quartz in pyrite. The BSE image shows the pyrite particle with a quartz inclusion in FIG. 9.20.

Figure 67:
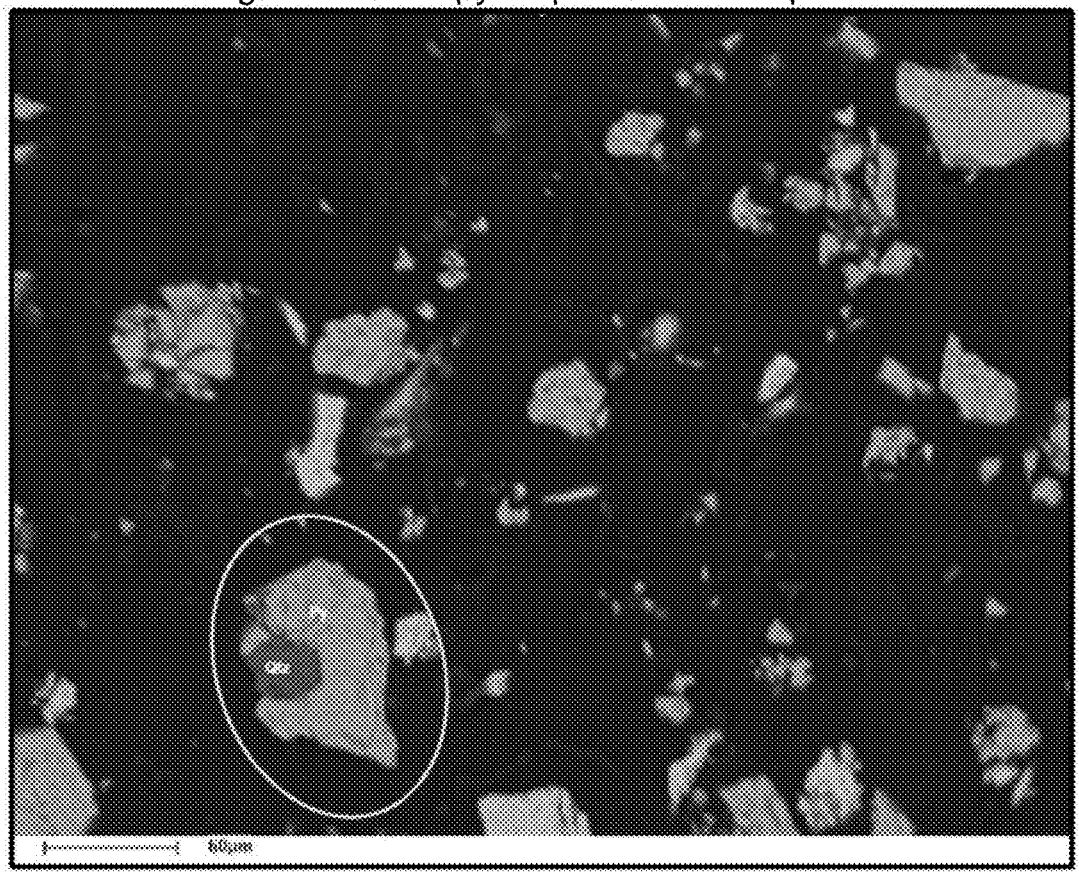

FIG. 67: BSE image from the K-4 leach residue.

Figure 68:
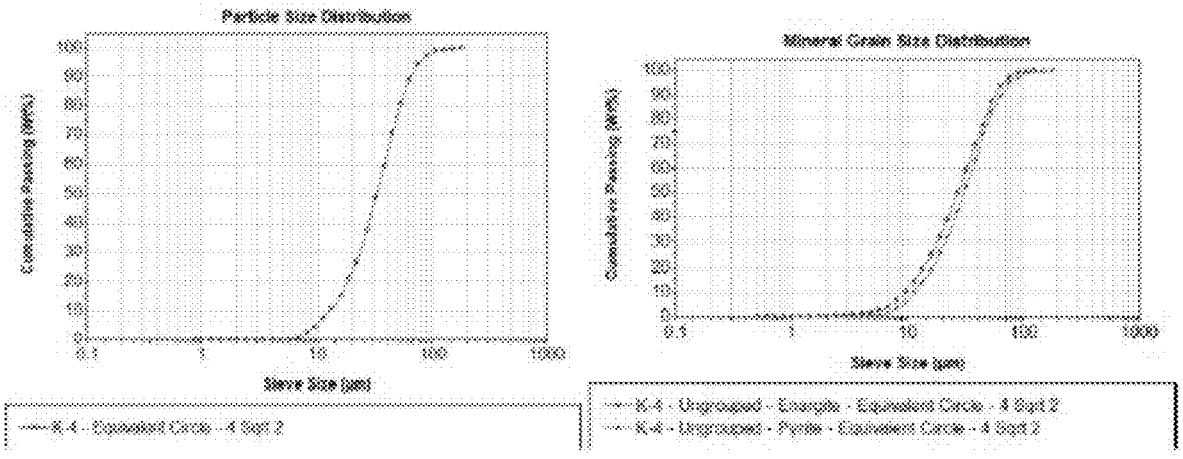

FIG. 68: Particle size distribution (left) and mineral grain size distributions (right) of enargite and pyrite for the K-4 leach residue.

Figure 69:
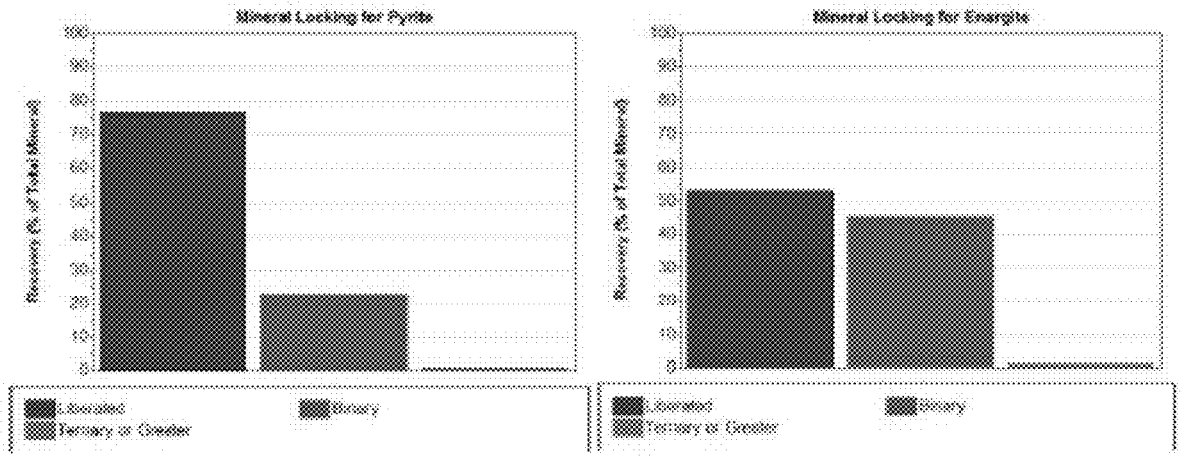

FIG. 69: Mineral locking for pyrite and enargite for the K-4 leach residue.

Figure 70:
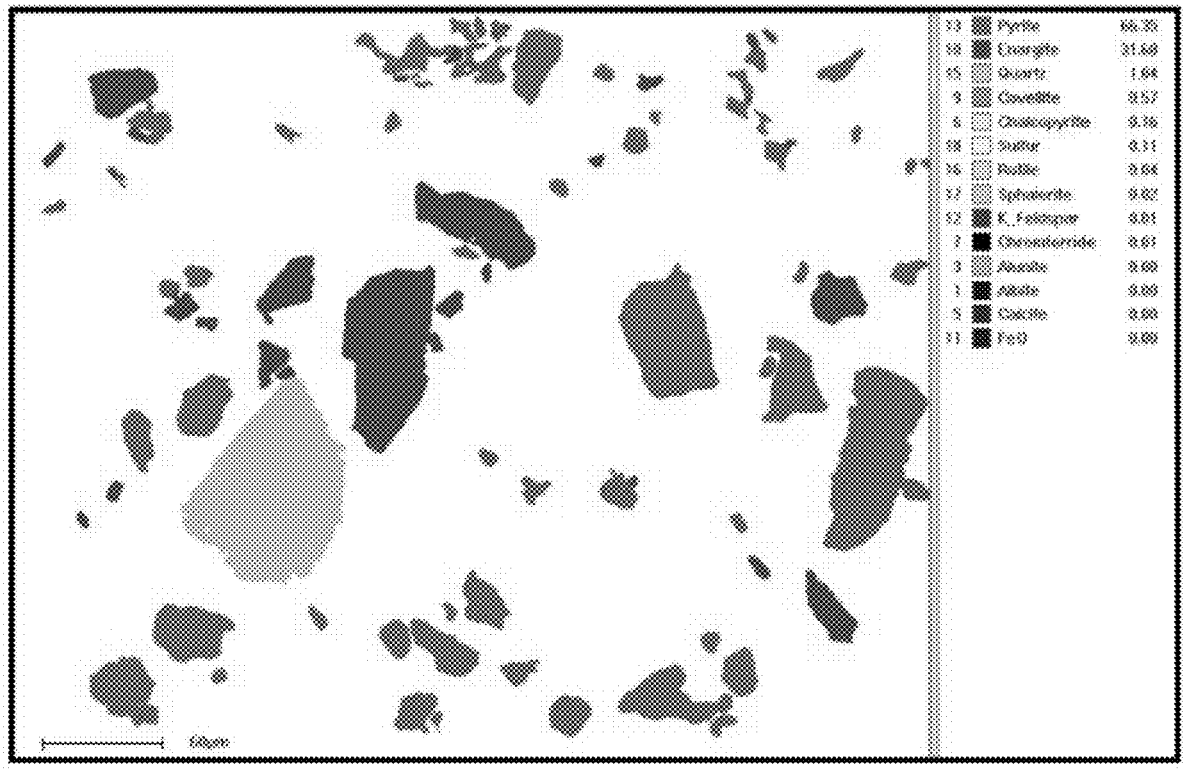

FIG. 70: MLA image from the K-5 leach residue.

Figure 71:
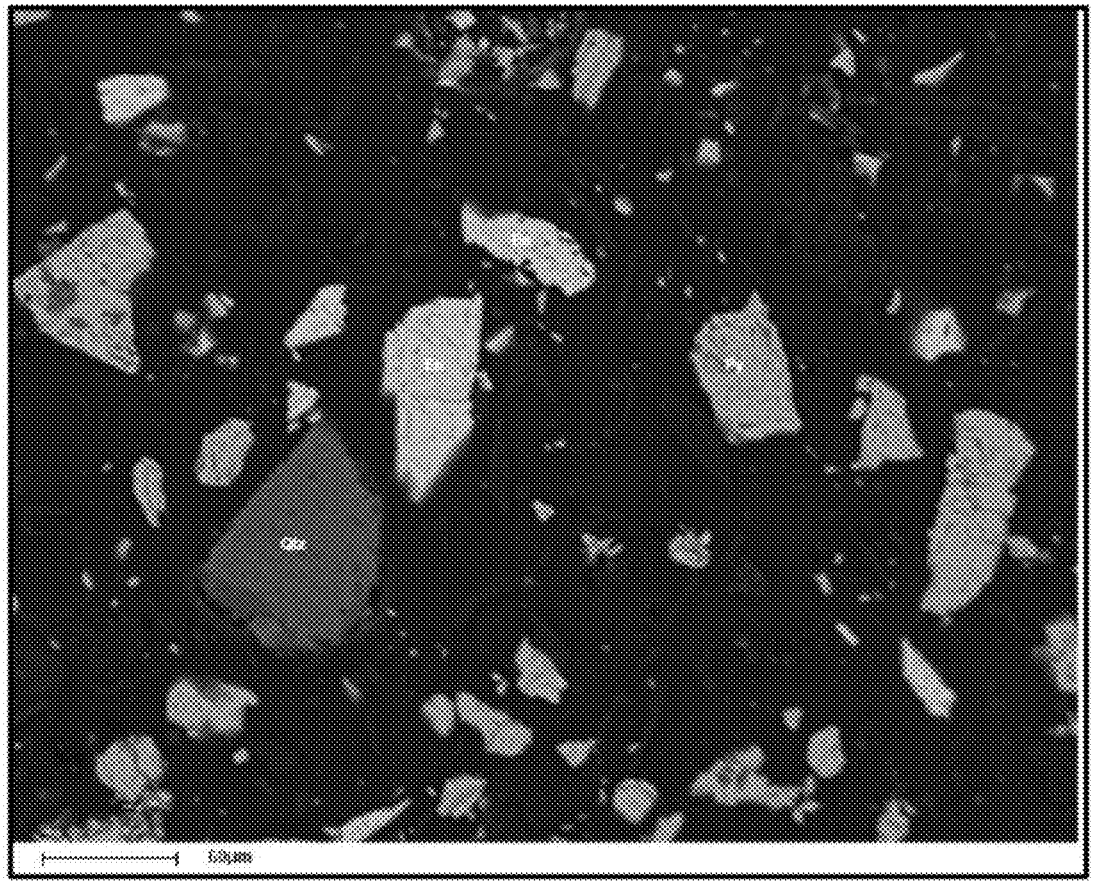

FIG. 71: BSE image from the K-5 leach residue.

Figure 72:
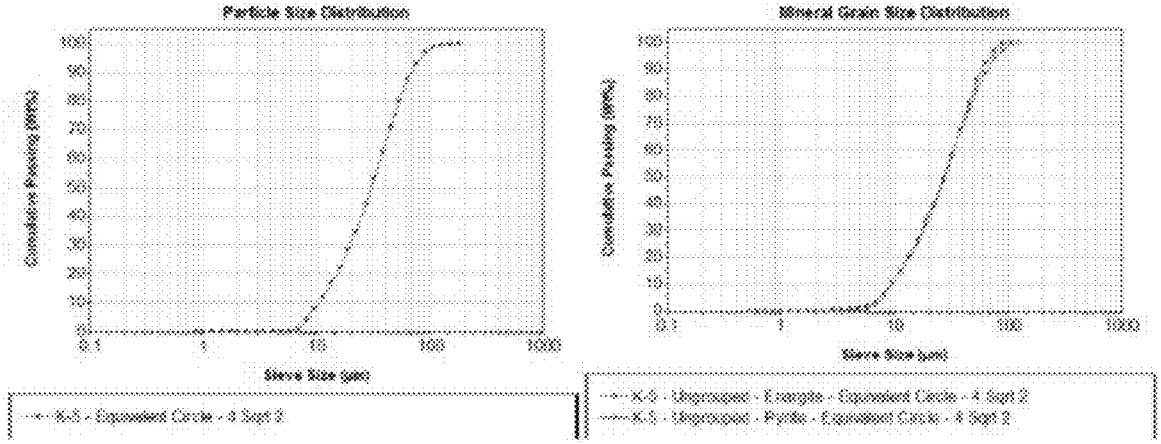

FIG. 72: Particle size distribution (left) and mineral grain size distributions (right) of enargite and pyrite for the K-5 leach residue.

Figure 73:
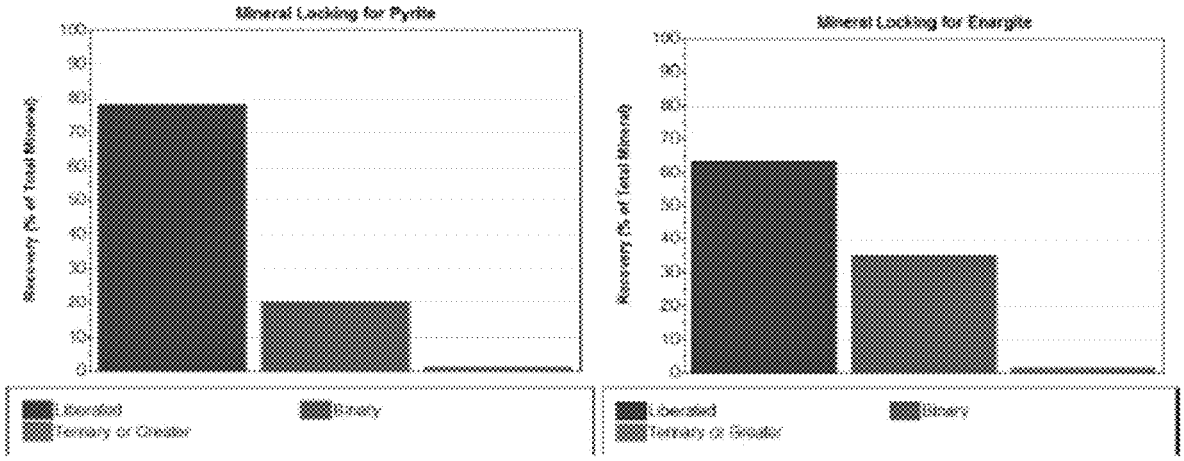

FIG. 73: Mineral locking for pyrite and enargite for the K-5 leach residue.

Figure 74:
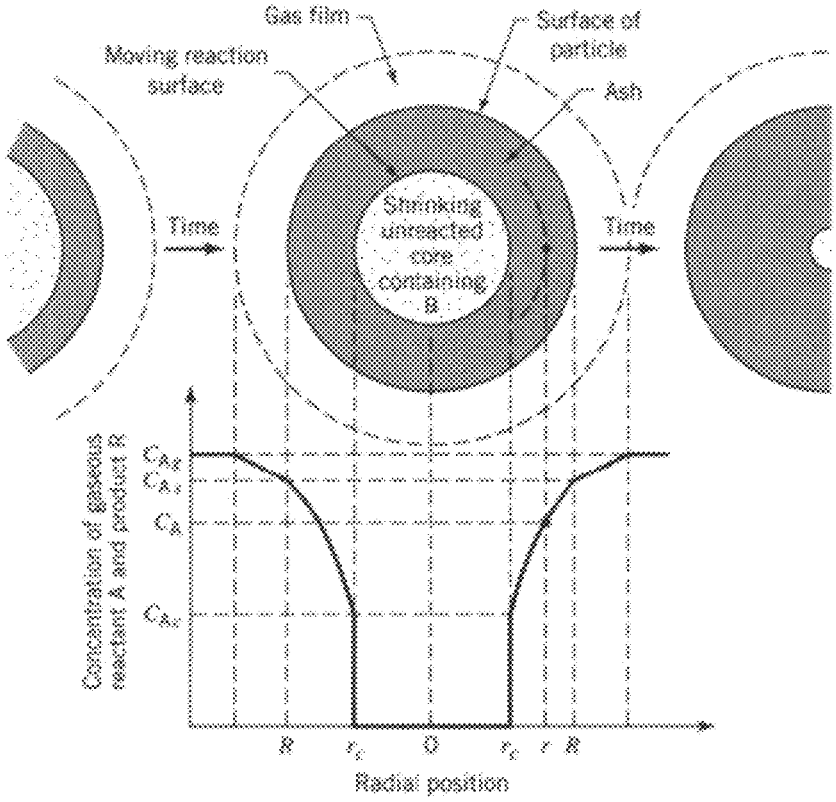

FIG. 74: Representation of concentrations of reactants and products for the reaction A(g)+bB(s)→solid product for a particle of unchanging size (Levenspiel 1999).

Figure 75:
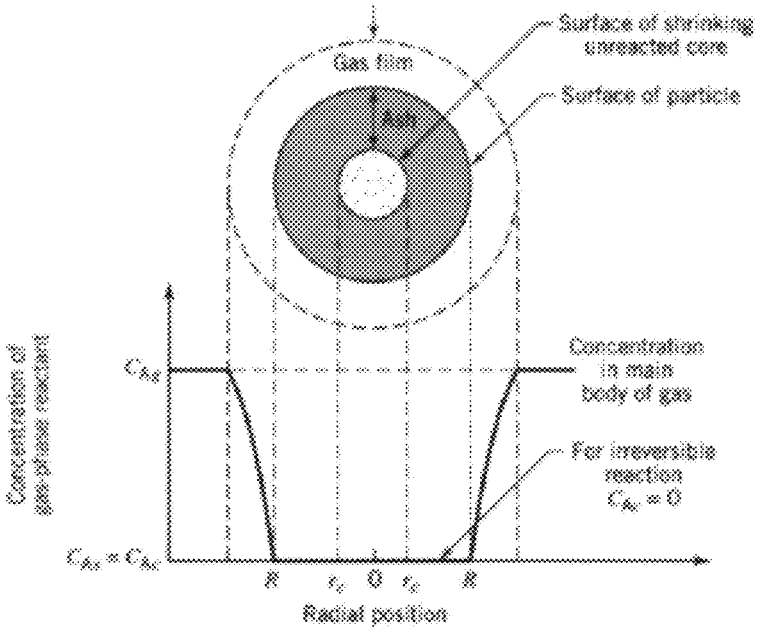

FIG. 75: Representation of a reacting particle when diffusion through film is the controlling resistance (Levenspiel 1999).

Figure 76:
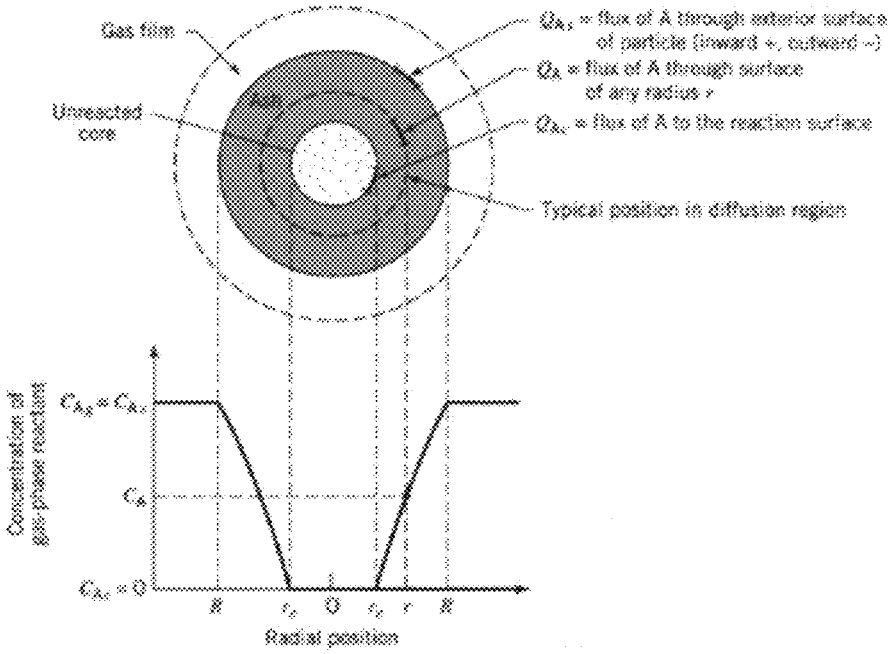

FIG. 76: Representation of a reacting particle when diffusion through the ash layer is the controlling resistance (Levenspiel 1999).

Figure 77:
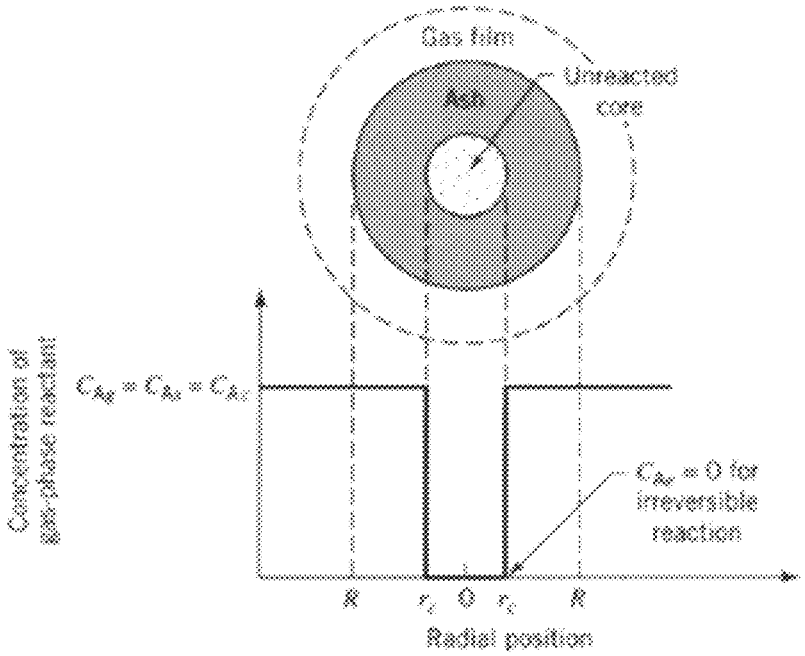

FIG. 77: Representation of a reacting particle when chemical reaction is the controlling resistance, the reaction being A(g)+bB(s)→products (Levenspiel 1999).

Figure 78:
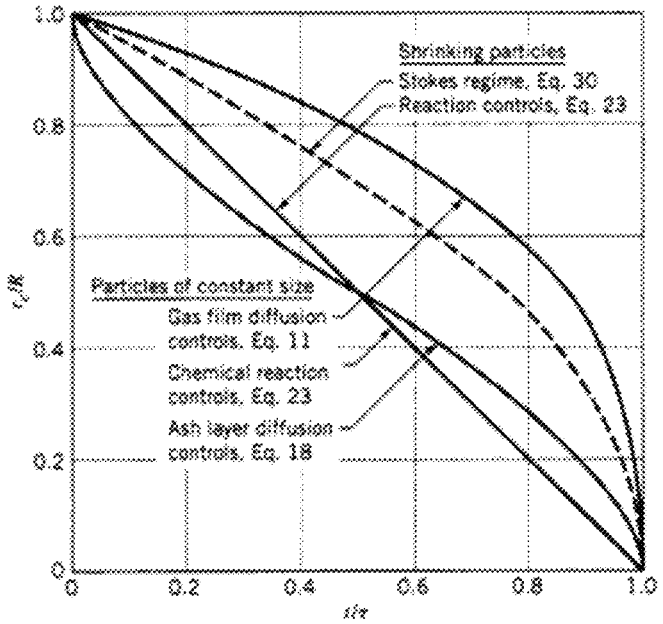

FIG. 78: Progress of reaction of a single spherical particle with surrounding fluid measured in terms of time for complete reaction (Levenspiel 1999).

Figure 79:
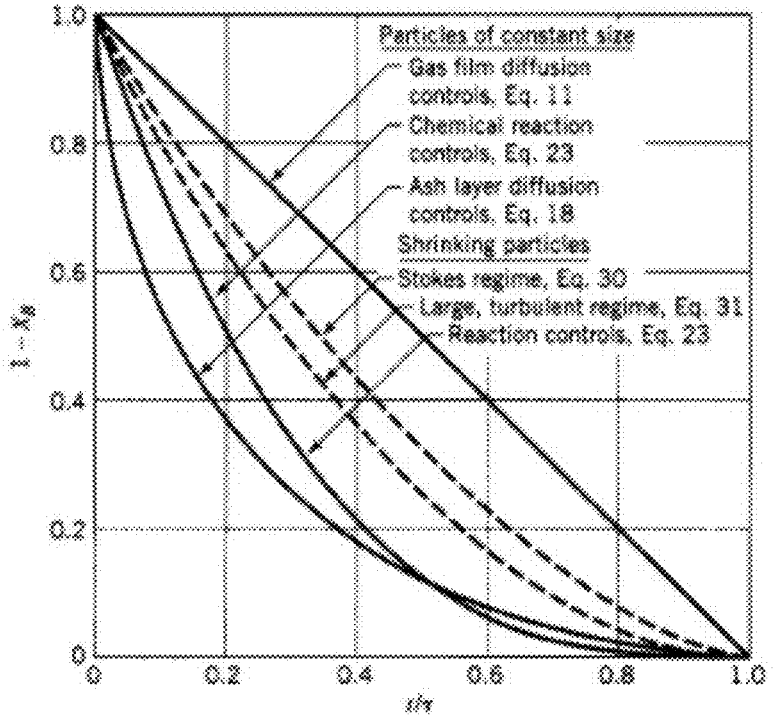

FIG. 79: Progress of reaction of a single spherical particle with surrounding fluid measured in terms of time for complete conversion (Levenspiel 1999).

Figure 80:
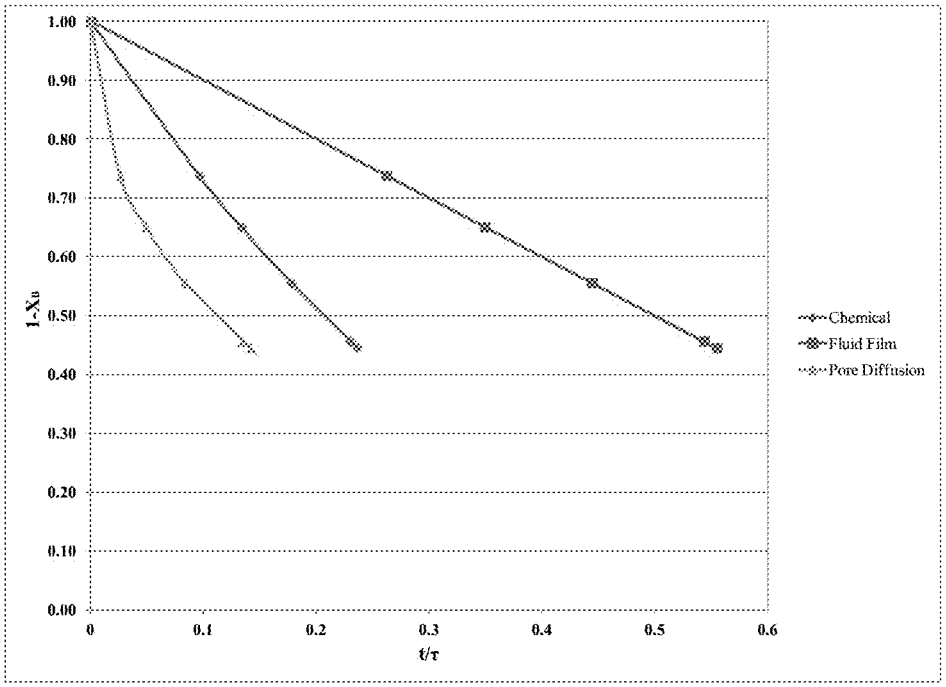

FIG. 80: Progress of PDX kinetic reactions.

Figure 81:
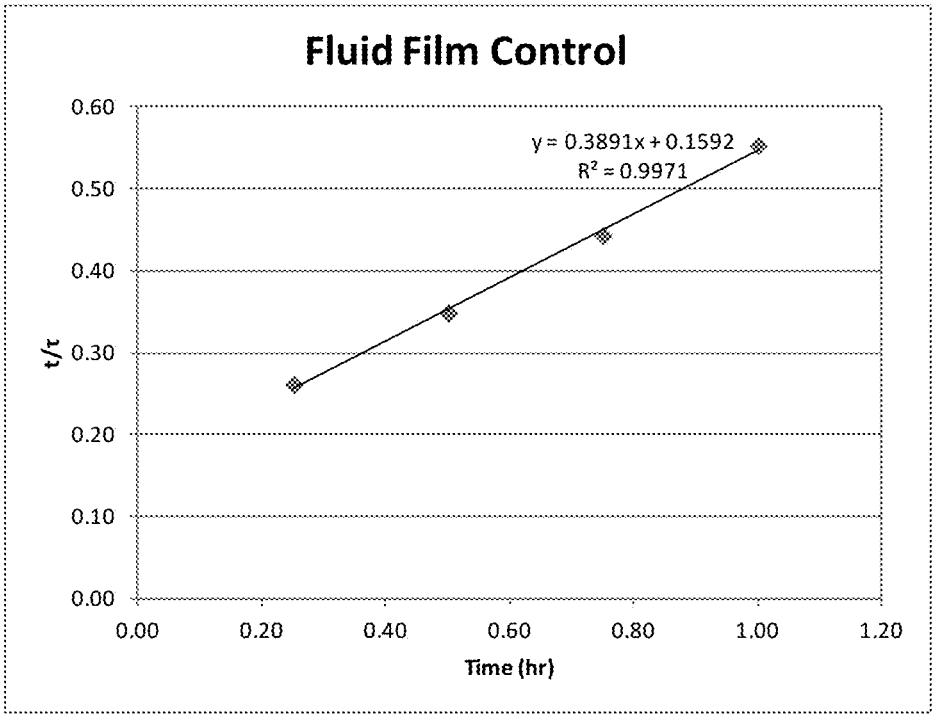

FIG. 81: Kinetic data plotted for fluid film control.

Figure 82:
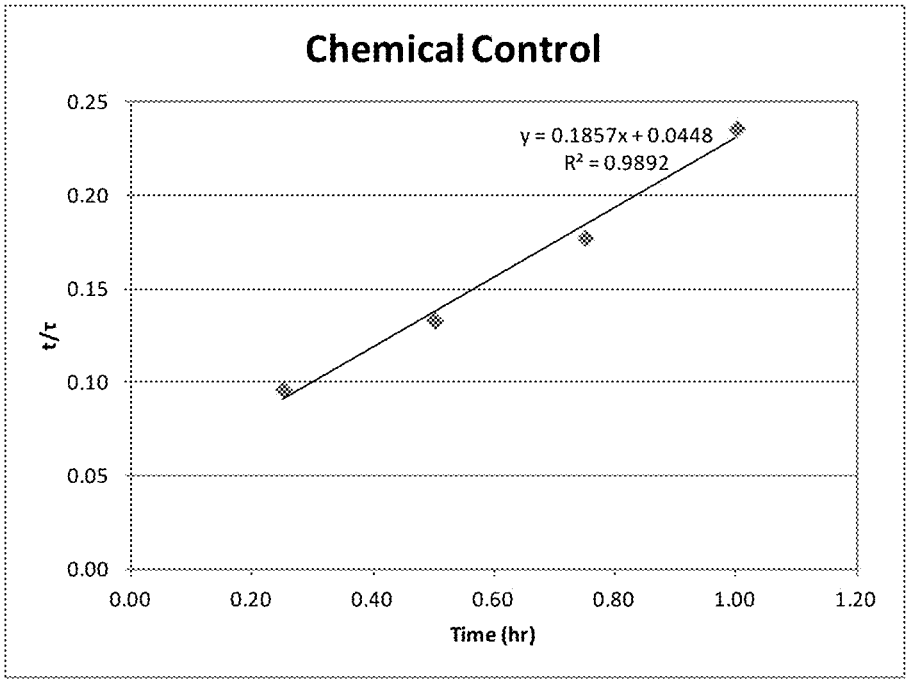

FIG. 82: Kinetic data plotted for chemical control.

Figure 83:
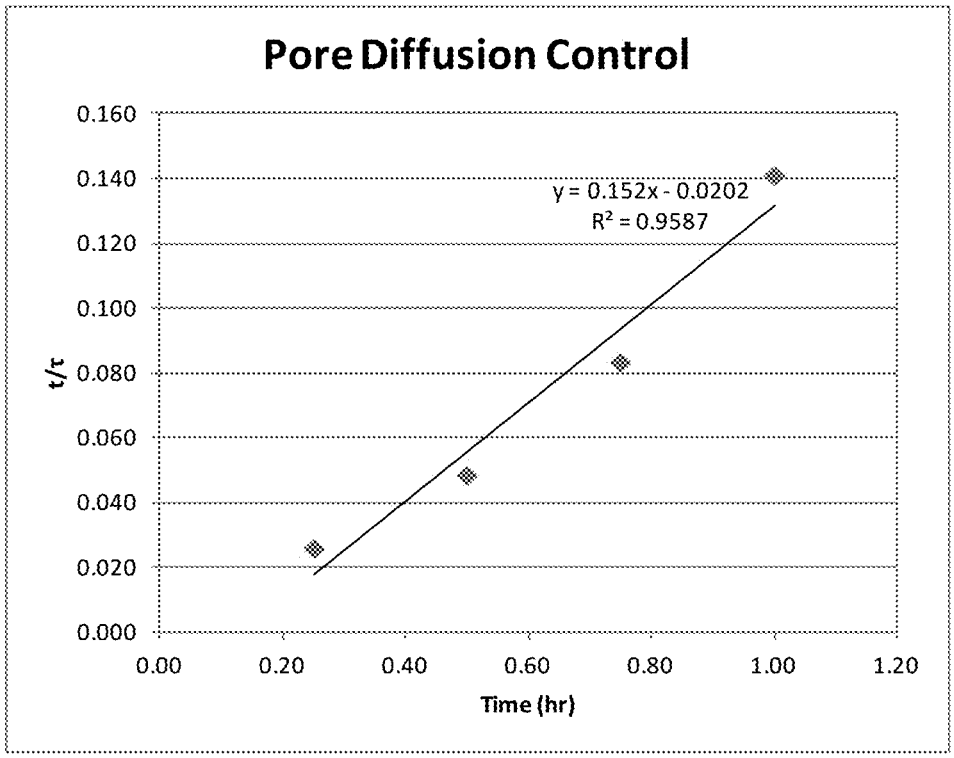

FIG. 83: Kinetic data plotted for pore diffusion control.

Figure 84:
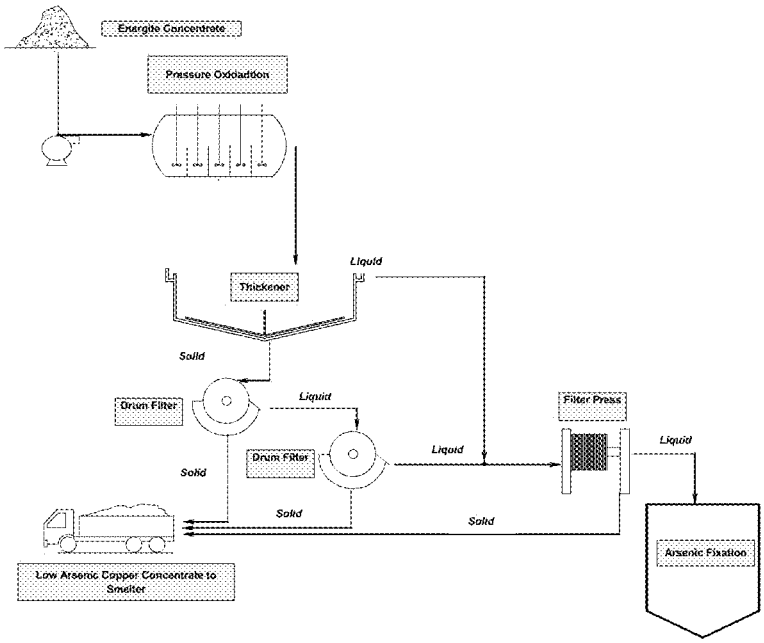

FIG. 84: Schematic of proposed enargite pressure oxidation flowsheet.

Figure 85:
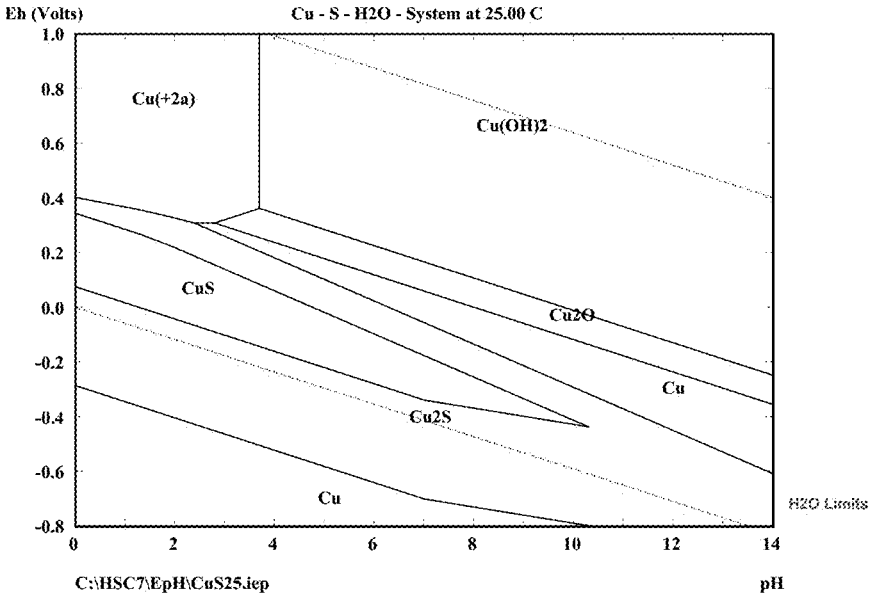

FIG. 85: HSC 7.1 Eh-pH stability diagram for the Cu—S—H2O system at 25° C.

Figure 86:
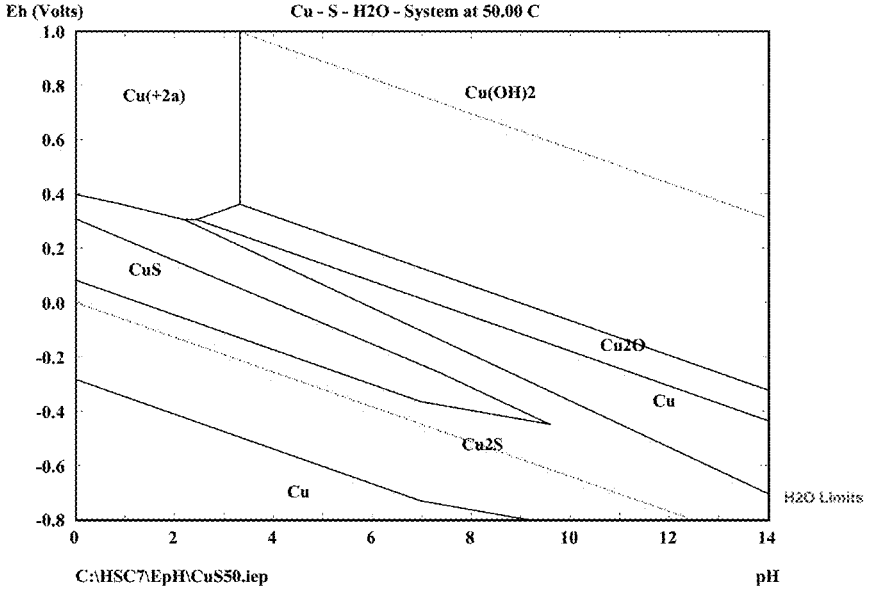

FIG. 86: HSC 7.1 Eh-pH stability diagram for the Cu—S—H2O system at 50° C.

Figure 87:
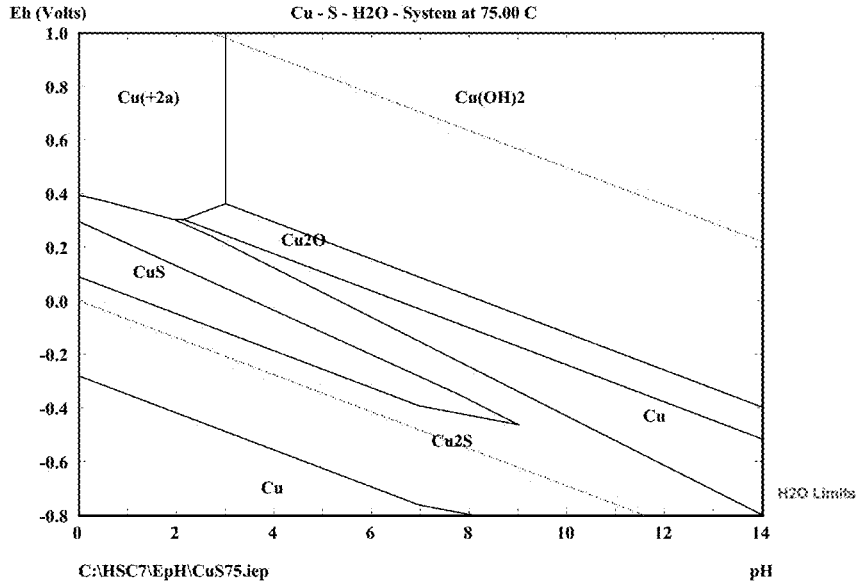

FIG. 87: HSC 7.1 Eh-pH stability diagram for the Cu—S—H2O system at 75° C.

Figure 88:
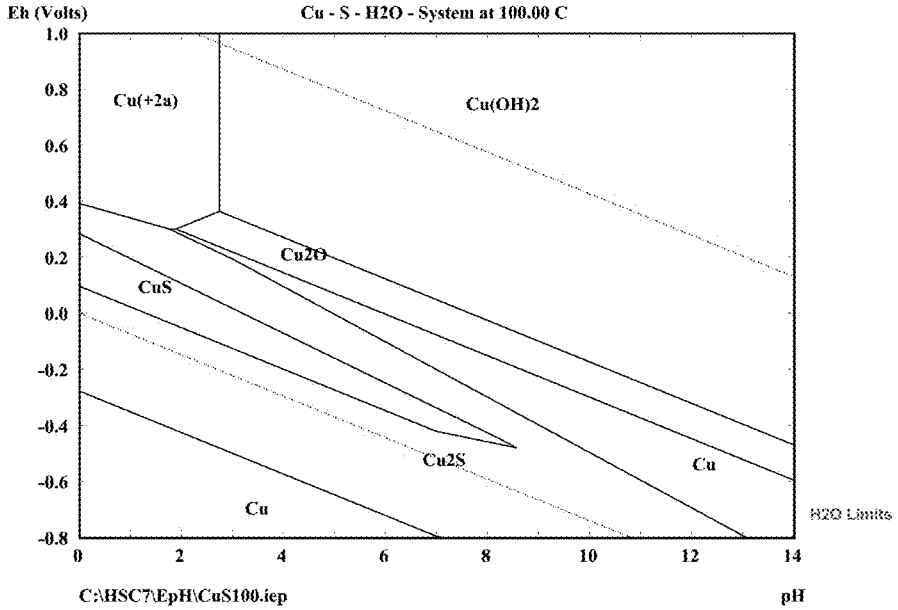

FIG. 88: HSC 7.1 Eh-pH stability diagram for the Cu—S—H2O system at 100° C.

Figure 89:
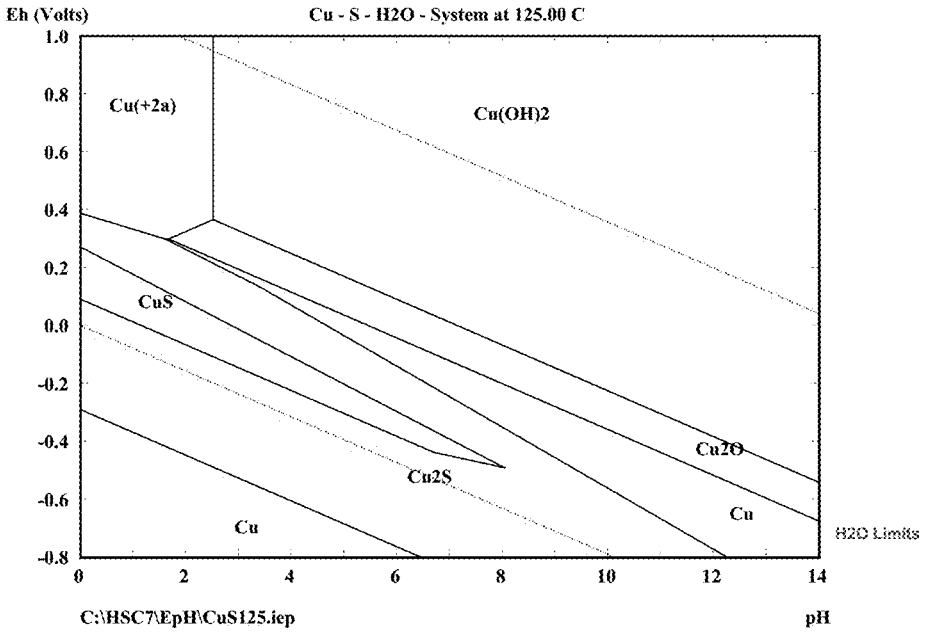

FIG. 89: HSC 7.1 Eh-pH stability diagram for the Cu—S—H2O system at 125° C.

Figure 90:
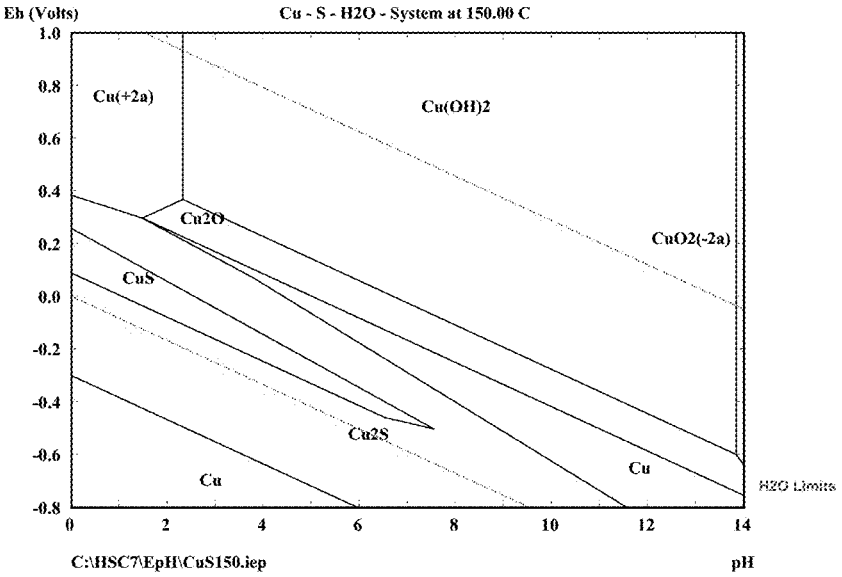

FIG. 90: HSC 7.1 Eh-pH stability diagram for the Cu—S—H2O system at 150° C.

Figure 91:
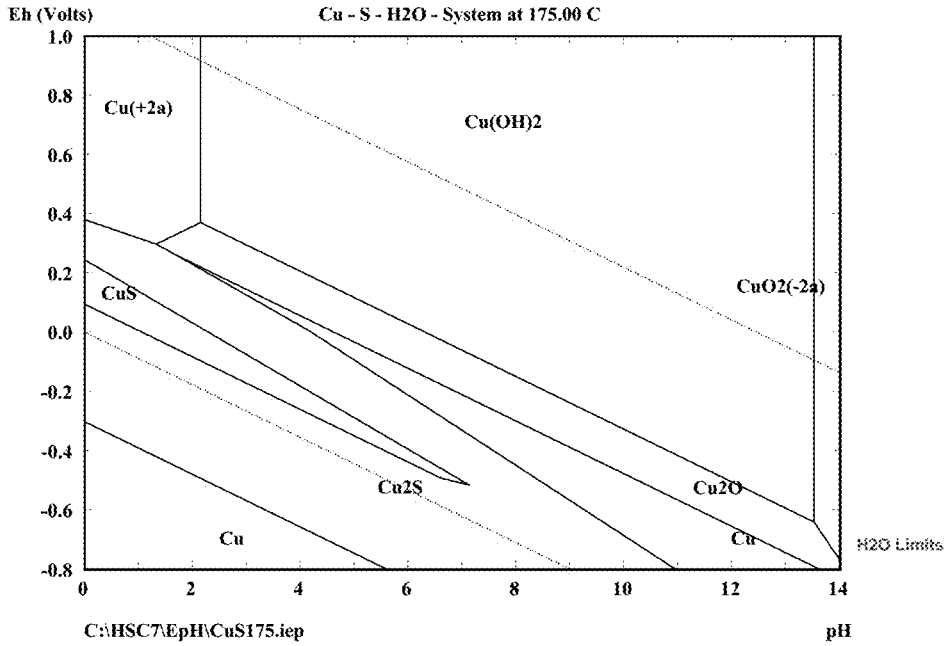

FIG. 91: HSC 7.1 Eh-pH stability diagram for the Cu—S—H2O system at 175° C.

Figure 92:
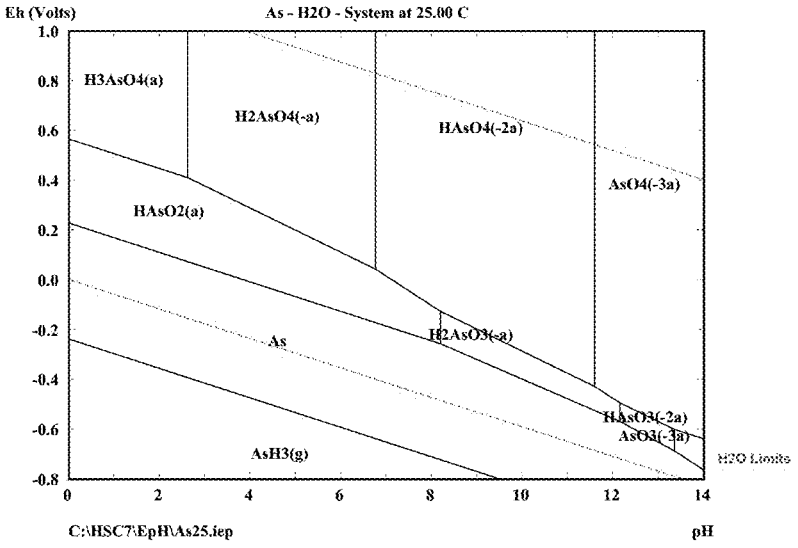

FIG. 92: HSC 7.1 Eh-pH stability diagram for the As—H2O system at 25° C.

Figure 93:
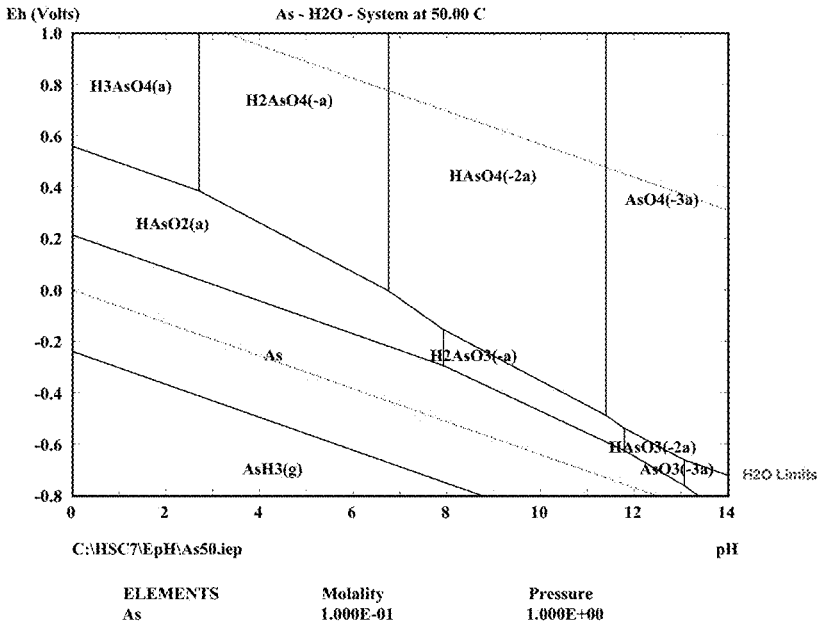

FIG. 93: HSC 7.1 Eh-pH stability diagram for the As—H2O system at 50° C.

Figure 94:
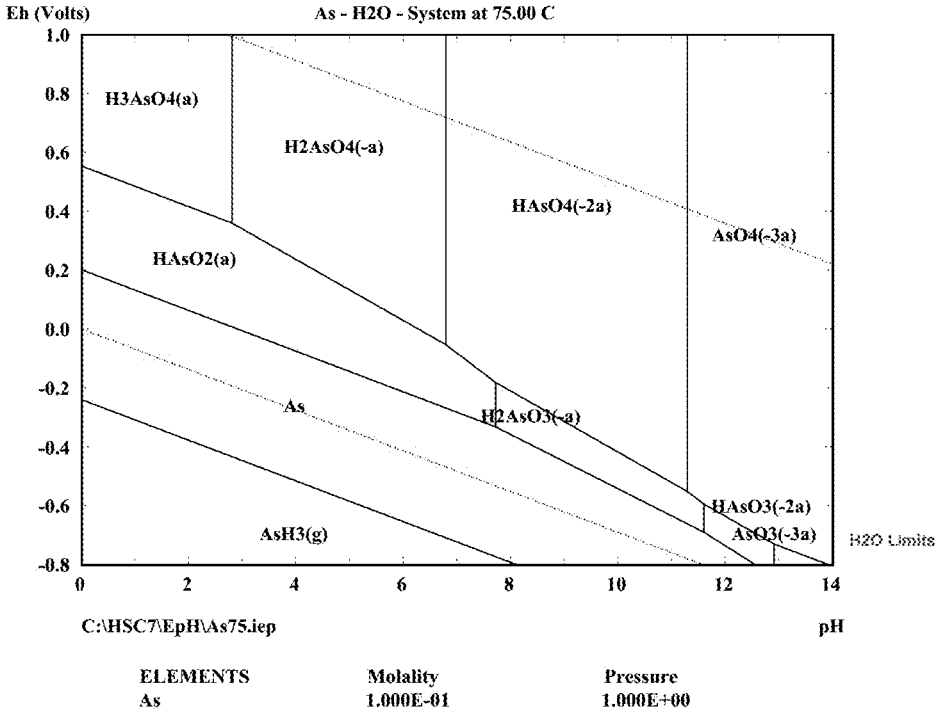

FIG. 94: HSC 7.1 Eh-pH stability diagram for the As—H2O system at 75° C.

Figure 95:
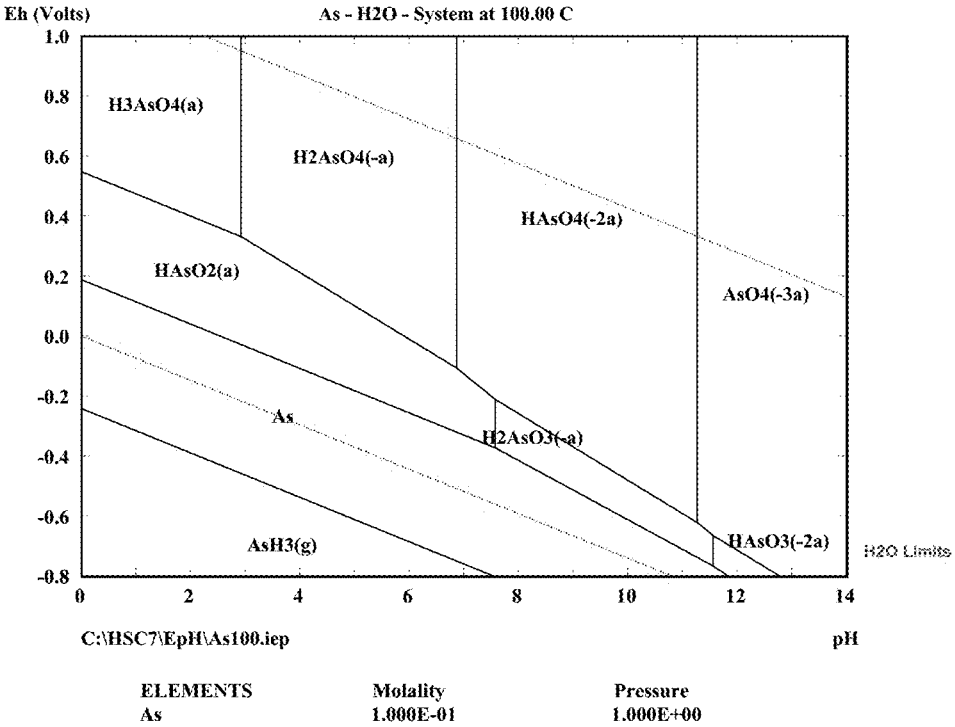

FIG. 95: HSC 7.1 Eh-pH stability diagram for the As—H2O system at 100° C.

Figure 96:
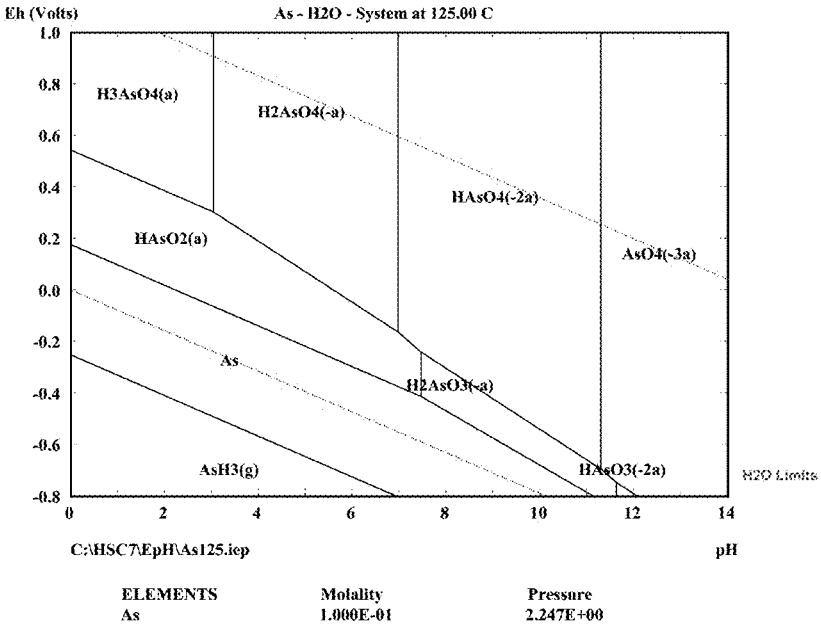

FIG. 96: HSC 7.1 Eh-pH stability diagram for the As—H2O system at 125° C.

Figure 97:
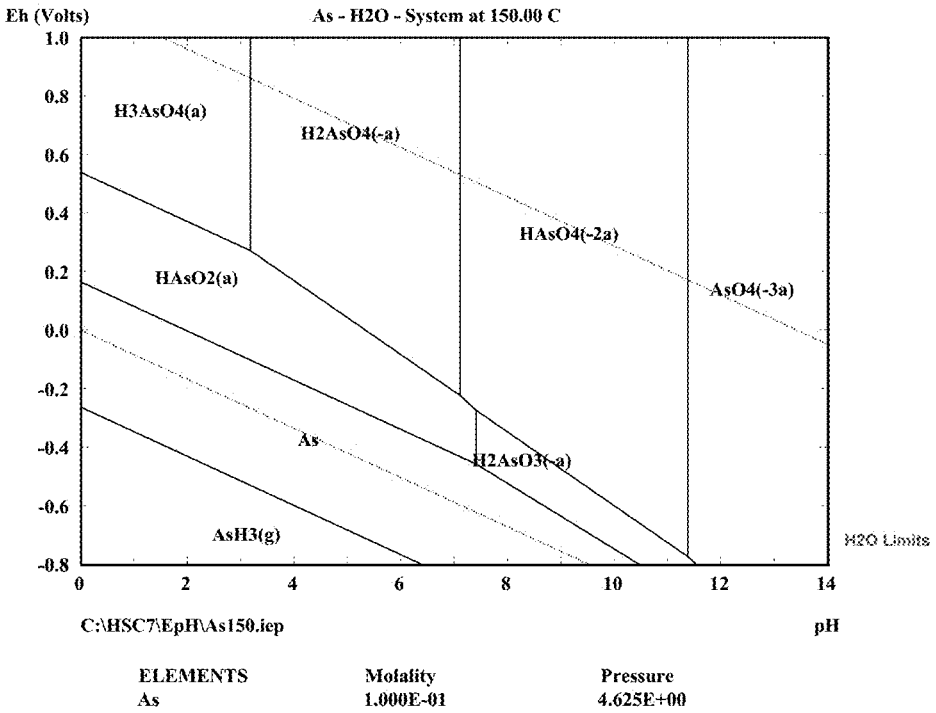

FIG. 97: HSC 7.1 Eh-pH stability diagram for the As—H2O system at 150° C.

Figure 98:
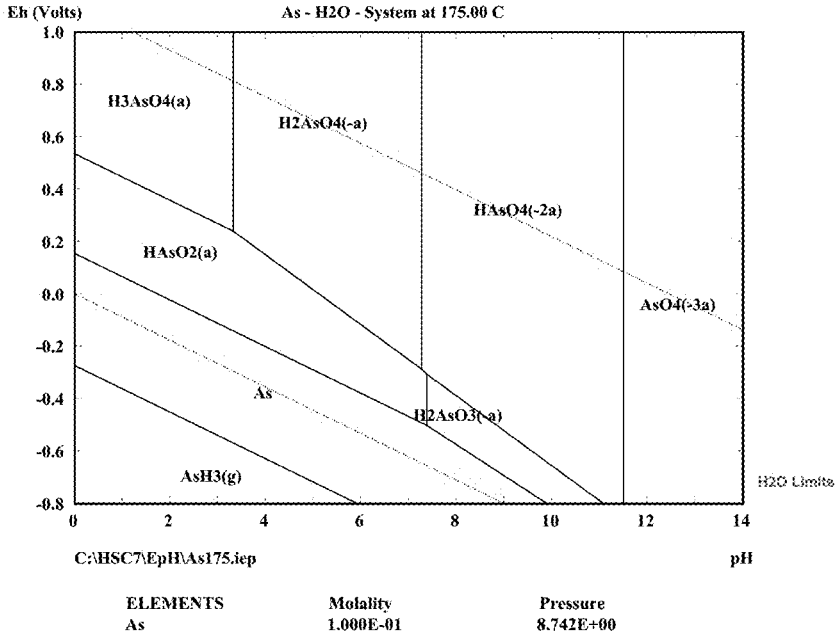

FIG. 98: HSC 7.1 Eh-pH stability diagram for the As—H2O system at 175° C.

Figure 99:
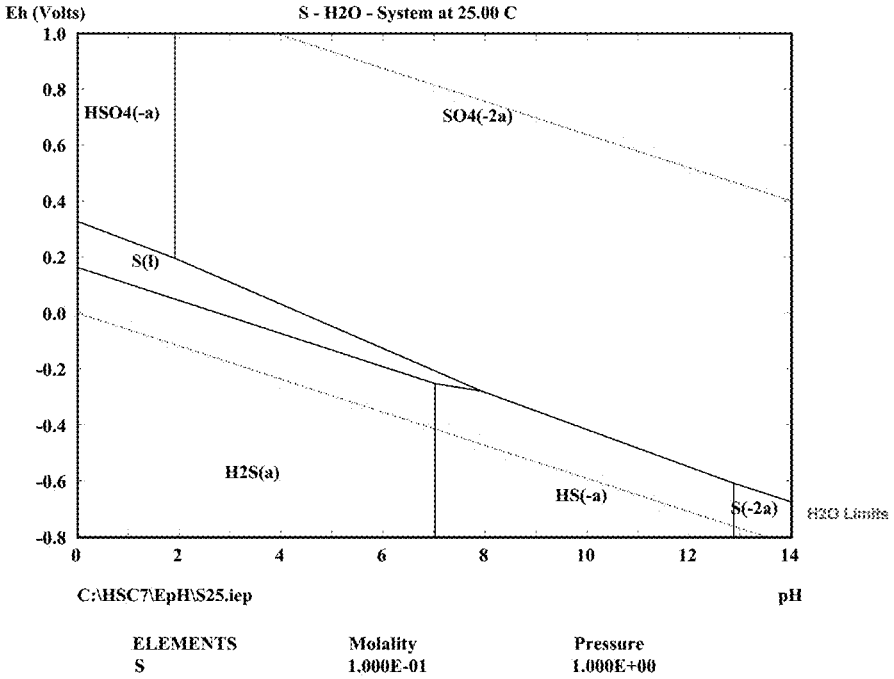

FIG. 99: HSC 7.1 Eh-pH stability diagram for the S—H2O system at 25° C.

Figure 100:
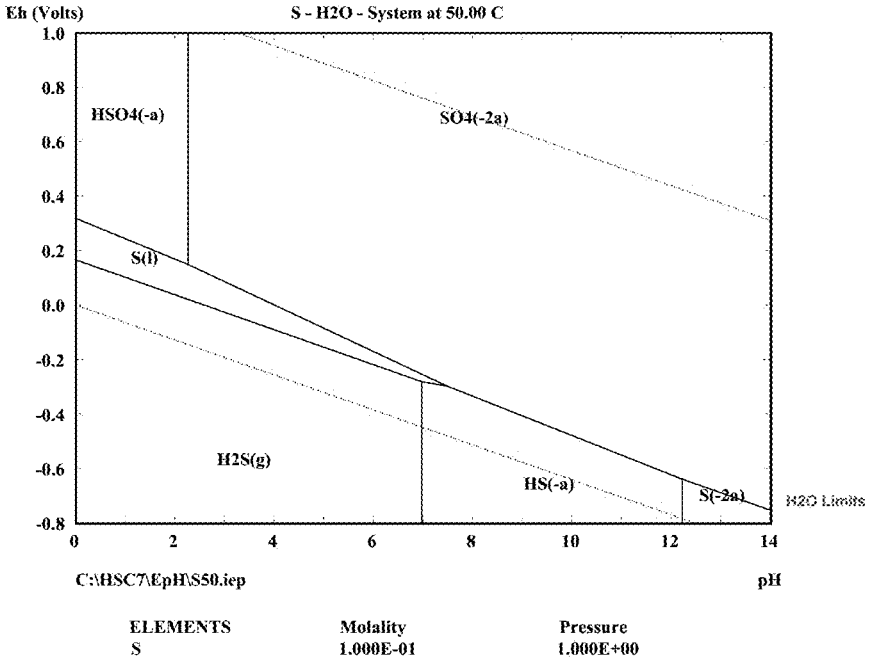

FIG. 100.16: HSC 7.1 Eh-pH stability diagram for the S—H2O system at 50° C.

Figure 101:
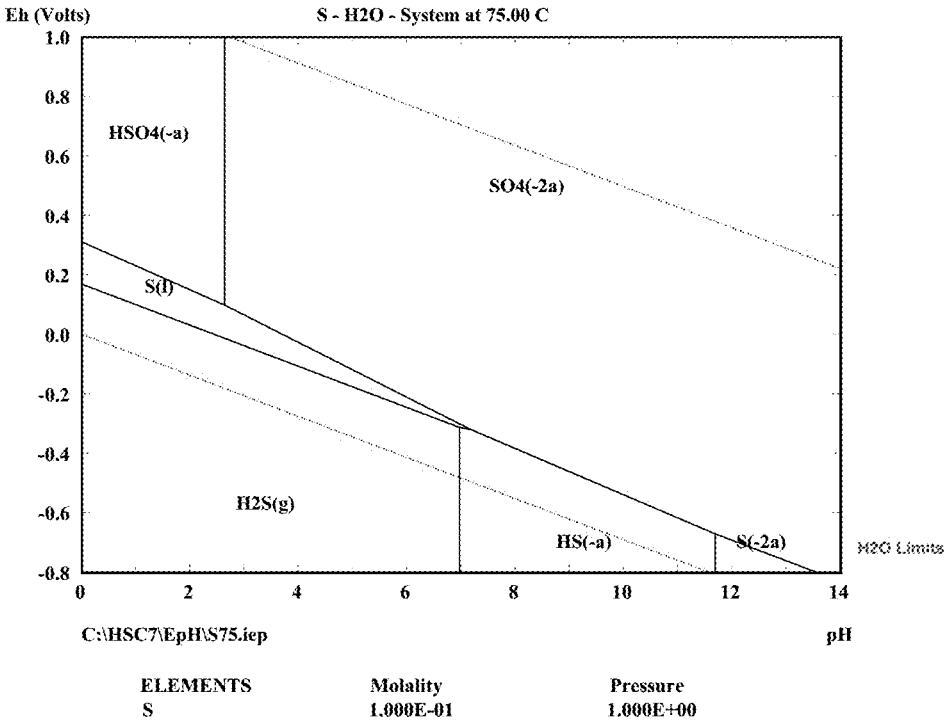

FIG. 101: HSC 7.1 Eh-pH stability diagram for the S—H2O system at 75° C.

Figure 102:
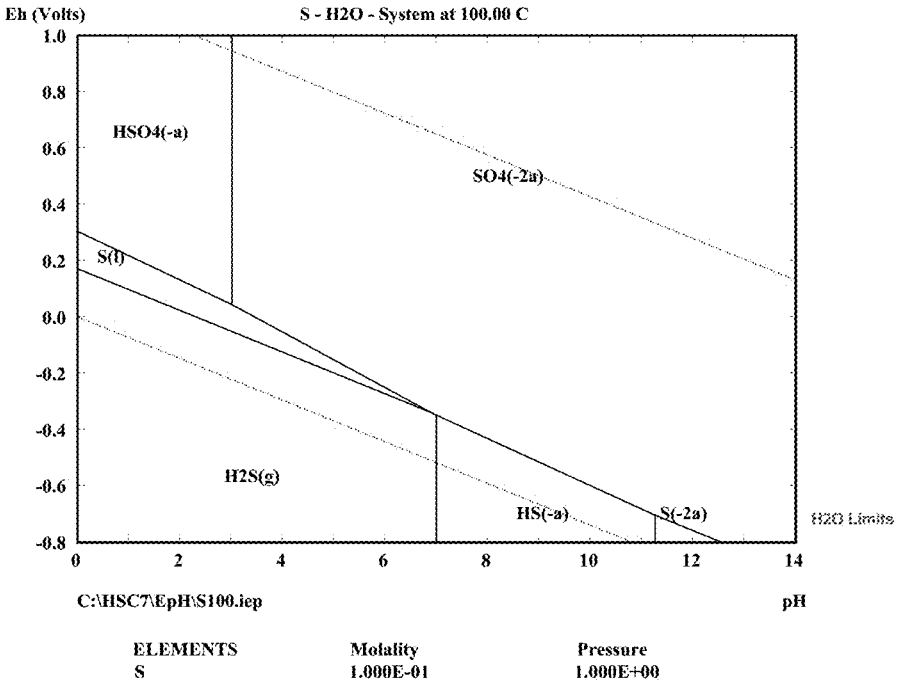

FIG. 102: HSC 7.1 Eh-pH stability diagram for the S—H2O system at 100° C.

Figure 103:
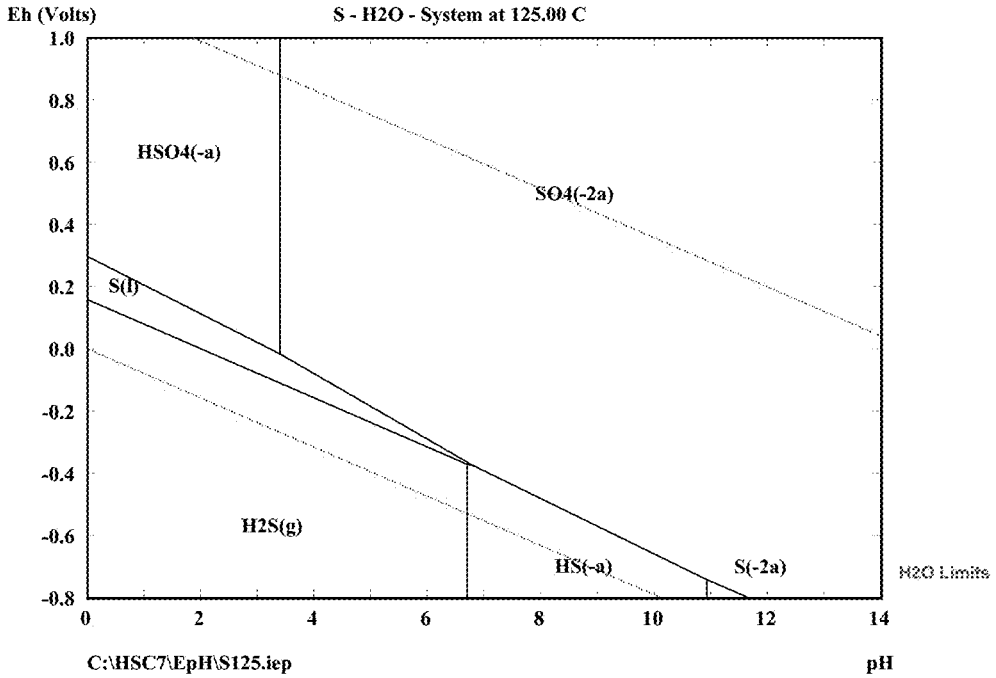

FIG. 103: HSC 7.1 Eh-pH stability diagram for the S—H2O system at 125° C.

Figure 104:
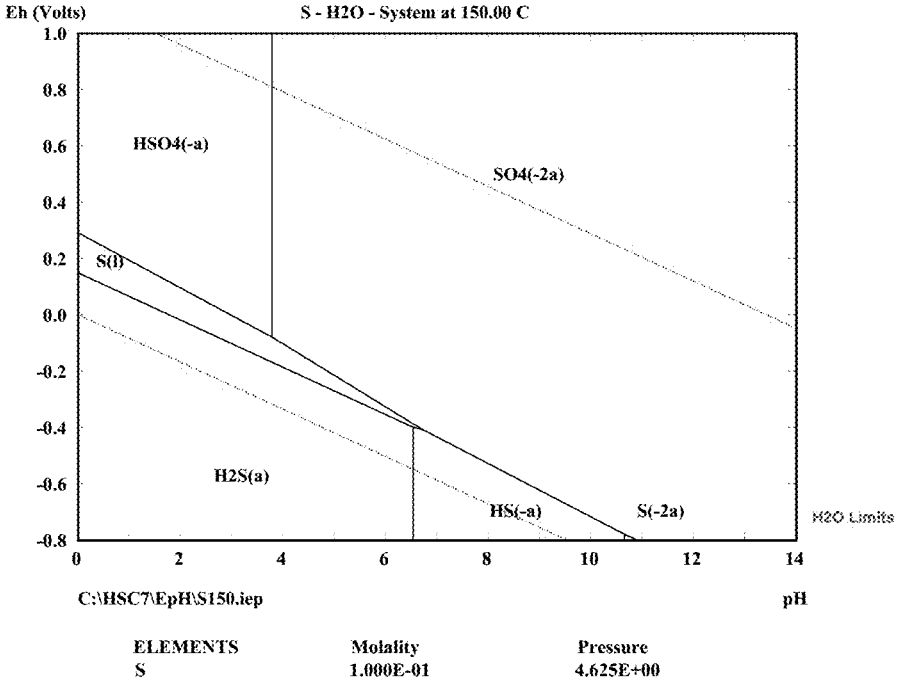

FIG. 104: HSC 7.1 Eh-pH stability diagram for the S—H2O system at 150° C.

Figure 105:
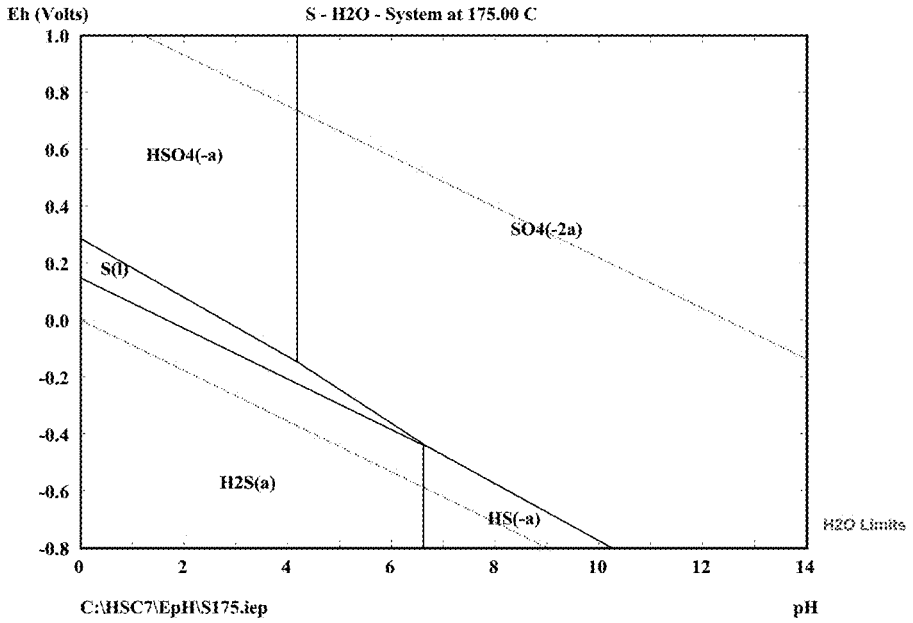

FIG. 105: HSC 7.1 Eh-pH stability diagram for the S—H2O system at 175° C.

Figure 106:
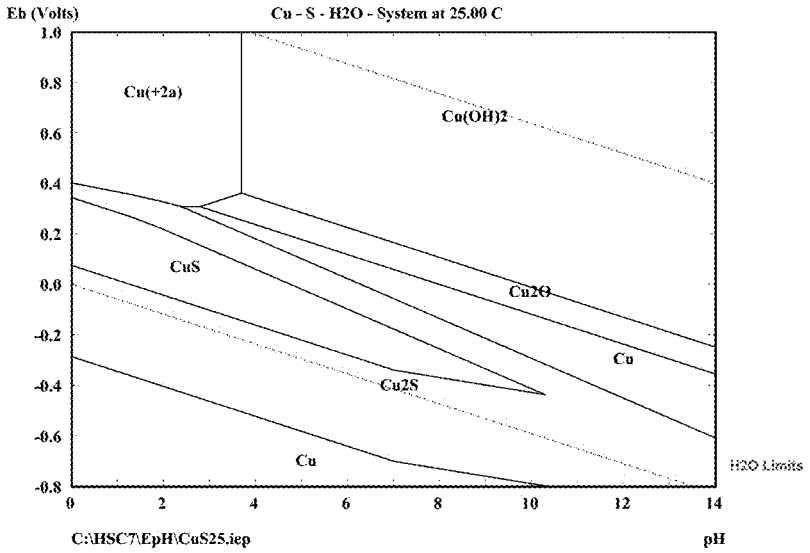

FIG. 106: HSC 7.1 Eh-pH stability diagram at 25° C. for the Cu—S—H2O system at 0.1 molal.

Figure 107:
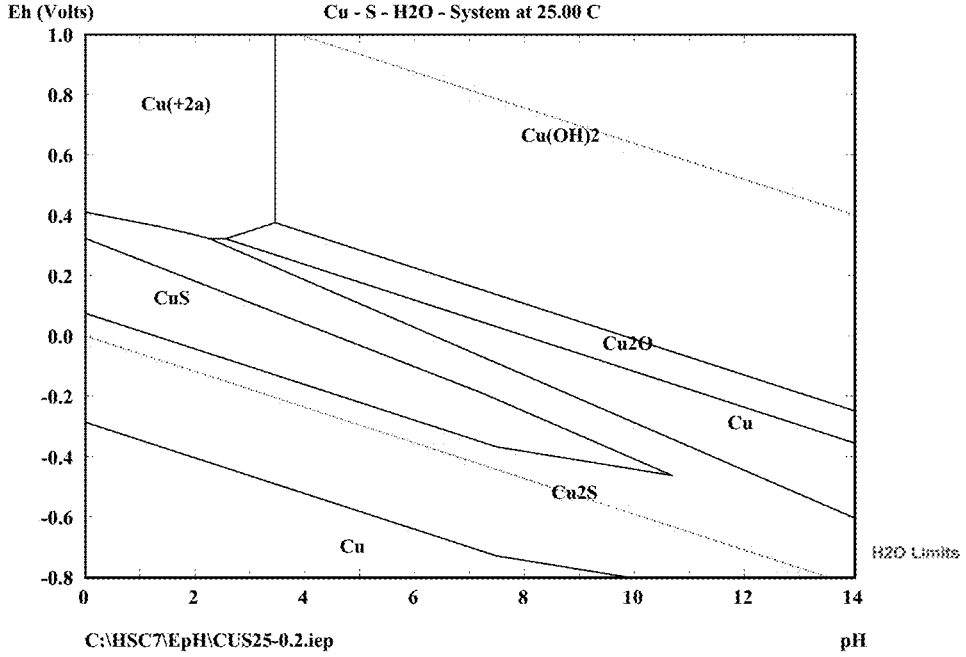

FIG. 107: HSC 7.1 Eh-pH stability diagram at 25° C. for the Cu—S—H2O system at 0.3 molal.

Figure 108:
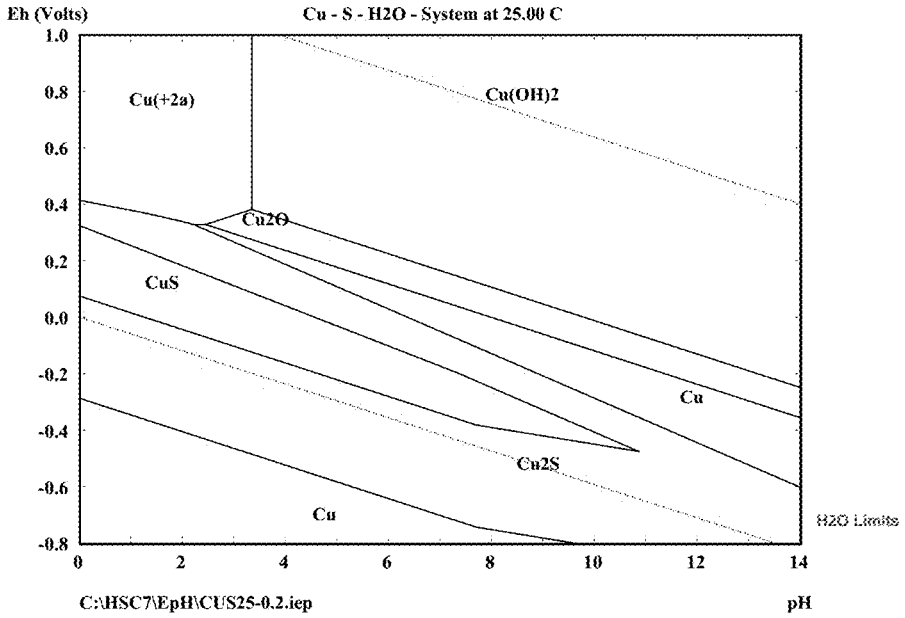

FIG. 108: HSC 7.1 Eh-pH stability diagram at 25° C. for the Cu—S—H2O system at 0.5 molal.

Figure 109:
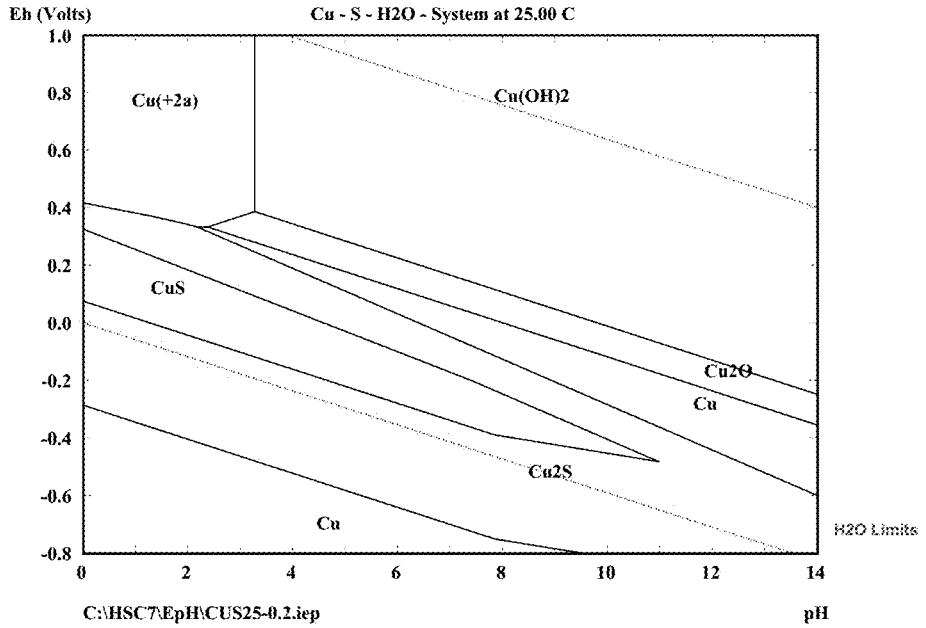

FIG. 109: HSC 7.1 Eh-pH stability diagram at 25° C. for the Cu—S—H2O system at 0.7 molal.

Figure 110:
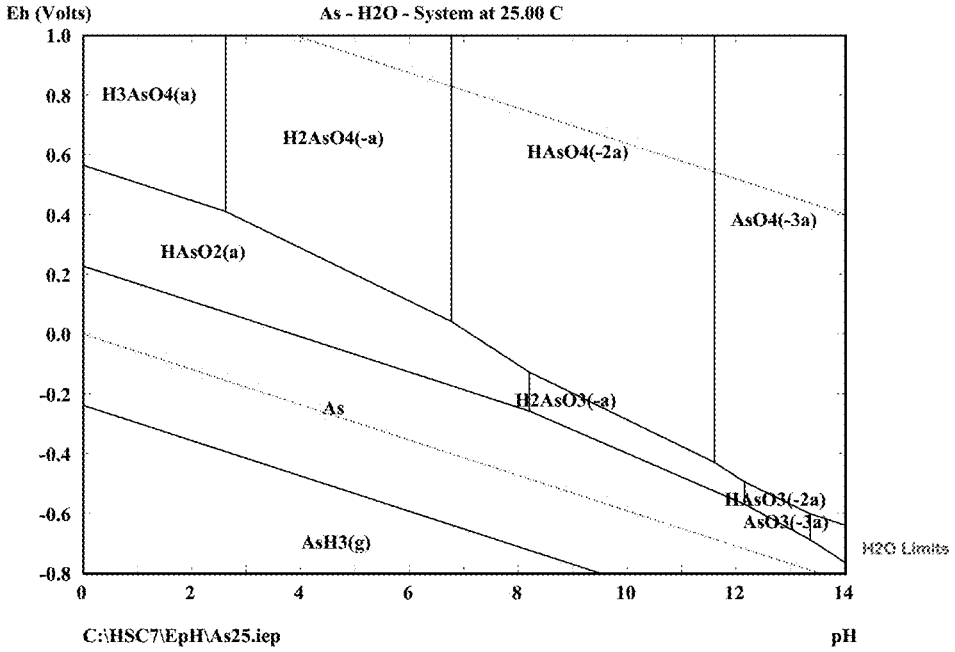

FIG. 110: HSC 7.1 Eh-pH stability diagram at 25° C. for the As—H2O system at 0.1 molal.

Figure 111:
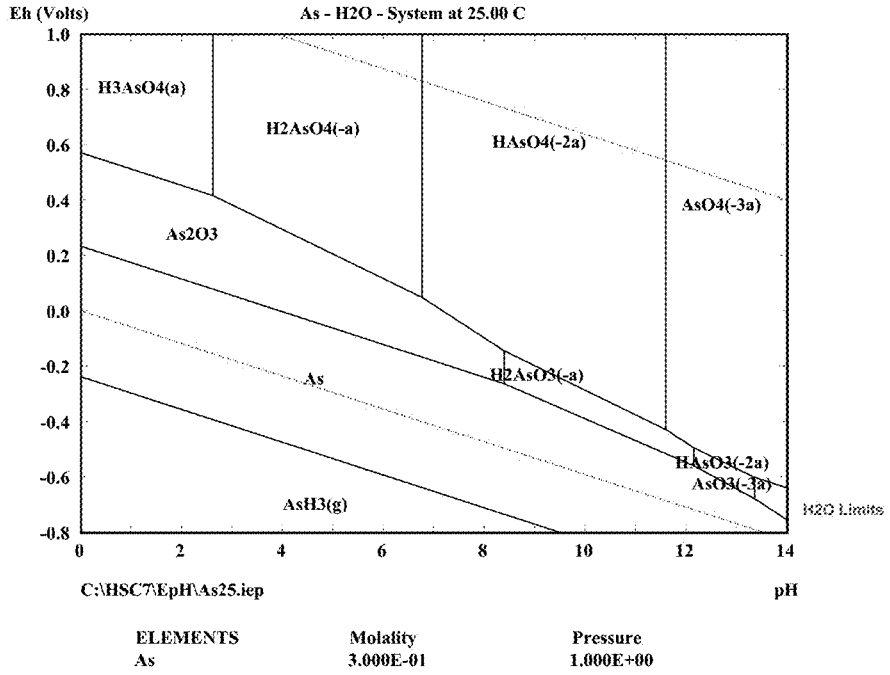

FIG. 111: HSC 7.1 Eh-pH stability diagram at 25° C. for the As—H2O system at 0.3 molal.

Figure 112:
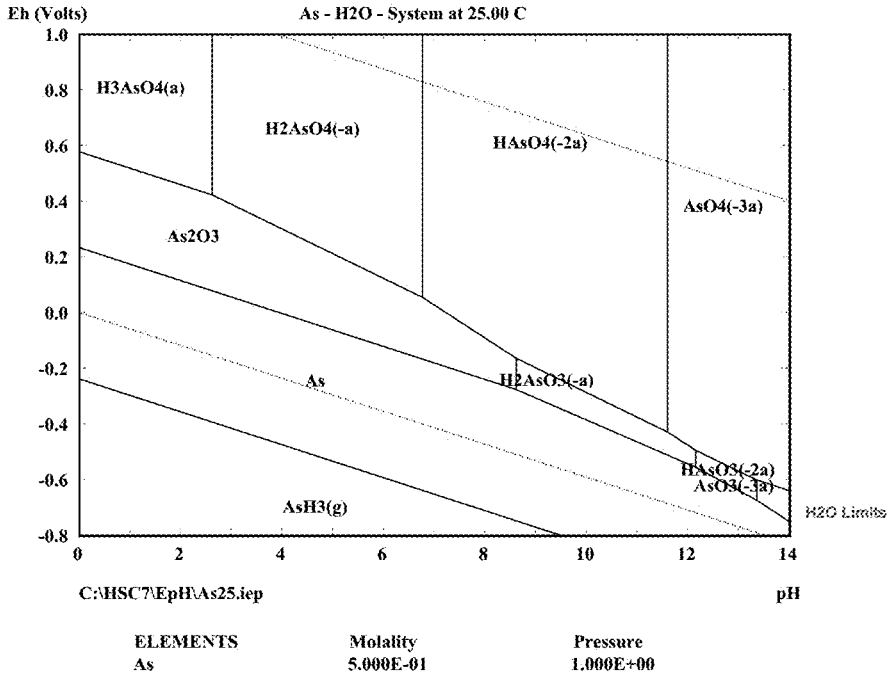

FIG. 112: HSC 7.1 Eh-pH stability diagram at 25° C. for the As—H2O system at 0.5 molal.

Figure 113:
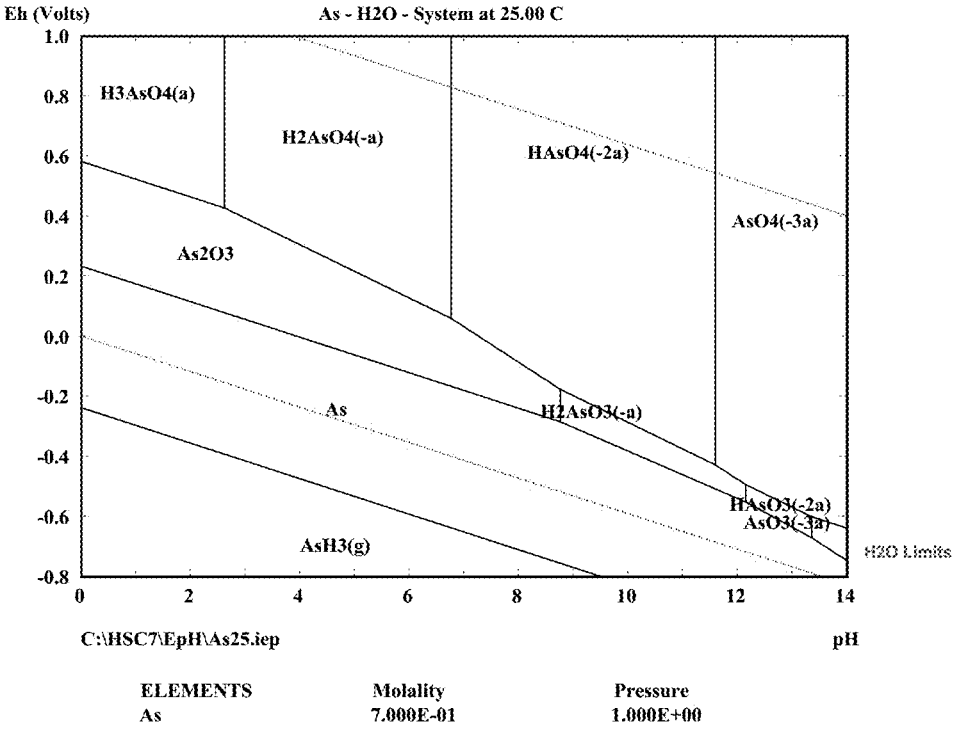

FIG. 113: HSC 7.1 Eh-pH stability diagram at 25° C. for the As—H2O system at 0.7 molal.

Figure 114:
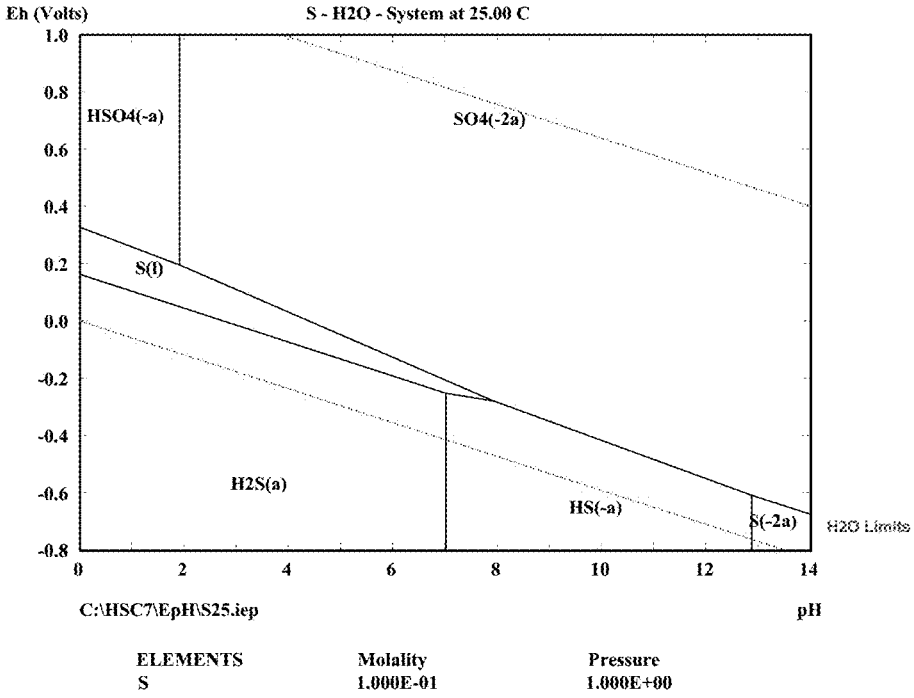

FIG. 114: HSC 7.1 Eh-pH stability diagram at 25° C. for the S—H2O system at 0.1 molal.

Figure 115:
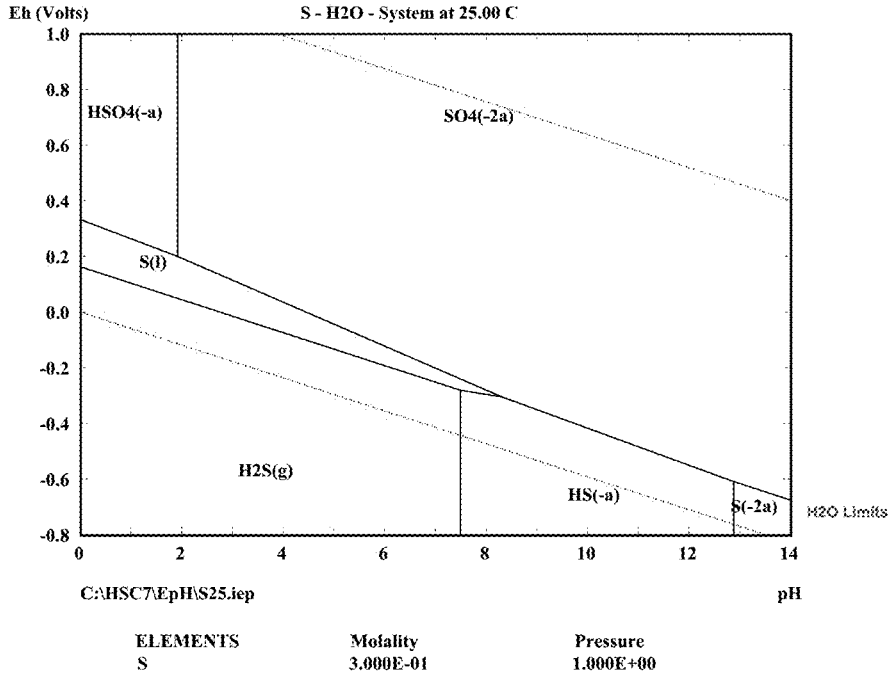

FIG. 115: HSC 7.1 Eh-pH stability diagram at 25° C. for the S—H2O system at 0.3 molal.

Figure 116:
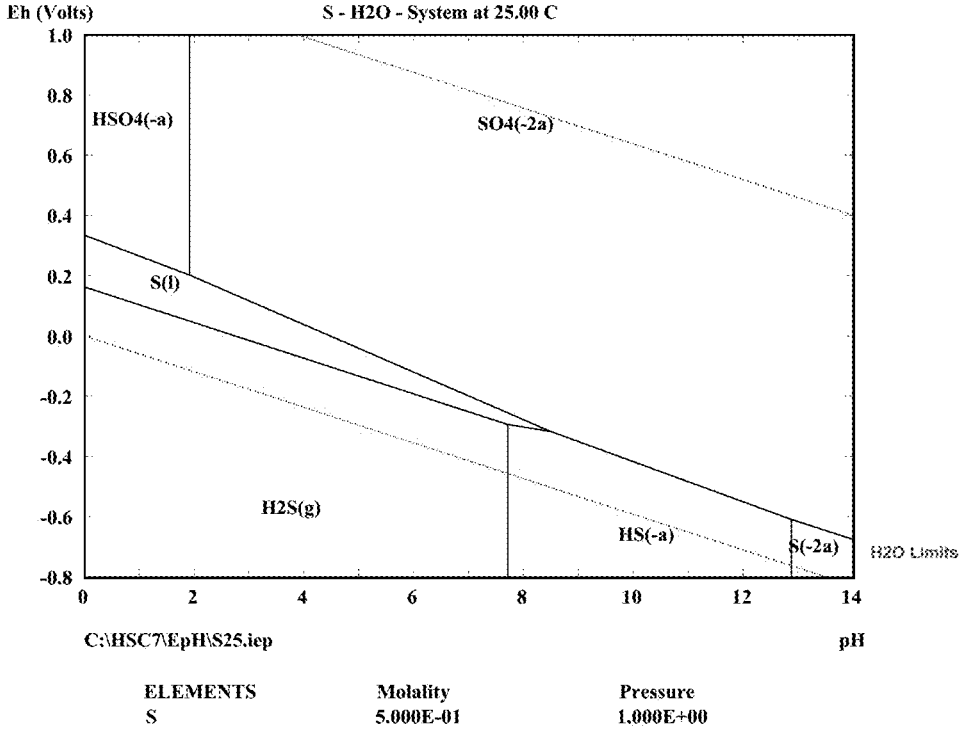

FIG. 116: HSC 7.1 Eh-pH stability diagram at 25° C. for the S—H2O system at 0.5 molal.

Figure 117:
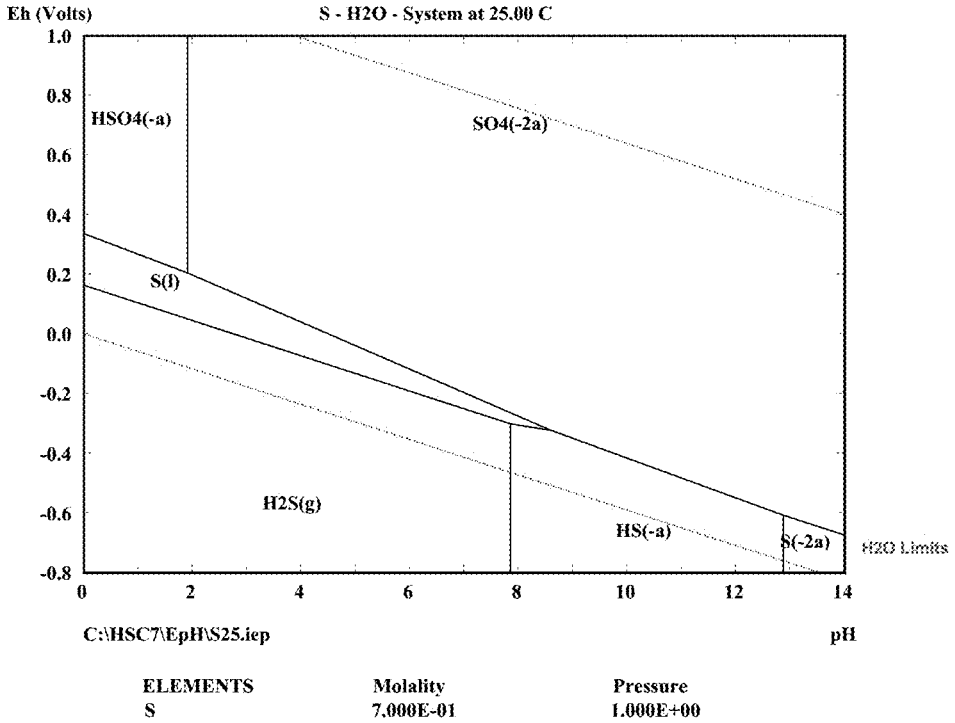

FIG. 117: HSC 7.1 Eh-pH stability diagram at 25° C. for the S—H2O system at 0.7 molal.

Figure 118:
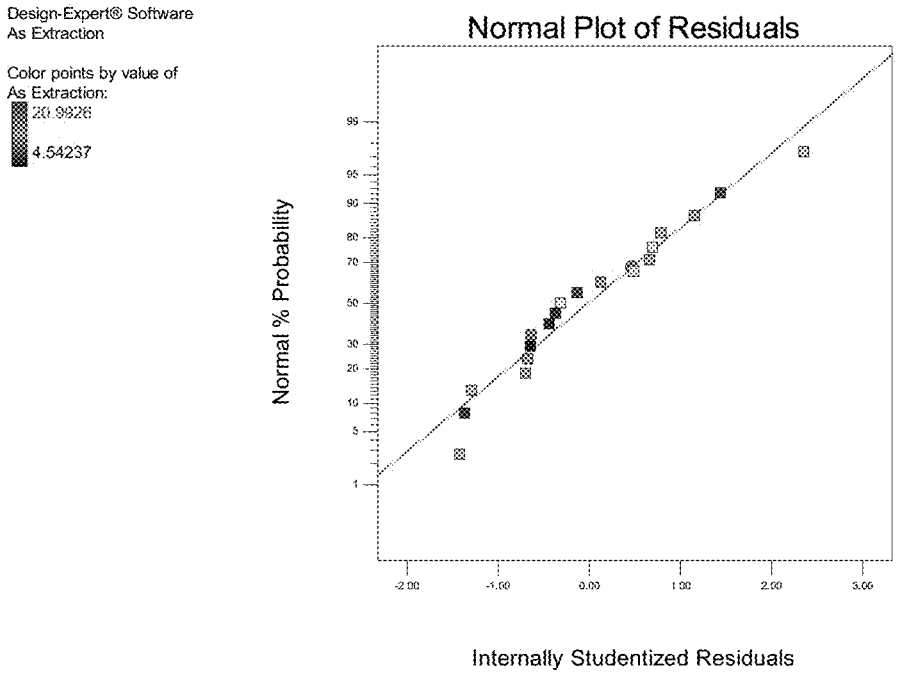

FIG. 118: Stat-Ease Normal Plot of Residuals for arsenic extraction model.

Figure 119:
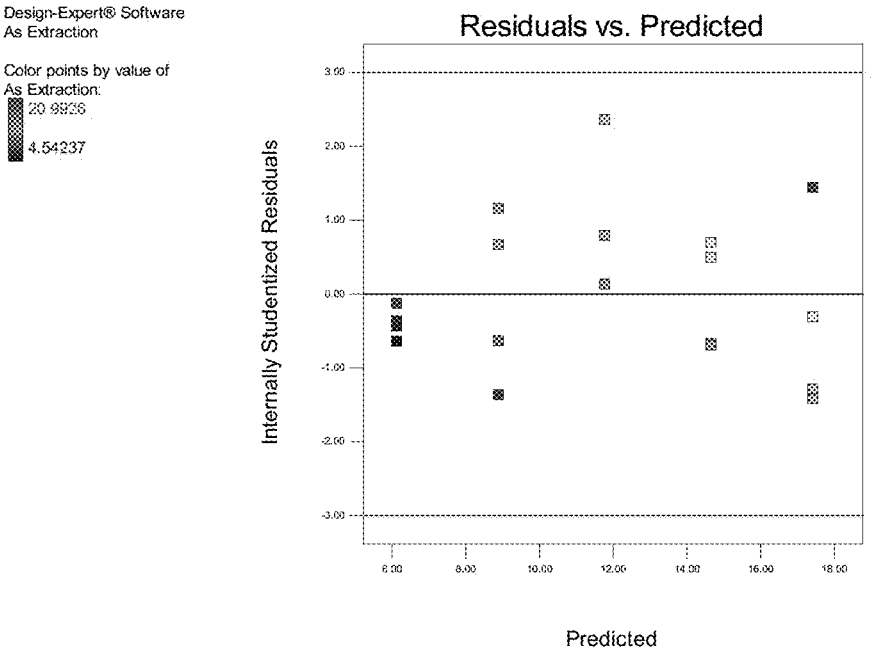

FIG. 119: Stat-Ease Residuals vs. Predicted for arsenic extraction model.

Figure 120:
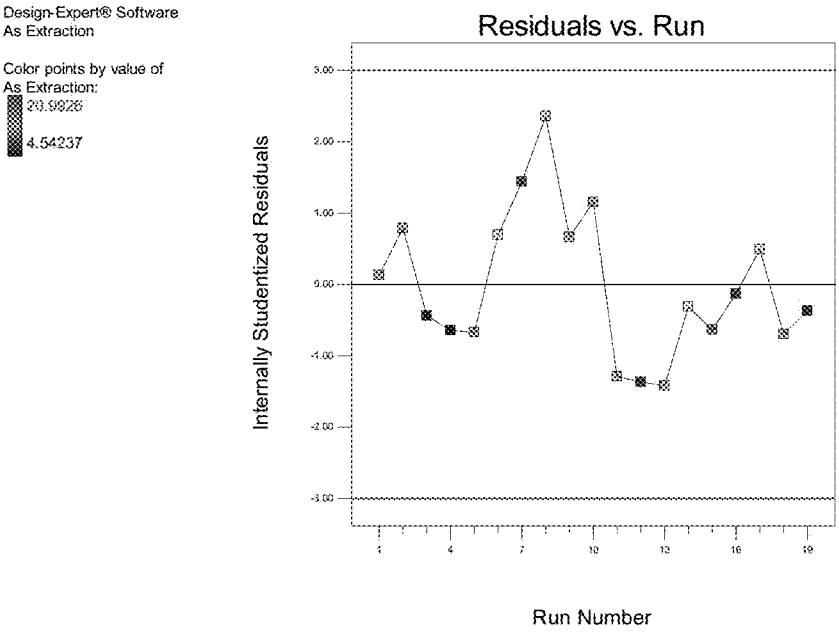

FIG. 120: Stat-Ease Residuals vs. Run for arsenic extraction model.

Figure 121:
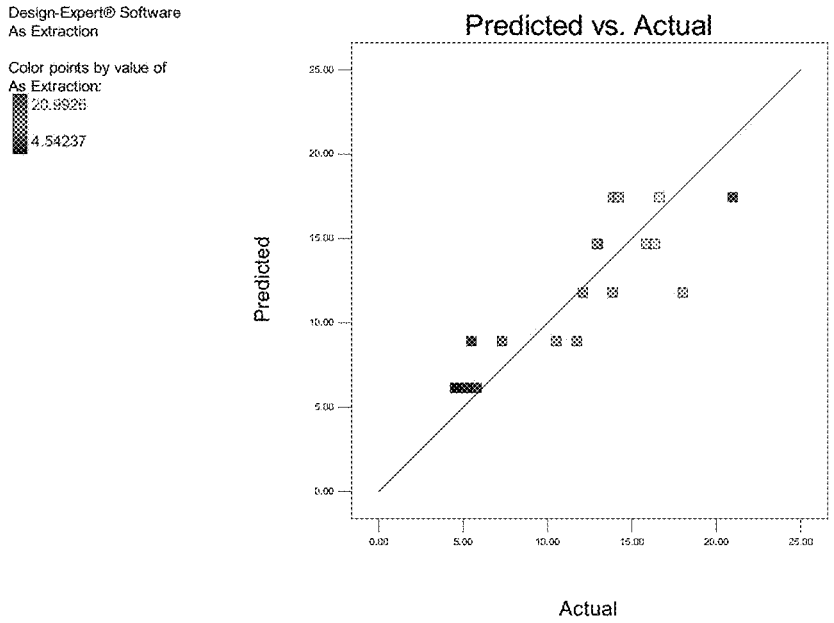

FIG. 121: Stat-Ease Predicted vs. Actual for arsenic extraction model.

Figure 122:
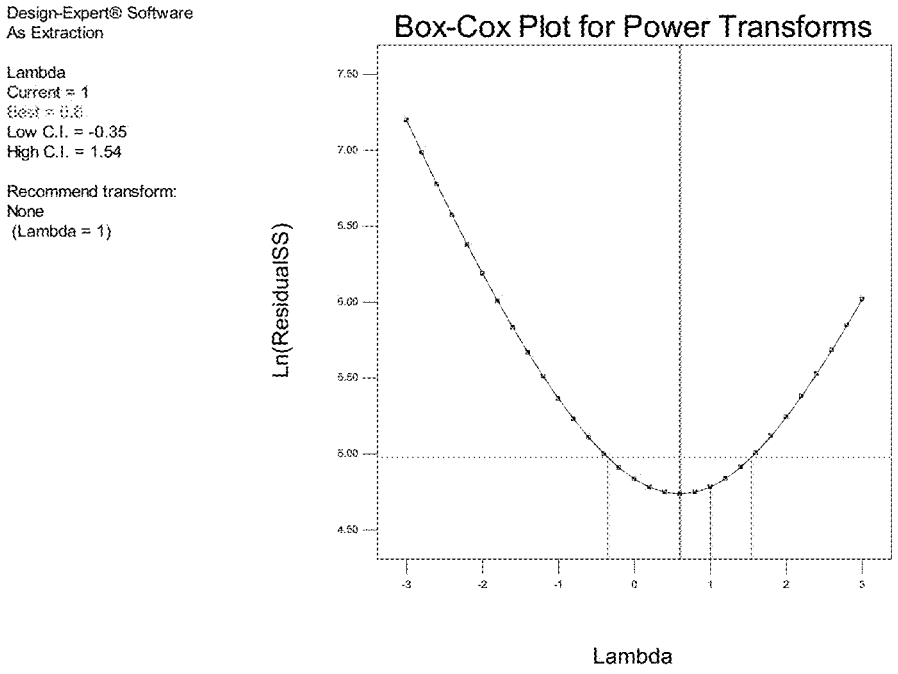

FIG. 122: Stat-Ease Box-Cox Plot for Power Transformations for arsenic extraction model.

Figure 123:
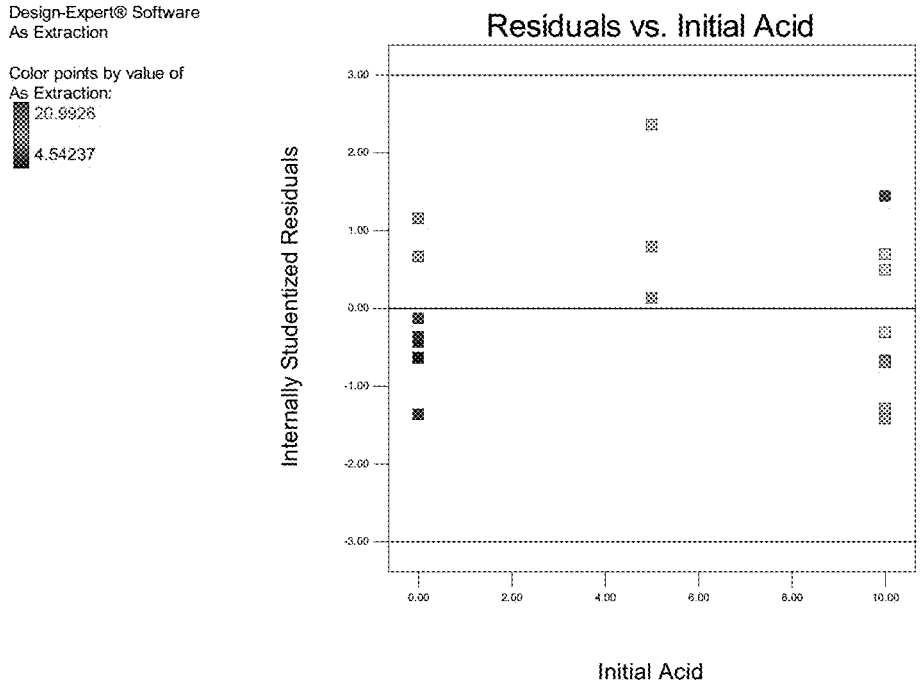

FIG. 123: Stat-Ease Residuals vs. Initial Acid for arsenic extraction model.

Figure 124:
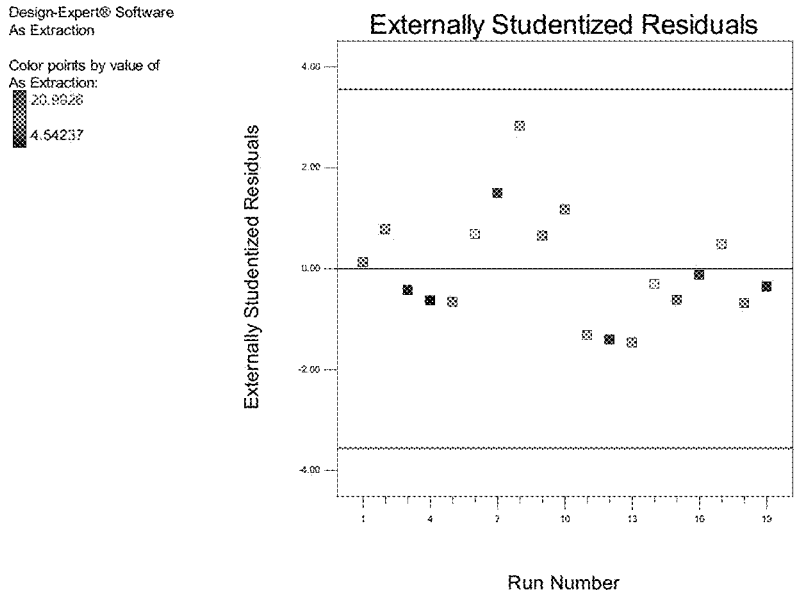

FIG. 124: Stat-Ease Externally Studentized Residuals for arsenic extraction model.

Figure 125:
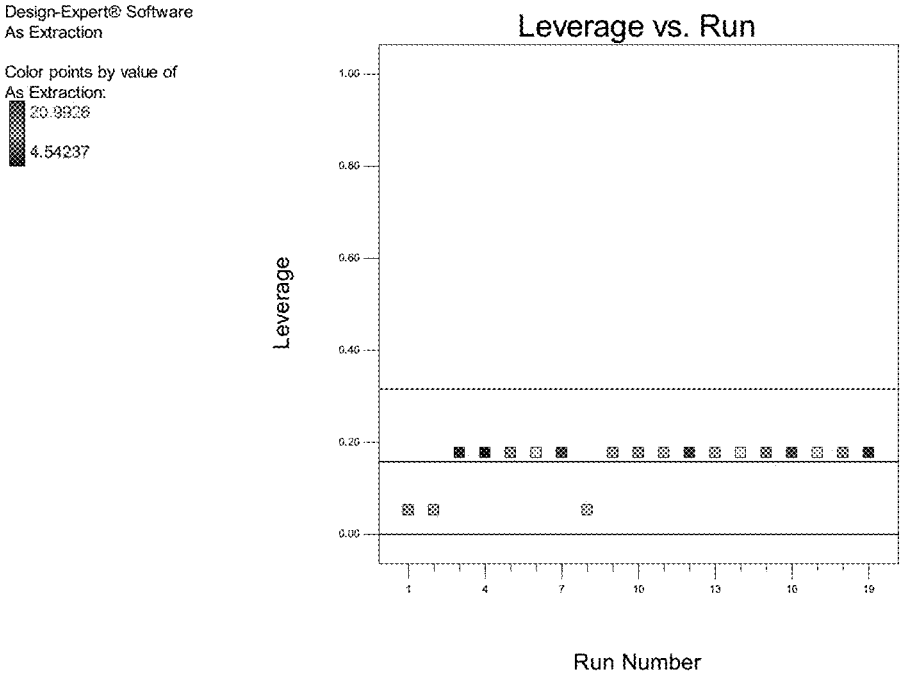

FIG. 125: Stat-Ease Leverage vs. Run for arsenic extraction model.

Figure 126:
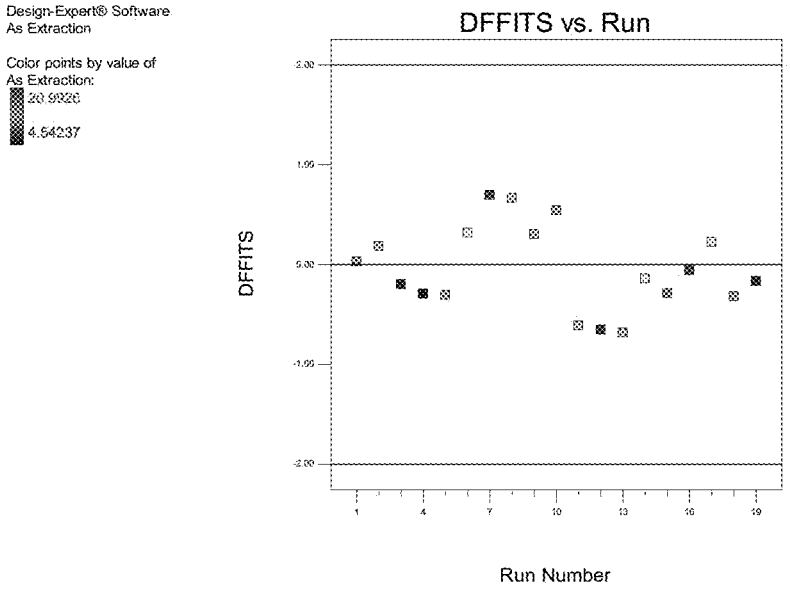

FIG. 126: Stat-Ease DFFITS vs. Run for arsenic extraction model.

Figure 127:
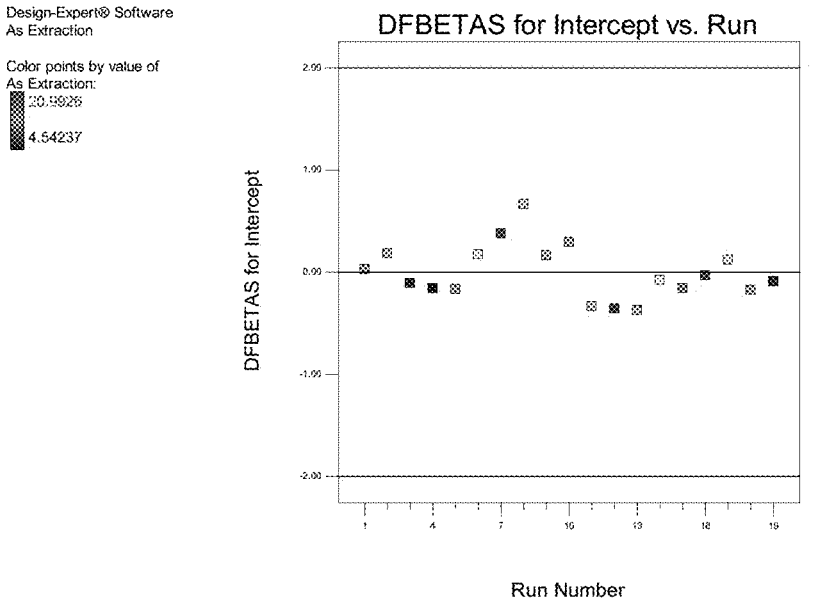

FIG. 127: Stat-Ease DFBETAS for Intercept vs. Run for arsenic extraction model.

Figure 128:
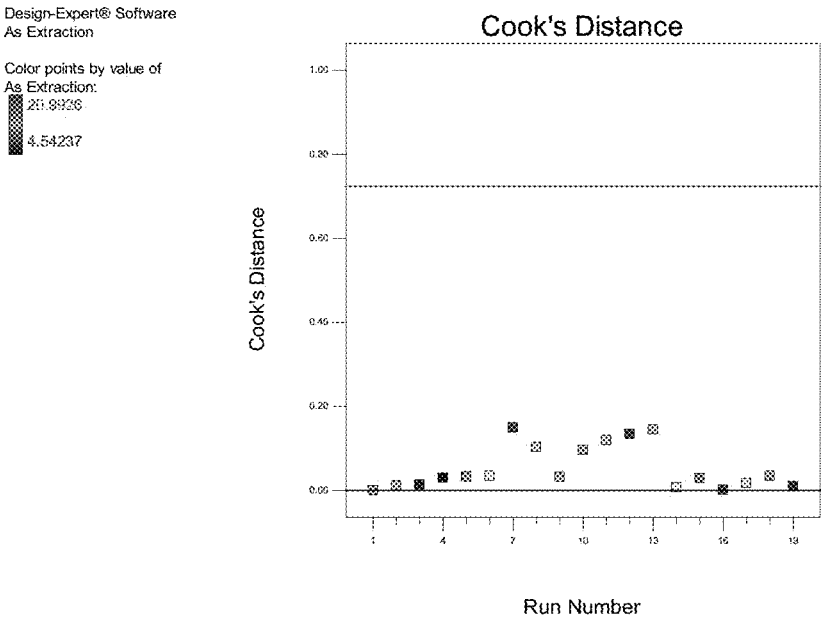

FIG. 128: Stat-Ease Cook's Distance for arsenic extraction model.

Figure 129:
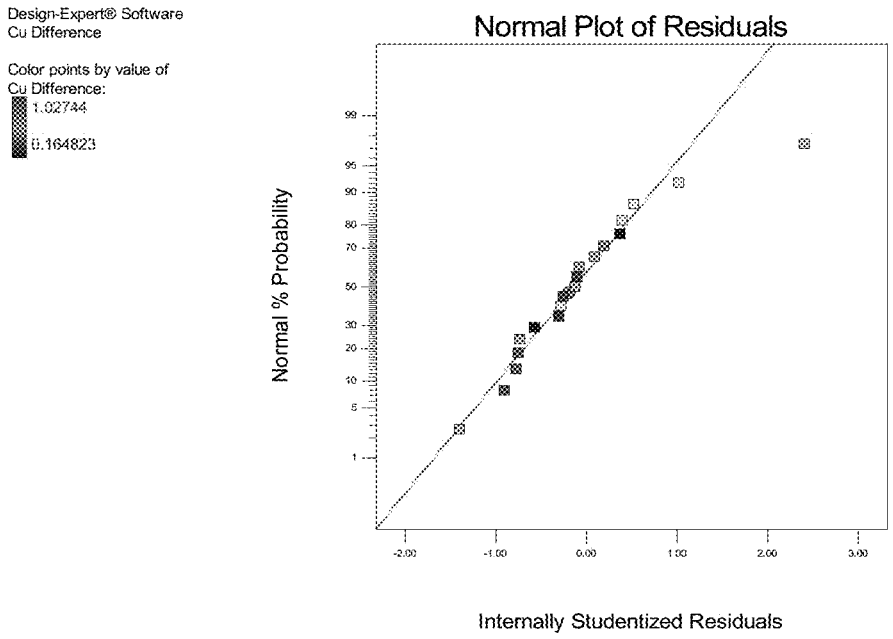

FIG. 129: Stat-Ease Normal Plot of Residuals for copper difference model.

Figure 130:
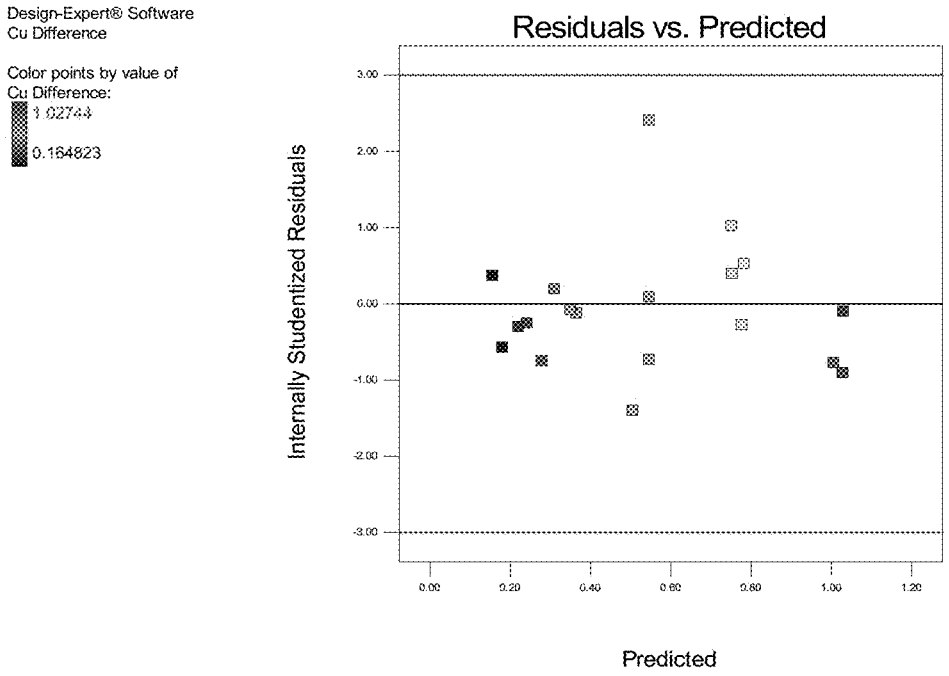

FIG. 130: Stat-Ease Residuals vs. Predicted for copper difference model.

Figure 131:
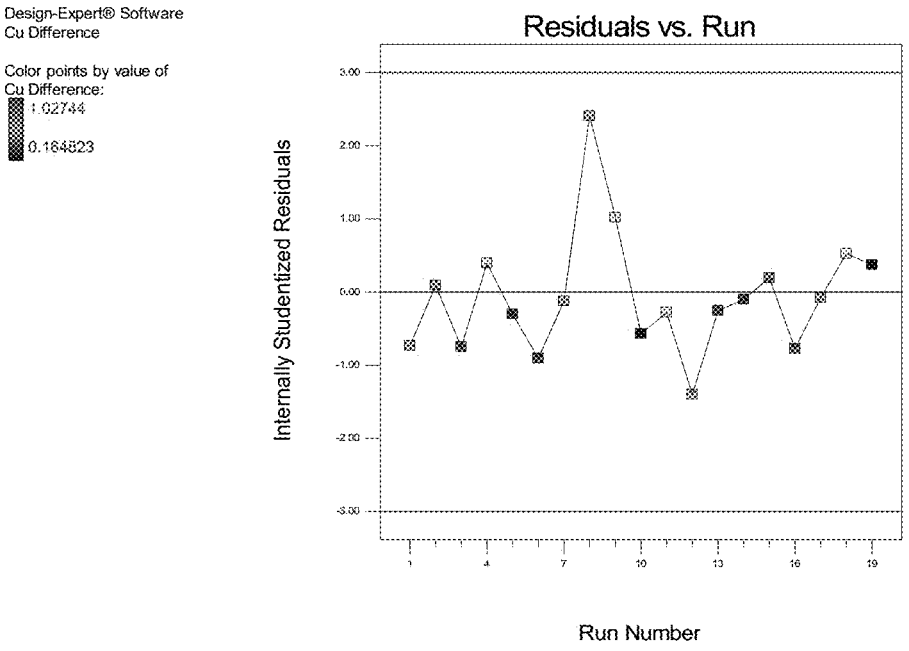

FIG. 131: Stat-Ease Residuals vs. Run for copper difference model.

Figure 132:
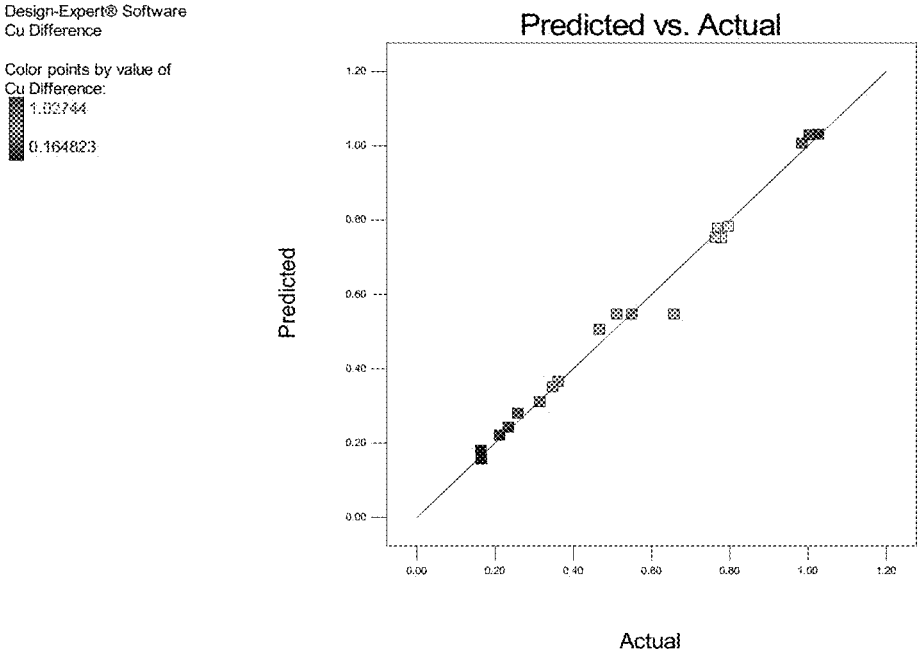

FIG. 132: Stat-Ease Predicted vs. Actual for copper difference model.

Figure 133:
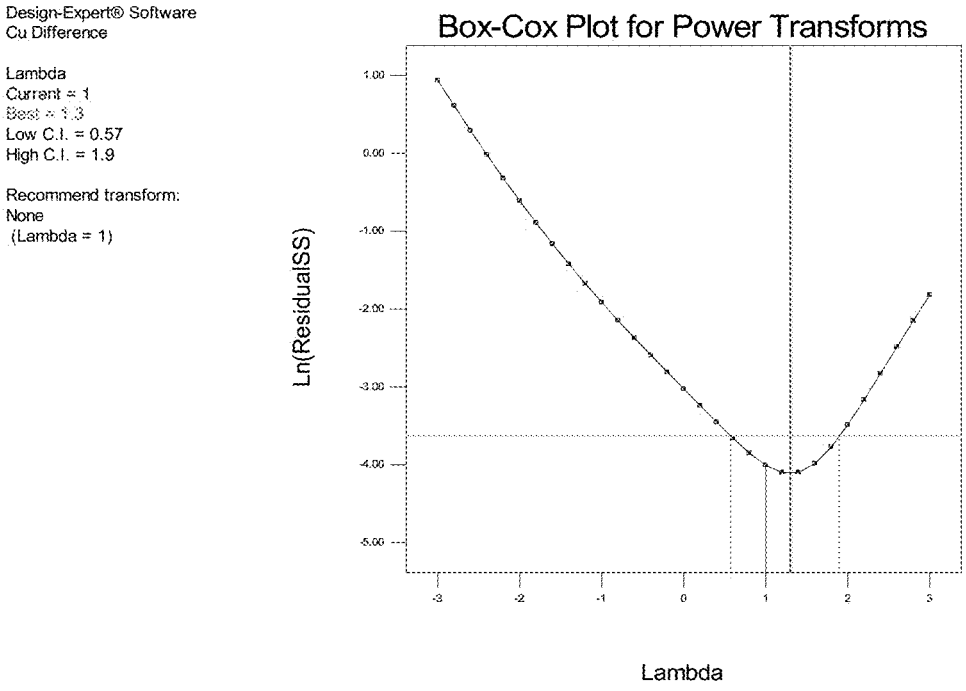

FIG. 133: Stat-Ease Box-Cox Plot for Power Transforms for copper difference model.

Figure 134:
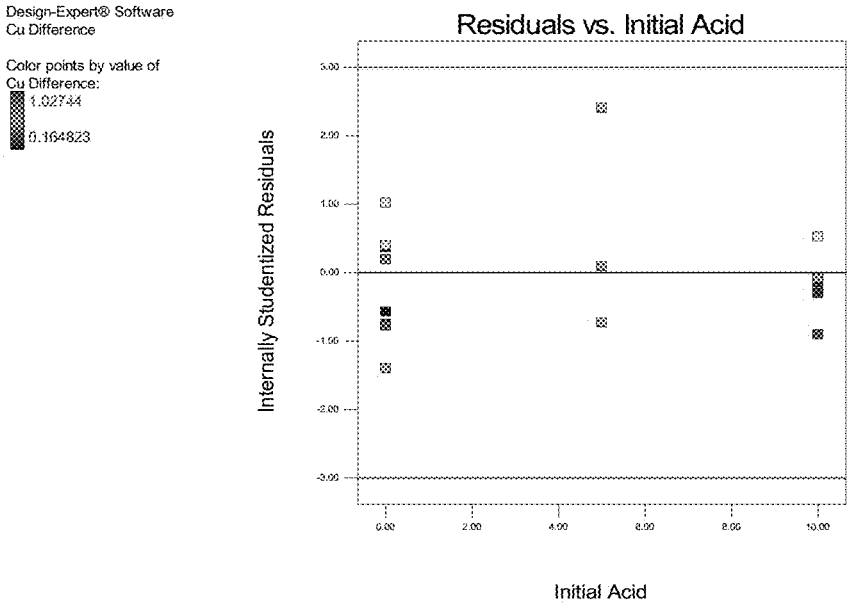

FIG. 134: Stat-Ease Residuals vs. Initial Acid for copper difference model.

Figure 135:
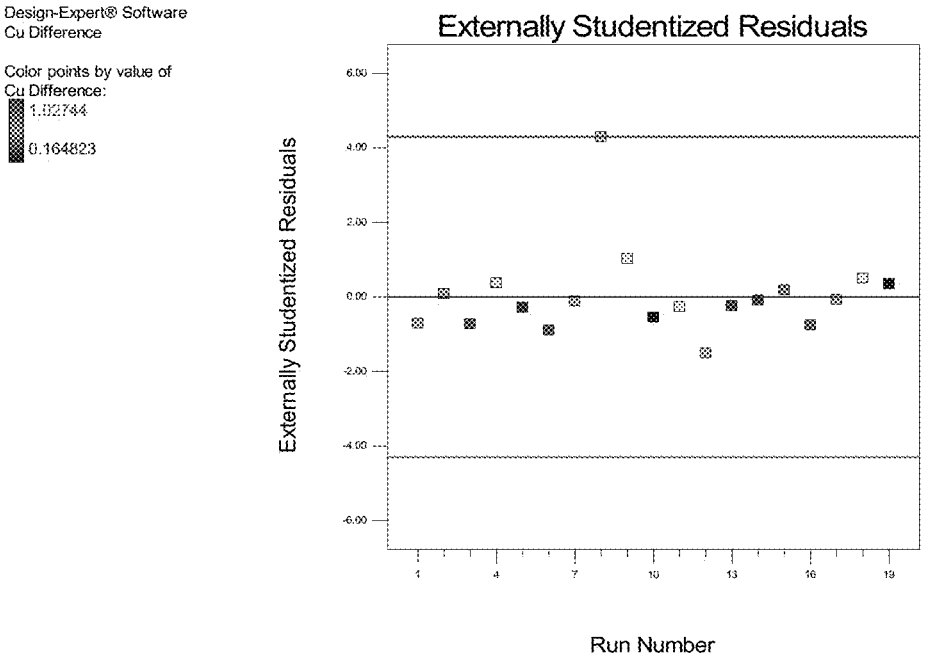

FIG. 135: Stat-Ease Externally Studentized Residuals for copper difference model.

Figure 136:
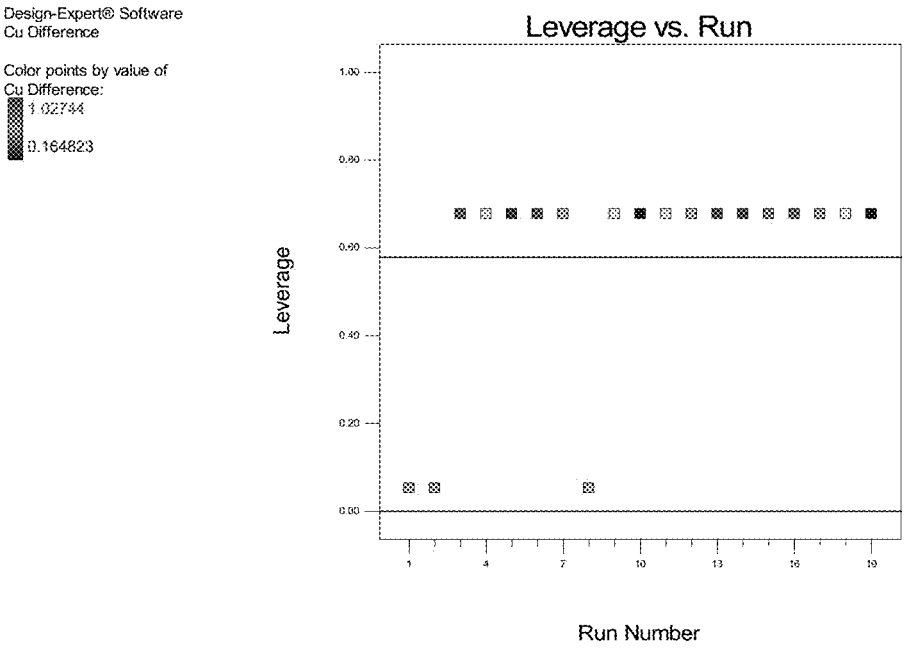

FIG. 136: Stat-Ease Leverage vs. Run for copper difference model.

Figure 137:
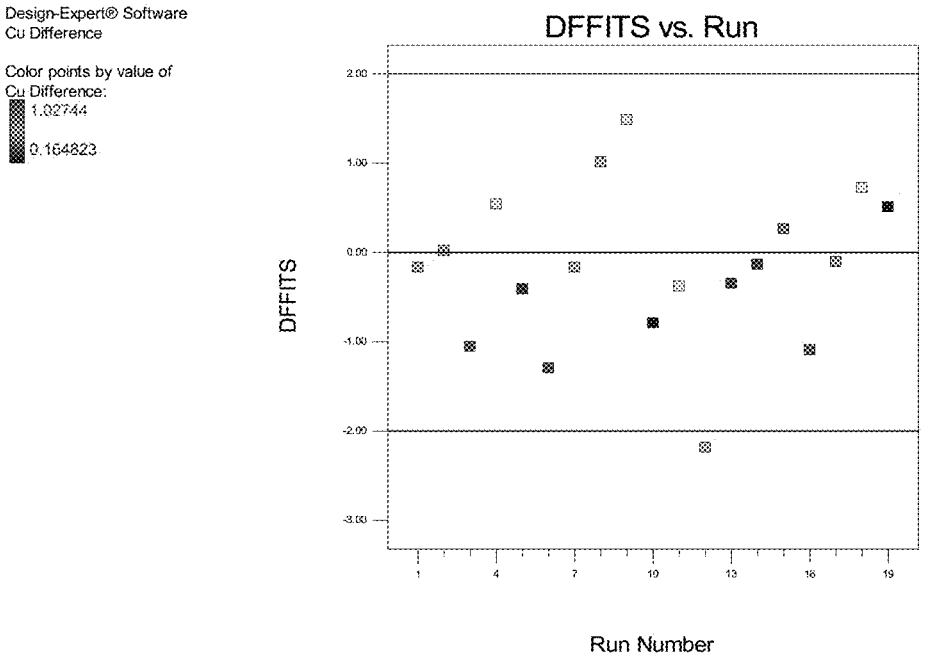

FIG. 137: Stat-Ease DFFITS vs. Run for copper difference model.

Figure 138:
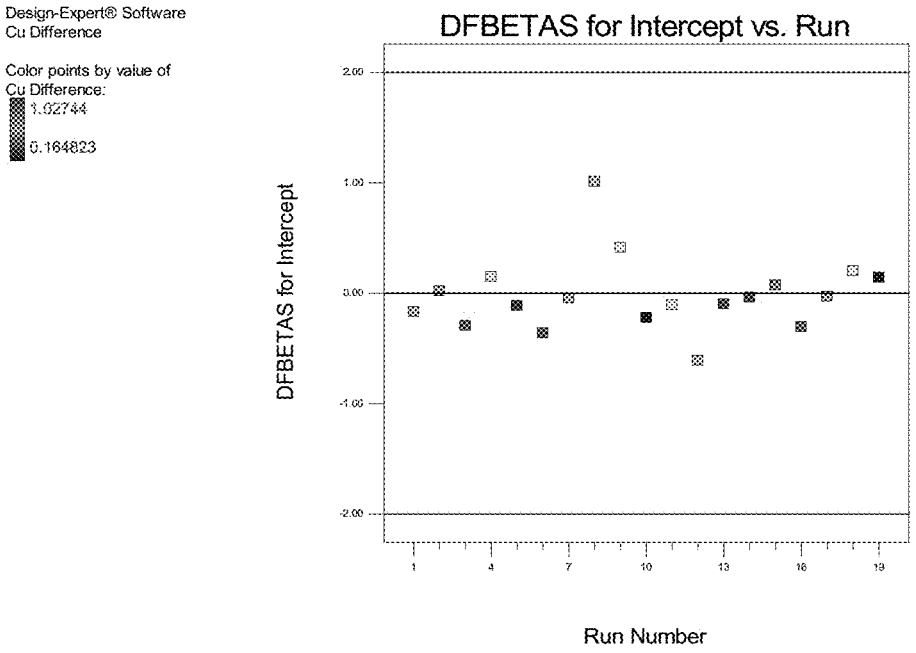

FIG. 138: Stat-Ease DFBETAS for Intercept vs. Run for copper difference model.

Figure 139:
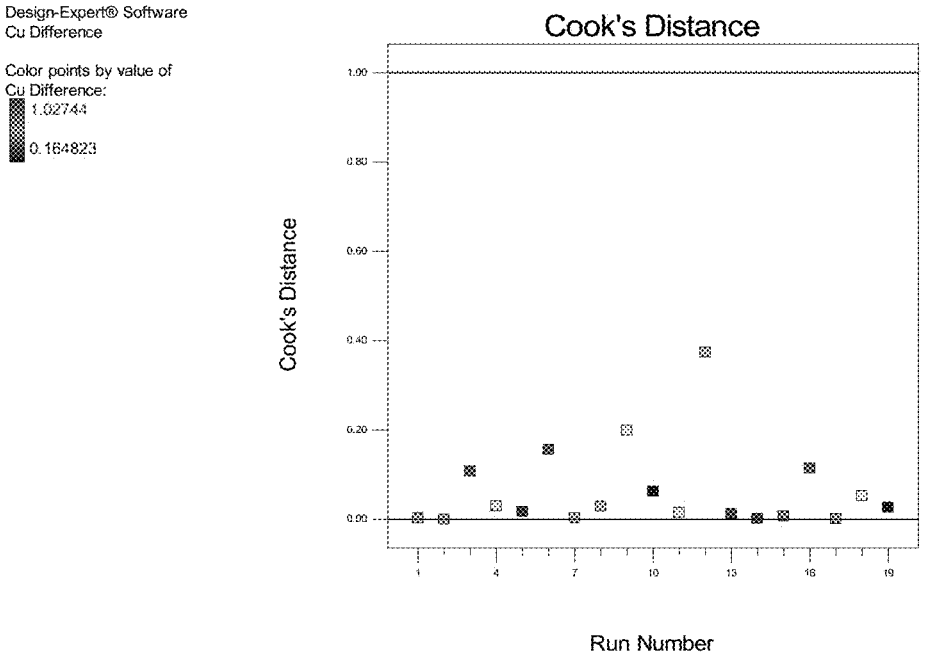

FIG. 139: Stat-Ease Cook's Distance for copper difference model.

Figure 140:
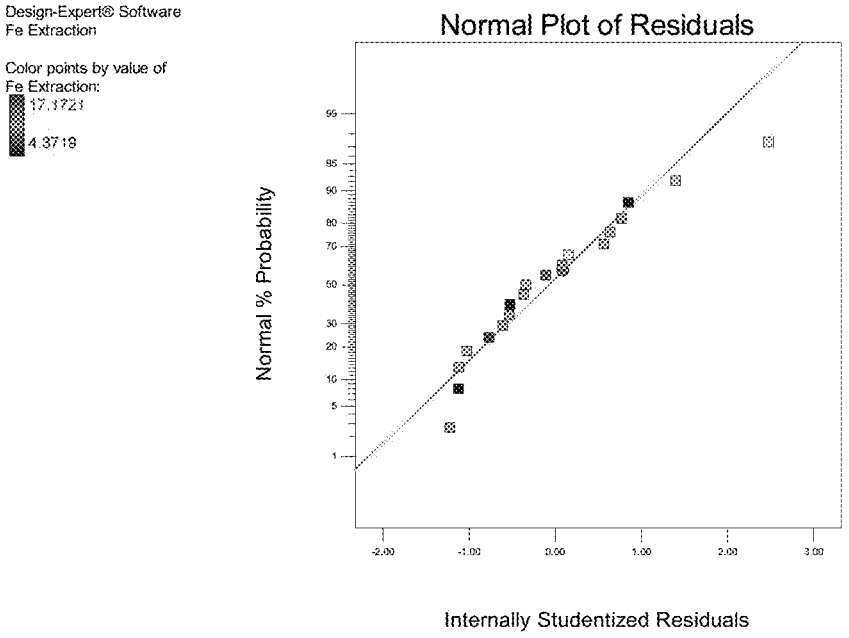

FIG. 140: Stat-Ease Normal Plot of Residuals for iron extraction model.

Figure 141:
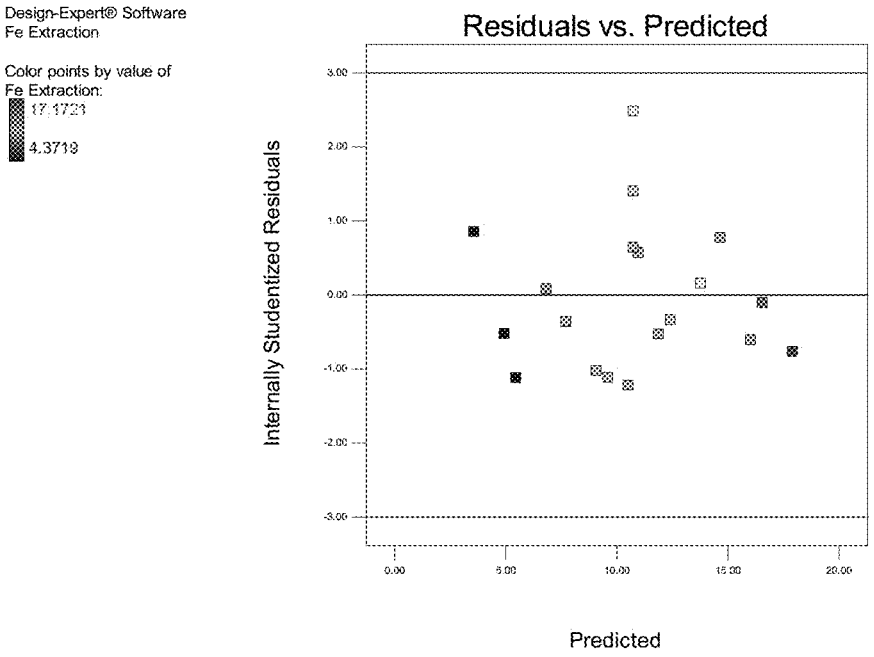

FIG. 141: Stat-Ease Residuals vs. Predicted for iron extraction model.

Figure 142:
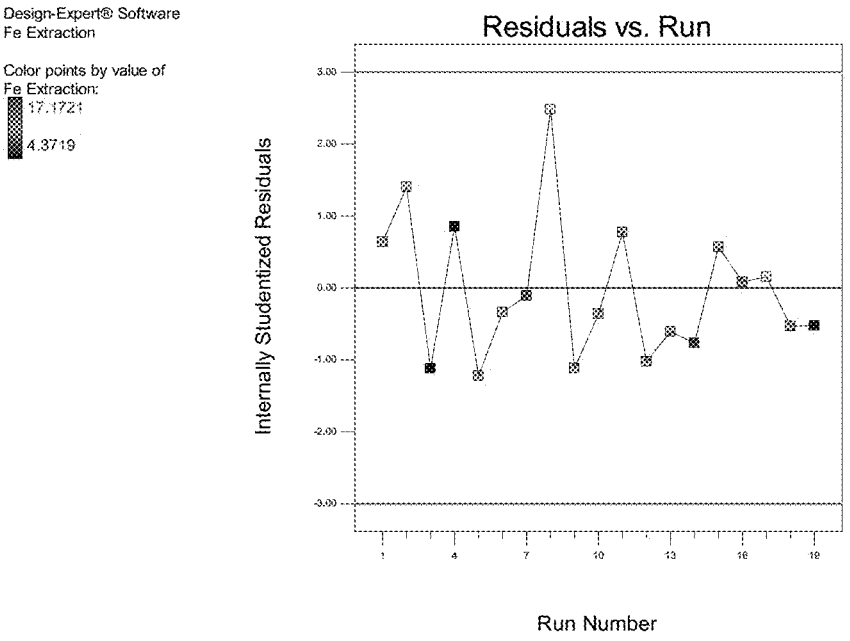

FIG. 142: Stat-Ease Residuals vs. Run for iron extraction model.

Figure 143:
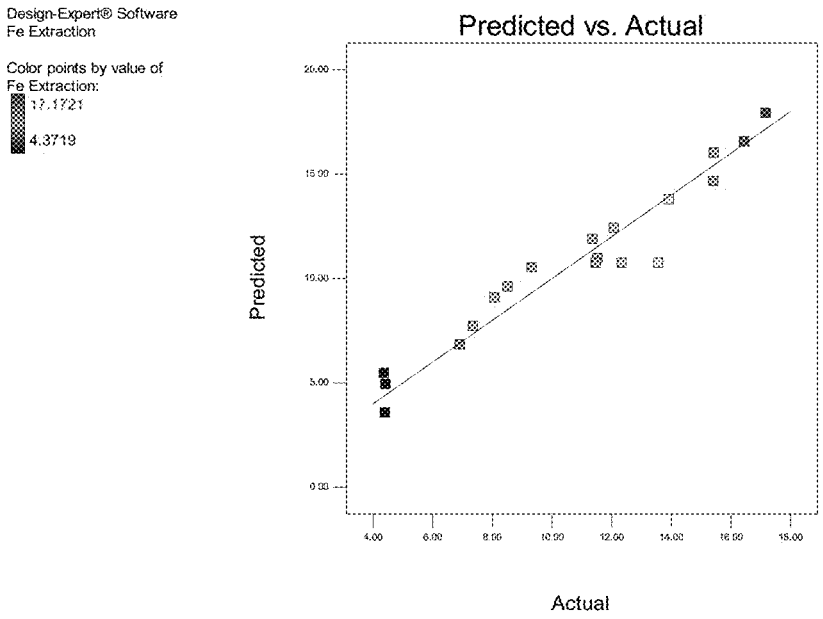

FIG. 143: Stat-Ease Predicted vs. Actual for iron extraction model.

Figure 144:
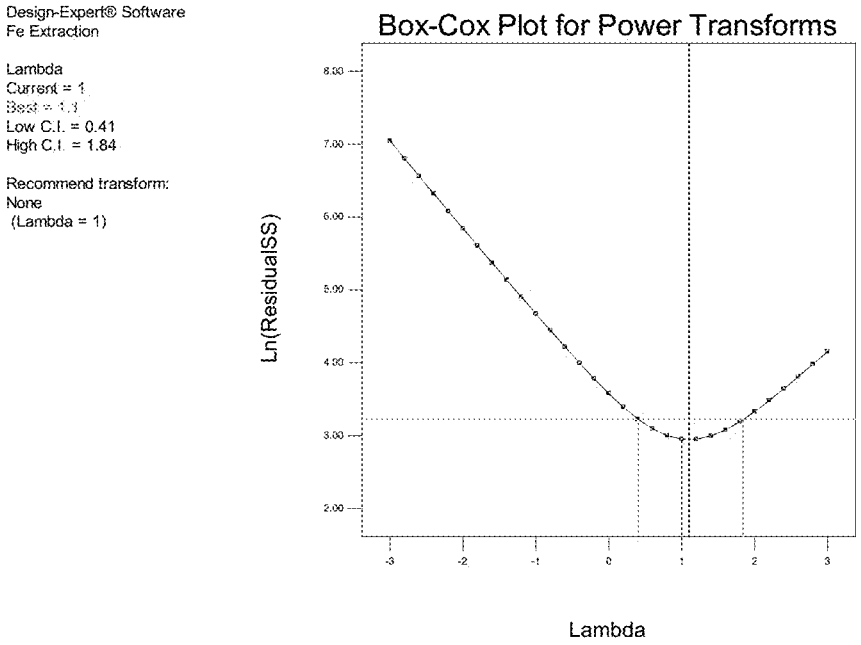

FIG. 144: Stat-Ease Box-Cox Plot for Power Transforms for iron extraction model.

Figure 145:
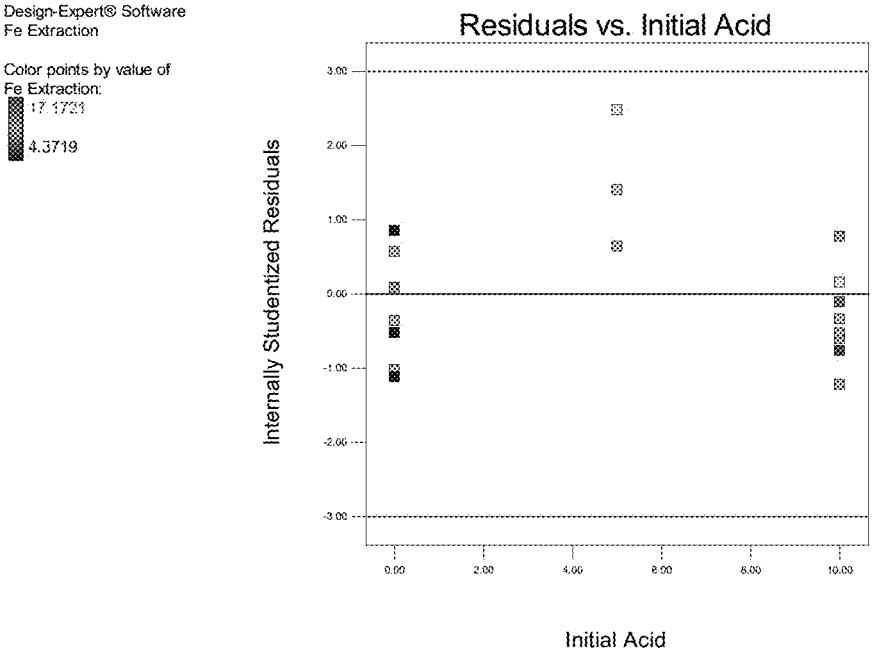

FIG. 145: Stat-Ease Residuals vs. Initial Acid for iron extraction model.

Figure 146:
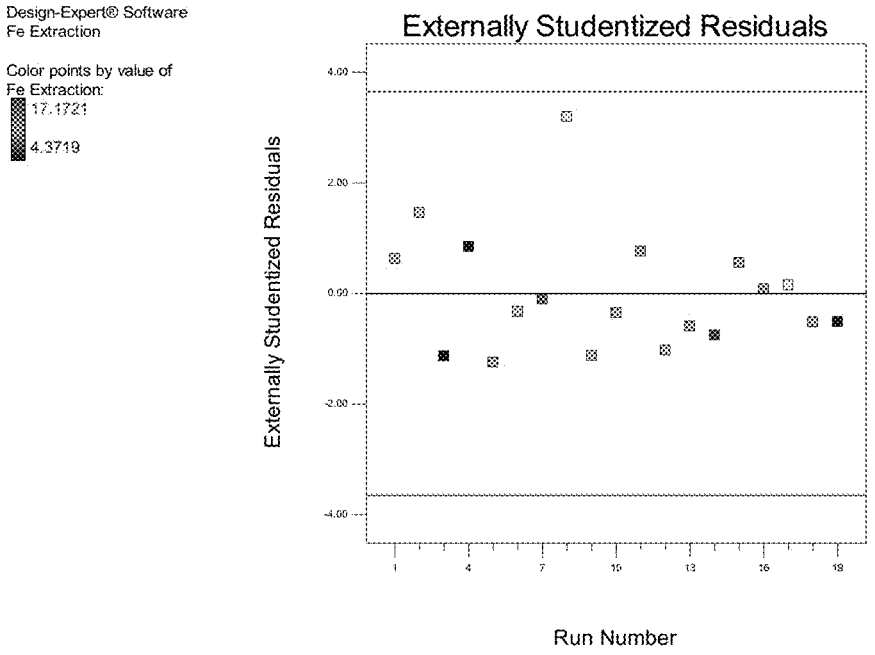

FIG. 146: Stat-Ease Externally Studentized Residuals for iron extraction model.

Figure 147:
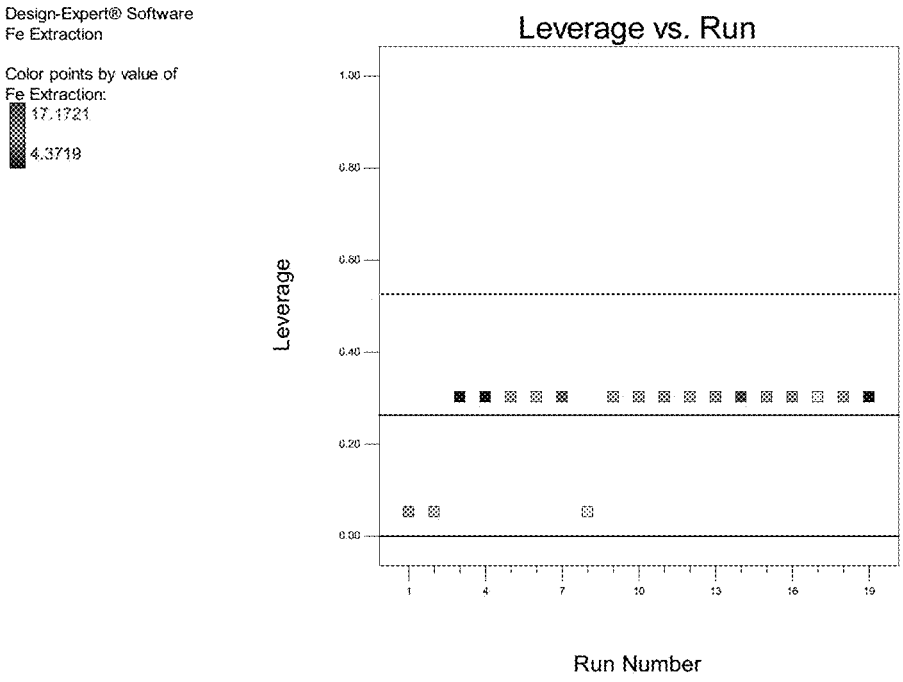

FIG. 147: Stat-Ease Leverage vs. Run for iron extraction model.

Figure 148:
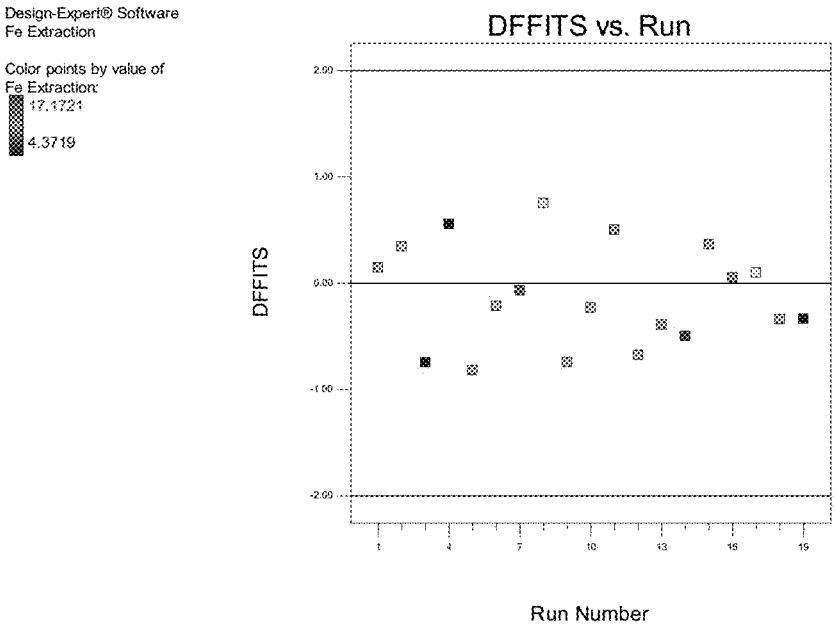

FIG. 148: Stat-Ease DFFITS vs. Run for iron extraction model.

Figure 149:
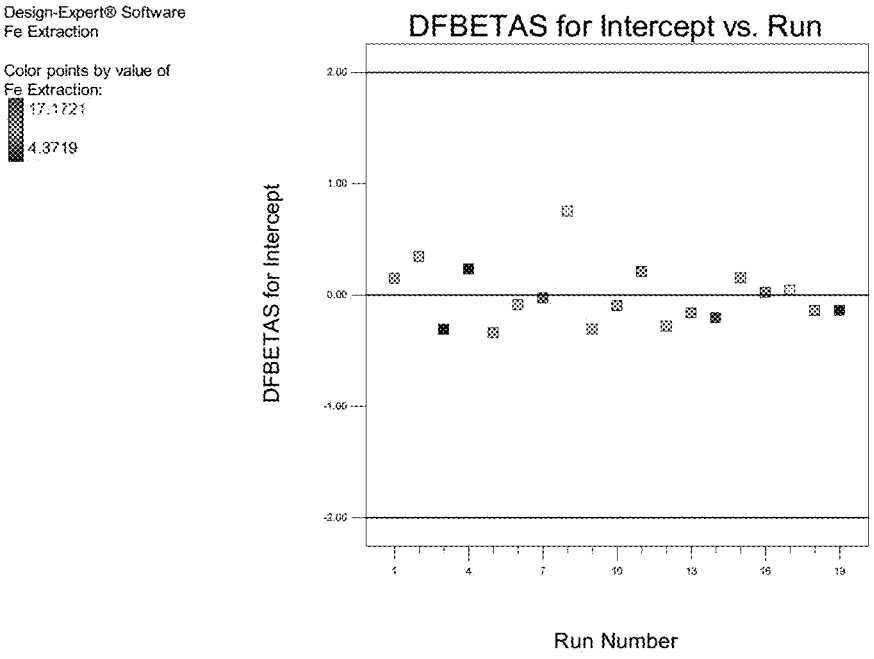

FIG. 149: Stat-Ease DFBETAS for Intercept vs. Run for iron extraction model.

Figure 150:
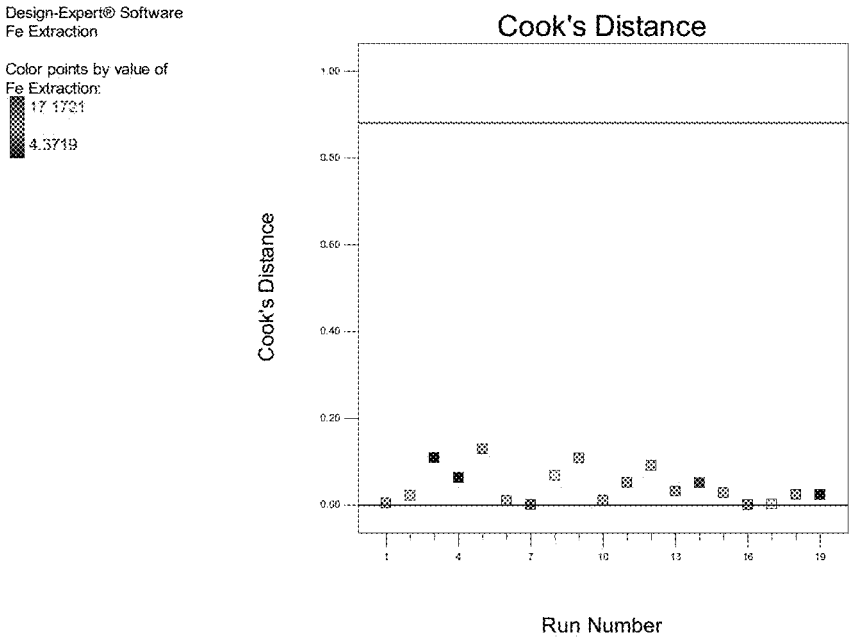

FIG. 150: Stat-Ease Cook's Distance for iron extraction model.

Figure 151:
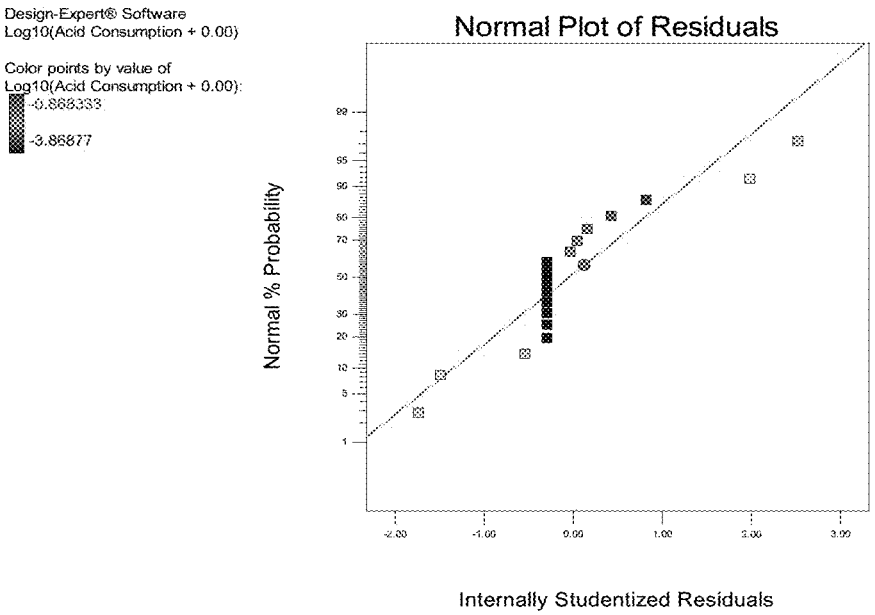

FIG. 151: Stat-Ease Normal Plot of Residuals for acid consumption model.

Figure 152:
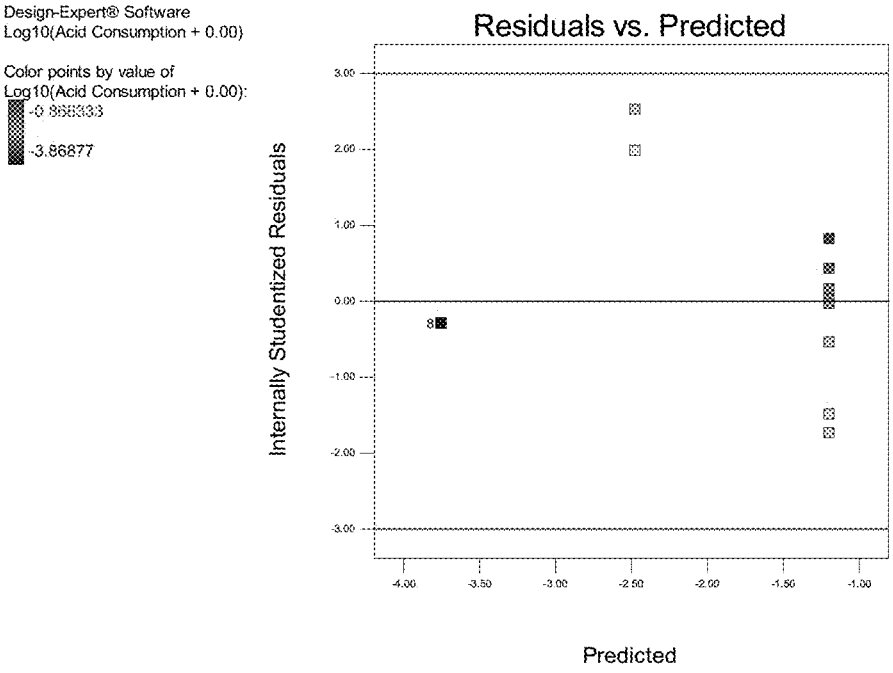

FIG. 152: Stat-Ease Residuals vs. Predicted for acid consumption model.

Figure 153:
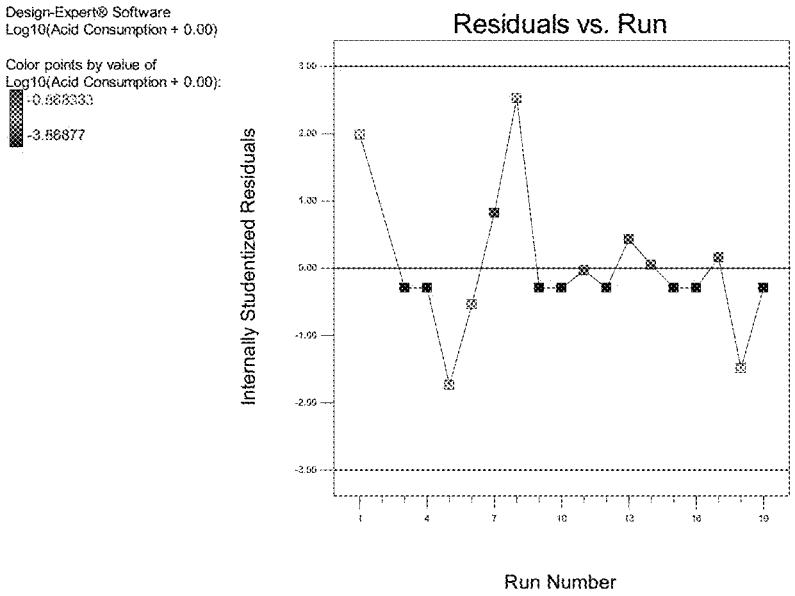

FIG. 153: Stat-Ease Residuals vs. Run for acid consumption model.

Figure 154:
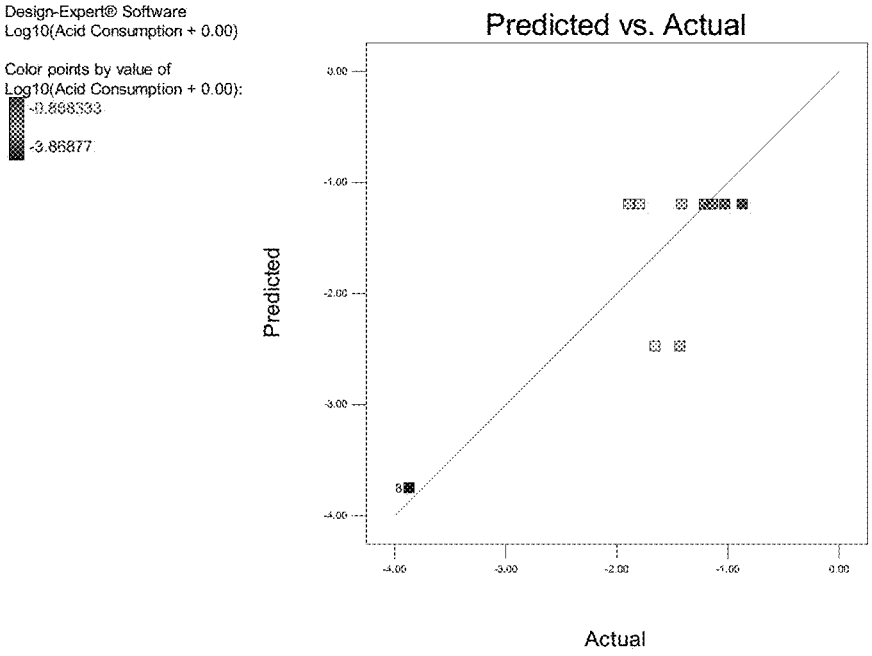

FIG. 154: Stat-Ease Predicted vs. Actual for acid consumption model.

Figure 155:
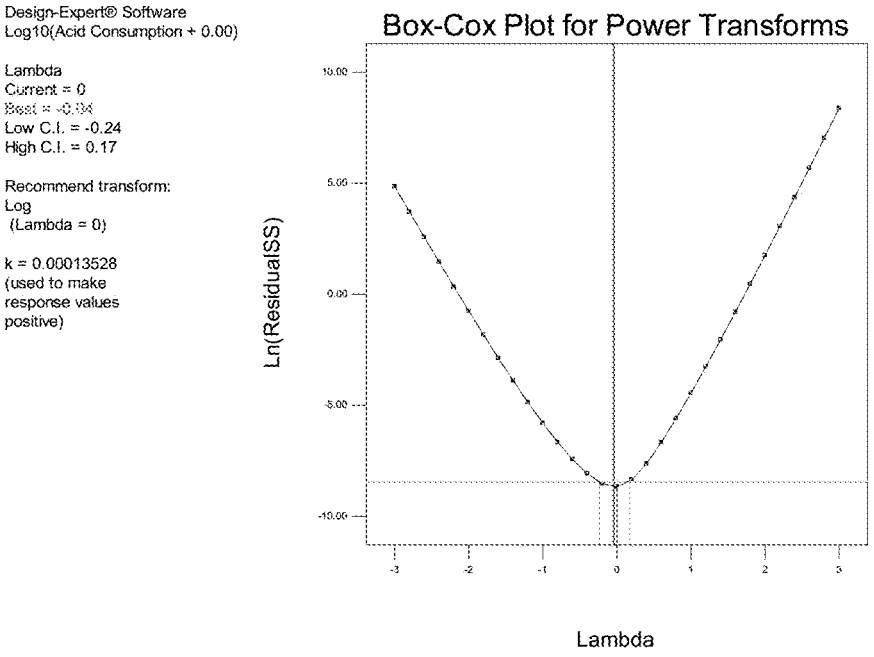

FIG. 155: Stat-Ease Box-Cox Plot for Power Transformations for acid consumption model.

Figure 156:
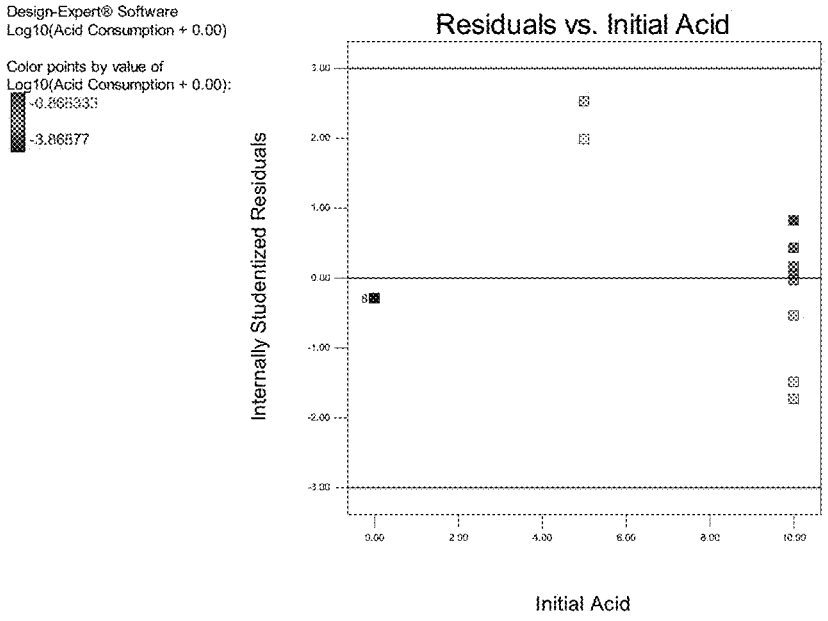

FIG. 156: Stat-Ease Residuals vs. Initial Acid for acid consumption model.

Figure 157:
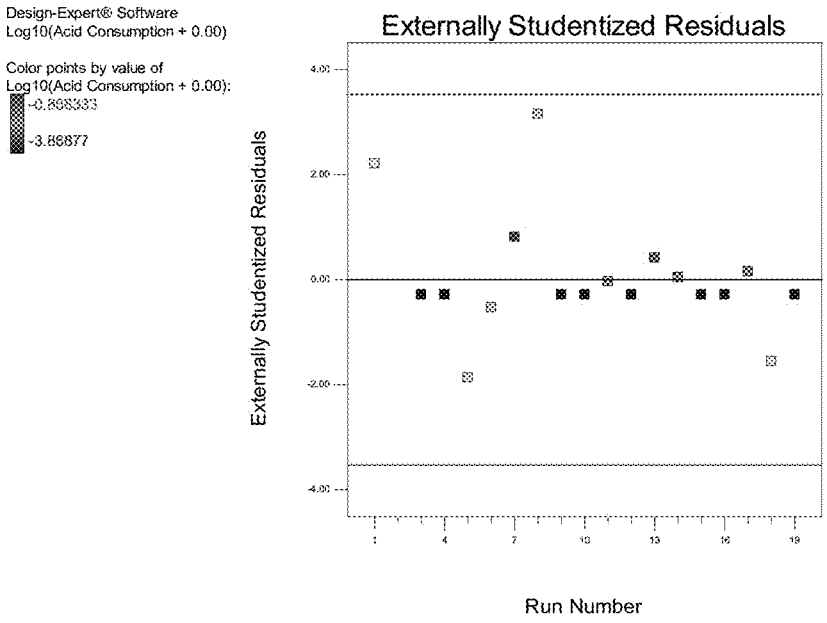

FIG. 157: Stat-Ease Externally Studentized Residuals for acid consumption model.

Figure 158:
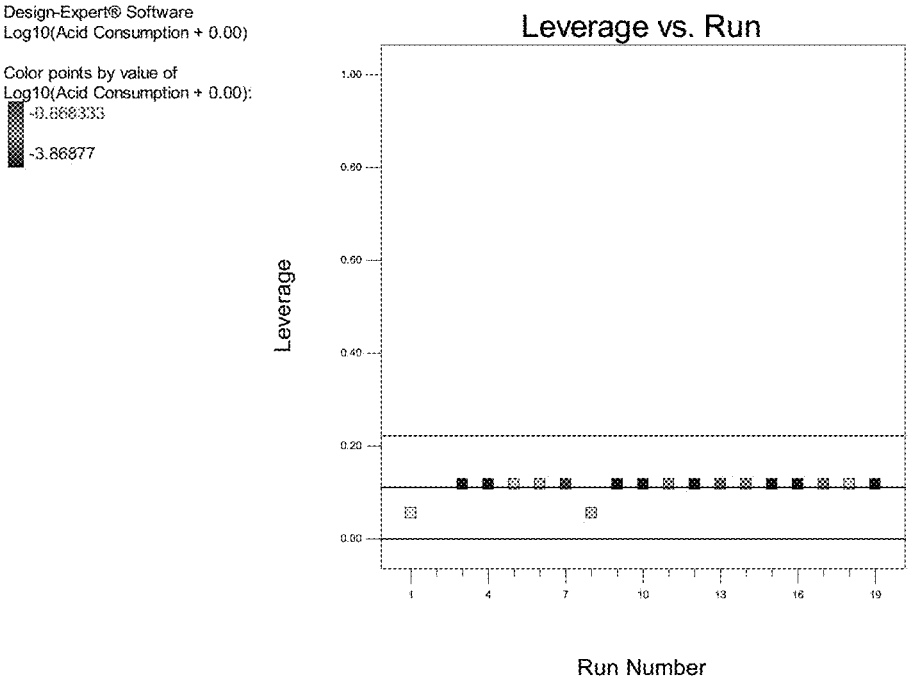

FIG. 158: Stat-Ease Leverage vs. Run for acid consumption model.

Figure 159:
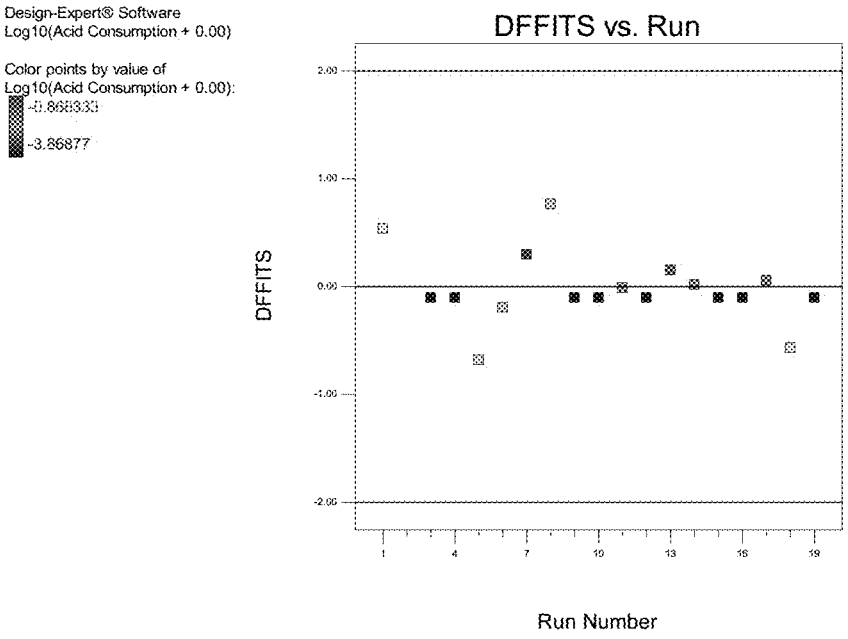

FIG. 159: Stat-Ease DFFITS vs. Run for acid consumption model.

Figure 160:
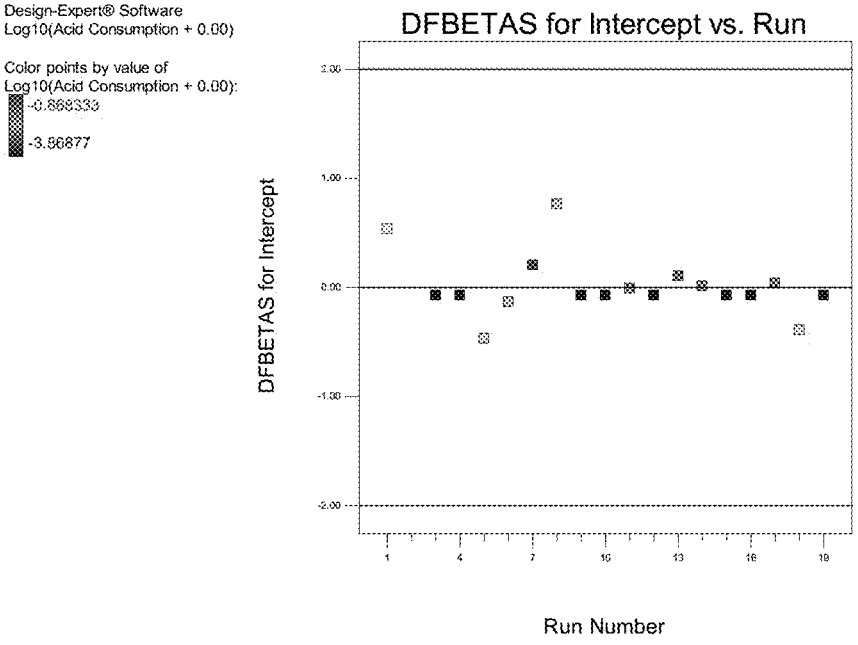

FIG. 160: Stat-Ease DFBETAS for Intercept vs. Run for acid consumption model.

Figure 161:
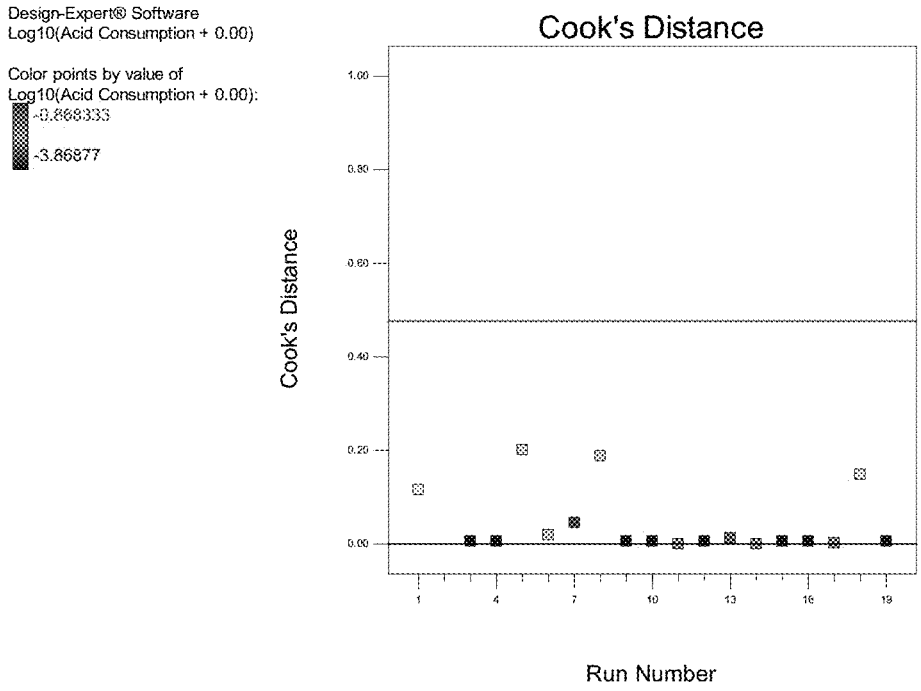

FIG. 161: Stat-Ease Cook's Distance for acid consumption model.

Figure 162:
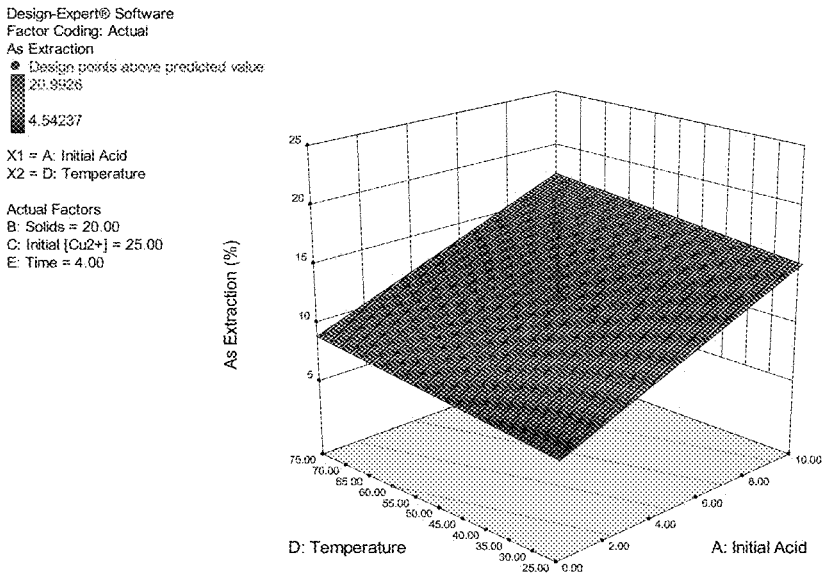

FIG. 162: Stat-Ease 3-D plot of effect of initial acid and temperature on arsenic extraction.

Figure 163:
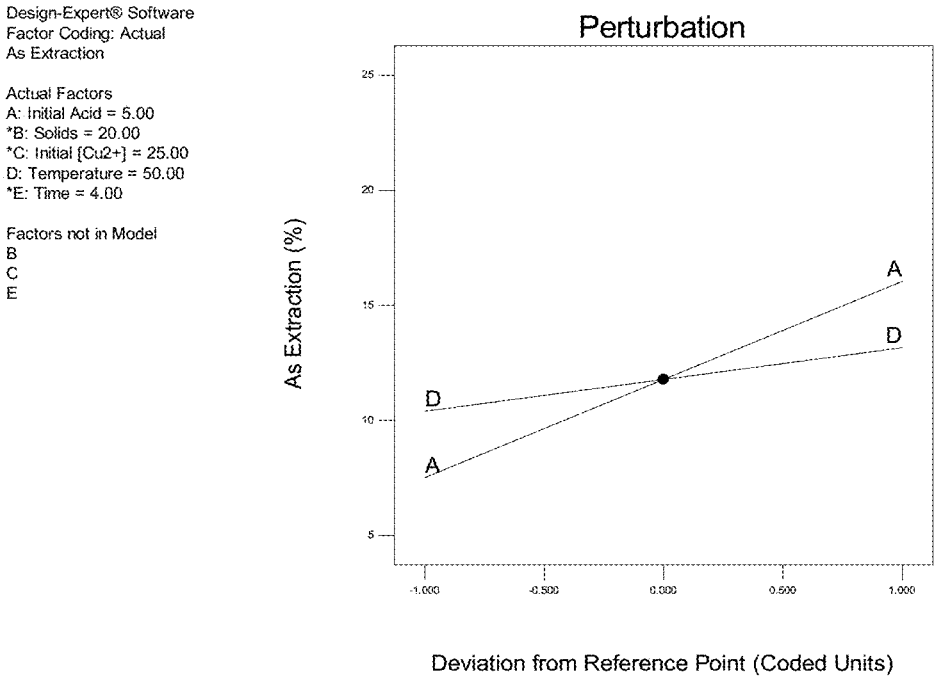

FIG. 163: Stat-Ease initial acid and temperature perturbation for arsenic extraction model.

Figure 164:
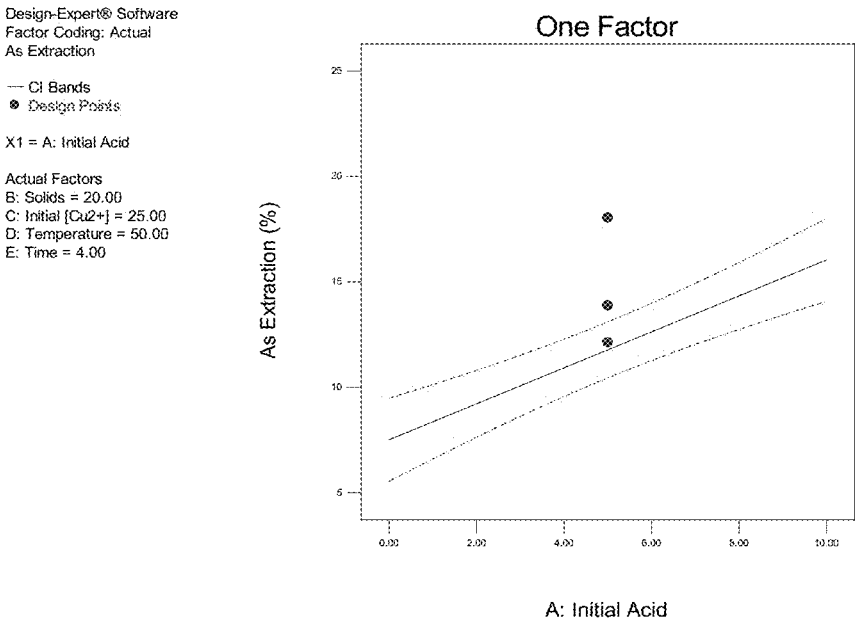

FIG. 164: Stat-Ease initial acid factor plot for arsenic extraction model.

Figure 165:
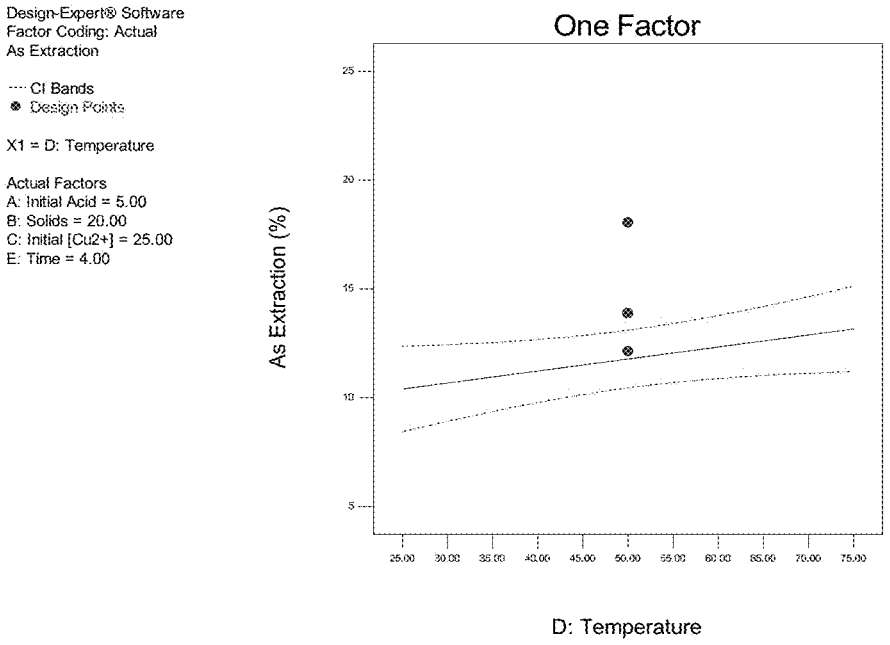

FIG. 165: Stat-Ease temperature factor plot for arsenic extraction model.

Figure 166:
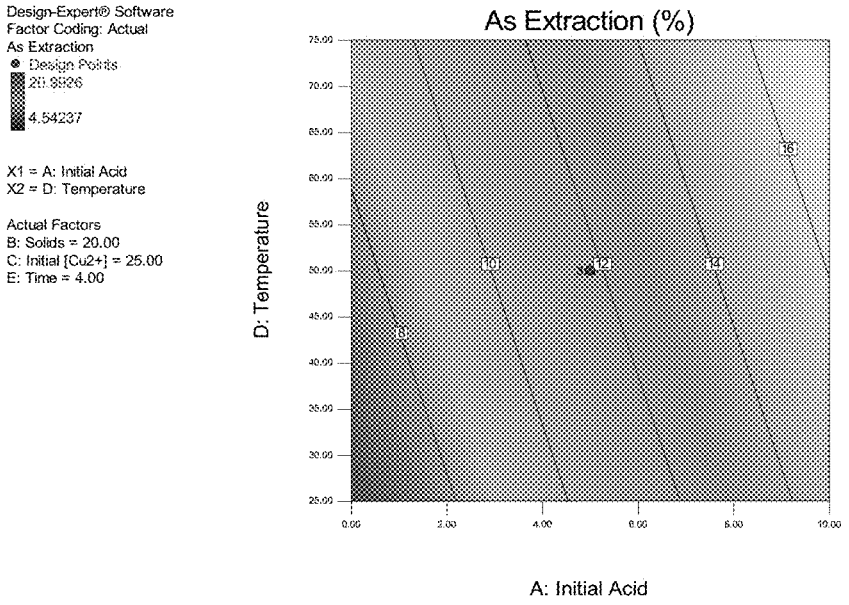

FIG. 166: Stat-Ease initial acid and temperature contour plot for arsenic extraction model.

Figure 167:
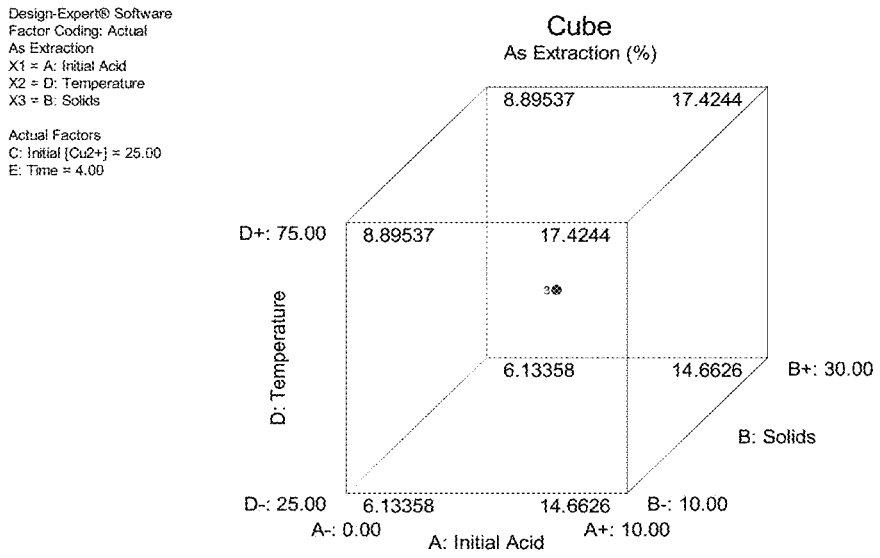

FIG. 167: Stat-Ease cube plot for arsenic extraction model.

Figure 168:
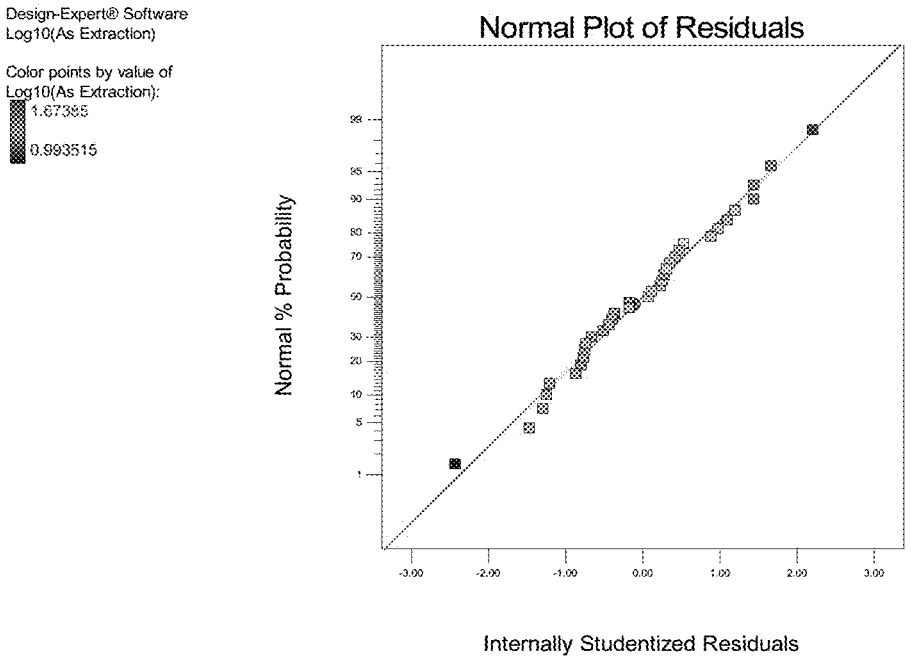

FIG. 168: Stat-Ease Normal Plot of Residuals for arsenic extraction model.

Figure 169:
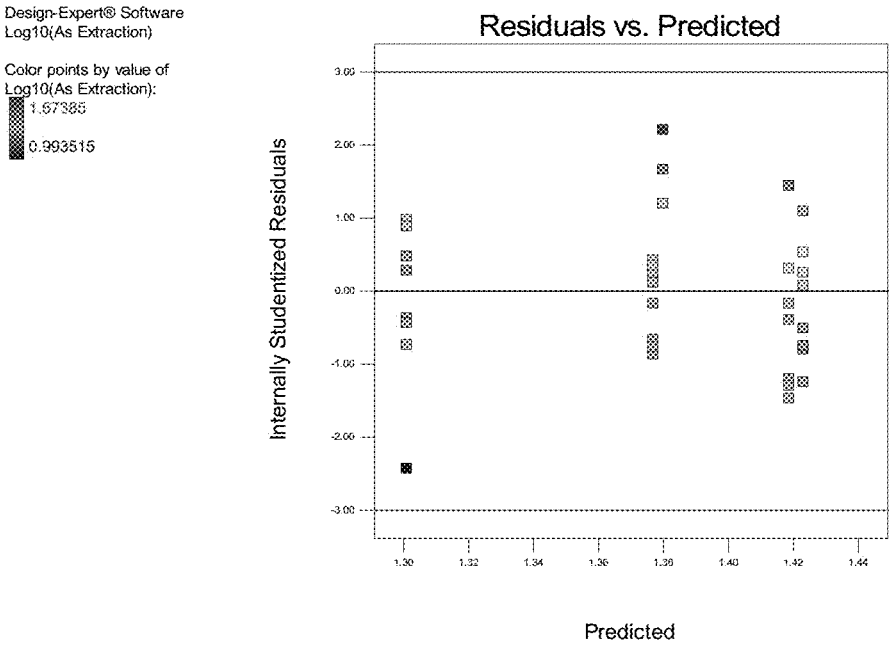

FIG. 169: Stat-Ease Residuals vs. Predicted for arsenic extraction model.

Figure 170:
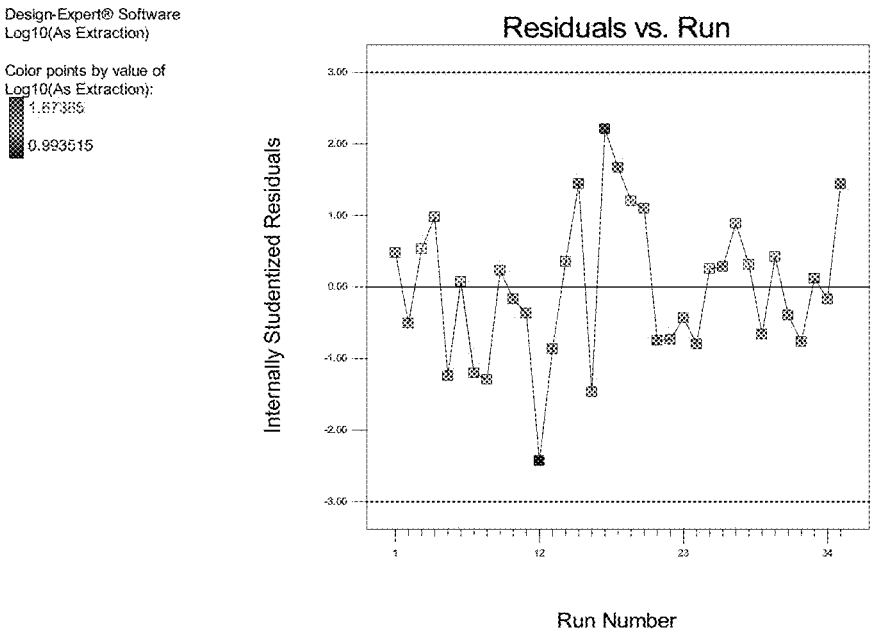

FIG. 170: Stat-Ease Residuals vs. Run for arsenic extraction model.

Figure 171:
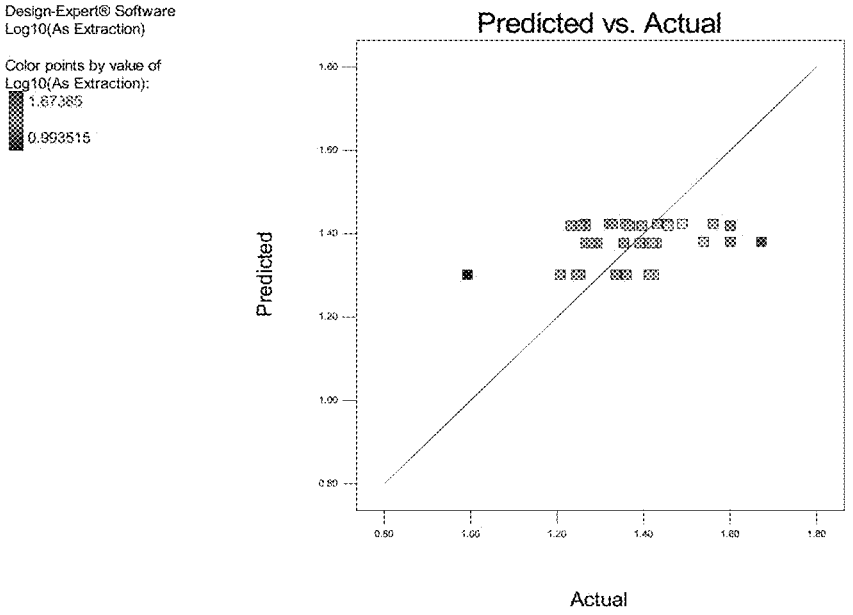

FIG. 171: Stat-Ease Predicted vs. Actual for arsenic extraction model.

Figure 172:
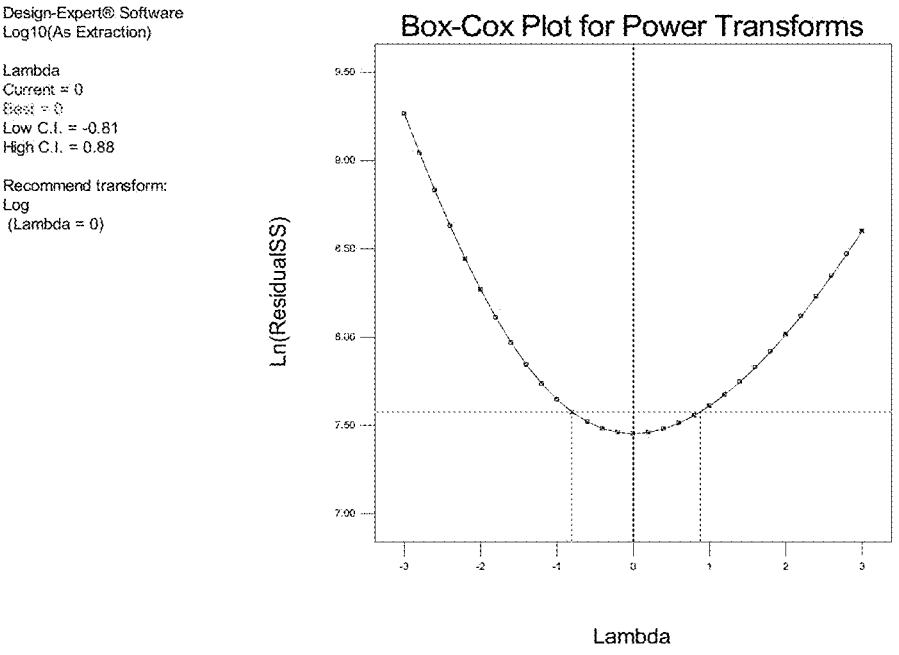

FIG. 172: Stat-Ease Box-Cox Plot for Power Transforms for arsenic extraction model.

Figure 173:
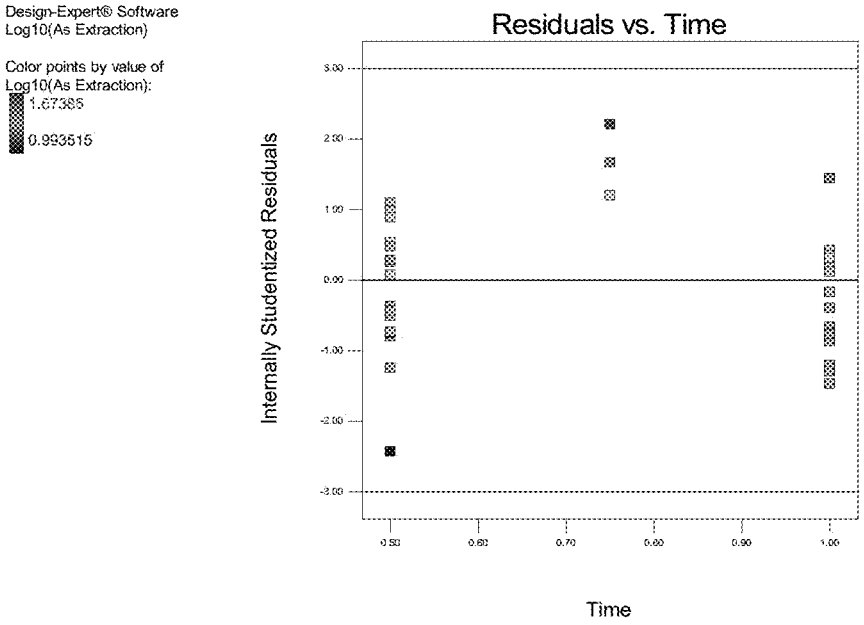

FIG. 173: Stat-Ease Residuals vs. Time for arsenic extraction model.

Figure 174:
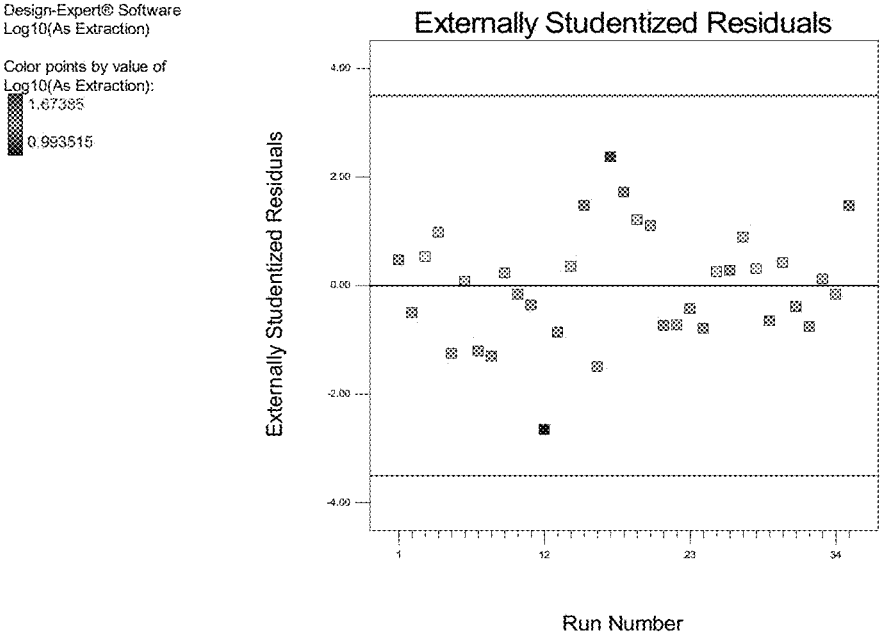

FIG. 174: Stat-Ease Externally Studentized Residuals for arsenic extraction model.

Figure 175:
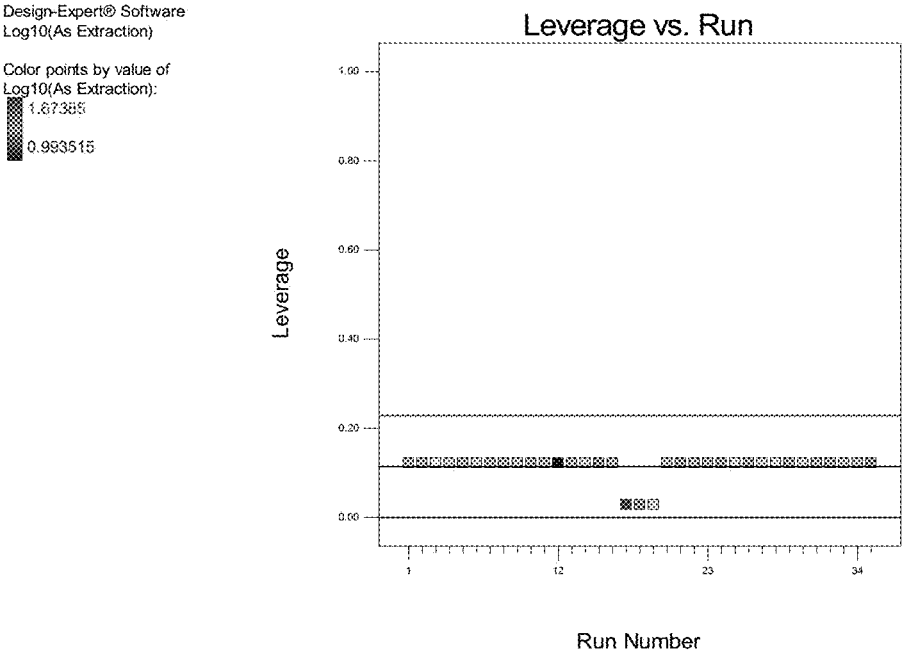

FIG. 175: Stat-Ease Leverage vs. Run for arsenic extraction model.

Figure 176:
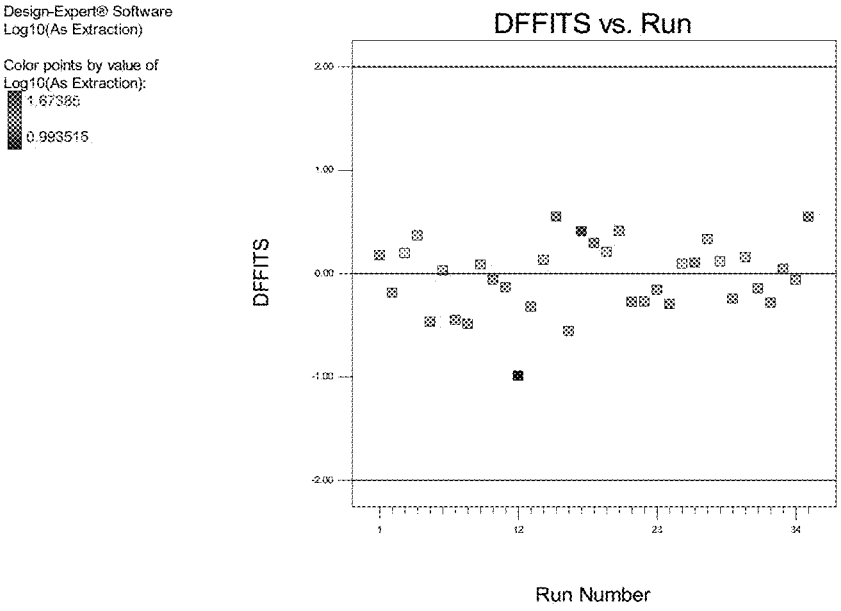

FIG. 176: Stat-Ease DFFITS vs. Run for arsenic extraction model.

Figure 177:
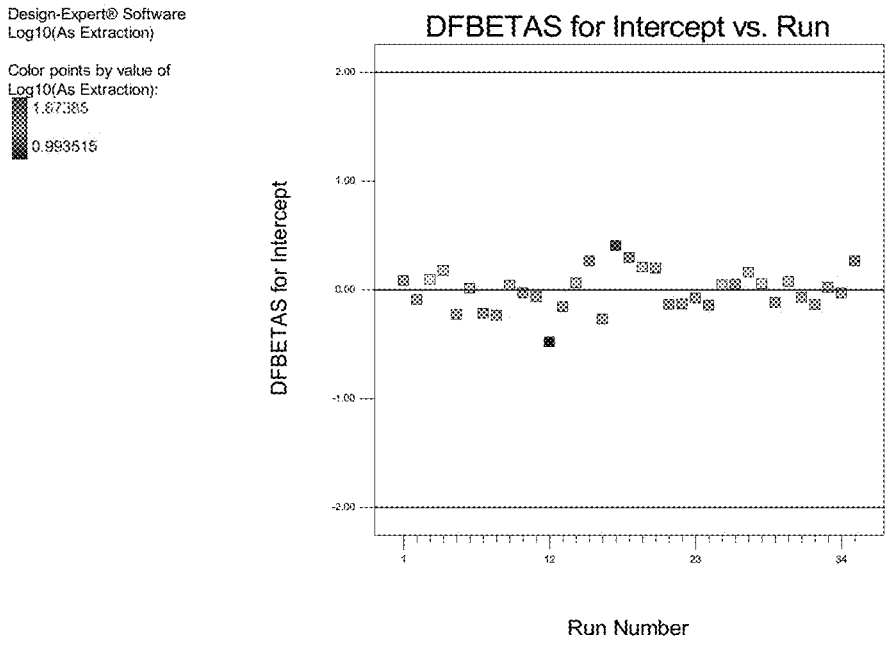

FIG. 177: Stat-Ease DFBETAS for Intercept vs. Run for arsenic extraction model.

Figure 178:
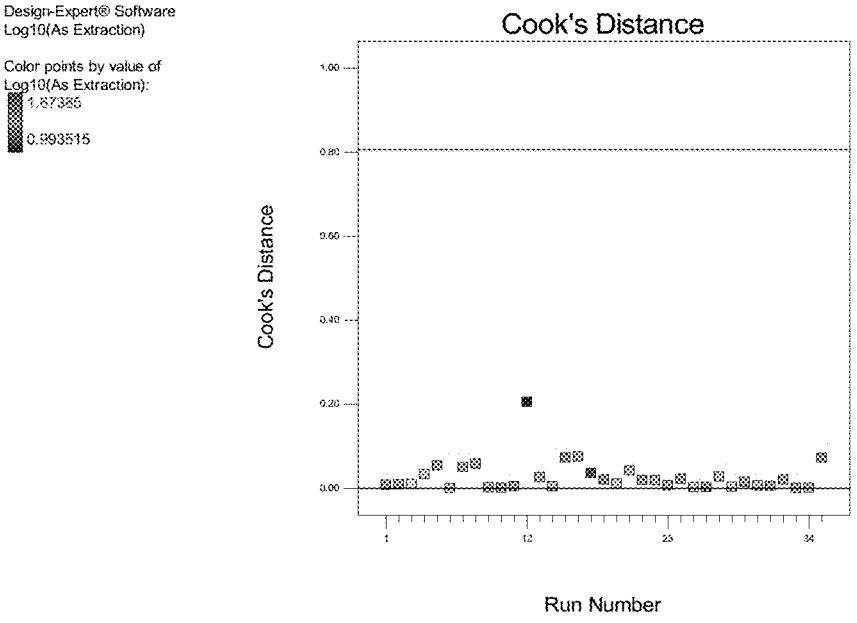

FIG. 178: Stat-Ease Cook's Distance for arsenic extraction model.

Figure 179:
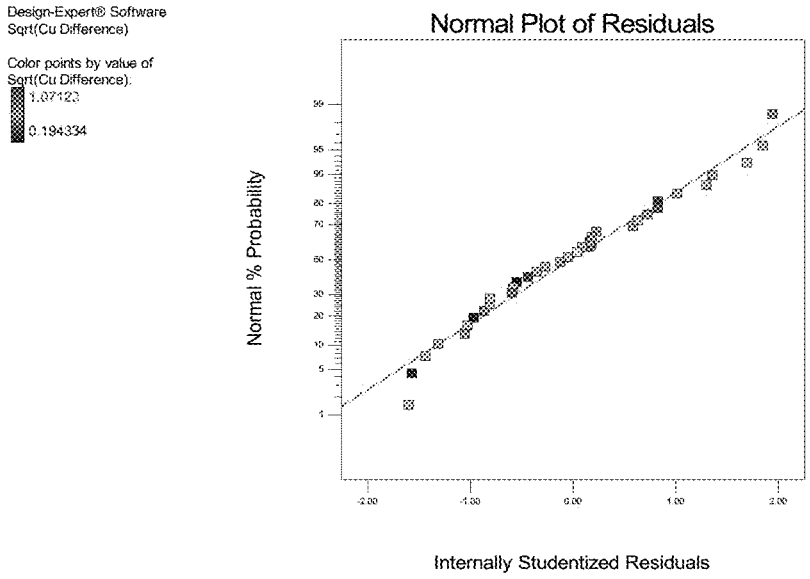

FIG. 179: Stat-Ease Normal Plot of Residuals for copper difference model.

Figure 180:
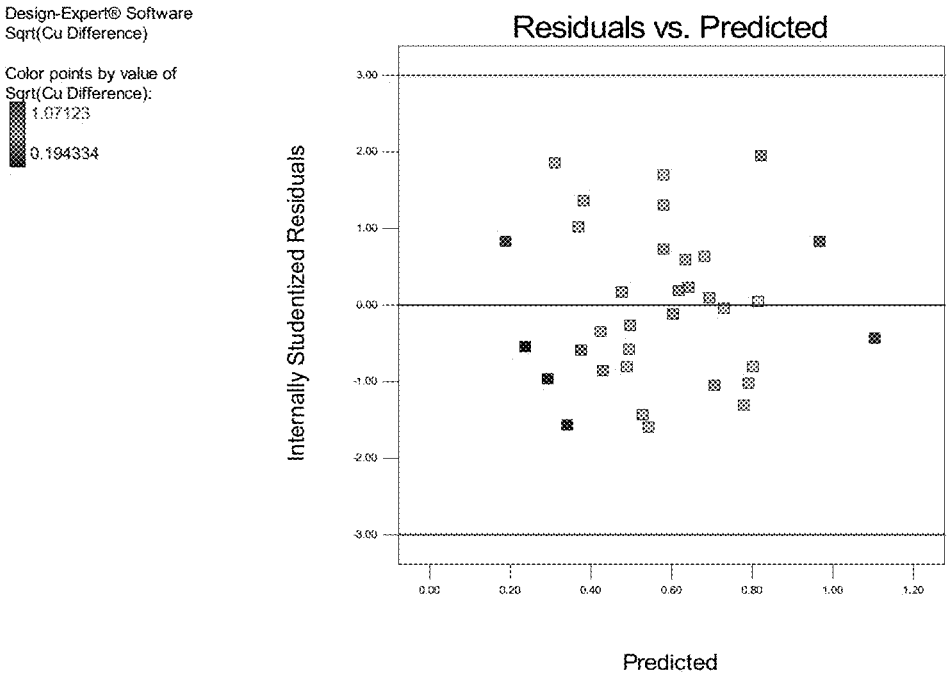

FIG. 180: Stat-Ease Residuals vs. Predicted for copper difference model.

Figure 181:
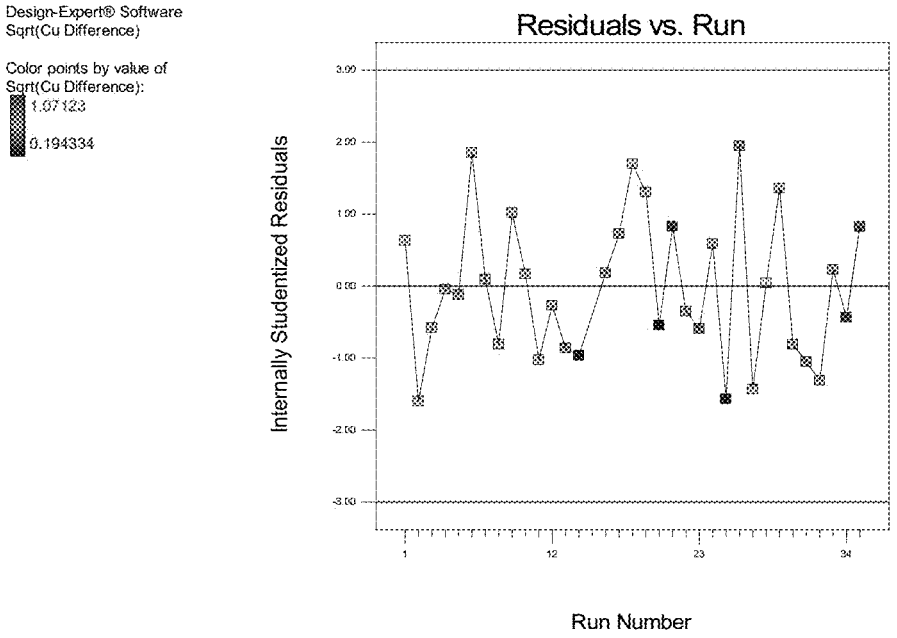

FIG. 181: Stat-Ease Residuals vs. Run for copper difference model.

Figure 182:
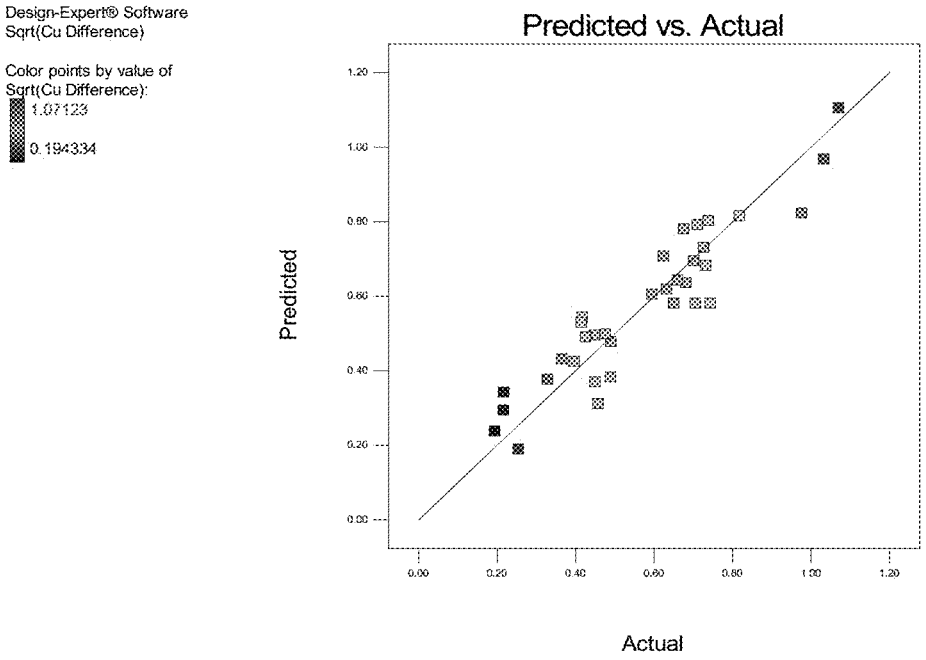

FIG. 182: Stat-Ease Predicted vs. Actual for copper difference model.

Figure 183:
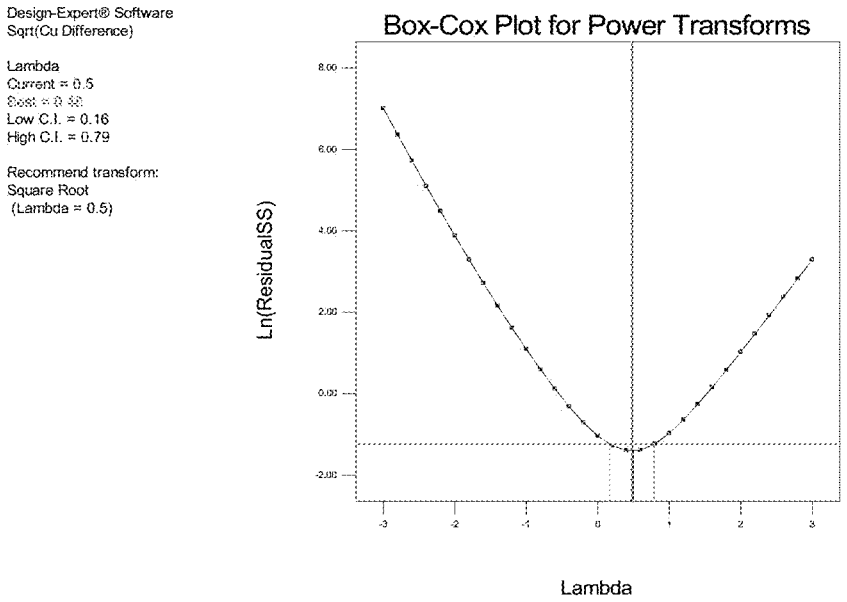

FIG. 183: Stat-Ease Box-Cox Plot for Power Transforms for copper difference model.

Figure 184:
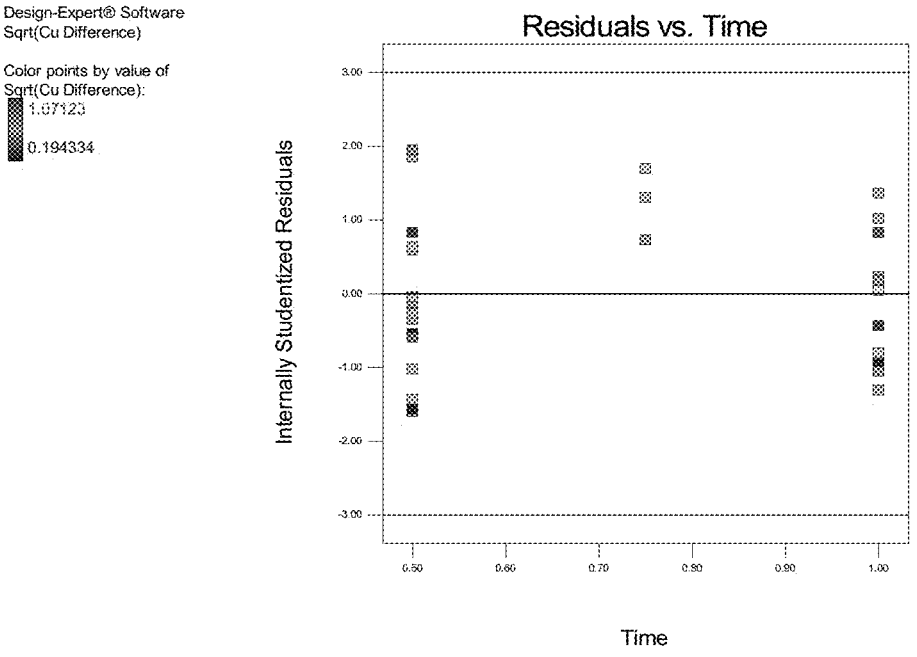

FIG. 184: Stat-Ease Residuals vs. Time for copper difference model.

Figure 185:
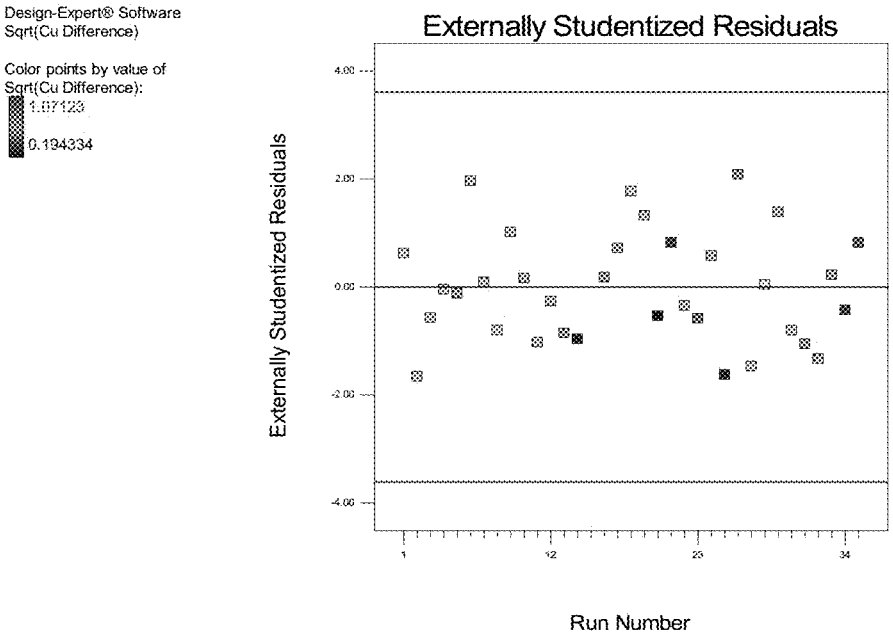

FIG. 185: Stat-Ease Externally Studentized Residuals for copper difference model.

Figure 186:
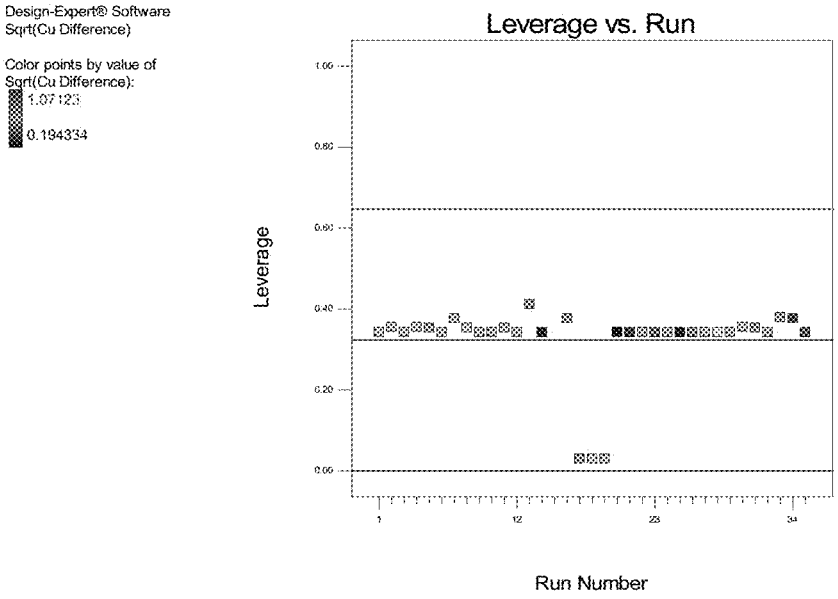

FIG. 186: Stat-Ease Leverage vs. Run for copper difference model.

Figure 187:
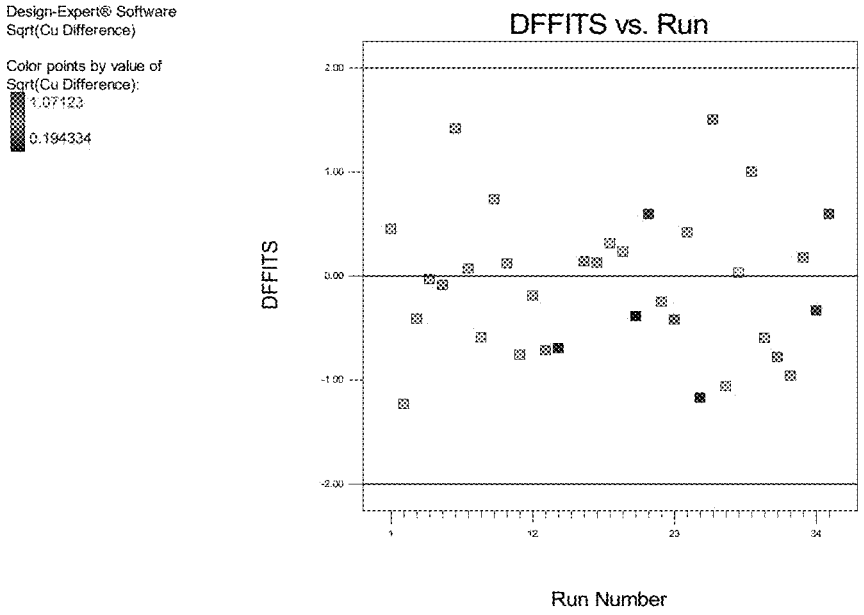

FIG. 187: Stat-Ease DFFITS vs. Run for copper difference model.

Figure 188:
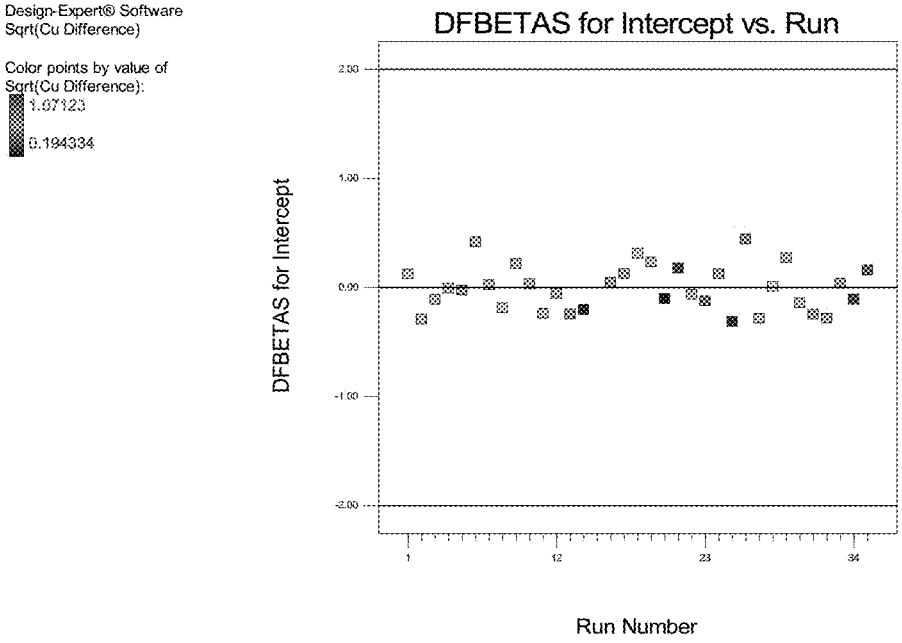

FIG. 188: Stat-Ease DFBETAS for Intercept vs. Run for copper difference model.

Figure 189:
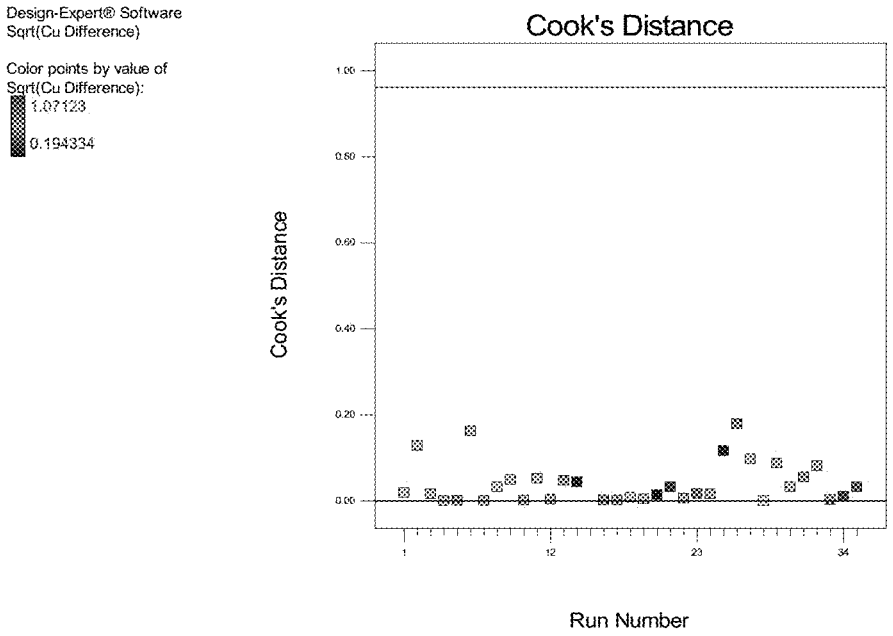

FIG. 189: Stat-Ease Cook's Distance for copper difference model.

Figure 190:
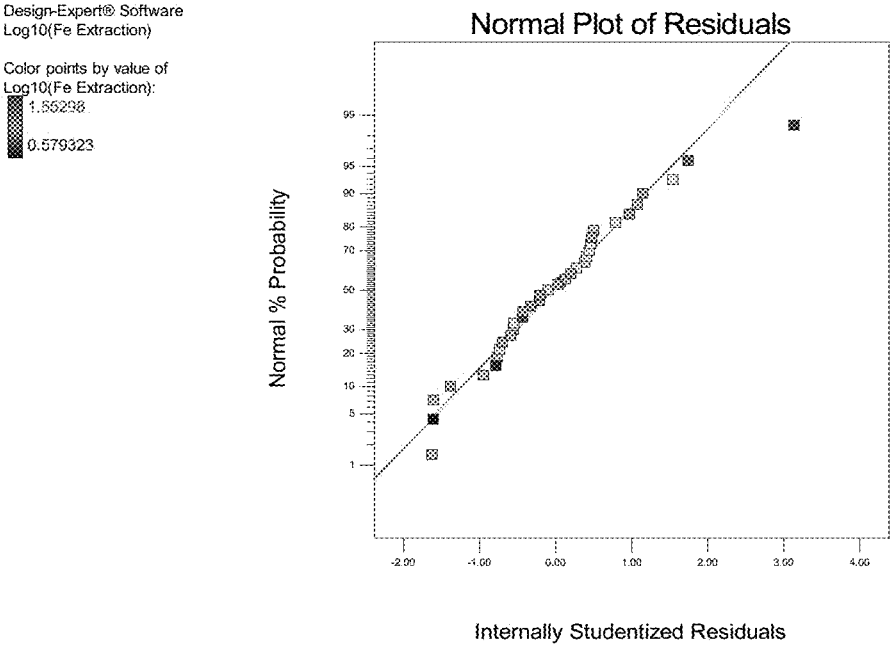

FIG. 190: Stat-Ease Normal Plot of Residuals for iron extraction model.

Figure 191:
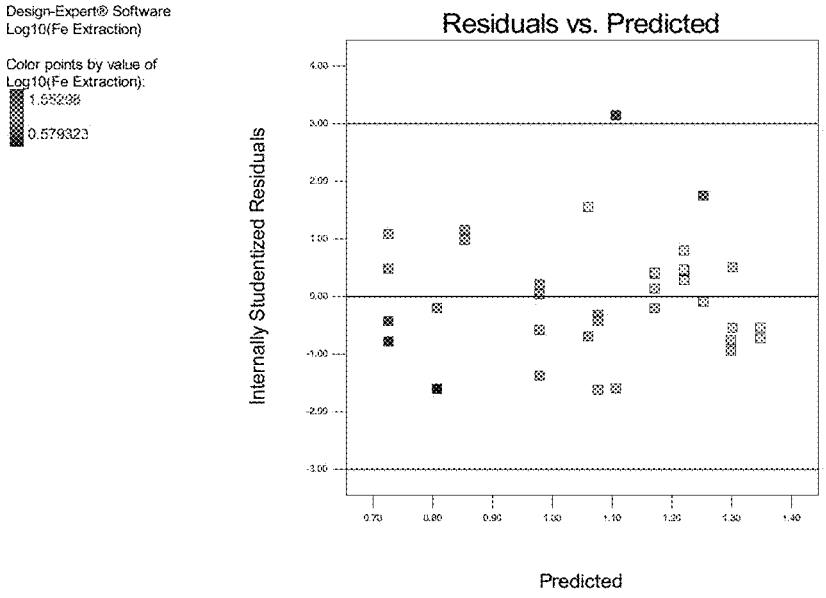

FIG. 191: Stat-Ease Residuals vs. Predicted for iron extraction model.

Figure 192:
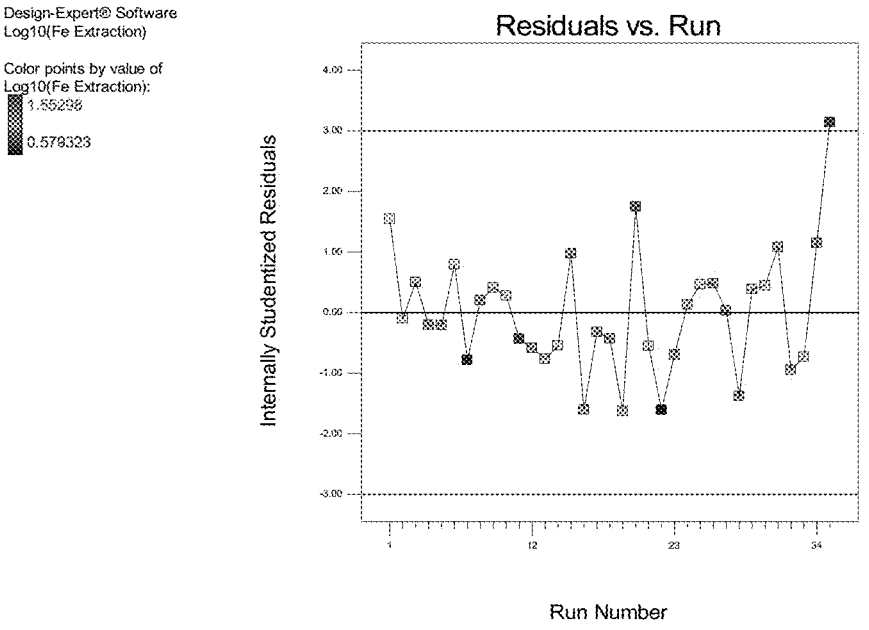

FIG. 192: Stat-Ease Residuals vs. Run for iron extraction model.

Figure 193:
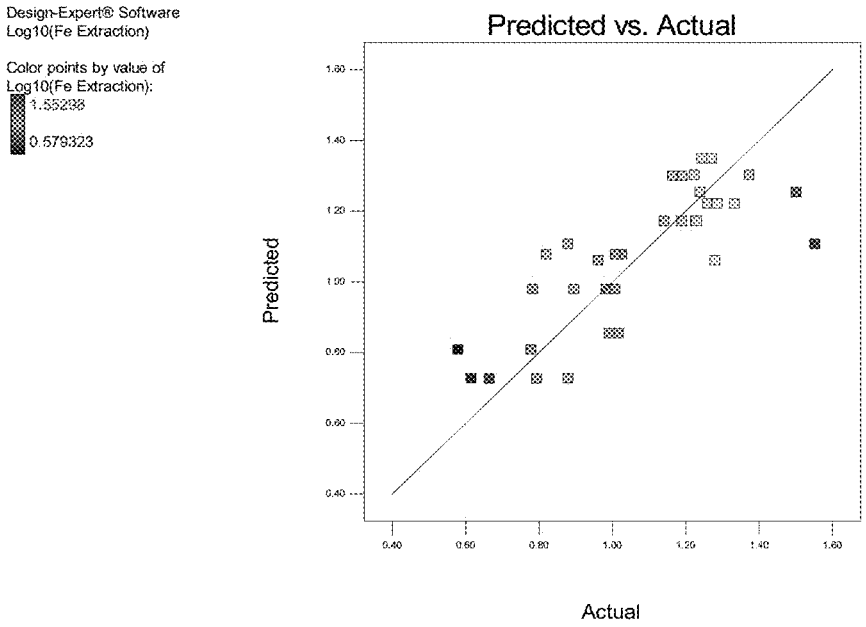

FIG. 193: Stat-Ease Predicted vs. Actual for iron extraction model.

Figure 194:
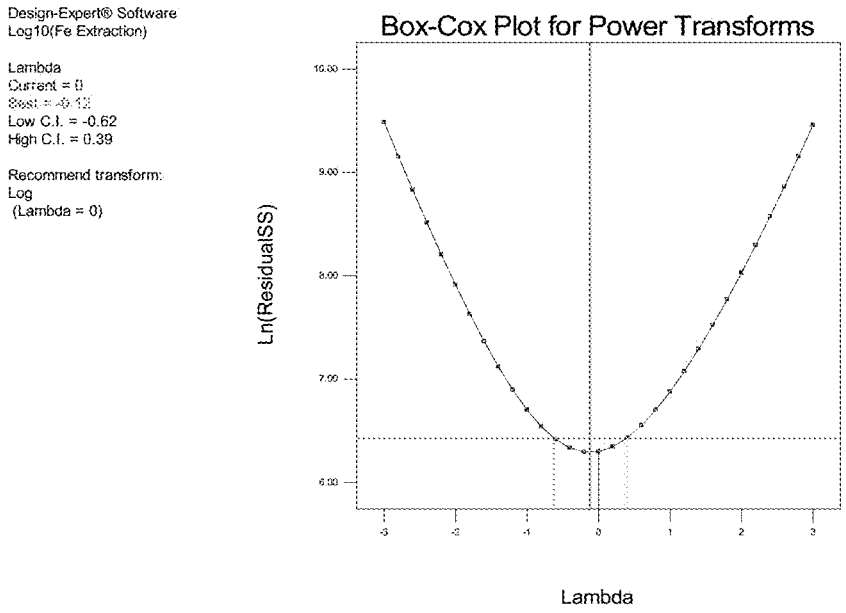

FIG. 194: Stat-Ease Box-Cox Plot for Power Transforms for iron extraction model.

Figure 195:
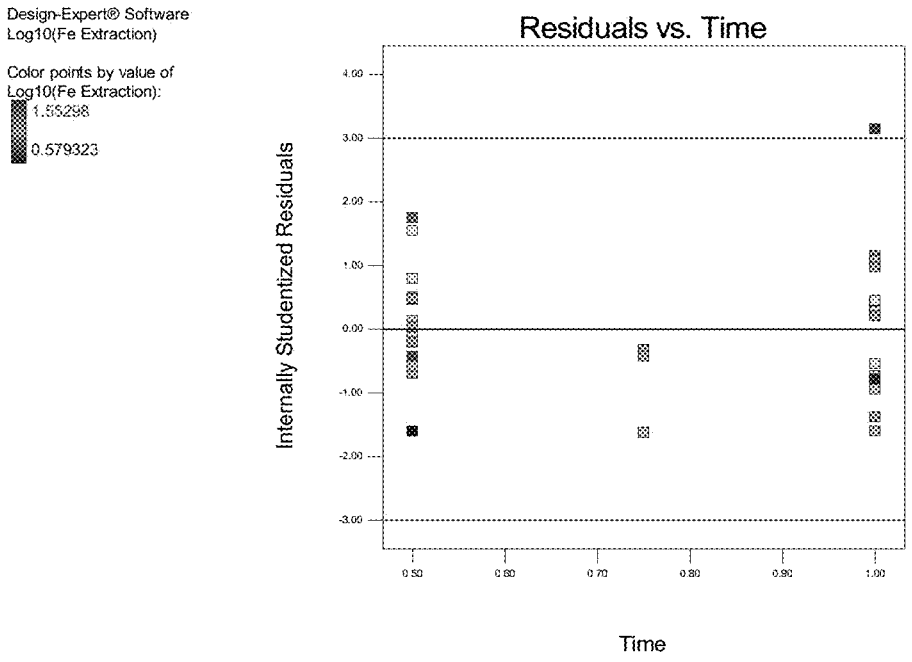

FIG. 195: Stat-Ease Residuals vs. Time for iron extraction model.

Figure 196:
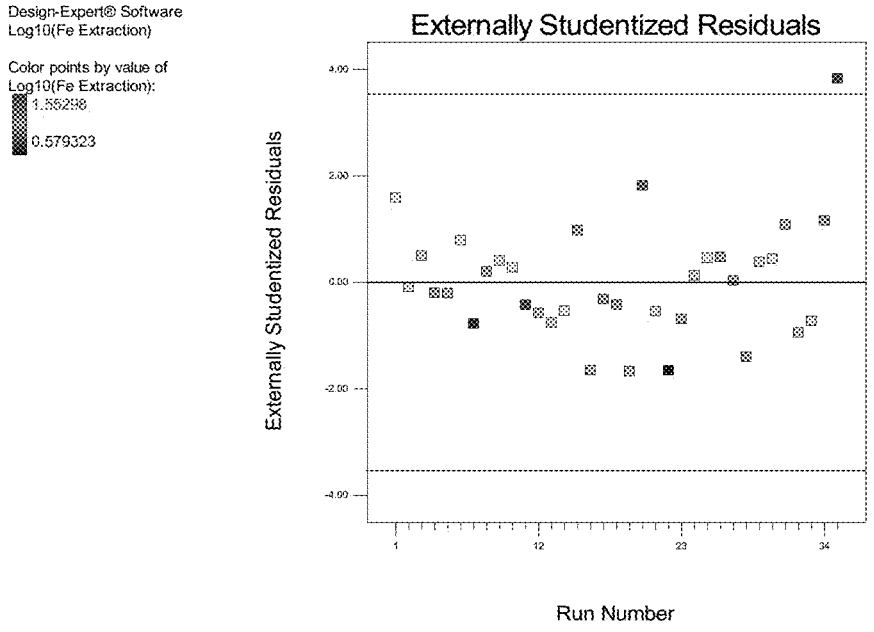

FIG. 196: Stat-Ease Externally Studentized Residuals for iron extraction model.

Figure 197:
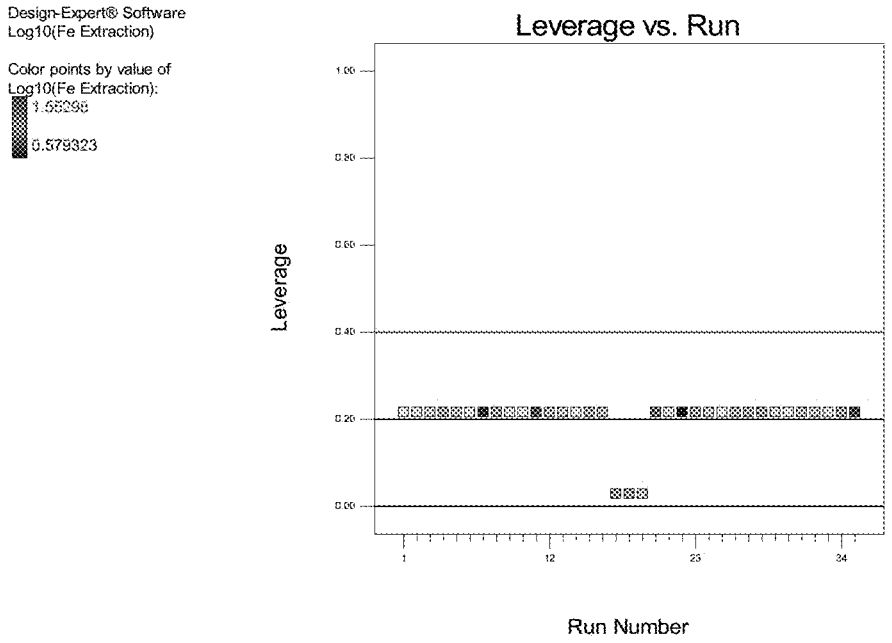

FIG. 197: Stat-Ease Leverage vs. Run for iron extraction model.

Figure 198:
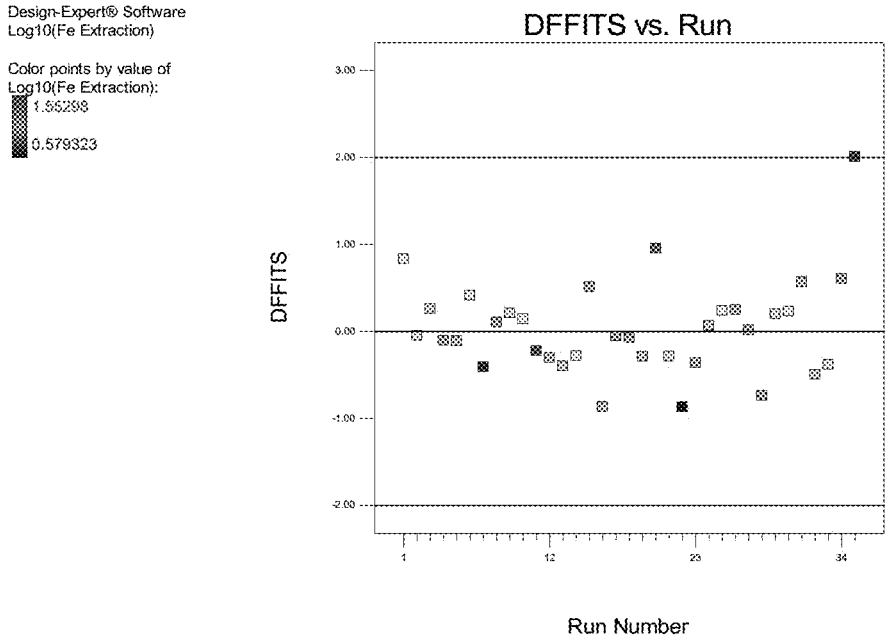

FIG. 198: Stat-Ease DFFITS vs. Run for iron extraction model.

Figure 199:
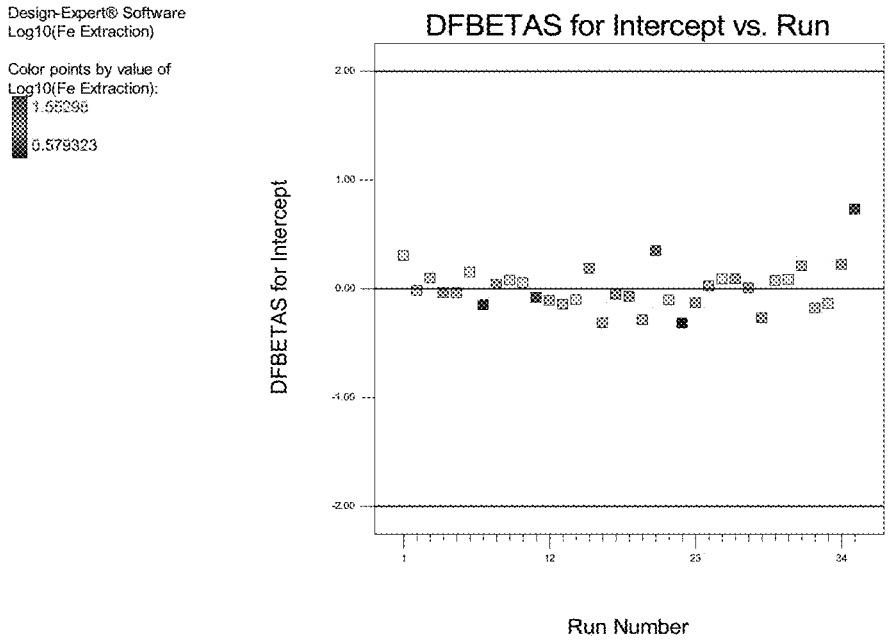

FIG. 199: Stat-Ease DFBETAS for Intercept vs. Run for iron extraction model.

Figure 200:
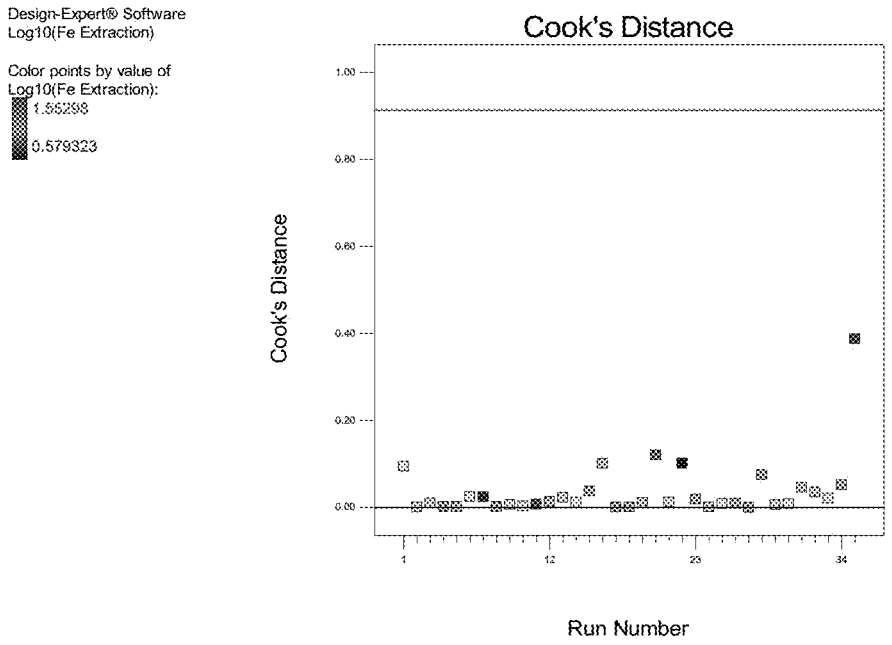

FIG. 200: Stat-Ease Cook's Distance for iron extraction model.

Figure 201:
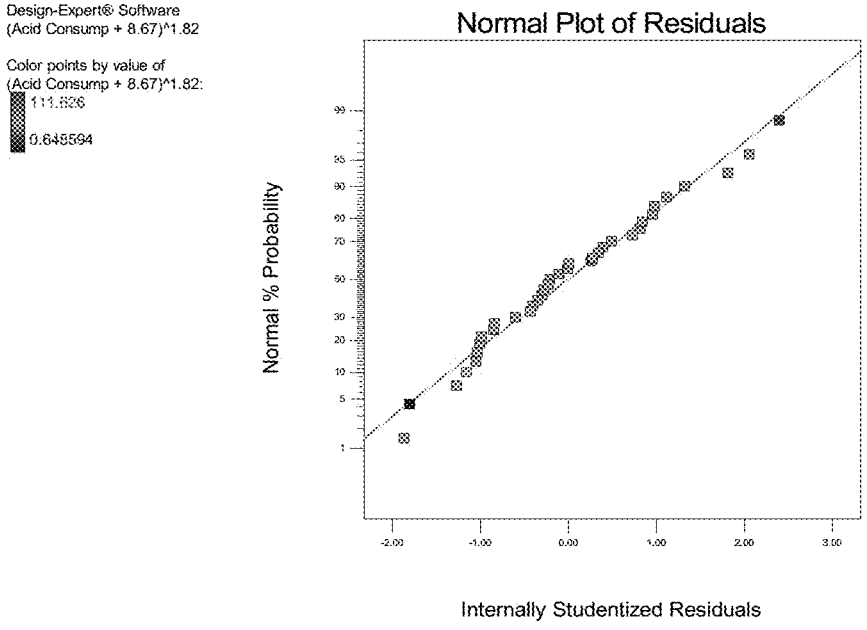

FIG. 201: Stat-Ease Normal Plot of Residuals for acid consumption model.

Figure 202:
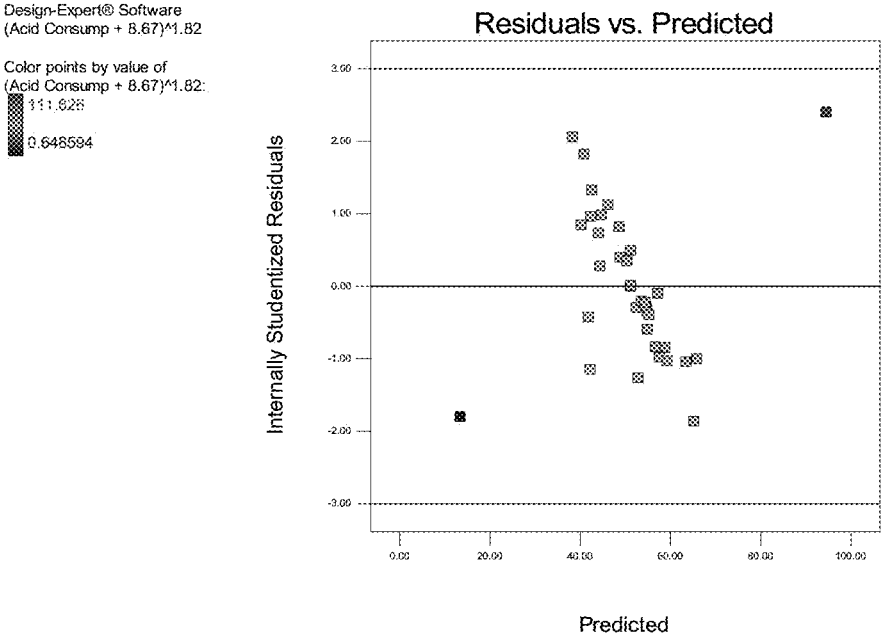

FIG. 202: Stat-Ease Residuals vs. Predicted for acid consumption model.

Figure 203:
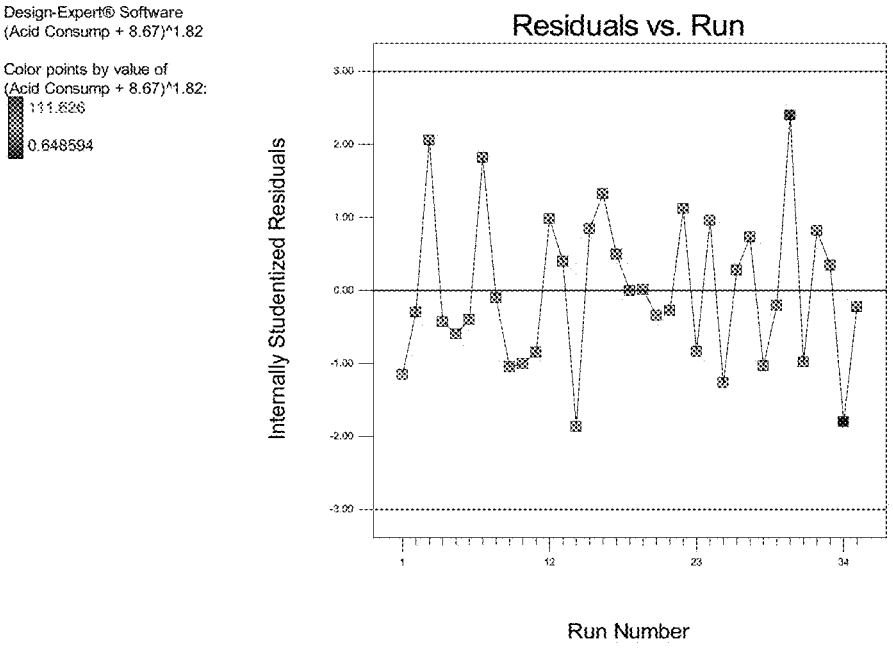

FIG. 203: Stat-Ease Residuals vs. Run for acid consumption model.

Figure 204:
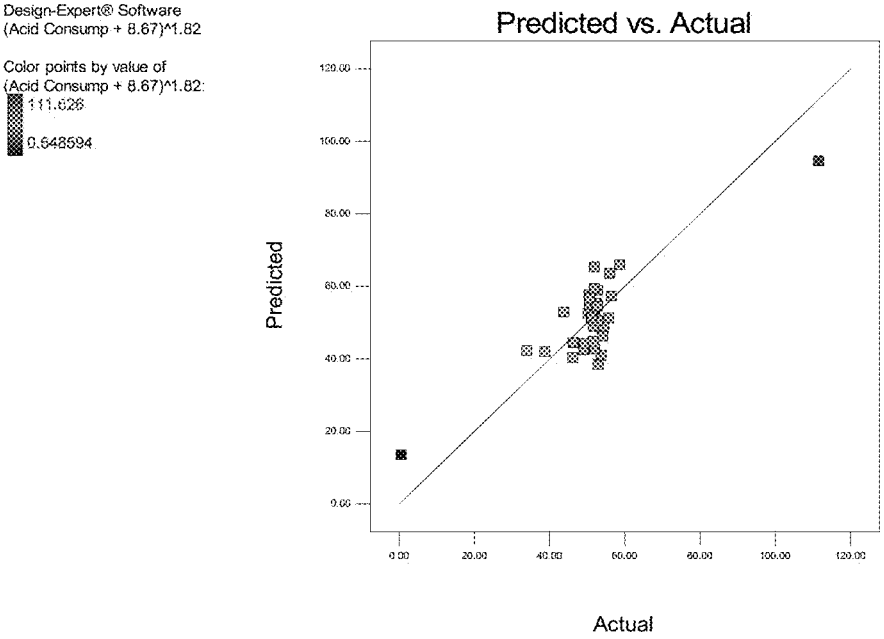

FIG. 204: Stat-Ease Predicted vs. Actual for acid consumption model.

Figure 205:
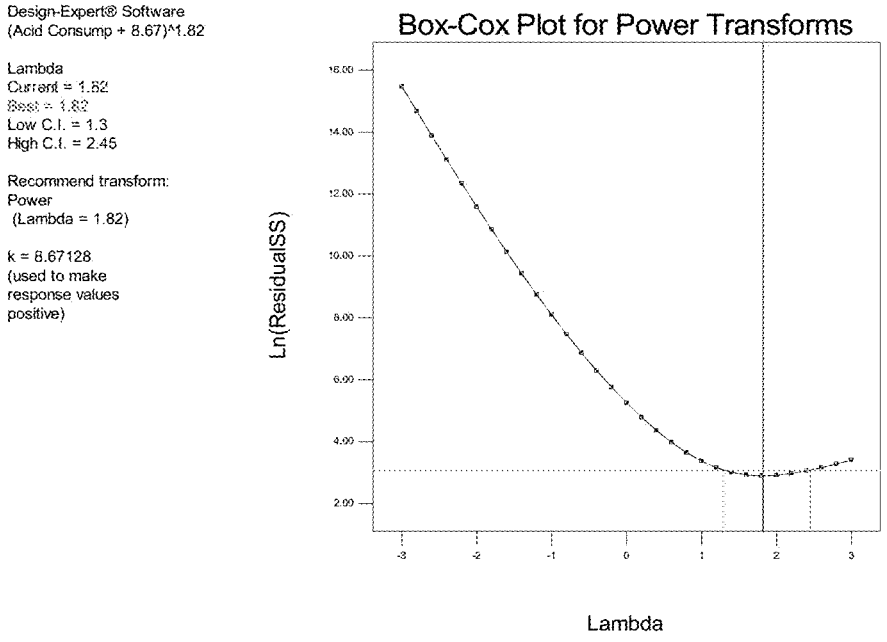

FIG. 205: Stat-Ease Box-Cox Plot for Power Transforms for acid consumption model.

Figure 206:
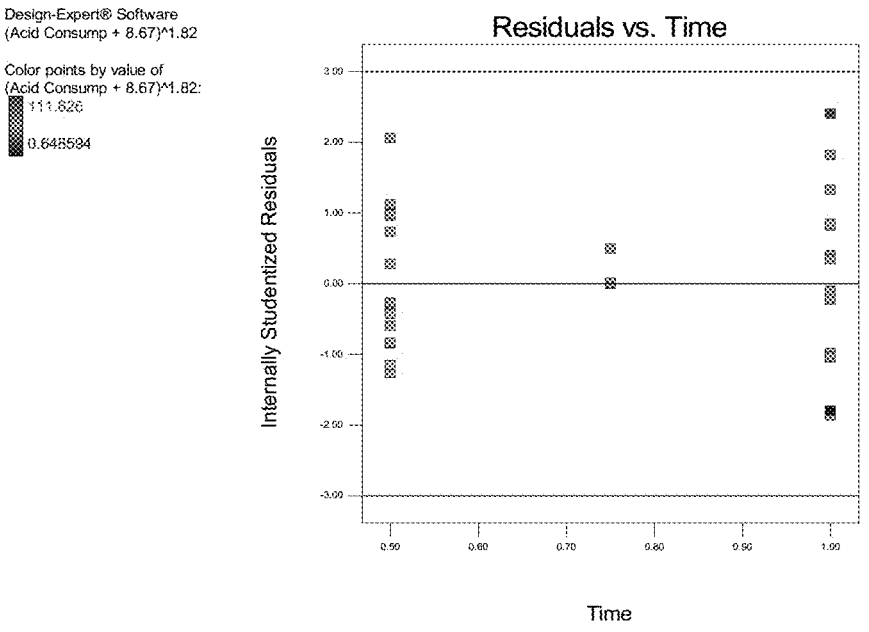

FIG. 206: Stat-Ease Residuals vs. Time for acid consumption model.

Figure 207:
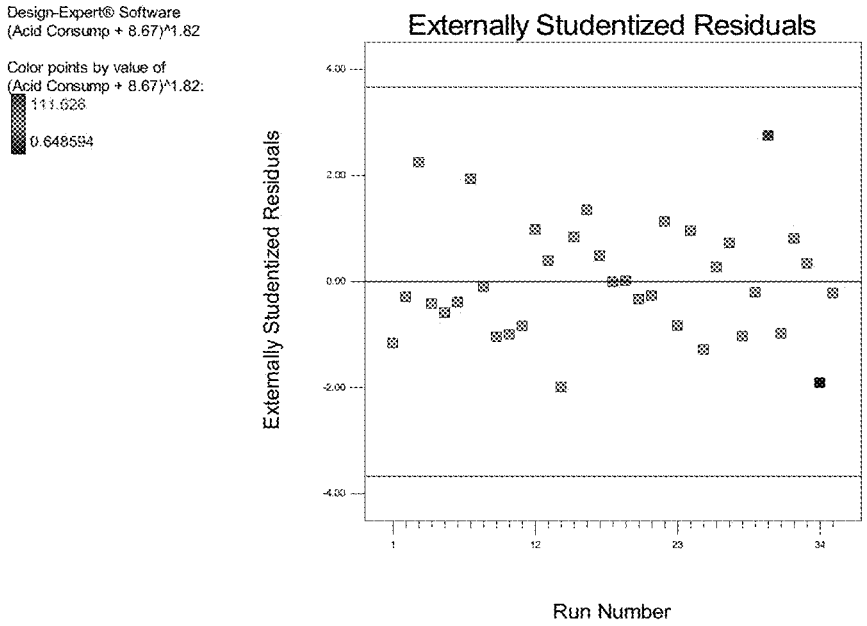

FIG. 207: Stat-Ease Externally Studentized Residuals for acid consumption model.

Figure 208:
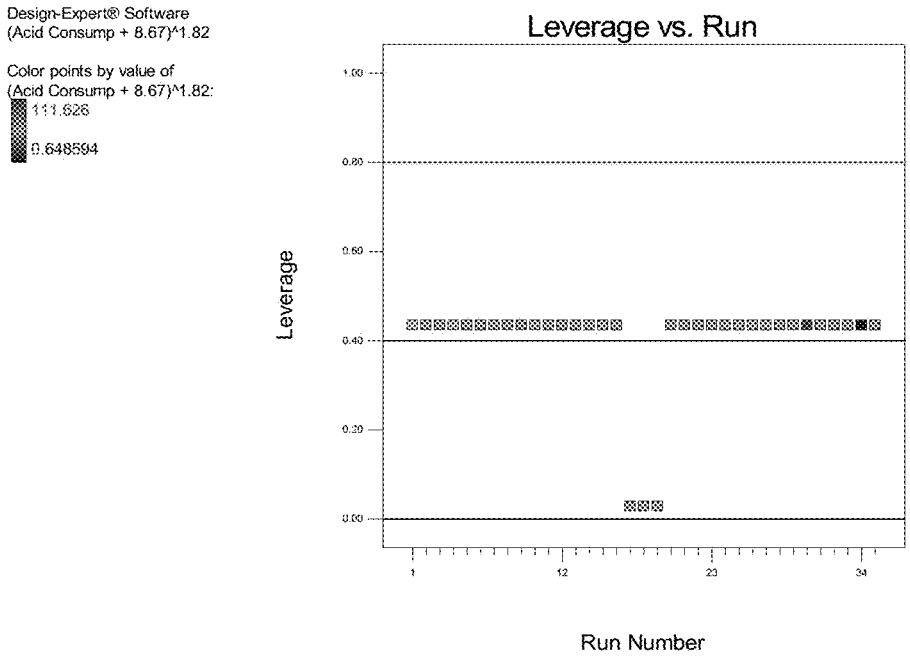

FIG. 208: Stat-Ease Leverage vs. Run for acid consumption model.

Figure 209:
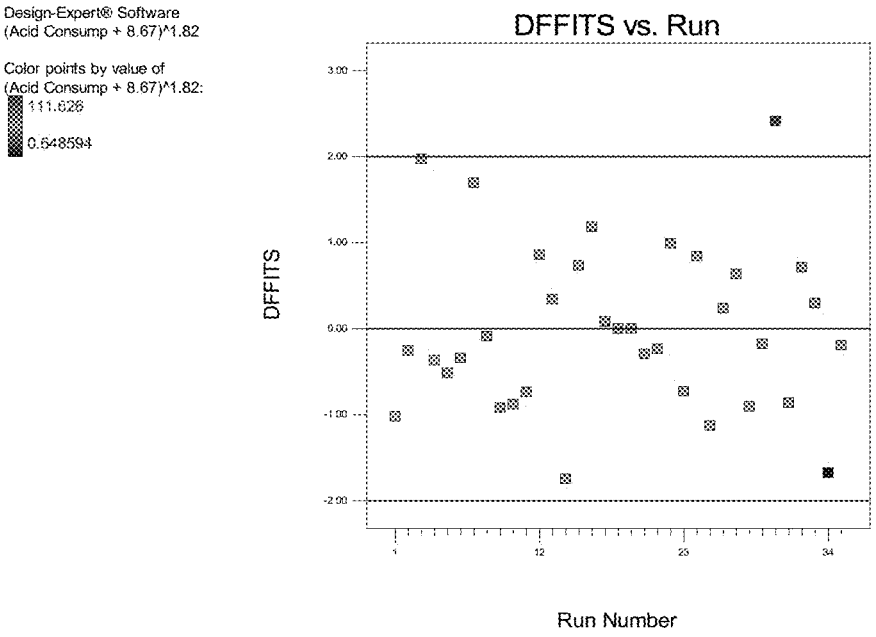

FIG. 209: Stat-Ease DFFITS vs. Run for acid consumption model.

Figure 210:
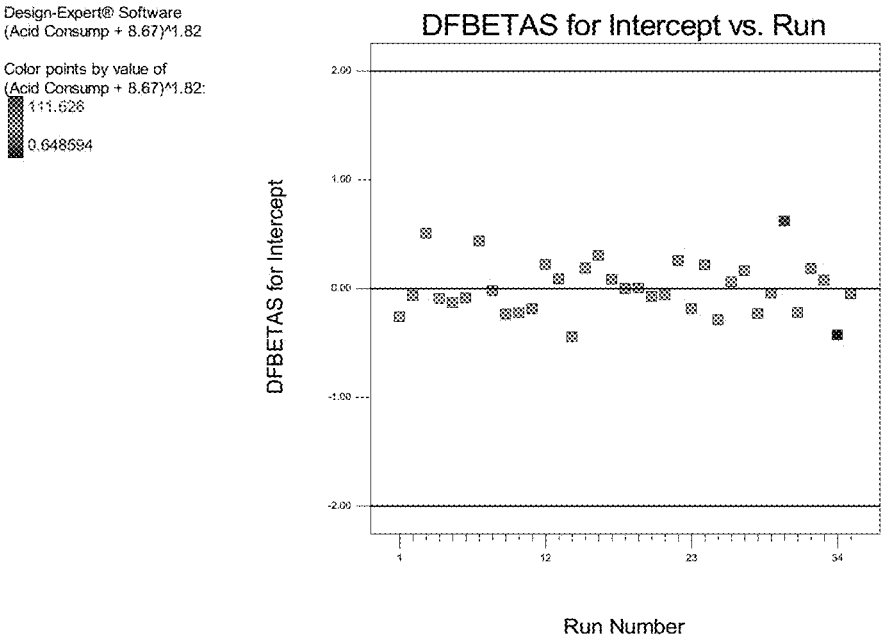

FIG. 210: Stat-Ease DFBETAS for Intercept vs. Run for acid consumption model.

Figure 211:
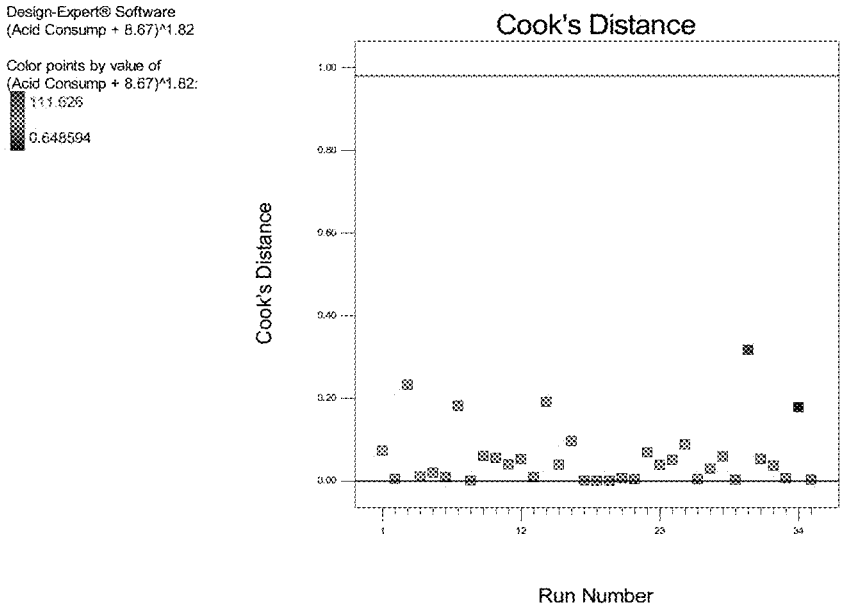

FIG. 211: Stat-Ease Cook's Distance for acid consumption model.

Figure 212:
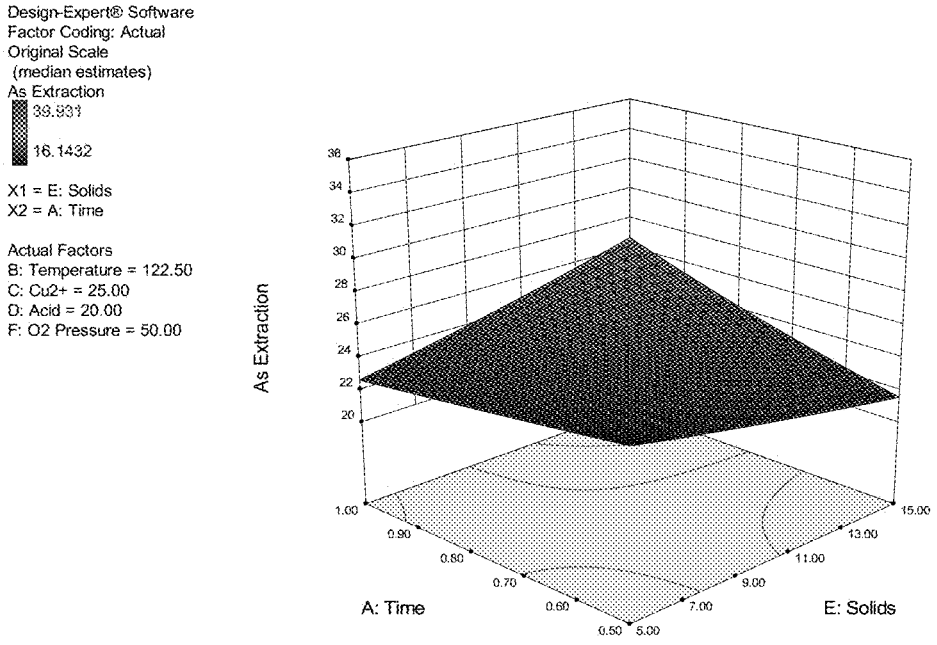

FIG. 212: Stat-Ease 3-D plot of effect of time and solids on arsenic extraction.

FIG. 213: Stat-Ease perturbation plot for arsenic extraction model.

FIG. 214: Stat-Ease solids factor plot for arsenic extraction model.

Figure 215:
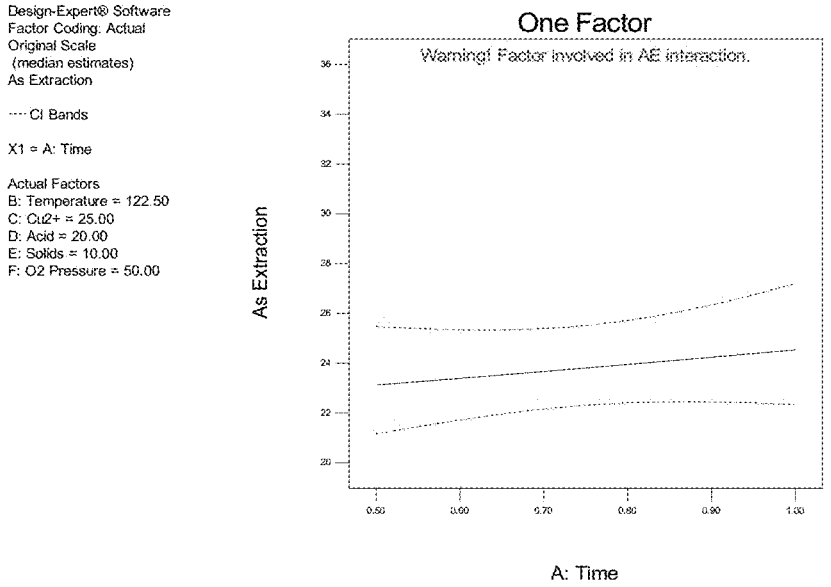

FIG. 215: Stat-Ease time factor plot for arsenic extraction model.

Figure 216:
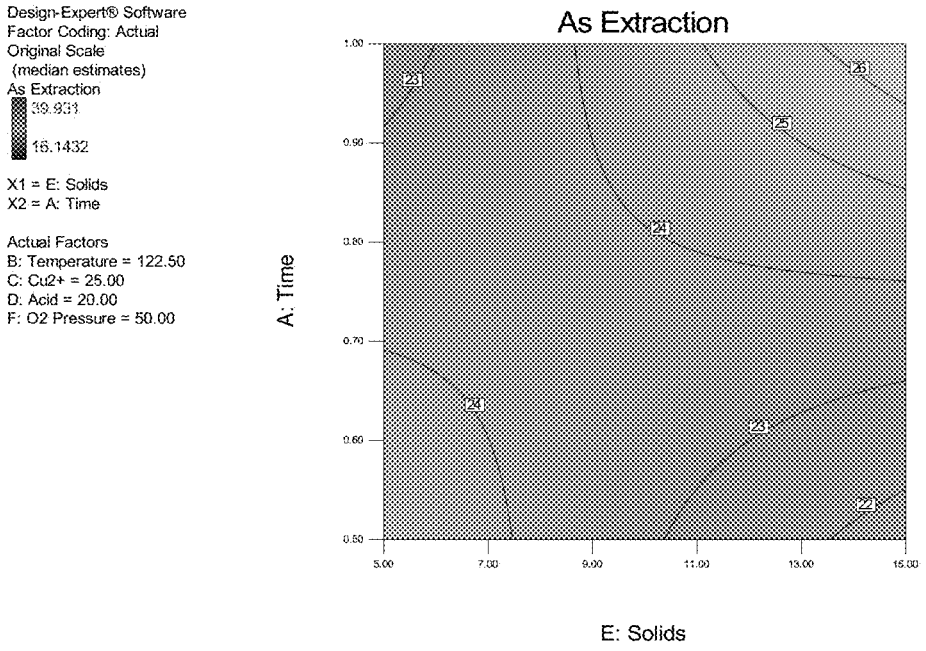

FIG. 216: Stat-Ease time and solids contour plot for arsenic extraction model.

Figure 217:
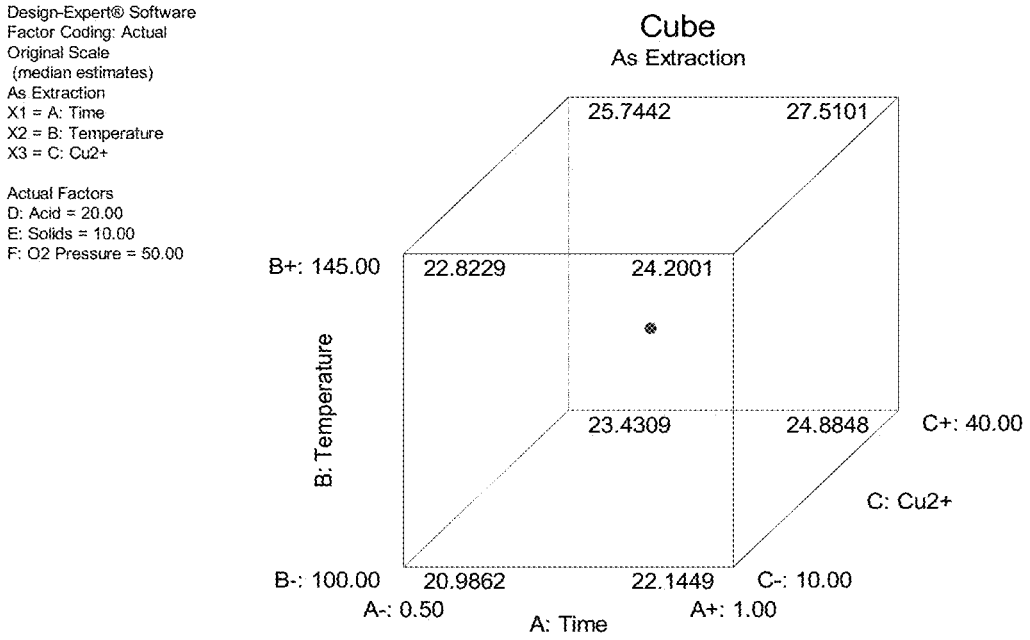

FIG. 217: Stat-Ease cube plot for arsenic extraction model.

Figure 218:
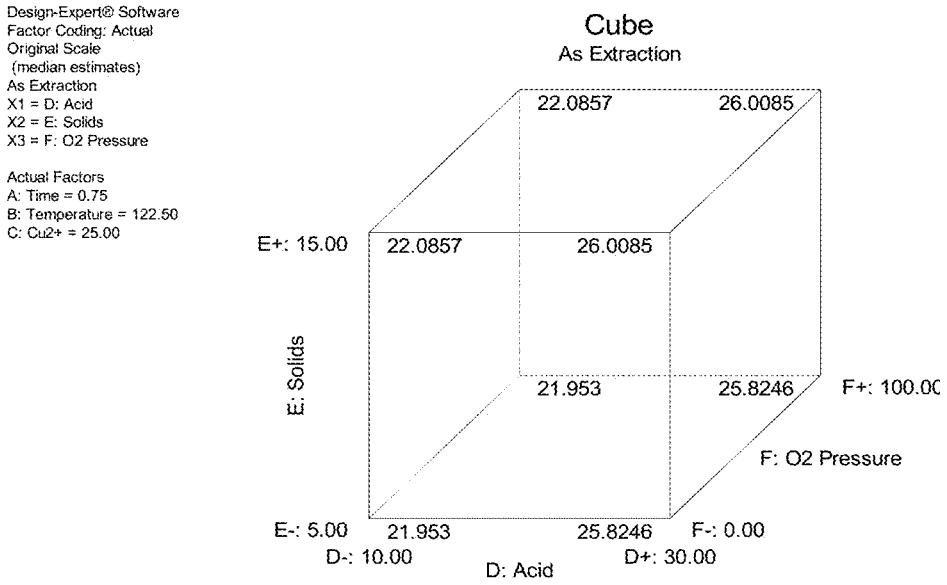

FIG. 218: Stat-Ease cube plot for arsenic extraction model.

DETAILED DESCRIPTION

Chapter 2—Copper Processing

Disclosed herein is a treated ore solid comprising a reduced amount of a contaminant, for example arsenic, compared to the ore solid prior to treatment. Also disclosed are temperature and pressure approaches to treating an ore solid by pressure oxidation leaching of enargite concentrates. The disclosed methods and processes may be applied to copper sulfide orebodies and concentrates containing arsenic. In some cases, the disclosed methods and systems extract contaminants, for example arsenic, from an ore containing solution at moderately increased temperature, pressure, and oxygen concentration, and in the presence of an acid.

The disclosed compositions, methods, and system involve low temperature, low pressure controlled oxygen addition for separation of copper and arsenic. The disclosure provides for the transition of enargite to covellite along with the copper mass balance indicating copper increases in the solid. The process and systems use moderate temperature and pressure with controlled oxygen addition for the separation of copper and arsenic. In some embodiments, the process provides for a transition of enargite to covellite along with the copper mass balance indicate copper increased in the solid and arsenic was leached, reducing the arsenic content in the concentrate. Disclosed compositions include an upgraded copper concentrate that may contain precious metals, and a stabilized arsenic precipitate for disposal. The disclosed processes and systems may be used on copper sulfide orebodies and concentrates containing significant arsenic. The disclosed processes and systems provide for advantages over existing technologies including reducing the arsenic penalty at a smelter, operating at lower temperature and possibly lower oxygen pressure or oxygen consumption.

Previous industrial methods have employed sulfuric acid-oxygen pressure leaching, alkaline sulfide leaching, and roasting. The disclosed approach may include evaluating the chemical reactions taking place and the effects of pressure, temperature, pH and redox potential on the fate of the minerals present in the concentrates as well as creating a fundamental understanding of the thermodynamics, kinetics and mineralogy aspects of the system. Applicants disclose the development and confirmation of an innovative, alternative approach to selectively upgrade enargite concentrates to recover the copper, gold and silver values while selectively leaching the arsenic. Also described are thermodynamic, kinetic and optimization studies of the disclosed method utilizing a bench scale batch autoclave. In these studies, enargite concentrate minerals were characterized before and after the experiments to determine any changes in mineralogy, composition and morphology. In one embodiment, the disclosed pressure oxidation process resulted in arsenic extraction of up to 47%. Mineralogically, the leached residues showed higher pyrite content than the feed sample by 6.5-15 weight percent with a slight decrease in the enargite content. Iron content increased in the solid leach residues by 1-3 weight percent, copper decreased slightly by 1-3 weight percent, and arsenic decreased about 1.5 weight percent. There was an apparent change and qualitative increase in copper mineral phases other than enargite indicating a possible separation of arsenic from copper. For example, in PDX Test #33 with the highest arsenic extraction, the copper mass balance gain in the solids was about 12.5%, which would increase the amount paid for copper from the concentrate sent to the smelter. In summary, the propensity for moderate temperature selective pressure oxidation for separation of arsenic from enargite appears to be promising.

2.1 Background of Copper

The name copper comes from the Latin cuprum, from the island of Cyprus and is abbreviated as Cu. The discovery of copper dates from prehistoric times and is said to have been mined for more than 5000 years. It is one of the most important metals used by man (Haynes and Lide 2011).

Metallic copper will occur occasionally in nature so it was known to man about 10,000 B.C. It has been used for many things including jewelry, utensils, tools and weapons. Use increased gradually over the years and in the $20^{th}$ century with electricity it grew dramatically and continues today with China's industrialization (Schlesinger et al. 2011).

FIG. 2 below shows the dramatic increase in the world production of copper since 1900, and FIG. 3: shows Goldman Sachs copper supply/demand balance ("Europe: Metals & Mining: Base Metals" 2012).

A comparison of world supply and demand of copper is presented below since 2006 and estimated through 2016, which was compiled by Goldman Sachs Global Investment Group.

TABLE 2.1

Goldman Sachs Copper Supply/Demand Balance ("Europe: Metals & Mining: Base Metals" 2012)

| Refined copper supply/ demand balance (kt) | 2006 | 2007 | 2008 | 2009 | 2010 | 2011 | 2012E |
|---|---|---|---|---|---|---|---|
| Consumption | | | | | | | |
| Developmed Markets | 9,391 | 9,067 | 8,475 | 6,967 | 7,426 | 7,321 | 7,219 |
| China | 3,606 | 4,777 | 5,050 | 6,373 | 7,200 | 7,628 | 8,048 |
| Other Emerging Markets | 3,970 | 4,176 | 4,270 | 3,578 | 3,926 | 4,151 | 4,151 |
| Total global consumption | 16,967 | 18,020 | 17,795 | 16,918 | 18,552 | 19,100 | 19,589 |
| % change y/y | 1.9% | 6.2% | −1.3% | −4.9% | 9.7% | 3.0% | 2.5% |
| Production | | | | | | | |
| Mine production | 15,167 | 15,699 | 15,680 | 15,994 | 16,117 | 15,841 | 16.584 |
| % change y/y | 1.3% | 3.5% | −0.1% | 2.0% | 0.8% | −1.7% | 4.7% |
| Total refined copper production | 17,232 | 17,853 | 18,116 | 18,141 | 18,778 | 18,845 | 19,516 |
| % change y/y | 4.6% | 3.6% | 1.5% | 0.1% | 3.5% | 0.4% | 3.6% |

TABLE 2.1-continued

| | | | | | | | |
|---|---|---|---|---|---|---|---|
| Global Balance-surplus/(deficit) | 265 | (167) | 321 | 1,223 | 226 | (255) | (70) |
| Total reported inventory | 592 | 565 | 713 | 978 | 864 | 867 | 797 |
| Reported stocks (days consumption) | 12.7 | 11.4 | 14.6 | 21.1 | 17.0 | 16.6 | 14.8 |
| Price forecast | | | | | | | |
| US$/t | 6,735 | 7,139 | 6,957 | 5,145 | 7,532 | 8,829 | 8,378 |
| USc/lb | 306 | 324 | 316 | 233 | 342 | 400 | 380 |

| Refined copper supply/ demand balance (kt) | 2013E | 2014E | 2015E | 2016E | CAGRs '11-'16 | CAGRs '06-'11 |
|---|---|---|---|---|---|---|
| Consumption | | | | | | |
| Developmed Markets | 7,441 | 7,636 | 7,753 | 7,842 | 1.4% | −4.9% |
| China | 8,651 | 9,257 | 9,905 | 10,598 | 6.8% | 16.2% |
| Other Emerging Markets | 4,574 | 4,810 | 5,060 | 5,353 | 5.2% | 0.9% |
| Total Global Consumption | 20,666 | 21,703 | 22,718 | 23,793 | 4.5% | 2.4% |
| % change y/y | 5.5% | 5.0% | 4.7% | 4.7% | | |
| Production | | | | | | |
| Mine production | 17,714 | 18,647 | 19,235 | 20,046 | 4.8% | 0.9% |
| % change y/y | 6.8% | 5.3% | 3.2% | 4.2% | | |
| Total refined copper production | 20,838 | 21,934 | 22,724 | 23,732 | 4.7% | 1.8% |
| % change y/y | 6.8% | 5.3% | 3.6% | 4.4% | | |
| Global Balance-surplus/(deficit) | 171 | 231 | 6 | (61) | | |
| Total reported inventory | 969 | 1199 | 1205 | 1144 | | |
| Reported stocks (days consumption) | 17.1 | 20.2 | 19.4 | 17.6 | | |
| Price forecast | | | | | Long-term (2017$ nominal) | |
| US$/t | 7,496 | 7,606 | 7,716 | 7,937 | 7,000 | |
| USc/lb | 340 | 345 | 350 | 360 | 318 | |

2.1.1 Sources of Copper

Copper occasionally occurs in its native form and is found in many minerals such as cuprite, malachite, azurite, chalcopyrite and bornite. Large copper ore deposits are found in the U.S., Chile, Zambia, Zaire, Peru and Canada. The most important copper ores are the sulfides, oxides and carbonates (Haynes and Lide 2011).

World copper mine production is primarily in the western mountain (Andes) region of South America. The remaining production is scattered around the world (Schlesinger et al. 2011).

The primary copper smelters of the world in 2010 compared to those in 2002 are shown in the FIGS. 4 and 5.

2.1.2 Properties of Copper

Copper has an atomic number of 29 on the periodic table with an atomic weight of 63.546 grams/mole. It has a freezing point of 1084.62° C. and a boiling point of 2562° C. The specific gravity of copper is 8.96 at 20° C., a valence of +1 or +2, atomic radius of 128 pm and an electronegativity of 1.90. Copper is reddish colored, takes on a bright metallic luster, and is malleable, ductile, and a good conductor of heat and electricity, second only to silver in electrical conductivity. It is soluble in nitric acid and hot sulfuric acid. Natural copper contains two isotopes. Twenty-six other radioactive isotopes and isomers are known (Haynes and Lide 2011; Perry and Green 2008).

2.1.3 Applications of Copper

The electrical industry is one of the greatest users of copper. Its alloys, brass and bronze have been used for a long time and are still very important. All American coins are now copper alloys, and monel and gun alloys also contain copper. The most important compounds are the oxide and the sulfate, blue vitriol. Blue vitriol has wide use as an agricultural poison and as an algicide in water purification. Copper compounds such as Fehling's solution are widely used in analytical chemistry in tests for sugar. High-purity copper (99.999+%) is readily available commercially. The price of commercial copper has fluctuated widely (Haynes and Lide 2011). The average price of LME high-grade copper in 2011 was $4.00 per pound (Edelstein 2012). Shown in FIG. 6 is the historical copper price.

2.2 Background to Copper Ore Processing and Copper Extraction

Copper minerals are approximately 0.5 to 2% Cu in the ore and as a result, are not eligible for direct smelting from an economic perspective. Ores that will be treated pyrometallurgically are usually concentrated resulting in a sulfide concentrate containing approximately 30% copper prior to smelting. By comparison, ores treated hydrometallurgically are not commonly concentrated since copper is usually extracted by leaching ore that has only been blasted or crushed.

Most of the copper present in the earth's crust exists as copper-iron-sulfides and copper sulfide minerals such as chalcopyrite ($CuFeS_2$), bornite ($Cu_5FeS_4$) and chalcocite ($Cu_2S$). Copper also occurs in oxidized minerals as carbonates, oxides, hydroxy-silicates, and sulfates, but to a lesser extent. Copper metal is usually produced from these oxidized minerals by hydrometallurgical methods such as heap or dump leaching, solvent extraction and electrowinning. Hydrometallurgy is also used to produce copper metal from chalcocite, $Cu_2S$, oxides, silicates and carbonates.

Another major source of copper is from scrap copper alloys. Production of copper from recycled used objects is 10 or 15% of mine production. In addition, there is considerable re-melting/re-refining of scrap generated during fabrication and manufacture.

A majority of the world's copper-from-ore originates in Cu—Fe—S ores. Cu—Fe—S minerals are not easily dissolved by aqueous solutions by leaching, so most copper extraction from these minerals is pyrometallurgical. The extraction entails:

(a) isolating an ore's Cu—Fe—S(and Cu—S) mineral particles into a concentrate by froth flotation
(b) smelting this concentrate to molten high-Cu matte
(c) converting the molten matte to impure molten copper
(d) fire- and electrorefining this impure copper to ultra-pure copper.

The objective of the smelting is to oxidize S and Fe from the Cu—Fe—S concentrate to produce a Cu-enriched molten sulfide phase (matte). The oxidant is commonly oxygen-enriched air.

Example reactions for smelting are:

$$2CuFeS_2+13/4O_2 \rightarrow Cu_2S.\tfrac{1}{2}FeS+3/2FeO+5/2SO_2 \quad (2.1)$$

$$2FeO+SiO_2 \rightarrow 2FeO.SiO_2 \quad (2.2)$$

The enthalpies of the reactions above, respectively are:

$$\Delta H^0_{25^\circ C.} = -450\frac{MJ}{\text{kg mol } CuFeS_2} \quad (2.3)$$

and $$\Delta H^0_{25^\circ C.} = -20\frac{MJ}{\text{kg mol FeO}}. \quad (2.4)$$

$SO_2$-bearing offgas (10-60% $SO_2$) is also generated during smelting and is harmful to the environment so it should be removed before the offgas is released to the atmosphere. This is commonly done by capturing the $SO_2$ as sulfuric acid.

Many anode impurities from electrorefining are insoluble in the electrolyte such as gold, lead, platinum metals and tin so they are collected as 'slimes' and treated for Cu and byproduct recovery. Other impurities such as arsenic, bismuth, iron, nickel and antimony are partially or fully soluble. They do not plate with the copper though at the low voltage of the electrorefining cell. They should be kept from accumulating in the electrolyte to avoid physical contamination of the copper cathode by continuously bleeding part of the electrolyte through a purification circuit (Davenport et al. 2002).

As mentioned before, most of copper from ore is obtained by flotation, smelting and refining. The rest is obtained though hydrometallurgical extraction by:

(a) sulfuric acid leaching of copper from broken or crushed ore in heaps, stockpiles, vats, agitated tanks or under pressure to produce Cu-bearing aqueous solution
(b) transfer of Cu from this solution to pure, high-Cu electrolyte via solvent extraction, if necessary
(c) electrowinning pure cathode copper from this pure electrolyte.

Ores most commonly treated this way include 'oxide' copper minerals such as carbonates, hydroxy-silicates, sulfates and hydroxy-chlorides and chalcocite, $Cu_2S$.

The leaching is performed by sprinkling dilute sulfuric acid on top of heaps of broken or crushed ore with a lower copper content than that which is concentrated and sent to smelting. The acid trickles through the heap to collection ponds over several months.

Oxidized minerals are rapidly dissolved by sulfuric acid by reactions like:

$$CuO+H_2SO_4 \rightarrow Cu^{2+}+SO_4^{2-}+H_2O. \quad (2.5)$$

Sulfide minerals, on the other hand, require oxidation:

$$Cu_2S+5/2O_2+H_2SO_4 \rightarrow 2Cu^{2+}+2SO_4^{2-}+H_2O. \quad (2.6)$$

The copper in electrowinning electrolytes is recovered by plating pure metallic cathode copper. Pure metallic copper with less than 20 ppm undesirable impurities is produced at the cathode and gaseous $O_2$ at the anode (Davenport et al. 2002).

As well, concentrates comprised of chalcopyrite and enargite can be treated by sulfidation with elemental sulfur at 350-400° C. to transform the chalcopyrite to covellite and pyrite without transforming the enargite by:

$$CuFeS_2(s)+Cu_3AsS_4(s)+\tfrac{1}{2}S_2(g) \rightarrow CuS(s)+FeS_2(s)+Cu_3AsS_4(s). \quad (2.7)$$

The results of this work showed that temperature had the largest effect on the dissolution rate of copper and arsenic (Padilla, Vega, and Ruiz 2007).

2.2.1 Other Hydrometallurgical Extraction Processes

Pressure oxidation provides another process option when smelting and refining costs are high and variable, smelting capacity is limited and provides a better economic alternative to installing new smelting capacity. When kinetics in a heap leach are too slow, the elevated temperature and pressure affect both the thermodynamics and kinetics of leaching (Schlesinger et al. 2011). These processes are discussed further in Section 2.3.

2.2.2 Copper Metathesis

The leaching of Cu—Ni—Co mattes from pyrometallurgical operations is performed by four processes: metathetic leaching; sulfuric oxidative leaching; hydrochloric chlorine leaching ($ClH+Cl_2$); and ammoniacal oxidative leaching. They allow selective dissolution of nickel sulfide.

Metathetic leaching is represented by the reaction:

$$MeS(s)+CuSO_4 \rightarrow MeSO_4+CuS(s)\downarrow \quad (2.8)$$

The driving force for this reaction is the lower solubility of copper sulfide.

This process is used as the first stage of the processing of the INCO's pressure carbonyl residue. The residue is leached at an elevated temperature while under pressure with sulfuric acid and copper sulfate. The sulfides and Ni, Co, Fe metals are dissolved by the metathetic reaction and the cementation reactions. The $Cu_2S$ passes through this leaching step unchanged (Vignes 2011).

The ability of nickel-copper matte to precipitate $Cu^{2+}$ ions is well known. The general consensus in the modern literature is on the overall reaction (metathesis):

$$Ni_3S_2+2Cu^{2+} \rightarrow Cu_2S+NiS+2Ni^{2+}. \quad (2.9)$$

The reaction proceeds when hydrogen ions are present and accelerate with increasing acid concentration. The generally accepted reaction is:

$$Ni_3S_2+2H^++0.5O_2 \rightarrow 2NiS+Ni^{2+}+H_2O. \quad (2.10)$$

Work carried out at Sherritt Gordon has indicated that the reaction above proceeds stepwise:

$$3Ni_3S_2+4H^++O_2 \rightarrow Ni_7S_6+2Ni^{2+}+H_2O \quad (2.11)$$

$$Ni_7S_6+2H^++0.5O_2 \rightarrow 6NiS+Ni^{2+}+H_2O. \quad (2.12)$$

Ferrous ion is released into solution and is rapidly reduced to the ferrous state and assumed to act as an electron carrier and enhance the leaching rate:

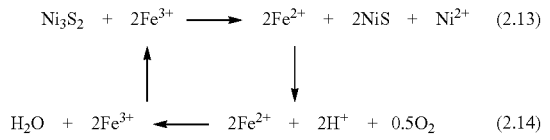

$$Ni_3S_2 + 2Fe^{3+} \longrightarrow 2Fe^{2+} + 2NiS + Ni^{2+} \quad (2.13)$$

$$H_2O + 2Fe^{3+} \longleftarrow 2Fe^{2+} + 2H^+ + 0.5O_2 \quad (2.14)$$

Copper metathesis ceases at a pH of about 2.5. At pH values above 2-2.5 the reactions of iron dissolution and its reduction to the ferrous state appear to cease and the ferrous ion is oxidized to the ferric ion by the oxygen in air:

$$2Fe^{2+}+2H^++0.5O_2 \rightarrow 2Fe^{3+}+H_2O \quad (2.15)$$

The ferric ion becomes unstable above a pH of 3.5 and begins to hydrolyze to ferric hydroxide or basic ferric sulfate:

$$Fe^{3+}+3H_2O \rightarrow Fe(OH)_3+H^+ \quad (2.16)$$

$$Fe^{3+}+HSO_4^-+H_2O \rightarrow Fe(OH)SO_4+2H^+ \quad (2.17)$$

Under normal operating conditions iron hydrolysis is completed at a pH of 4.5-5 and the residual iron in solution is generally below 10 mg/l. At a residual iron concentration in solution below 0.1 g/l, the pH rises above the stability of the cupric ion, which hydrolyzes to form basic cupric sulfate $Cu_3(OH)_4SO_4$:

$$3Cu^{2+}+HSO_4^-+4H_2O \rightarrow Cu_3(OH)_4SO_4+5H^+ \quad (2.18)$$

The reaction releases acid into solution, which is consumed by the unreacted $Ni_3S_2$ or $Ni_7S_6$. Good aeration is required to promote hydrogen ion removal and shift the equilibrium in favor of precipitation.

At a residual copper concentration in solution below 0.05 g/l, hydrogen ion production by hydrolysis becomes slower than its removal, and the pH rapidly rises to maximum of 6.5-6.7. At this pH, basic nickel sulfates may start to precipitate (Hofirek and Kerfoot 1992).

2.3 Background of Pressure Hydrometallurgy

Habashi divides pressure hydrometallurgy into two areas: leaching and precipitation. Pressure leaching has been used commercially both in the absence of oxygen and in the presence of oxygen and applied in the copper industry. These leaching processes involve removing the metal through oxidation as an ion in solution. Precipitation described by Habashi is a reduction process. He describes the developments of pressure hydrometallurgy in detail as shown in the table below (Habashi 2004).

TABLE 2.2

Historical Developments in Pressure Hydrometallurgy (Habashi 2004)

| Type | Year | | Location | Reaction |
|---|---|---|---|---|
| Precipitation | 1859 | Nikolai N. Beketoff | France | $2Ag^+ + H_2 \rightarrow 2Ag + 2H^+$ |
| | 1900 | Vladimir N. Ipatieff | Russia | $M^{2+} + H_2 \rightarrow M + 2H^+$ |
| | 1903 | G.D. Van Arsdale | USA | $Cu^{2+} + SO_2 + 2H_2 \rightarrow Cu + 4H^+ + SO_4^{2-}$ |
| | 1909 | A. Jumau | France | $CuSO_4 + (NH_4)_2SO_3 + 2NH_3 + H_2O \rightarrow Cu + 2(NH_4)_2SO_4$ |
| | 1952 | H.A. Pray, et al. | USA | Solubility of hydrogen in water at high temperature and pressure |
| | 1952 | CHEMICO/Howe Sound, National Lead | USA | $Ni^{3+} + H_2 \rightarrow Ni + 2H^+$<br>$Co^{2+} + H_2 \rightarrow Co + 2H^+$<br>$Cu^{2+} + H_2 \rightarrow Cu + 2H^+$ |
| | 1952 | CHEMICO/Freeport | USA | $Ni^{2+} + H_2S \rightarrow NiS + 2H^+$<br>$Co^{2+} + H_2S \rightarrow CoS + 2H^+$ |
| | 1955 | Sherritt-Gordon | Canada | $[Ni(NH_3)_2]^{2+} + H_2 \rightarrow Ni + 2NH_4^+$ |
| | 1960 | Bunker Hill | USA | $PbS + 2O_2 \rightarrow PbSO_4$<br>$ZnS + 2O_2 \rightarrow ZnSO_4$ |
| | 1970 | Benilite | USA | $FeTiO_3 + 2HCl \rightarrow FeCl_2 + TiO_2 + H_2O$ |
| | 1970 | Anaconda | USA | $Cu_2SO_3 \cdot (NH_4)_2SO_3 \rightarrow 2Cu + SO_2 + 2NH_4^+ + SO_4^{2-}$ |
| Leaching | 1892 | Karl Josef Bayer | Russia | $Al(OH)_3 + OH^- \rightarrow [Al(OH)_4]^-$ |
| | 1903 | M. Malzac | France | $MS + 2O_2 + nNH_3 \rightarrow [M(NH_3)_n]^{3+} + SO_4^{2-}$ |
| | 1927 | F.A. Henglein | Germany | $ZnS + 2O_2 \rightarrow Zn^{2+} + SO_4^{2-}$ |
| | 1940 | Mines Branch | Canada | $UO_3 + 3CO_3^{2-} + \frac{1}{3}O_2 + H_2O \rightarrow [UO_2(CO_3)_3]^{4-} + 2OH^-$ |
| | 1952 | H.A. Pray, et al. | USA | Solubility of hydrogen in water at high temperature and pressure |
| | 1952 | CHEMICO/Calera | USA | $CoAsS + \frac{7}{3}O_2 + H_2O \rightarrow Co^{3+} + SO_4^{2-} + AsO_4^{5-} + 2H^+$ |
| | 1952 | CHEMICO/Freeport Nickel | USA | $NiO$ (in laterite) $+ H_2SO_4 \rightarrow NiSO_4 + H_2O$ |
| | 1955 | Sherritt-Gordon | Canada | $NiS + 2O_2 + 2NH_3 \rightarrow [Ni(NH_3)_2]^{2+} + SO_4^{2-}$ |
| | 1975 | Gold industry | World-wide | $2FeS_2 + 7\frac{1}{2}O_2 + 4H_2O \rightarrow Fe_2O_3 + 4SO_4^{3-} + 8H+$ |
| | 1980 | Sherritt-Gordon | Canada | $ZnS + 2H^+ + \frac{1}{2}O_2 \rightarrow ZN^{2+} + S + H_3O$ |
| | 2004 | Phelps Dodge | USA | $4CuFeS_2 + 17O_2 + 4H_2O \rightarrow 4CuSO_4 + 2Fe_2O_3 + 4H_2SO_4$ |

2.3.1 Copper Concentrate Pressure Oxidation and Leaching

Chalcopyrite ($CuFeS_2$) is the most abundant of the copper sulfides and the most stable because of its structural configuration having a face-centered tetragonal lattice, as a result it is very refractory to hydrometallurgical processing. Recovery of copper from chalcopyrite involves froth flotation that produces a concentrate of the valuable metal sulfides which is smelted and electrorefined to produce copper. Treating chalcopyrite concentrates hydrometallurgically has received increasing attention over the last several decades.

The many different processing options are discussed in the following sections.

2.3.2 Acidic Pressure Oxidation

Freeport-McMoRan Copper & Gold has developed a sulfate-based pressure leaching technology for the treatment of copper sulfide concentrates. The main drivers for the activity were the relatively high and variable cost of external smelting and refining capacity, the limited availability of smelting and refining capacity and the need to cost-effectively generate sulfuric acid at mine sites for use in stockpile leaching operations. Freeport was looking to treat chalcopyrite concentrates with this technology. FMI developed both high and medium temperature processes. The following chemistry provides detail on chalcopyrite oxidation in the presence of free acid at medium temperatures, meaning above 119° C. and below 200° C., showing that some of the sulfide sulfur is converted to molten elemental sulfur:

$$4CuFeS_2+5O_2+4H_2SO_4 \rightarrow 4Cu^{2+}+4SO_4^{2-}+2Fe_2O_3+8S^0+4H_2O \quad (2.19)$$

but, under these conditions, oxidation may also occur by:

$$4CuFeS_2+17O_2+2H_2SO_4 \rightarrow 4Cu^{2+}+10SO_4^{2-}+4Fe^{3+}+2H_2O. \quad (2.20)$$

It should be noted that the first reaction consumes approximately 70% less oxygen per mole of chalcopyrite oxidized that the latter but the second reaction requires less acid. Pressure leaching sulfide minerals at temperatures above the melting point of sulfur at 119° C., but below 200° C., is complicated by the relationship between sulfur viscosity and temperature, which can be seen in the figure in FIG. 7. The sulfur tends to wet sulfide surfaces and may agglomerate to form "prills" (J. O. Marsden, Wilmot, and Hazen 2007a).

Work has also been performed by Anaconda Copper Company on ores from the Butte, Mont. area to evaluate the possibility of converting chalcopyrite to digenite at about 200° C. to upgrade and clean the concentrate to the point where it could be shipped as a feed to a copper smelter. They showed that this reaction is possible and a significant amount of the iron and arsenic (along with other impurities) were removed from the solid product while retaining the majority of the copper, gold and silver in the concentrate. The upgrading process also results in lower mass of concentrate to ship thereby decreases shipping costs. Primarily, the process consists of chemical enrichment that releases iron and sulfur from the chalcopyrite, followed by solid-liquid separation with treatment of the liquid effluent. This is followed by flotation with recycle of the middling product back to the enrichment process and rejection of the tailing. The resultant product is digenite formed as a reaction product layer around the shrinking core of each chalcopyrite grain by the following reaction:

$$1.8CuFeS_2+0.8H_2O+4.8O_2=Cu_{1.8}S+1.8FeSO_4+0.8H_2SO_4. \quad (2.21)$$

In this work, about 80% of the zinc impurities reported to the liquor while arsenic, bismuth and antimony were evenly distributed between the discharge liquor and the enriched product. Gold, silver and selenium followed the copper. (Bartlett et al. 1986; Bartlett 1992). This cleaned concentrate may also be utilized in a cyanidation-SART type process. It may also be possible to perform a similar process on enargite concentrates at lower pressure and using less acid.

2.4 Alkaline Sulfide Leaching

Other work has indicated that leaching with sodium sulfide in 0.25 molar NaOH at 80-105° C. will dissolve sulfides of arsenic, antimony and mercury. Enargite is solubilized by the following reaction (Nadkarni and Kusik 1988; C. G. Anderson 2005; C. Anderson and Twidwell 2008):

$$2Cu_3AsS_4+3Na_2S=2Na_3AsS_4+3Cu_2S. \quad (2.22)$$

In the case of gold-bearing enargite concentrates, leaching with basic $Na_2S$ has been shown to selectively solubilize the arsenic and some gold but does not affect the copper. The copper is transformed in the leach residue to a species $Cu_{1.5}S$ and the gold is partly solubilized in the form of various anionic Au—S complexes. The gold and arsenic could then be recovered from solution (Curreli et al. 2009).

2.5 Example Copper Hydrometallurgical Processes

Many processes have been developed over the last few decades for the hydrometallurgical extraction of copper from chalcopyrite. Processes using various lixiviants, including ammonia, chloride, chloride-enhanced, alkaline sulfide leaching, nitrogen species catalyzed pressure leaching and sulfate have been receiving attention and are discussed below. Problems with these processes for chalcopyrite include how to overcome a passivating sulfur layer forming on the mineral surfaces during leaching and how to deal with excess sulfuric acid or elemental sulfur production (Wang 2005).

2.5.1 Ammonia

Ammonia leaching was first applied at Kennecott, Ak. in 1916 on gravity concentration tailings of a carbonate ore and on gravity tailings from a native copper ore at Calumet and Hecla, Mich. By driving off the ammonia through steaming, both recovered copper oxide (Arbiter and Fletcher 1994). The Anaconda Arbiter Process, which has been shut down, and the Sherritt Gordon process treat concentrates using low pressure and temperature, but are expensive. Flowsheets for both processes are shown in FIG. 8.

The Anaconda Arbiter Process leached using ammonia in vessels at 5 psig with oxygen to dissolve copper from sulfide concentrates which is concentrated and then purified using ion exchange and is then electrowon (Chase and Sehlitt 1980).

Sherritt Gordon developed two potential processes which were successfully piloted at Fort Saskatchewan. One, shown in FIG. 9, was based on ammoniacal pressure oxidation leaching, followed by recovery of the copper as powder from solution using hydrogen with byproduct ammonium sulfate. The second process leached used sulphuric acid oxidation and produces elemental sulphur as a byproduct (Chalkley et al.).

2.5.2 Chloride

Using a chloride system provides the possibility of a direct leach at atmospheric pressure and recovery of sulfur, gold and PGMs. Many metal chlorides are considerably more soluble than their sulfate salts allowing the use of more concentrated solutions and there can be effective recycling of leachant. Electrowinning can be performed in diaphragm cells theoretically requiring less energy but with low copper recovery.

Typically chlorides of metals in a higher valence state, such as ferric or cupric chloride, will leach metals from their sulfides because oxidation is necessary. Of the many chloride routes, ferric chloride ($FeCl_3$) leaching of chalcopyrite concentrates received significant attention. The processes developed by Duval Corporation (CLEAR), Imperial Chemical Industries, Technicas Reunidas and the Nerco Minerals Company (Cuprex), Cyprus Metallurgical Processes Corporation (Cymet), as well as Intec Limited (Intec) and Outotec (HydroCopper) have demonstrated significant potential for the production of copper by the chloride leaching process (Wang 2005).

Acidified cupric chloride-bearing brine solutions have been used as a leachant for copper sulfides, complex metal sulfides, and metal scraps. A flow chart is shown in FIG. 10. This process is based on four basic steps. The first is leaching at 105° C. and ambient pressure to dissolve copper and iron:

$$CuFeS_2+3Cu^{2+}\rightarrow 4Cu^{+}+Fe^{2+}+2S \quad (2.1)$$

The second is treatment of the residue for elemental sulfur recovery and purification of leach liquor by precipitating impurity elements as hydroxides. The third step is electrolysis in a diaphragm cell to deposit copper from the cathode and regenerate the leachant in the anolyte. The fourth and final step is recycling of the anolyte as a leaching agent. Success is highly dependent on achieving a high leaching efficiency with minimum reagent consumption and conversion of most of the cupric chloride to cuprous chloride (Gupta and Mukherjee 1990).

The principal chemical reactions in the ferric chloride leaching of chalcopyrite concentrate are shown below.

$$CuFeS_2+3FeCl_3\rightarrow CuCl+4FeCl_2+2S^0 \quad (2.2)$$

$$CuFeS_2+4FeCl_2\rightarrow CuCl_2+5FeCl_2+2S^0 \quad (2.3)$$

The corresponding reactions for $CuCl_2$ attack are shown below.

$$CuFeS_2+3CuCl_2\rightarrow 4CuCl+FeCl_2+2S^0 \quad (2.4)$$

$$S^0+4H_2O+6CuCl_2\rightarrow 6CuCl+6HCl+H_2SO_4 \quad (2.5)$$

The Intec process involves a four-stage countercurrent leach with chloride/bromide solution at atmospheric pressure. Leach residue is filtered and discharged from stage 4 to waste, while copper-rich pregnant liquor leaves stage 1. Gold and silver are solubilized along with copper. Gold is recovered from solution through a carbon filter, and silver is cemented along with mercury ions to form an amalgam. Both of these are then further treated. Impurities in the liquor are precipitated with lime and removed by filtration. The purified copper solution is electrowon to produce pure copper metal and to regenerate the solution for recycling in leaching. An extremely important feature of the process is that heat is provided by the exothermic leach reactions. This, along with the flow of air in leaching, evaporates water and keeps the water balance close to neutral so no liquid effluent is produced from the plant. Another equally important note is that all impurities including mercury are either recovered or stabilized (Wang 2005).

The chloride/bromide chemistry in the Intec process provides a strong oxidant at nearly ambient (85° C., atmospheric pressure) conditions. This process for has been run at demonstration plant scale for copper. The Intec process flowsheet is shown in FIG. 11 (Milbourne et al. 2003).

The CLEAR process was developed by Duval Corporation as a new approach to copper sulfide concentrate processing. CLEAR is an acronym for the processing steps—Copper Leach Electrolysis And Regeneration. It is designed to solubilize copper in a recycling chloride solution; to electrolytically deposit metallic copper with any associated silver; to discharge a residue of elemental sulfur, iron and all else associated with the copper minerals and to do so without solid, liquid or gaseous pollution. The aqueous solutions of certain metal chloride salts will chemically attack most metal sulfides taking into solution the metals and leaving behind a residue of elemental sulfur. CLEAR has the capability of completely leaching copper and silver values from copper concentrate consisting of any combination of copper sulfide and/or copper-iron-sulfide mineralization. A process flowsheet is shown in FIG. 12 (Atwood and Livingston 1980).

The Cuprex process leaches chalcopyrite concentrate at atmospheric pressure with ferric chloride solution in two stages. The pregnant liquor containing copper, iron, and minor impurities, mainly zinc, lead, and silver, is sent to the extraction stage of the SX circuit. The copper is selectively transferred to the organic phase and the aqueous solution of copper chloride is then sent to the electrolysis section as catholyte, which is fed to the cathode compartment of an EW cell to produce granular copper. Electrowinning of copper from takes place in a diaphragm cell. Chlorine generated at the anode is recovered and used to reoxidize the cuprous chloride generated in the catholyte during EW (Wang 2005).

The Cyprus Copper Process, or Cymet, converts copper concentrates into copper metal. Copper concentrates are dissolved in a ferric chloride—copper chloride solution in a countercurrent two-stage leach as shown in the flowsheet in FIG. 13.

The pregnant solution from the first leach is high in cuprous ion concentration. This solution is cooled and cuprous chloride crystals are precipitated. These crystals are washed, dried and fed to a fluid-bed reactor, where hydrogen reduction takes place. Copper nodules are produced which are suitable for melting, fire-refining and casting into wirebars. The fluidized bed also produces HCl, which is recycled to the wet end of the process where it is mixed with the mother liquor from the crystallizer, reacted with oxygen to regerate ferric and cupric lixiviant, and recycled to the leaching section (McNamara, Ahrens, and Franek 1978).

The Outotec HydroCopper process involves countercurrent leaching of chalcopyrite concentrates using air and chlorine as oxidants as shown below.

$$CuFeS_2+CuCl_2+\tfrac{3}{4}O_2\rightarrow 2CuCl+\tfrac{1}{2}Fe_2O_3+2S \quad (2.6)$$

After leaching, the cuprous bearing solution is oxidized by chlorine to cupric that is recycled back in leaching as shown below.

$$CuCl+\tfrac{1}{2}Cl_2\rightarrow 2CuCl_2 \quad (2.7)$$

The remaining cuprous solution, after purification for silver and impurity removal is treated with sodium hydroxide to precipitate cuprous oxide that is then reduced to metal. The process produces, in a standard chloro-alkali cell, and provides all of the chlorine, sodium hydroxide, and hydrogen needed to operate as shown below (Wang 2005).

$$CuCl+NaOH\rightarrow \tfrac{1}{2}Cu_2O+NaCl+\tfrac{1}{2}H_2O \quad (2.8)$$

$$\tfrac{1}{2}Cu_2O+\tfrac{1}{2}H_2\rightarrow Cu+\tfrac{1}{2}H_2O \quad (2.9)$$

$$2NaCl+2H_2O\rightarrow 2NaOH+Cl_2+H_2 \quad (2.10)$$

A process flowsheet for the process is shown in FIG. 14.

2.5.3 Chloride-Enhanced

Chloride-enhanced processes use chlorine to enhance leaching in another medium. The process should be able to tolerate the chlorine in the system but none have been demonstrated commercially long term.

The Activox process, depicted in FIG. 15, is a mild pressure leaching process employing fine grinding (P80 5-15 micron, 100-110° C., 1000 kPa oxygen). This process has been demonstrated at the continuous pilot plant level (Milbourne et al. 2003). The process uses 4 g/L addition of chlorides as sodium chloride salt solution (Palmer and Johnson 2005).

The CESL process is a low-severity pressure oxidation process where a high portion of sulfide sulfur remains in the elemental form in the leach residue. The process also employs a chloride-enhanced oxidative pressure leach in a controlled amount of acid to convert the copper to a basic copper sulfate salt, the iron to hematite, and the sulfur to elemental sulfur. The CESL process is composed of two leaching stages. First is a pressure oxidation leach and leaching residue is fed to the second atmospheric leach mainly by the reactions shown below.

$$3CuFeS_4+7.5O_2+H_2O+H_2SO_4 \rightarrow CuSO_4.2Cu(OH)_2+1.5Fe_2O_3+6S \quad (2.11)$$

$$CuSO_4.2Cu(OH)_{2(s)}+2H_2SO_4 \rightarrow 3CuSO_{4(aq)}+4H_2O \quad (2.12)$$

Part of the first leach solution is recycled into the autoclave while the rest is mixed with the second leach solution and fed to SX. After SX, stripping, and EW, the process produces high-quality copper cathodes (Wang 2005). The process flowsheet is shown in FIG. 16.

CESL has patented a process for the recovery of gold from the leach residue, which includes the following steps:

- removal of elemental sulfur using a hot perchloroethylene (PCE) leach,
- total oxidation of the remaining sulfides to release refractory gold,
- neutralization, and
- cyanide leaching of the solids for gold recovery.

This process has been extensively tested for copper at demonstration plant scale, but not for copper-nickel (Milbourne et al. 2003).

2.5.4 Nitric/Sulfuric Acid

The Sunshine plant used nitrogen species catalyzed (NSC) sulfuric acid where copper was produced by SX-EW, silver recovered by precipitation as silver chloride, then reduced to silver metal. It offers a non-cyanide approach for gold recovery as well.

In the NSC process, a sulfate leach system is augmented with 2 g/L sodium nitrite. Both total and partial oxidation processes have been proposed. It operates with mild conditions of 125° C., 400 kPa total pressure. The partial oxidation process was commercialized as a batch operation at the Sunshine Mine in Idaho on chalcocite-tetrahedrite minerals (Milbourne et al. 2003). FIG. 17 shows a NSC process flowsheet from Sunshine (Ackerman and Bucans 1986).

2.5.5 Sulfate

Sulfate processes are well established for copper concentrates and ores but tend to require higher temperature and fine grinding. Final copper recovery is by SX-EW and precious metals can be recovered by cyanidation.

The Dynatec process involved oxidative leaching of chalcopyrite concentrate at 150° C. using coal at a modest dosage (25 kg/t of concentrate) as an effective anti-agglomerant. The sulfide oxidation chemistry is similar to the CESL process and produces elemental sufur in a sulfate medium. Coal is used as a source of surfactant for elemental sulfur dispersion. It is likely to dissolve less PGMs than the chloride-enhanced CESL process. A high extraction of copper (98+%) is achieved by either recycling the unreacted sulfide to the leach after flotation and removal of elemental sulfur by melting and filtration or pretreating the concentrates with a fine grinding of P90~25 μm. This process, shown in FIG. 18 has been piloted but not demonstrated; its operating conditions have a good pedigree in zinc leaching (Wang 2005; Milbourne et al. 2003).

The Chelopech mine in Bulgaria proposed the use of PDX at 225° C. and pressure of 3,713 kPa. The autoclave discharge goes to a CCD circuit for solid-liquid separation, allowing subsequent treatment of the solution that contains copper, zinc and other base metals. The gold values are in the solid phase. Solution from the clarifier goes to solvent extraction then electrowinning for copper. Impurities such as arsenic, zinc, iron and others are removed in a separate circuit. The pressure oxidation is a pre-treatment for the ore which is then sent to a CIL circuit for gold recovery. The proposed process flowsheet is shown in FIG. 19.

The Mt. Gordon process is a whole ore, hot acid ferric leach process developed to treat chalcocite ores in Australia. It uses low temperature pressure oxidation to leach copper from the ore followed by SX/EW. Chalcocite is leached to form covellite, and then leached to form soluble copper and elemental sulfur. A total pressure of 7.7 bars and oxygen partial pressure of 4.2 bars are used in an autoclave with about 60 minutes of residence time (Dreisinger 2006; Arnold, Glen, and Richmond 2003) as depicted in FIG. 20.

Kansanshi, shown in FIG. 21, uses a high pressure leach (HPL) to treat copper concentrates in two autoclaves operating at 225° C. Using sulfuric acid and oxygen, chalcopyrite is oxidized to copper sulfate and ferric sulfate. The autoclave discharge is cooled and pumped to an oxide leach circuit where high temperature and ferric ion drive the leaching reaction. This is followed by SX/EW (Chadwick 2011).

The Albion, or Nenatech, shown in FIG. 22, process is another sulfate-based process employing fine grinding (10-15 micron) at mild conditions (85-90° C. atmospheric leach, 24 hours residence time). Oxygen and air sparging are used for oxidation. The process has been demonstrated at the continuous pilot plant level. Mount Isa Mines, the process owners, have said they wish to keep the technology internal for use in their own projects. A flowsheet is shown below (Milbourne et al. 2003).

The Sepon Copper Project in Laos is primarily a chalcocite ore. The autoclave circuit is designed to oxidize a high-grade pyrite concentrate to produce iron and acid. A flowsheet is shown in FIG. 23.

The Galvanox process is a galvanically-assisted atmospheric leach (~80° C.) of chalcopyrite concentrates in a ferric/ferrous sulfate medium to extract copper. The process consumes approximately a stoichiometic amount of oxygen and generates mostly elemental sulfur. It operates below the melting point of sulfur to eliminate the need for surfactants. A flowsheet is shown in FIG. 24.

Phelps Dodge, now Freeport-McMoRan, constructed a concentrate leaching demonstration plant in Bagdad, Ariz. to demonstrate the viability of the total pressure oxidation process developed by Phelps Dodge and Placer Dome (J. O Marsden, Brewer, and Hazen 2003). It treats about 136 t/day of concentrate to produce about 16,000 t/y of copper cathode via conventional SX/EW. After 18 months of continuous operation, the Bagdad Concentrate Leach Plant has demonstrated that the high-temperature process is suitable for applications where the dilute acid can be used beneficially. Recently, PD has started its development of medium-temperature pressure leaching in sulfate media at 140-180° C. With its MT-DEW-SX process (Wilmot, Smith, and Brewer 2004), chalcopyrite concentrate is first super-finely ground and then pressure leached at medium temperature in an autoclave. After solid-liquid separation, the leach solution is directly electrowon to produce copper and the electrolyte, with a relatively low content of copper, is either recycled in the autoclave or mixed with stockpile returned leach solution and fed to SX. The SX raffinate is sent to stockpile leach and the stripped solution is then electrowon for final copper cathode production (Wang 2005). The subsequent commercial scale process flowsheet from Morenci is in FIG. 25.

2.5.6 Competing Technologies

One competing technology to copper pressure oxidation is Outotec's Partial Roasting Process. Outotec has developed a two-stage partial roasting process to remove impurities such as arsenic, antimony and carbon from copper and gold concentrates as a pre-treatment to actual extraction processes. They are currently building the world's largest arsenic-removing roasting furnace at Codelco's Mina Ministro Hales mine in Chile, which will use this process. More than 90% of the arsenic in the concentrate can be removed to produce clean copper calcine. Depending on the composition of the concentrate and the plant's capacity, the process can either be run in a stationary fluidized bed or in a circulating fluidized bed. The partial roasting process for copper concentrates is a single-stage roasting process. The impurities are volatilized and the process produces calcine, which is rich in copper sulfide but has a low impurity content. The calcine is mixed and can be further processed in copper smelters. The partial roasting process is also combined with post-combustion of process gas to convert all volatile compounds into oxides. The roasting process for refractory gold concentrates contaminated with arsenic and carbon is a two-stage process. Arsenic is removed in the first roasting stage while carbon and remaining sulfur are removed in the second stage. All sulfur, iron and carbon are fully oxidized in the process and calcine suitable for actual gold leaching is produced ("Outotec Launches a New Partial Roasting Process to Purify Contaminated Copper and Gold Concentrates" 2011).

2.6 Namibia Custom Smelter

The Namibia Custom Smelter (NCS), owned by Dundee Precious Metals, Inc. (DPM), is located in Tsumeb, Namibia which is approximately 430 km north of the capital, Windhoek. The smelter is one of only a few in the world able to treat arsenic and lead bearing copper concentrate. The Chelopech mine, also owned by DPM, sends their concentrate to be processed by this smelter. For the year of 2011, NCS processed 88,514 mt of Chelopech concentrate and 91,889 mt of concentrate from third parties for a total of 180,403 mt.

Since acquiring NCS in 2010, DPM has embarked on an expansion and modernization program designed to bring the smelter into the 20$^{st}$ century from a health, safety and environmental perspective. The first phase of the project is designed to address arsenic handling. They are expanding the Ausmelt furnace, a superior furnace from an environmental point of view, enabling them to perform all primary smelting through the Ausmelt, allowing the older reverbatory furnace to be used as a holding furnace. A new baghouse is also being installed and all the existing systems designed to manage the arsenic are being upgraded. When this phase is completed, expected in December of 2012, the smelter will be one of the most modern in the world with respect to the safe management and disposal of arsenic.

When the two phases of the project are completed, the specialty smelter at Tsumeb will be repositioned to be one of the most unique smelters in the world, with the ability to treat DPM and third party complex concentrates in a responsible and sustainable manner that meets Namibian as well as global health, safety and environmental standards.

In December 2011, an independent team of technical experts was retained by the Namibian Government to ensure that both the Government and DPM had properly identified the issues with respect to concerns raised regarding the disposal and management of arsenic in concentrate processed at NCS. The review was completed in January 2012 and the report is expected to be issued in the near future. They believe that the program of upgrades and improvements completed to date and scheduled over the coming years properly addresses the issues and concerns raised and that the report will support that view ("Annual Review 2011" 2012).

Chapter 3—Arsenic Processing and Fixation 3.1 Background of Arsenic

The name arsenic comes from the Latin arsenicum, Greek arsenikon, and yellow orpiment identified with arsenikos, meaning male, from the belief that metals were different sexes. Arabic Az-zernikh was the orpiment from Persian zerni-zar for gold. It is abbreviated as As and it is believed that Albert Magnus obtained arsenic as an element in 1250 A.D. In 1649 Shroeder published two methods of preparing the element (Haynes and Lide 2011).

3.1.1 Sources of Arsenic

Elemental arsenic occurs in two solid forms: yellow and gray or metallic. Several other allotropic forms of arsenic are reported in the literature. Arsenic is found in its native form, in the sulfides realgar and orpiment, as arsenides and sulfarsenides of heavy metals, as the oxide, and as arsenates. Mispickel, arsenopyrite, (FeSAs) is the most common mineral, from which on heating the arsenic sublimes leaving ferrous sulfide. (Haynes and Lide 2011).

3.1.2 Properties of Arsenic

Arsenic has an atomic number of 33 on the periodic table with an atomic weight of 74.92160 grams/mole. It can have a valence of −3, 0, +3, or +5. Yellow arsenic has a specific gravity of 1.97 while gray, or metallic, is 5.75. Gray arsenic is the ordinary stable form. It has a triple point of 817° C., sublimes at 616° C. and has a critical temperature of 1400° C. The element is a steel gray, very brittle, crystalline, semimetallic solid; it tarnishes in air, and when heated is rapidly oxidized to arsenous oxide ($As_2O_3$) with the odor of garlic. Arsenic and its compounds are poisonous. Exposure to arsenic and its compounds should not exceed 0.01 mg/m$^3$ as elemental arsenic during an eight hour work day. Natural arsenic is made of one isotope $^{75}$As. Thirty other radioactive isotopes and isomers are known (Haynes and Lide 2011).

3.1.3 Applications of Arsenic

Arsenic trioxide and arsenic metal have not been produced as primary mineral commodity forms in the United States since 1985. However, arsenic metal has been recycled from gallium-arsenide semiconductors. Owing to environmental concerns and a voluntary ban on the use of arsenic trioxide for the production of chromate copper arsenate wood preservatives at year end 2003, imports of arsenic trioxide averaged 6,100 tons annually during 2006-10 compared with imports of arsenic trioxide that averaged more than 20,000 tons annually during 2001-02. Ammunition used by the United States military was hardened by the addition of less than 1% arsenic metal, and the grids in lead-acid storage batteries were strengthened by the addition of arsenic metal. Arsenic metal was also used as an anti-friction additive for bearings, to harden lead shot, and in clip-on wheel weights. Arsenic compounds were used in fertilizers, fireworks, herbicides, and insecticides. High-purity arsenic (99.9999%) was used by the electronics industry for allium-arsenide semiconductors that are used for solar cells, space research, and telecommunication. Arsenic was also used for germanium-arsenide-selenide specialty optical materials. Indium-gallium-arsenide was used for short-wave infrared technology. The value of arsenic compounds and metal consumed domestically in 2011 was estimated to be about $3 million (Brooks 2012).

Arsenic is used in bronzing, pyrotechny, and for hardening and improving the sphericity of shot. The most important compounds are white arsenic ($As_2O_3$), the sulfide, Paris green $3Cu(AsO_2)_2.Cu(C_2H_3O_2)_2$, calcium arsenate, and lead arsenate. The last three have been used as agricultural insecticides and poisons. Marsh's test makes use of the formation and ready decomposition of arsine ($AsH_3$), which is used to detect low levels of arsenic, especially in cases of poisoning. Arsenic is available in high-purity form. It is finding increasing uses as a doping agent in solid-state devices such as transistors. Gallium arsenide is used as a laser material to convert electricity directly into coherent light. Arsenic (99%) costs about $75 for 50 grams. Purified arsenic (99.9995%) costs about $50 per gram (Haynes and Lide 2011).

3.2 Arsenic Extraction Processes

The removal of arsenic from process solutions and effluents has been practiced by the mineral industries for many years. Removal by existing hydrometallurgical techniques is adequate for present day product specifications but the stability of waste materials for long term disposal will not meet the regulatory requirements of the future. The aqueous inorganic chemistry of arsenic as it relates to the hydrometallurgical methods that have been applied commercially for arsenic removal, recovery, and disposal, as well as those techniques which have been used in the laboratory or otherwise suggested as a means of eliminating or recovering arsenic from solution. The various separation methods which are then referenced include: oxidation-reduction, adsorption, electrolysis, solvent extraction, ion exchange, membrane separation, precipitate flotation, ion flotation, and biological processes. The removal and disposal of arsenic from metallurgical process streams will become a greater problem as minerals with much higher arsenic content are being processed in the future.

It is mostly the arsenic sulfide minerals which cause impurity levels in hydrometallurgical processes. The main sulfide mineral to cause arsenic impurity problems in arsenopyrite, FeAsS, but in certain locations enargite, $Cu_3AsS_4$, tennantite, $Cu_{12}As_4S_{13}$, cobaltite, CoAsS, rammelsbergite, $NiAs_2$, skutterudite, $(Co, Ni, Fe)As_3$, safflorite, $(Co, Fe)As_2$, pararammelsbergite, $NiAs_2$, and seligmannite, $PbCuAsS_3$, are the major source.

After smelting of sulfides or in wholly hydrometallurgical treatment, arsenic appears in solution as either arsenic (iii) or arsenic (v) but occasionally as arsenic (-iii).

Speciation in uncomplexed solution is described most conveniently by means of the potential-pH diagram shown in FIG. 26

Oxidation-reduction reactions between arsenic (v) and arsenic (iii) is possible using sulfur dioxide or sulfite. On an industrial scale this process is used to precipitate arsenic trioxide from arsenic acid solutions as a commercial commodity. There appears to be little likelihood of applying more powerful reductants in hydrometallurgical processing due to the concern of producing arsine, $AsH_3$. Arsine gas is produced commercially, however, as an intermediate to pure arsenic metal for semiconductor use.

Arsenate complexes are very similar to those of phosphate, and there is a fairly extensive literature on the metal phosphate complexes which has been reviewed by Robins, Twidwell and Dahnke. A model for ferric arsenate complexing has been proposed by Khoe and Robins which has significant effect on free energies of formation which have been used previously to describe the solubility of ferric arsenate ($FeAsO_4.2H_2O$) a compound of low solubility which is used extensively for removing arsenate from hydrometallurgical process solutions (Robins 1988).

Arsenic can be leached specifically from enargite using various methods such as alkaline sulfide leaching, acidic sulfate and chloride media, acidified ferric sulfate, and others, which will be discussed in the next chapter.

3.3 Arsenic Fixation Processes

Because arsenic is most hazardous when mobile, it should be fixed as a solid precipitate to get it in a stable form for long-term storage. Two stable forms include ferrihydrite and scorodite which are discussed in the sections to follow.

3.3.1 Ferrihydrite

Ferrihydrite is a ferric oxyhydroxide precipitate that forms very small particles with a large surface area.

In treating hydrometallurgical solutions and waste streams for the removal of arsenic, the use of coprecipitation with Fe (III) has been specified by the US EPA as the Best Demonstrated Available Technology (BDAT). This technology has been widely adopted over the last century, and developments have been well reviewed (L. G. Twidwell, Robins, and Hohn 2005). This technology has also been selected as one of the Best Available Technologies (BAT) for removing arsenic from drinking waters (L. Twidwell and McCloskey 2011).

R. G. Robins was the first investigator to recognize and to alert the gold industry that arsenic storage as calcium arsenate was inappropriate. Twidwell & McCloskey have continued work until the present and a number of research summaries are available from the EPA Mine Waste Technology Program (MWTP), e.g. arsenic, arsenic & selenium cementation using elemental iron and catalyzed elemental iron, formation and stability of arsenatephosphate apatites, ferric and ferrous treatment of mine waters (Berkeley Pitlake and Acid Drainage mine water), ferrihydrite/arsenic co-precipitation and aluminum-modified-ferrihydrite (AMF)/arsenic treatment of waste water and long-term storage, influence of anion species on ferrihydrite/arsenic co-precipitation and long-term storage, and ferrihydrite/AMF/metals co-precipitation and long-term storage.

Twidwell quoted two other authors; one says arsenical ferrihydrite can be considered stable provided that: the Fe/As molar ratio is greater than 3, the pH is slightly acidic, and it does not come into contact with reducing substances such as reactive sulfides or reducing conditions such as deep water, bacteria or algae. Another author says that there is no clear experimental evidence that either process is better for safe disposal of arsenic. Local storage conditions will greatly affect stability of arsenic product. Some factors influencing arsenic removal include initial arsenic concentration, valence state, Fe/As mole ratio, presence of associated solution ions, structural modifications to ferrihydrite, mode of precipitation (co-precipitation, post-precipitation, adsorption), pH, temperature and time. To form ferrihydrite different reagents can be used; usually ferric nitrate, ferric chloride, and ferric sulfate. The adsorption capacity is related to the method of preparation (L. G. Twidwell, Robins, and Hohn 2005).

Important reviews detailing conditions for formation and the stability of ferrihydrite are presented by Schwertmann and Cornell, who have published a "recipe" book that presents details of how to prepare iron oxides in the laboratory, including ferrihydrite, hematite and goethite. Many of the experimental studies reported in the literature reference this publication (L. Twidwell and McCloskey 2011).

Two ferric precipitation arsenic removal technologies are presently practiced by industry: ambient temperature ferrihydrite/arsenic co-precipitation and elevated temperature precipitation of ferric arsenate. The ambient temperature technology is relatively simple and the presence of commonly associated metals such as copper, lead and zinc and gypsum have a stabilizing effect on the long term stability of the product. The disadvantages of the adsorption technology are the formation of voluminous waste material that is difficult to filter, the requirement that the arsenic be present in the fully oxidized state as arsenate, and the question as to long term stability of the product in the presence of reducing substances. The disadvantages of the ferric arsenate precipitation are that the treatment process is more capital intensive, the compound may dissolve incongruently if the pH is >4, and it may not be stable under reducing or anaerobic bacterial conditions (L. G. Twidwell, Robins, and Hohn 2005).

Ferrihydrite is characterized by x-ray diffraction as having a two-line or six-line structure, which relates to the number of broad peaks present. Two-line ferrihydrite is formed by rapid hydrolysis to pH 7 ambient temperature. Six-line ferrihydrite is formed by rapid hydrolysis at elevated temperature and is generally more crystalline than two-line ferrihydrite (L. Twidwell and McCloskey 2011). However, Schwertmann and Cornell have demonstrated that either can be formed at ambient temperature by controlling the rate of hydrolysis (i.e., less crystalline two-line forms at rapid hydrolysis rates whereas, six-line forms if the precipitation is conducted at lower rates, and lepidocrocite forms if the rate of addition of sodium hydroxide is slow enough) (Schwertmann and Cornell 2012).

The rate of transformation of ferrihydrite to hematite or goethite has been discussed in great detail by Cornell and Schwertmann in their book. The rate of transformation is a function of time, temperature and pH (e.g., conversion of two-line ferrihydrite to hematite at 25° C. is half complete in 280 days at pH 4 but is completely converted at 100° C. in four hours) (Cornell and Schwertmann 2003). It has been pointed out by many investigators that ferrihydrite converts rapidly and that the conversion results in a significant decrease in surface area. However, the ferrihydrite conversion rate may be mitigated (changed from days to perhaps years) by the presence of other species and solution conditions during precipitation and subsequent storage (L. Twidwell and McCloskey 2011). General factors that have been shown to decrease the rate of conversion of two-line ferrihydrite to more crystalline forms include: lower pH, lower temperatures, presence of silicate, aluminum, arsenic, manganese, metals, sulfate, and organics (L. Twidwell and McCloskey 2011; Cornell and Schwertmann 2003).

3.3.2 Scorodite

Scorodite, $FeAsO_4.2H_2O$, is a naturally occurring mineral formed in oxidized zones of arsenic-bearing ore deposits. Its wide occurrence in comparison to other secondary arsenate minerals has led many to advocate it as an acceptable carrier for the immobilization of arsenic released during pyrometallurgical or hydrometallurgical processing of arsenic-containing ores and those of gold, copper, and uranium.

The production of scorodite, especially from arsenic-rich and iron-deficient sulfate solutions offers a number of operational advantages such as high arsenic content, stoichiometric iron demand, and excellent dewatering characteristics.

There are two process options of industrial relevance; the hydrothermal option that involves autoclave processing at elevated temperature (≥150° C.) and pressure and the atmospheric process based on supersaturation-controlled precipitation of scorodite at 90-95° C.

In addition to hydrothermal production of scorodite the work done by Demopoulos has determined that it is feasible to produce scorodite by step-wise lime neutralization at 90° C. The atmospheric scorodite possesses the same structural and solubility characteristics with the hydrothermally produced scorodite. Thermodynamic calculations determined that scorodite is stable in the presence of ferrihydrite under oxic conditions up to pH 6.75 at 22° C. or higher pH at lower temperature and gypsum-saturated solutions (Demopoulos 2005).

Crystalline scorodite has been prepared many ways. Dove and Rimstidt prepared scorodite by mixing ferric chloride and sodium arsenate solutions and equilibrating the resultant slurry for two weeks at ~100° C. (Dove and Rimstidt 1985).

3.4 Stability of Arsenic-Bearing Residues

A review of methods for the environmentally acceptable disposal of arsenic-bearing residues, such as those produced from hydrometallurgical operations, indicated that chemical precipitation as a metal arsenate offered a solution, not only of precipitating arsenic from process liquors, but also of producing a residue sufficiently stable (giving <5 mg As/L in solution) for disposal. Since published thermodynamic data suggested that metal arsenates were not as stable as had previously been thought, the Noranda Research Centre undertook a comprehensive laboratory study of the stability of metal arsenates, such as might be precipitated from typical hydrometallurgical process solutions, as a function of time and pH. The results indicate that (i) the presence of excess ferric iron (Fe/As molar ratio>3) co-precipitated with ferric arsenate confers a high degree of stability to arsenical residue at pH≤7, (ii) the presence of small quantities of base metals (Zn, Cu, Cd) in solution, in addition to excess ferric iron, at the time of precipitation confers stability on the residue in the pH range 4-10, and (iii) naturally-occurring crystalline ferric arsenate (scorodite) has a solubility some two orders of magnitude lower than the chemically-precipitated amorphous form (Harris and Monette 1988).

Chapter 4—Enargite 4.1 Background of Enargite

High arsenic-containing enargite concentrates can be smelted directly but most copper smelters limit their total arsenic inputs for both environmental and economic reasons. The average arsenic level in custom copper concentrates has also been increasing, further limiting the potential market for high-arsenic enargite concentrates (Peacey, Gupta, and Ford 2010).

4.1.1 Properties of Enargite

Enargite, $Cu_3AsS_4$, is a blackish gray mineral with a metallic luster, Mohs hardness of 3, and a density of 4.5 g/cm$^3$. It is a semiconductor. Copper is nominally in the monovalent state, and arsenic in the pentavalent state. In most natural occurrences, enargite is associated with pyrite, and other copper and/or arsenic and/or base metal sulfides (chalcopyrite, chalcocite, covellite, digenite, tennantite, sphalerite, galena). Enargite may contain minor amounts of other elements (Sb, Ag, Fe). The presence of Sb (up to 6 wt %) is quite common, and environmentally relevant; enargite is frequently associated with Sb-bearing minerals (Lattanzi et al. 2008).

Enargite is a complex copper-arsenic sulfide mineral, that typically contains significant gold and silver values, and poses many process challenges. Large enargite deposits are found in Chile as well as other countries and the increasing demand for copper and gold have spurred research into developing more effective methods of extracting value metals from enargite concentrates (Peacey, Gupta, and Ford 2010). The compound $Cu_3(As,Sb)S_4$ occurs naturally in two crystallographic forms: orthorhombic and tetragonal. The orthorhombic form is enargite ($Cu_3AsS_4$) and the tetragonal forms are luzonite ($Cu_3AsS_4$) and famatinite ($Cu_3SbS_4$) (Springer 1969). It has been suggested that enargite is a high temperature modification of luzonite (Maske and Skinner 1971).

4.1.2 Enargite Orebodies

There are numerous properties around the world that contain enargite mineralization. The following table lists many of them.

TABLE 4.1

Worldwide Enargite Containing Orebodies

| | | | | Grade | | | |
|---|---|---|---|---|---|---|---|
| Orebody | Company | Location | Resource Tonnes | Cu (%) | Au (g/t) | Ag (g/t) | As (%) |
| Marca Punta ("Memoria Anual 2011" 2012) | El Brocal | Peru | 37,916,386 | 1.85 | 0.26 | 15.88 | 0.56 |
| Tampakan ("Annual Report 2011" 2012), ("Xstrata Copper: Operations: Tampakan" 2012) | Xstrata | Philippines | 2,940,000,000 | 0.51 | | | |
| Mount Carlton | Evolution Mining | Australia | | 14.70 | 152.98 | 846.86 | 4.2 |
| Chelopech ("Annual Review 2011" 2012) | Dundee Precious Metals, Inc. | Bulgaria | | 1.55 | 4.17 | 8.46 | |
| Frieda River ("Xstrata Copper Announces Mineral Resources Increase for the Frieda River Copper-gold Project in Papua New Guinea" 2011) | Xstrata | New Guinea | 1,900,000,000 | 0.45 | 0.22 | 0.7 | |
| Lepanto | Lepanto Consolidated Mining Co. | Philippines | | | | | |
| Caspiche ("Exeter Resource Corporation Caspiche Project Pre-Feasibility Study" 2012) | Exeter Resources | Chile | 1,646,000 | 0.18 | 0.47 | 1.09 | |
| La Coipa ("Annual Report 2011") | Kinross Gold | Chile | 21,334,000 | | 1.28 | 37.1 | |
| Golpu ("Integrated Annual Report" 2011) | Harmony Gold/Newcrest | New Guinea | 868,700,000 | 1.03 | 0.69 | | |
| Canariaco ("Consolidated Financial Statements of Candente Copper Corp. Dec. 31, | Candente Copper Corp. | Peru | 910,100,000 | 0.44 | | | |

TABLE 4.1-continued

| Worldwide Enargite Containing Orebodies | | | | | | | |
|---|---|---|---|---|---|---|---|
| | | | | Grade | | | |
| Orebody | Company | Location | Resource Tonnes | Cu (%) | Au (g/t) | Ag (g/t) | As (%) |
| 2011 and 2010" 2012) | | | | | | | |
| Yanacocha | Newmont Mining | Peru | | | | | |
| El Indio | Barrick | Chile | | | | | |
| El Galeno | China Minmetals | Peru | | | | | |
| Andina | Codelco | Chile | | | | | |
| Chuquicamata | Codelco | Chile | | | | | |
| Mina Ministro Hales | Codelco | Chile | | | | | |

4.2 Enargite Concentrate Treatment Options

The process used commercially in the recent past for treating large quantities of enargite concentrate is partial roasting at temperatures in the range 600-750° C. to produce a low-As calcine and arsenic trioxide for sale or storage. Roasters and fluid bed reactors have been used to treat high arsenic concentrates at Barrick's El Indio mine in Chile, Lepanto in the Philippines and Boliden in Sweden. The resulting low-As calcine was sold to Cu smelters. Sale of significant amounts of arsenic trioxide is, however, no longer possible but the scrubbing of arsenic trioxide from copper smelter gases and its fixation in an environmentally acceptable manner is well-proven by various methods at several smelters. A key issue in selecting the preferred roasting process flowsheet is minimizing the cost of arsenic fixation and disposal to satisfy the environmental regulations ("Outotec Launches a New Partial Roasting Process to Purify Contaminated Copper and Gold Concentrates" 2011), (Peacey, Gupta, and Ford 2010).

In the early 1900's arsenic kitchens were used for the recovery of arsenic and the production of arsenic trioxide. The plant at Anaconda originally consisted of a Brunton roasting furnace for treating the flue dust and a small reverberatory furnace for treating crude arsenic produced in the roasting operations. The kitchens were connected to the main flue system to condense the gases and capture the $As_2O_3$ which was then prepared for market. The ASARCO Tacoma Smelter used this technology and was named a Superfund Site due to arsenic and lead contamination (Bender and Goe 1934; "Asarco Smelter—Ruston" 2013).

Several new hydrometallurgical processes have been developed to treat copper sulfide concentrates and most are suitable for the treatment of enargite concentrates. These hydrometallurgical processes include atmospheric leaching and pressure oxidation. Hydrometallurgical processes have a major advantage over roasting options as the arsenic is usually precipitated directly within the leach reactor as ferric arsenate, which is generally regarded as environmentally acceptable for disposal (Peacey, Gupta, and Ford 2010).

The Outotec neutral roast may also be a possibility based on the company's press release from Dec. 27, 2011 stating that the process can "remove impurities such as arsenic, antimony and carbon from copper and gold concentrates as a pre-treatment to actual extraction processes" ("Outotec Launches a New Partial Roasting Process to Purify Contaminated Copper and Gold Concentrates" 2011).

As there has not been a commercial hydrometallurgical application to primarily treat enargite-bearing copper concentrates, there is still work to be done to understand the chemistry, thermodynamics and kinetics of a process to successfully treat concentrates containing arsenic minerals. Further, the demand for clean copper concentrates containing silver and gold as feed to a smelter is considerable. Therefore, this research will focus on the selective dissolution and fixation of arsenic while leaving behind a clean copper-precious metals bearing solid suitable as a smelter feed. This will minimize the on-site capital investment hydrometallurgically producing copper cathode on site, while taking advantage of lower smelting treatment and refining charges and precious metal recovery credits.

4.3 Enargite Literature Review

The following sections discuss work that has been performed in the areas of enargite processing and pressure oxidation.

4.3.1 Enargite Surface Properties

In a flotation study of the surface properties of enargite as a function of pH, it was observed that the sign and magnitude of enargite's zeta potential is governed by the adsorption of the hydrolysis products of the As—Cu—S—$H_2O$ system formed at the mineral/solution interface. The zeta potential of enargite was found to be quite sensitive to changes in pH, probably due to several simultaneous ionization and disassociation reactions (Castro and Baltierra 2005). Electrochemical oxidation and reduction of enargite were performed in 0.1 M HCl solution. The presence of $Cu^{2+}$, sulfate and chloride were detected at potentials above 0.2V, while at potentials below 0.6V the oxidation of arsenic was detected. Dissolved sulfur increased under reducing conditions forming $H_2S$ and at oxidizing conditions forming sulfoxy species. The sulfur was believed to be responsible for the observation of an active-passive transition at 0.3V (SCE) (Ásbjörnsson et al. 2004).

Selective flotation of enargite from chalcopyrite under varied pulp potentials was conducted to investigate the feasibility of enargite removal from a chalcopyrite concentrate. The test results indicate that chalcopyrite began to oxidize quickly at a much lower potential than enargite. Selective flotation revealed that enargite can be successfully removed from chalcopyrite through controlling the pulp potential above +0.2V and below +0.55V (SCE) (Guo and Yen 2005). The electrochemical behavior of natural enargite in an alkaline solution was studied under conditions pertinent to those used in flotation of sulfide minerals. Photoelectrochemical experiments confirmed that the samples studied were p-type semiconductors. The potential range where the photocurrent was noticeable (below −0.4±0.2V vs. SCE) is more negative than the potential range of flotation (near 0.0V vs. SCE). It is believed that a surface layer forms over the potential range studied, and the law for the growth of this layer corresponds to two processes: the formation and dissolution of the layer (Pauporté and Schuhmann 1996).

The oxidation of synthetic and natural samples of enargite and tennantite were compared through dissolution and zeta potential studies. The changes in zeta potential with pH and oxidizing conditions are consistent with the presence of a copper hydroxide layer covering a metal-deficient sulfur-rich surface. The amount of copper hydroxide coverage increases with oxidation conditions. Arsenic dissolution was much lower than copper and does not appear to contribute to the mineral oxidation. The work showed that the natural samples of tennantite and enargite oxidize more than the synthetic samples in alkaline conditions, and tennantite oxidizes more than enargite (Fullston, Fornasiero, and Ralston 1999a). The surface oxidation of synthetic and natural samples of enargite and tennantite were monitored by X-ray photoelectron spectroscopy (XPS). The XPS results showed that the oxidation layer on the mineral surface is thin and the products are comprised of copper and arsenic oxide/hydroxide, sulfite, and a sulfur-rich layer of metal-deficient sulfide and/or polysulfide (Fullston, Fornasiero, and Ralston 1999b).

The extended milling of enargite concentrate in an oxygen atmosphere at elevated temperature led to increased solubility of enargite due to the formation of $CuSO_4$ and $As_2O_3$, both of which are soluble in the leachant (Welham 2001).

4.3.2 Enargite Treatments

The study of the separation of enargite and tennantite from non-arsenic copper sulfide minerals by selective oxidation or dissolution showed that it is difficult to use flotation to separate chalcocite, covellite or chalcopyrite from enargite or tennantite under normal oxidation conditions. Improved separation occurred at pH 5.0 after selective oxidation with $H_2O_2$, or at pH 11.0 after oxidation with $H_2O_2$ followed by EDTA addition to selectively remove surface oxidation products (Fornasiero et al. 2001).

Hydrometallurgical oxidation of enargite in air is a slow process. At acidic to neutral pH, oxidation/dissolution is slow but is accelerated by the presence of ferric iron and/or bacteria. When sulfuric acid and ferric iron are present, and at high potentials, +0.74 V vs. SHE, copper dissolves and there is a formation of sulfur, which may be subsequently partially oxidized to sulfate (Lattanzi et al. 2008).

Several new hydrometallurgical processes have been developed to treat copper sulfide concentrates and may be suitable for enargite including atmospheric leaching, bio-oxidation and pressure oxidation. The advantage of hydrometallurgy over roasting is that the arsenic can be precipitated directly within the leach reactor as ferric arsenate (Peacey, Gupta, and Ford 2010).

One commercial process for treating large quantities of enargite concentrates is the Outotec Partial Roasting Process. It includes partial roasting at 600-750° C. to produce a low-arsenic calcine and arsenic trioxide for sale or storage. The low-arsenic calcine was sold to copper smelters. The sale of significant amounts of arsenic trioxide is no longer possible but scrubbing from copper smelter gases and fixation in an environmentally acceptable manner is well-proven (Lattanzi et al. 2008; Peacey, Gupta, and Ford 2010).

4.3.3 Pyrometallurgical Processing

Pyrometallurgical processing of enargite concentrates has been shown to remove arsenic, but the problem is handling of the arsenic-containing species and long term stability (Kusik and Nadkarni 1988). Decomposition of enargite in a nitrogen atmosphere at 575-700° C. proceeded in two sequential steps forming tenantite as an intermediate compound (Padilla, Fan, and Wilkomirsky 2001). Sulfidation of chalcopyrite-enargite concentrate at 350-400° C. resulted in rapid conversion of the chalcopyrite to covellite and pyrite. This was followed by pressure leaching in sulfuric acid with oxygen (Padilla, Vega, and Ruiz 2007).

4.3.4 Bio-Oxidation

Enargite was leached faster by bacteria in sulfuric acid with ferric sulfate than by chemical leaching at the same or higher ion concentration (Escobar, Huenupi, and Wiertz 1997). Arsenic-bearing copper ores and concentrates could be leached by Sulfolobus B C, a strain of bacteria that can oxidize aresnite to arsenate, in the presence of ferric iron due to precipitation of ferric arsenate (Escobar et al. 2000). In evaluating bio-oxidation of a gold concentrate prior to cyanidation of high pyrite and enargite content, the bacterial attack was directed toward pyrite with minimal effect on the enargite (Canales, Acevedo, and Gentina 2002). The electrochemical study of enargite bioleaching by mesophilic and thermophilic microorganisms showed that enargite dissolution increased at higher temperatures, or thermophilic conditions (Munoz et al. 2006). Leach tests on composited sulfide ores containing enargite and covellite achieved higher copper extraction at thermophilic conditions than mesophilic conditions (Lee et al. 2011). Arsenic-tolerant acidithiobacillus ferrooxidans achieved oxidation dissolution of enargite by forming elemental sulfur, arsenate and oxidized sulfur species (Sasaki et al. 2009). The study of $CO_2$ supply on the biooxidation of an enargite-pyrite gold concentrate showed a marked effect on the kinetics of growth and bioleaching. Four percent carbon dioxide resulted in suspended cell population as well as maximum extraction of Fe, Cu and As (Acevedo, Gentina, and Garcia 1998).

4.3.5 Hydrometallurgical Processing

Arsenic dissolved from concentrates by leaching enargite with sodium hypochlorite under alkaline oxidizing conditions where the enargite is converted into crystalline CuO and arsenic dissolves forming $AsO_4^{3-}$. The reaction rate was very fast and chemically controlled (Curreli et al. 2005; Vinals et al. 2003).

Dissolution of enargite in acidified ferric sulfate solutions at 60-95° C. yielded elemental sulfate and sulfate with dissolved copper and arsenic. The dissolution kinetics were linear and copper extraction increased with increasing ferric sulfate and sulfuric acid concentration (Dutrizac and MacDonald 1972). Leaching of enargite in acidic sulfate and chloride media resulted in complete dissolution at temperatures above 170° C. (Riveros, Dutrizac, and Spencer 2001). At <100° C., enargite dissolves slowly in either $Fe(SO_4)_{1.5}$ or $FeCl_3$ media, and the dissolution rate obeys the shrinking core model. The rate increases with increasing temperature and the apparent activation energies are 50-64 kJ/mol. The rate increases slightly with increasing $FeCl_3$ concentrations in 0.3M HCl media. The leaching of enargite at elevated temperatures and pressures was also investigated. Potentially useful leaching rates are achieved above 170° C., at which temperature sulfate, rather than sulfur, is produced. Lower temperatures (130-160° C.) lead to fast initial leaching rates, but the dissolution of the enargite is incomplete because of the coating of the enargite particles by elemental sulfur (Riveros and Dutrizac 2008).

Enargite dissolution in ammoniacal solutions was slow and 60% of copper was extracted after 14 hours (Gajam and Raghavan 1983).

In the case of gold-bearing enargite concentrates, leaching with basic $Na_2S$ has been shown to selectively solubilize the arsenic, and some gold, but does not affect the copper. The copper is transformed in the leach residue to a species $Cu_{1.5}S$ and the gold is partly solubilized in the form of various anionic Au—S complexes. The gold and arsenic could then be recovered from solution (Curren et al. 2009). Other work had indicated that leaching with sodium sulfide in 0.25 M NaOH at 80-105° C. will dissolve sulfides of arsenic, antimony and mercury (Nadkarni and Kusik 1988; C. G. Anderson 2005; C. Anderson and Twidwell 2008). The selective leaching of antimony and arsenic from mechanically activated tetrahedrite, jamesonite and enargite in alkaline solution of sodium sulfide is temperature-sensitive. (Baláz and Achimovicova 2006). The treatment of copper ores and concentrates with industrial nitrogen species catalyzed pressure leaching and non-cyanide precious metals recovery was effective in leaching copper and oxidizing the sulfide to sulfate in a minimum amount of time while keeping the arsenic out of solution through in-situ precipitation (C. G. Anderson 2003).

Bornite, covellite and pyrite were reacted hydrothermally with copper sulfate solutions at pH 1.1-1.4 to produce digenite which was then transformed to djurleite, chalcocite, and chalcocite-Q and trace djurleite respectively. The bornite reaction is diffusion controlled while the covellite and pyrite are chemically controlled. A Chilean copper concentrate was hydrothermally treated at 225-240° C. with copper sulfate solutions to remove impurities. The mineral phases behaved in a similar manner as described above. Arsenic was described as being moderately eliminated (20-40%) (Fuentes, Vinals, and Herreros 2009a; Fuentes, Vinals, and Herreros 2009b). Hydrothermally reacting sphalerite with acidified copper sulfate solution by metathesis reaction at 160-225° C. resulted in digenite at lower temperature and chalcocite at higher temperature. Copper sulfide formed in a compact layer around a core of sphalerite retaining the same size and shape of the original particle. The work shows that sphalerite could be removed from a digenite or chalcopyrite copper concentrate (Vinals, Fuentes, Hernandez and Herreros 2004).

Complete dissolution of enargite at 220° C., 100 psi in 120 minutes was achieved and it was found that a sulfuric acid content over 0.2 molar had a negligible effect on dissolution (Padilla, Rivas, and Ruiz 2008). Leaching of enargite in sulfuric acid, sodium chloride, and oxygen media found arsenic dissolution was very slow. About 6% of the arsenic dissolved in 7 hours at 100° C. (Padilla, Giron, and Ruiz 2005). Enargite dissolved faster when pressure leaching in the presence of pyrite at 160-200° C. than the dissolution of pure enargite which is thought to be the result of ferric ions (Ruiz, Vera, and Padilla 2011).

4.3.6 Other Processing Technologies

A pyro-hydrometallurgical approach is the acid-bake leach, or Anaconda-Treadwell process, which achieved approximately 90% copper extraction when baking at 200° C. with less than 1% of arsenic reporting to the gas phase. Results show that upon baking with 5 grams concentrated sulfuric acid per gram of contained copper, the enargite, chalcopyrite, sphalerite and galena will be converted to their corresponding sulfates (Safarzadeh, Moats, and Miller 2012a; Safarzadeh, Moats, and Miller 2012b).

4.3.7 Pressure Oxidation

Many companies have been investigating hydrometallurgical treatment methods for the leaching of copper concentrates as an alternative to conventional smelting technology by pressure oxidation. Freeport-McMoRan Copper & Gold has developed a sulfate-based pressure leaching technology for the treatment of copper sulfide concentrates. The main drivers for the activity were the relatively high and variable cost of external smelting and refining capacity, the limited availability of smelting and refining capacity and the need to cost-effectively generate sulfuric acid at mine sites for use in stockpile leaching operations. Freeport was looking to treat chalcopyrite concentrates with this technology and developed both high and medium temperature processes (J. O. Marsden, Wilmot, and Hazen 2007a); (J. O. Marsden, Wilmot, and Hazen 2007b).

Anaconda Copper Company performed work on ores from the Butte area to evaluate the possibility of converting chalcopyrite to digenite at about 200° C. to upgrade and clean the concentrate to the point where it could be shipped as a feed to a copper smelter. They showed that this reaction is possible and a significant amount of the iron and arsenic (along with other impurities) were removed from the solid product while retaining the majority of the copper, gold and silver in the concentrate. The upgrading process also results in a lower mass of concentrate to ship, thereby decreasing shipping costs. Primarily, the process consists of chemical enrichment that releases iron and sulfur from the chalcopyrite, followed by solid-liquid separation with treatment of the liquid effluent. This is followed by flotation with recycle of the middling product back to the enrichment process and rejection of the tailing. The resultant product is digenite formed as a reaction product layer around the shrinking core of each chalcopyrite grain. About 80% of the zinc impurities reported to the liquor, while arsenic, bismuth and antimony were evenly distributed between the discharge liquor and the enriched product. Gold, silver and selenium followed the copper (Bartlett 1992); (Bartlett et al. 1986).

Chapter 5—Thermodynamic Modeling

5.1 Enargite Thermodynamics

The thermodynamics associated with enargite have been studies by several people. The starting point for this evaluation is with the chemical reactions that might be occurring. Reactions related to the pressure leaching of enargite in a sulfate-oxygen media and their associated Gibbs Energies are shown below (Padilla, Rivas, and Ruiz 2008; Seal et al. 1996; Knight 1977).

$$Cu_3AsS_4+8.75O_2+2.5H_2O+2H^+=3Cu^{2+}+H_3AsO_4+4HSO_4^- \quad (5.1)$$

$$\Delta G_{rxn,25°\ C.}{}^0=-2821.8\ \text{kJ/mole} \quad (5.2)$$

$$\Delta G_{rxn,200°\ C.}{}^0=-2476.7\ \text{kJ/mole} \quad (5.3)$$

$$Cu_3AsS_4+2.75O_2+6H^+=3Cu^{2+}+H_3AsO_4+4S^0+1.5H_2O \quad (5.4)$$

$$\Delta G_{rxn,25°\ C.}{}^0=-747.7\ \text{kJ/mole} \quad (5.5)$$

$$\Delta G_{rxn,200°\ C.}{}^0=-627.4\ \text{kJ/mole} \quad (5.6)$$

These reactions and the resultant Gibbs Energies predict a strong thermodynamic possibility of enargite oxidation with resultant sulfate or sulfur production.

The Gibbs free energy of formation for enargite was calculated in Padilla's work from data published by Seal & Knight, shown below.

TABLE 5.1

Standard Gibbs Free Energy of Formation for Enargite (Padilla, Rivas, and Ruiz 2008)

| Compound | ΔG°, kcal/mole | Temperature Range, K |
|---|---|---|
| $Cu_3AsS_4$ | −45.002 + 0.00707T ± 0.19 | 298-944 |

The table below shows the standard free energy for the various species used in Padilla's Eh-pH diagrams which are depicted at FIGS. 27-28.

TABLE 5.2

Standard Free Energy for the Various Species in the Eh-pH Diagrams (Padilla, Rivas, and Ruiz 2008)

| Species | $\Delta G°_{25° C.}$ (kJ/mol) | $\Delta G°_{200° C.}$ (kJ/mol) |
|---|---|---|
| As | 0.000 | 0.000 |
| Cu | 0.000 | 0.000 |
| $Cu_3AsS_4$ | −177.462 | −174.359 |
| $CuH_3$ | 283.576 | 289.333 |
| CuO | −128.380 | −112.273 |
| $Cu_2O$ | −147.982 | −134.597 |
| CuS | −53.507 | −53.135 |
| $Cu_2S$ | −86.524 | −90.493 |
| S | 0.000 | 0.000 |
| $AsH_3$ (a) | 80.642 | 94.701 |
| $Cu^{2+}$ (a) | 65.599 | 66.072 |
| $Cu^{+}$ (a) | 50.020 | 35.533 |
| $CuO_2^{2-}$ (a) | −172.576 | −77.598 |
| $H_3AsO_3$ (a) | −640.061 | −574.856 |
| $H_2AsO_3^{-}$ (a) | −587.328 | −506.519 |
| $HAsO_3^{2-}$ (a) | −524.171 | −401.154 |
| $AsO_3^{3-}$ (a) | −447.577 | −279.875 |
| $H_3AsO_4$ (a) | −766.515 | −685.283 |
| $H_2AsO_4^{-}$ (a) | −753.620 | −655.707 |
| $HAsO_4^{2-}$ (a) | −714.942 | −588.019 |
| $AsO_4^{3-}$ (a) | −648.669 | −482.181 |
| $H_2S$ (a) | −27.281 | −25.083 |
| $HS^{-}$ (a) | 12.087 | 35.496 |
| $S^{2-}$ (a) | 86.026 | 129.087 |
| $HSO_4^{-}$ (a) | −756.182 | −672.731 |
| $SO_4^{2-}$ (a) | −744.865 | −631.876 |

(a) refers to aqueous

Additional Eh-pH stability diagrams for the Cu—S—$H_2O$, As—$H_2O$, and S—$H_2O$ systems are shown individually in Appendices A and B. Appendix A shows how the diagrams change by increasing temperature in 25° C. increments. Appendix B shows how the diagrams change by increasing species molality in 0.1 mol/kg increments.

Padilla's diagrams were recreated using Stabcal as seen in FIGS. 29-30. The enargite data utilized is from Craig & Barton (Craig and Barton 1973).

The most important item to note from the above figures is that at the acidic conditions proposed by CSM for the pressure oxidation of enargite at positive oxidation potentials, enargite can be transformed to solid copper sulfide phase (stability region surrounding enargite region), which would stay in the solid concentrate, and a soluble arsenic species. Padilla focused on the upper left corner of the diagram, acidic oxidizing conditions, showing $Cu^{2+}$ as stable. At pH<2, the species would be $Cu^{2+}$, $H_3AsO_4$ and $HSO_4^{-}$; at pH between 2 and 2.3, the species will be $Cu^{2+}$, $H_3AsO_4$, and $SO_4^{2-}$; and at a pH between 2.3 and 4.3, $Cu^{2+}$, $H_2AsO_4^{-}$ and $SO_4^{2-}$ will be stable (Padilla, Rivas, and Ruiz 2008). Based on the diagrams, it appears that there is a region where $Cu^{2+}$ is no longer the stable form of copper, but rather CuS or $Cu_2S$, while there is still a soluble arsenic phase. This is a metathesis-like reaction path.

It is important to keep in mind that a thermodynamic evaluation commonly predicts whether such reaction is possible, not whether the reaction kinetics are viable.

5.2 Metathesis Reaction Thermodynamics

A metathesis reaction is a double-replacement chemical reaction. Metathetic leaching may be represented by the reaction (Vignes 2011):

$$MeS(s)+CuSO_4 \rightarrow MeSO_4+CuS(s)\uparrow \quad (5.7)$$

Metathesis is an exchange of bonds. The copper sulfide in Reaction 5.7 above is insoluble in the system and is precipitated.

Metathesis has long been used for copper cementation, as part of the nickel-copper matte leach (Hofirek and Kerfoot 1992), at Stillwater (Mular, Halbe, and Barratt 2002), and to transform sphalerite to copper sulfide particles (Vinals et al. 2004). For copper minerals, it has been used to convert chalcopyrite to digenite (Bartlett 1992). The chalcopyrite metathesis reaction is shown below.

$$3CuFeS_2+6CuSO_4+4H_2O=5Cu_{1.8}S+3FeSO_4+4H_2SO_4 \quad (5.8)$$

Metathesis has also been successful for the purification and enrichment of Chilean copper concentrates using pressure oxidation. Bornite and covellite were successfully treated for impurities, including a moderate (20-40%) extraction of arsenic (Fuentes, Vinals, and Herreros 2009a; Fuentes, Vinals, and Herreros 2009b).

For our work, based on the enargite Eh-pH diagrams, an example metathesis reaction may be:

$$Cu_3AsS_4(s)+2.25O_2(g)+2.5H_2O(l) \rightarrow 3CuS(s)+H_3AsO_3(aq)+H_2SO_4 \quad (5.9)$$

Chapter 6—Feed Sample Characterization

Two enargite samples were collected for experimentation. The samples consist of a Peruvian concentrate (Marca Punta) and a high enargite content mineral specimen.

6.1 Marca Punta Sample

The first sample analyzed was from Marca Punta, Peru. The feed concentrate was analyzed using various methods shown below.

This sample was analyzed both by The Center for Advanced Mineral and Metallurgical Processing (CAMP) at Montana Tech of the University of Montana in Butte and by Freeport's Mineralogy group.

Total sulfur and carbon were analyzed on the LECO analyzer. Arsenic, copper and iron were analyzed on the digested sampled by ICP-AES. Gold and silver values were determined by fire assay. These values are shown in the table below.

TABLE 6.1

Marca Punta CAMP Concentrate Analysis

| | |
|---|---|
| Cu, % | 20.64 |
| Fe, % | 28.3 |
| As, % | 5.89 |
| Au, g/t | 1.93 |
| Ag, o/t | 1.65 |
| TS, % | 40.1 |

The sample was examined by XRD to determine the major mineral phases present as shown in FIGS. 31 and 32. The MLA-determined particle size distribution for the sample is presented in FIGS. 32. The particle size was biased high due to agglomeration of the material from drying; the P80 was approximately 30 μm. The prepared sample was analyzed by the MLA X-ray Backscatter Electron (XBSE) method. The XBSE method uses the variation in the gray level of mineral phases based on the backscatter electron (BSE) image to differentiate (segment) the particles and mineral phases. After segmentation of the BSE image is complete, EDX spectra are collected at the "center" of each phase. The collected X-ray spectra are compared to a mineral X-ray database for identification. The phases present are shown in Table 6.2.

TABLE 6.2

| Phase/Mineral Concentrations for the Marca Punta sample (wt %) | | |
|---|---|---|
| Phase/Mineral | Formula | Con Feed |
| Pyrite | $FeS_2$ | 61.4 |
| Enargite | $Cu_3AsS_4$ | 38.0 |
| Quartz | $SiO_2$ | 0.27 |
| Chalcocite | $Cu_2S$ | 0.20 |
| Chalcopyrite | $CuFeS_2$ | 0.04 |
| FeO | $Fe_2O_3$ | 0.03 |
| Sphalerite | ZnS | 0.02 |
| Galena | PbS | 0.01 |

P—mineral present, found at less than 0.01%
ND—mineral not detected

The MLA-calculated bulk elemental analysis is shown below.

TABLE 6.3

| MLA-Calculated Bulk Elemental Analysis (wt %) | |
|---|---|
| Element | wt (%) |
| Sulfur | 45.3 |
| Iron | 28.6 |
| Copper | 18.6 |
| Arsenic | 7.23 |
| Oxygen | 0.15 |
| Silicon | 0.12 |
| Zinc | 0.01 |
| Lead | 0.01 |

P—element present at less than 0.01%
ND—element not detected

FIG. 33 is a classified MLA image from a selected frame obtained during analysis of the sample. The image is of agglomerate that is mainly pyrite and enargite. Enargite (pink) constituted approximately one-third of the sample shown in the MLA image.

The BSE image shown in FIG. 34 is from the same analytical frame as the MLA image shown in the figure above. It is difficult to discern by casual observation, but the enargite (En) grain is slightly brighter than the pyrite (Py) in the BSE image in FIG. 34.

The BSE image in FIG. 35 is taken at a lower magnification than in the previous figure shows a relatively large enargite compared to those that are in the agglomerate and comprise the majority of the sample.

A comparison between the MLA calculated and analytical assays are shown below.

TABLE 6.4

| Comparison | | |
|---|---|---|
| Element | MLA Calculated | Head Assay |
| Cu | 18.6 | 20.64 |
| Fe | 28.6 | 28.3 |
| As | 7.23 | 5.89 |
| S | 45.3 | 40.1 |

As mentioned above, Freeport also performed analysis on this sample. XRD bulk mineralogy is shown in the table below.

TABLE 6.5

| Marca Punta FMIXRD Bulk Mineralogy | |
|---|---|
| Quartz | 2.50 |
| Pyrite | 52.96 |
| Enargite | 31.44 |
| Poitevinite | 5.02 |
| Swelling Clays | 8.09 |

ICP from Freeport shows a full elemental sweep.

TABLE 6.6

| Marca Punta FMI ICP Elemental Analysis | | |
|---|---|---|
| Ag | ppm | 56.5 |
| Al | % | 0.04 |
| As | % | 5.9 |
| Ba | % | 0.00155 |
| Bi | ppm | 36.6 |
| Ca | % | 0.25 |
| Cd | ppm | 4 |
| Ce | ppm | 2.6 |
| Co | % | 0.00444 |
| Cr | % | 0.0049 |
| Cs | ppm | 0.5 |
| Cu | % | 19.3 |
| Dy | ppm | <0.5 |
| Er | ppm | <0.5 |
| Eu | ppm | <0.5 |
| Fe | % | 27.39 |
| Ga | ppm | 6.9 |
| Gd | ppm | <0.5 |
| Hf | ppm | 1.8 |
| Ho | ppm | <0.5 |
| K | % | <0.1 |
| La | ppm | 1.3 |
| Li | ppm | <10.0 |
| Lu | ppm | <0.5 |
| Mg | % | <0.0 |
| Mn | % | 0.00995 |
| Na | % | <0.1 |
| Nb | ppm | <5.0 |
| Nd | ppm | 1 |
| Ni | ppm | 34 |
| P | ppm | 34.7 |
| Pb | % | 0.05 |
| Pr | ppm | <0.5 |
| Rb | ppm | <0.5 |
| Re | ppm | <0.5 |
| S | % | 40.31 |
| Sb | ppm | 678.8 |
| Se | ppm | 11.2 |
| Si | | 0.57 |
| Sm | ppm | <2.0 |
| Sn | ppm | 284.9 |
| Sr | % | 0.00244 |
| Tb | ppm | <0.5 |
| Te | ppm | 166.5 |
| Th | ppm | 0.7 |
| Ti | % | 0.03 |
| Tl | ppm | 14.1 |
| Tm | ppm | <0.5 |
| U | ppm | <1.0 |
| W | ppm | 14.8 |
| Y | ppm | <2.0 |
| Yb | ppm | <0.5 |
| Zn | % | 0.17 |
| Zr | ppm | 97.1 |

FMI QEMSCAN bulk mineralogy compared to chemical analysis shows elements and minerals present in the table below followed by QEMSCAN liberation analysis based on copper sulfides and arsenic sulfides, in FIG. 36.

TABLE 6.7

| Marca Punta FMI QEMSCAN Bulk Mineralogy | |
|---|---|
| Particle Size | 11.91 |
| As (QEMSCAN) | 6.51 |
| As (Chemical) | 5.90 |
| Cu (QEMSCAN) | 20.59 |
| Cu (Chemical) | 19.30 |
| Fe (QEMSCAN) | 26.52 |
| Fe (Chemical) | 27.39 |
| Pb (QEMSCAN) | 0.08 |
| Pb (Chemical) | 0.05 |
| S (QEMSCAN) | 42.45 |
| S (Chemical) | 40.31 |
| Sb (QEMSCAN) | 0.68 |
| Sb (Chemical) | 0.07 |
| Zn (QEMSCAN) | 0.19 |
| Zn (Chemical) | 0.17 |
| Chalcopyrite | 0.29 |
| Chalcocite | 0.94 |
| Covellite | 4.18 |
| Bornite | 1.45 |
| Cu/As/SbGroup | 4.78 |
| Enargite | 30.41 |
| Cu bearing clays | 1.96 |
| Other (Cu) | 0.06 |
| Pyrite | 54.27 |
| Arsenopyrite | 0.34 |
| Galena | 0.09 |
| Sphalerite | 0.30 |
| Quartz | 0.57 |
| Other | 0.35 |

TABLE 6.8

| Marca Punta FMI QEMSCAN Liberation | | |
|---|---|---|
| | Cu Sulfides | As Sulfides |
| Locked (0-30%) | 39.45 | 19.73 |
| Middling (30-90%) | 47.83 | 63.31 |
| Liberated (90-100%) | 12.72 | 16.95 |

6.2 High Grade Enargite Sample

The second sample analyzed was a high grade enargite specimen from Butte, Mont. Photographs of the specimens before testing are shown in FIG. 37.

The feed sample was pulverized at CAMP and analyzed using various methods shown below.

Total sulfur and carbon were analyzed on the LECO analyzer. Arsenic, copper and iron were analyzed on the digested sampled by ICP-AES. Gold and silver values were determined by fire assay.

TABLE 6.9

| High Grade Sample Analysis | |
|---|---|
| Cu, % | 29.7 |
| Fe, % | 9.97 |
| As, % | 10.7 |
| Au, oz/ton | 0.16 |
| Ag, oz/ton | 26.5 |
| TS, % | 34.1 |
| TC, % | 0.19 |

The enargite sampled was examined by XRD to confirm the presence of major mineral phases as shown in FIG. 38.

The acquired diffractogram for enargite is shown in red in FIG. 39 with the whole powder patter fitted (WPPF) calculated plot shown in blue. The residual graph, which is the difference between acquired and calculated, is shown in pink. The WPPF plot was calculated using the phases shown in the figure above. Qualitative observation of the peak positions on the diffractogram above and the candidate phases shows that enargite and quartz are responsible for the majority of observed peaks.

FIG. 40 is a classified MLA image from a selected frame obtained during analysis of the enargite sample. The highlighted particle shows the association of the three most abundant phases found in the sample, enargite (red), pyrite (sea foam green) and quartz (grey). A small grain of the copper arsenic-antimonide sulfide, watanabeite (pink) is located at the grain boundary between enargite and pyrite.

The BSE image in FIG. 41 is from the same analytical frame as the MLA image shown in the above figure. The watanabeite (Wtb) is seen as a small sliver, slightly brighter than enargite (En) which is brighter than pyrite (Py). Quartz is the darkest phase in the highlighted particle.

Enargite was the main phase in the sample at 65%. Pyrite was significant at 25% with minor quartz at 5% and bornite at 2%. Numerous other minor and trace phases were found and are listed in the table below. A trace, but noteable phase, was watanabeite that contained tellurium and bismuth.

| Mineral | Formula | Wt % |
|---|---|---|
| Enargite | $Cu_3AsS_4$ | 65.4 |
| Pyrite | $FeS_2$ | 24.9 |
| Quartz | $SiO_2$ | 5.18 |
| Bornite | $Cu_5FeS_4$ | 2.04 |
| Chalcocite | $Cu_2S$ | 0.90 |
| Mica | $KAl_2(AlSi_3O_{10})(OH)_2$ | 0.58 |
| Chalcopyrite | $CuFeS_2$ | 0.35 |
| Sphalerite | $ZnS$ | 0.33 |
| Hubnerite | $MnWO_4$ | 0.05 |
| Berlinite | $AlPO_4$ | 0.05 |
| Watanabeite | $Cu_4(As,Sb)_2S_5$ | 0.04 |
| Hinsdalite | $(Pb,Sr)Al_3(PO_4)(SO_4)(OH)_6$ | 0.06 |
| Pyroxene | $CaMgSi_2O_6$ | 0.02 |
| Plagioclase | $(Na,Ca)(Al,Si)_4O_8$ | 0.02 |
| K_Feldspar | $KAlSi_3O_8$ | 0.11 |
| Biotite | $K(Mg,Fe)_3(AlSi_3O_{10})(OH)_2$ | 0.01 |
| Rutile | $TiO_2$ | P |
| Ilmenite | $FeTiO_3$ | P |
| FeO | $Fe_{2.5}O_{3.5}$ | P |
| Vermiculite | $(Mg,Fe,Al)_3(Si,Al)_4O_{10}(OH)_2 \cdot 4H_2O$ | P |
| Galena | $PbS$ | P |
| Monazite | $(La,Ce)PO_4$ | P |
| Calcite | $CaCO_3$ | P |

P—mineral present, found at less than 0.01%
ND—mineral not detected

The MLA-calculated bulk elemental analysis is shown in the table below. Sulfur was 35.5%, copper was almost 33.8%, arsenic was 12.4% and iron was 11.9%.

TABLE 6.10

| MLA-Calculated Bulk Elemental Analysis (wt %) | |
|---|---|
| Element | wt (%) |
| Sulfur | 35.5 |
| Copper | 33.8 |
| Arsenic | 12.4 |
| Iron | 11.9 |
| Oxygen | 3.18 |
| Silicon | 2.59 |
| Aluminum | 0.15 |
| Zinc | 0.22 |
| Potassium | 0.07 |
| Tungsten | 0.03 |
| Phosphorus | 0.02 |
| Manganese | 0.01 |
| Antimony | 0.01 |

TABLE 6.10-continued

| MLA-Calculated Bulk Elemental Analysis (wt %) | |
|---|---|
| Element | wt (%) |
| Lead | 0.01 |
| Calcium | 0.01 |
| Titanium | P |
| Magnesium | P |
| Hydrogen | P |
| Strontium | P |
| Sodium | P |
| Cerium | P |
| Lanthanum | P |
| Carbon | P |

P—element present at less than 0.01%
ND—element not detected

Arsenic was found in enargite and watanabeite. Due to the relatively large content of enargite, the input of arsenic from watanabeite was minimal, making enargite effectively responsible for all of the arsenic in the sample. Copper was found in several minerals in the sample. Enargite was responsible for 94% of the copper with bornite and chalcocite contributing slightly more than 5% to the overall copper balance as seen below.

TABLE 6.11

| Copper Distribution in the Enargite Sample by Mineral | |
|---|---|
| Mineral | Copper (wt %) |
| Bornite | 3.8 |
| Chalcocite | 2.1 |
| Chalcopyrite | 0.4 |
| Enargite | 93.7 |
| Watanabeite | 0.0 |
| Total | 100.0 |

TABLE 6.12

| Iron Distribution in the Enargite Sample by Mineral | |
|---|---|
| Mineral | Iron (wt %) |
| Biotite | 0.0 |
| Borrrite | 1.9 |
| Chalcopyrite | 0.9 |
| FeO | 0.0 |
| Pyrite | 97.2 |
| Total | 100.0 |

TABLE 6.13

| Sulfur Distribution in the enargite sample by mineral | |
|---|---|
| Mineral | Sulfur (wt %) |
| Bornite | 1.5 |
| Chalcocite | 0.5 |
| Chalcopyrite | 0.3 |
| Enargite | 59.9 |
| Hinsdalite | 0.0 |
| Pyrite | 37.4 |
| Sphalerite | 0.3 |
| Watanabeite | 0.0 |
| Total | 100.0 |

A comparison between the MLA calculated and analytical assays are shown below.

TABLE 6.14

| Comparison | | |
|---|---|---|
| Element | MLA Calculated | Head Assay |
| Cu | 33.8 | 29.7 |
| Fe | 12.4 | 9.97 |
| As | 12.4 | 10.7 |
| S | 35.5 | 34.1 |

Chapter 7—Research Program

The goal of this project is to develop a process to be integrated into an existing hydrometallurgical operation for the treatment of enargite concentrates and the operational parameters for this treatment. For this project, a rigorous experimental program was required to evaluate the processing technique. The experimental program is summarized in the following sections.

7.1 Sample Preparation

Sample preparation before testwork is very important to ensure that a representative sample is taken from the original feed sample. To do this, each solid sample was blended and split prior to testing.

7.2 Chemical Analysis Methods

In order to evaluate elemental distribution throughout experimentation, it is beneficial to establish accurate and precise quantitative analysis techniques. Liquid samples were sent to outside labs for assay by ICP for copper, iron and arsenic. Additional techniques are described in the following sections.

7.2.1 Copper Titration Procedure

To analyze PLS solutions for copper content as a check for the ICP results from the outside labs, the Short Iodide Method for Copper Ion Titration was used. Two titrations were performed on a pre-mixed known solution before each batch of samples to verify the accuracy of the results. The titration procedure is as follows:

1. Pipette 1 or 2 ml of sample into an Erlenmeyer flask
2. Dilute the sample to the 50 ml mark on the flask with distilled water
3. Add 5 ml of 20 g/l ammonium bifluoride solution using a plastic syringe
4. Pipette 5 ml of 30 wt % potassium iodide solution (solution will turn a reddish amber color)
5. Titrate using 0.05 N sodium thiosulfate solution until a light yellow color is obtained (about the color of orange juice)
6. Pipette 5 ml of 20 g/l thiodene indicator (solution will turn black)
7. Titrate using 0.05 N sodium thiosulfate solution until solution changes from black to clear or milky-white
8. The concentration of copper present is found by multiplying the number of ml's of sodium thiosulfate titrated by 3.177 and dividing by the volume of sample used $$\text{Copper(g/L)} = \frac{\text{ml titrant} \times 3.177}{\text{ml sample}} \tag{7.1}$$

7.2.2 Free Acid Titration Procedure

To determine the free acid content in the solutions, the Determination of Free Acid in the Presence of Iron Titration was used. Two titrations were performed on a pre-mixed known solution before each batch of samples to verify the accuracy of the results. The titration procedure is as follows:

1. Pipette 5 ml of sample into an Erlenmeyer flask
2. Dilute the sample to the 50 ml mark on the flask with distilled water
3. Add 2 drops of 20 wt % sodium thiosulfate solution
4. Pipette 1 ml of 0.5 g/l methyl orange indicator solution (when acid is present, solution turns red)
5. Titrate with 1.0 N sodium carbonate solution until a pH of 3.8 is reached or until the disappearance of all red color (solution will turn orange)
6. The concentration of free acid present is found by multiplying the number of ml's of sodium carbonate titrated by 49 and dividing by the volume of sample used $$\text{Free } H_2SO_4(g/L) = \frac{\text{Normality of titrant} \times 49 \times \text{ml of titrant}}{\text{ml sample}} \tag{7.2}$$

7.3 Data Analysis

Once assay results were received, all data was put into a mass balance and extractions were calculated. The mass balances are shown in Appendix C.

7.3.1 Analyzing Results Using Stat-Ease Design Expert

Stat-Ease Design Expert 8.0 software was used to perform statistical analyses including analysis of the variance (ANOVA). The Stat-Ease model fit summaries and ANOVA are shown in Appendix D.

Analysis consisted of the following:

1. Compute effects. Use half-normal probability plot to select model. Click the biggest effect (point furthest to the right) and continue right-to-left until the line runs through points nearest zero. Alternatively, on the Pareto Chart pick effects from left to right, largest to smallest, until all other effects fall below the Bonferroni and/or t-value limit.
2. Choose ANOVA and check the selected model:
   a. Review the ANOVA results.
      i. Model should be significant based on F-test:
         1. (Prob>F) is <0.05 is significant (good).
         2. (Prob>F) is >0.10 is not significant (bad).
      ii. Curvature and Lack of Fit (if reported) should be insignificant:
         1. (Prob>F) is <0.05 is significant (bad).
         2. (Prob>F) is >0.10 is not significant (good).
   b. Examine the F tests on the regression coefficients. Look for terms that can be eliminated, i.e., terms having (Prob>F)>0.10. Be sure to maintain hierarchy.
   c. Check for "Adeq Precision">4. This is a signal to noise ratio.
   d. Verify the ANOVA assumptions by looking at the residual plots (*Handbook for Experimenters, Version* 08.1 2009).

Design Expert provides prediction equations in terms of actual units and coded units. In the case of mixture designs, the options are actual, pseudo and real units. The coded equations are determined first, and the actual equations are derived from the coded. Experimenters often wonder why the equations look so different, even to the point of having different signs on the coefficients.

To get the actual equation, replace each term in the coded equation with its coding formula:

$$X_{Coded} = \frac{X_{Actual} - \overline{X}}{(X_{Hi} - X_{Low})/2} \tag{7.3}$$

Substituting the formula into each linear term will result in a new linear coefficient and a correction to the intercept.

Substituting the formula into each quadratic term will result in a new quadratic coefficient and a correction to the intercept.

Substituting the formula into each interaction term will result in a new interaction coefficient, a correction to each main effect in the interaction, and a correction to the intercept. These corrections from the interactions can be large and opposite in sign from the linear terms and can change the sign on the linear terms ("Stat-Ease Design Expert 8.0 Help" 2011).

Chapter 8—Atmospheric Pressure Leaching

Before starting experiments on the pressure oxidation of enargite, a series of atmospheric pressure leach tests were performed to evaluate whether there was a response in arsenic extraction. A Design of Experiments (DOE) matrix was generated using Stat-Ease Design Expert 8.0 software. This DOE matrix is shown below where −1 is the low, 0 is a center point, and 1 is the high.

TABLE 8.1

½ Factorial DOE for Atmospheric Pressure Leach Tests

| Std | Run | Factor 1 A: Acid g/L | Factor 2 B: Solids g | Factor 3 C: Cu2+ g/L | Factor 4 D: Temperature deg C. | Factor 5 E: Time hrs |
|---|---|---|---|---|---|---|
| 1 | 15 | −1 | −1 | −1 | −1 | 1 |
| 2 | 7 | 1 | −1 | −1 | −1 | −1 |
| 3 | 9 | −1 | 1 | −1 | −1 | −1 |
| 4 | 14 | 1 | 1 | −1 | −1 | 1 |
| 5 | 10 | −1 | −1 | 1 | −1 | −1 |
| 6 | 13 | 1 | −1 | 1 | −1 | 1 |
| 7 | 12 | −1 | 1 | 1 | −1 | 1 |
| 8 | 11 | 1 | 1 | 1 | −1 | −1 |
| 9 | 3 | −1 | −1 | −1 | 1 | −1 |
| 10 | 17 | 1 | −1 | −1 | 1 | 1 |
| 11 | 16 | −1 | 1 | −1 | 1 | 1 |
| 12 | 6 | 1 | 1 | −1 | 1 | −1 |
| 13 | 19 | −1 | −1 | 1 | 1 | 1 |
| 14 | 5 | 1 | −1 | 1 | 1 | −1 |
| 15 | 4 | −1 | 1 | 1 | 1 | −1 |
| 16 | 18 | 1 | 1 | 1 | 1 | 1 |
| 17 | 1 | 0 | 0 | 0 | 0 | 0 |
| 18 | 2 | 0 | 0 | 0 | 0 | 0 |
| 19 | 8 | 0 | 0 | 0 | 0 | 0 |

The experimental equipment setup can be seen in the FIG. 42.

The setup consisted of a 2 liter Pyrex resin kettle, constant temperature circulating water bath, agitator and a water cooled condenser to create a closed system.

8.1 Leaching Tests

The actual order in which these tests were performed differed slightly from the DOE so the following table shows the experimental order and also shows the actual numerical values of the test variables.

TABLE 8.2

Experimental Order of Atmospheric Leach Tests

| Test # | Factor 1 Acid g/L | Factor 2 Solids g | Factor 3 Cu2+ g/L | Factor 4 Temperature deg C. | Factor 5 Time hrs |
|---|---|---|---|---|---|
| 1 | 5 | 20 | 25 | 50 | 4 |
| 2 | 5 | 20 | 25 | 50 | 4 |
| 3 | 0 | 10 | 10 | 25 | 2 |
| 4 | 0 | 30 | 40 | 25 | 2 |
| 5 | 10 | 10 | 40 | 25 | 2 |
| 6 | 10 | 30 | 10 | 25 | 2 |
| 7 | 10 | 10 | 10 | 75 | 2 |
| 8 | 5 | 20 | 25 | 50 | 4 |
| 9 | 0 | 30 | 10 | 75 | 2 |
| 10 | 0 | 10 | 40 | 75 | 2 |
| 11 | 10 | 30 | 40 | 75 | 2 |
| 12 | 0 | 30 | 40 | 75 | 6 |
| 13 | 10 | 10 | 40 | 75 | 6 |
| 14 | 10 | 30 | 10 | 75 | 6 |
| 15 | 0 | 10 | 10 | 75 | 6 |
| 16 | 0 | 30 | 10 | 25 | 6 |
| 17 | 10 | 10 | 10 | 25 | 6 |
| 18 | 10 | 30 | 40 | 25 | 6 |
| 19 | 0 | 10 | 40 | 25 | 6 |

Two additional leach tests, 7-2 and 13-2 were performed to verify the results from the tests above. This will be discussed in more detail in the results section of this chapter below.

8.1.1 Leach Test Procedure

The procedure for the atmospheric pressure agitated leach tests was consistent throughout all 19 designed experiments.

1. Mix 1 liter of leach feed solution according to acid and copper ion concentrations as specified in the DOE matrix
2. Split and weigh out solid feed sample according to solids weight as specified in the DOE matrix
3. Pour solids and leach solution into Pyrex resin kettle, set agitation at level 4 and record leaching start time
4. Turn off agitator 5 minutes before taking hourly samples to allow solids to settle
5. After each hour, take a sample using glass pipette (10 ml for 6 hour test or 20 ml for 2 and 4 hour tests), replace rubber stopper, and turn agitation back to level 4
6. When samples return to room temperature, analyze for pH and ORP
7. When leaching is complete, rinse contents of resin kettle into #40 Whatman filter paper in funnel with distilled water to drip filter (record weight of filter paper before filtering)
8. Collect solution and record final volume
9. Rinse solids with distilled water and allow to drip filter again
10. Place filter paper containing solids in drying oven overnight at 90° C.
11. Remove dry filter and solids from oven and record final weight
12. Filter hourly samples according to above procedure and add dry solids to final weight from above The two additional tests, 7-2 and 13-2 were performed following this procedure except no hourly samples were taken.

8.2 Analysis

The following sections discuss the results of analysis performed on both solids and liquids from the leach tests outlined above.

8.2.1 Pregnant Leach Solution Analysis

Hourly PLS samples were analyzed for pH and ORP using an Ag/AgCl electrode as shown in FIGS. 43 and 44.

A response is shown in the first hour in both of the above plots for leach tests 3, 4, 8, 9, 10, 12, 15, 16 and 19, which correspond to zero acid in the leach solution, except for test 8. Hourly readings were not taken for test #1. This is indicating some kind of response taking place at atmospheric pressure. This response is further investigated in the analysis continued on these samples below.

Copper and Free Acid were analyzed by titration and the results are shown in the tables below.

TABLE 8.3

Copper Titration Results on Final PLS

| Test # | Total ml Added | Copper (g/l) |
|---|---|---|
| 1 | 14.4 | 22.87 |
| 2 | 14.5 | 23.03 |
| 3 | 6.1 | 9.69 |
| 4 | 22.1 | 35.11 |
| 5 | 22.5 | 35.74 |
| 6 | 6.7 | 10.64 |
| 7 | 6.3 | 10.01 |
| 8 | 14.9 | 23.67 |
| 9 | 6.3 | 10.01 |
| 10 | 24.5 | 38.92 |
| 11 | 23.8 | 37.81 |
| 12 | 22.9 | 36.38 |
| 13 | 24.0 | 38.12 |
| 14 | 6.2 | 9.85 |
| 15 | 6.0 | 9.53 |
| 16 | 6.0 | 9.53 |
| 17 | 6.1 | 9.69 |
| 18 | 22.9 | 36.38 |
| 19 | 23.5 | 37.33 |
| 7-2 | 4.7 | 7.47 |
| 13-2 | 18.7 | 29.70 |

TABLE 8.4

Free Acid Titration Results on Final PLS

| Test # | Total ml Added | Free Acid (g/l) |
|---|---|---|
| 1 | 0.5 | 4.90 |
| 2 | 0.6 | 5.88 |
| 3 | 0.0 | 0.00 |
| 4 | 0.0 | 0.00 |
| 5 | 1.0 | 9.80 |
| 6 | 1.0 | 9.80 |
| 7 | 1.0 | 9.80 |
| 8 | 0.5 | 4.90 |
| 9 | 0.0 | 0.00 |
| 10 | 0.0 | 0.00 |
| 11 | 0.9 | 8.82 |
| 12 | 0.0 | 0.00 |
| 13 | 1.0 | 9.80 |
| 14 | 0.9 | 8.82 |
| 15 | 0.0 | 0.00 |
| 16 | 0.0 | 0.00 |
| 17 | 1.0 | 9.80 |
| 18 | 1.0 | 9.80 |
| 19 | 0.0 | 0.00 |
| 7-2 | 0.7 | 6.86 |
| 13-2 | 0.8 | 7.84 |

ICP was performed by Montana Tech/CAMP on leach solutions for copper, iron and arsenic. The results of this analysis are shown below. The copper numbers compare well to the copper titrations shown above.

TABLE 8.5

| ICP by CAMP at Montana Tech | | | |
|---|---|---|---|
| | Arsenic g/L | Copper g/L | Iron g/L |
| 1 | 0.117 | 23.120 | 0.608 |
| 2 | 0.113 | 22.440 | 0.628 |
| 3 | 0.002 | 8.942 | 0.101 |
| 4 | 0.004 | 34.590 | 0.348 |
| 5 | 0.055 | 35.040 | 0.252 |
| 6 | 0.175 | 10.520 | 0.913 |
| 7 | 0.078 | 10.040 | 0.389 |
| 8 | 0.125 | 24.350 | 0.648 |
| 9 | 0.017 | 10.310 | 0.560 |
| 10 | 0.007 | 37.330 | 0.181 |
| 11 | 0.204 | 38.600 | 1.262 |
| 12 | 0.015 | 35.760 | 0.603 |
| 13 | 0.073 | 37.440 | 0.434 |
| 14 | 0.224 | 9.998 | 1.237 |
| 15 | 0.003 | 9.531 | 0.227 |
| 16 | 0.003 | 9.419 | 0.357 |
| 17 | 0.064 | 9.085 | 0.321 |
| 18 | 0.160 | 36.300 | 0.852 |
| 19 | 0.007 | 37.640 | 0.134 |
| 7-2 | 0.063 | 7.902 | 0.330 |
| 13-2 | 0.061 | 29.960 | 0.332 |

8.2.2 Solid Leach Residue Analysis

Solid leach residues were sent to Idaho for assay by Chris Christopherson, Inc. for copper, iron and arsenic.

TABLE 8.6

| Solid Leach Residue Assays Performed by Chris Christopherson, Inc. | | | |
|---|---|---|---|
| Test # | Cu % | Fe % | As % |
| 1 | 17.33 | 29.48 | 6.78 |
| 2 | 17.40 | 29.40 | 6.45 |
| 3 | 16.64 | 30.65 | 6.84 |
| 4 | 16.66 | 31.02 | 6.95 |
| 5 | 17.18 | 29.56 | 6.34 |
| 6 | 16.96 | 29.82 | 6.00 |
| 7 | 17.52 | 28.86 | 5.67 |
| 8 | 16.97 | 28.48 | 5.65 |
| 9 | 17.12 | 29.42 | 5.80 |
| 10 | 17.73 | 29.52 | 5.38 |
| 11 | 17.77 | 29.12 | 6.70 |
| 12 | 17.50 | 28.73 | 6.68 |
| 13 | 17.49 | 28.28 | 6.64 |
| 14 | 17.40 | 28.44 | 6.55 |
| 15 | 16.86 | 28.25 | 6.69 |
| 16 | 15.99 | 29.09 | 6.72 |
| 17 | 17.07 | 29.11 | 6.39 |
| 18 | 16.88 | 28.82 | 6.40 |
| 19 | 16.62 | 29.28 | 6.50 |
| 13-2 | 17.62 | 28.56 | 6.45 |
| 7-2 | 16.92 | 29.25 | 6.24 |

8.2.3 Atmospheric Leach Results Summary

The Atmospheric Leach summary shown in the table below is the result of the mass balances performed based on the assays from above. The mass balance calculations are shown in Appendix C.

TABLE 8.7

| Atmospheric Leach Results Summary | | | | |
|---|---|---|---|---|
| Test ID | Cu grams Diff Solids | Fe Extraction % | As Extraction % | Acid Consump. g acid/g solid |
| 1 | 0.51 | 11.48 | 12.12 | 0.022 |
| 2 | 0.55 | 12.34 | 13.88 | −0.030 |
| 3 | 0.26 | 4.37 | 5.05 | 0.000 |

TABLE 8.7-continued

| Atmospheric Leach Results Summary | | | | |
|---|---|---|---|---|
| Test ID | Cu grams Diff Solids | Fe Extraction % | As Extraction % | Acid Consump. g acid/g solid |
| 4 | 0.76 | 4.40 | 4.54 | 0.000 |
| 5 | 0.21 | 9.32 | 13.00 | 0.013 |
| 6 | 1.00 | 12.08 | 16.39 | 0.039 |
| 7 | 0.36 | 16.45 | 20.99 | 0.135 |
| 8 | 0.66 | 13.57 | 18.05 | 0.037 |
| 9 | 0.78 | 8.52 | 10.54 | 0.000 |
| 10 | 0.16 | 7.36 | 11.76 | 0.000 |
| 11 | 0.77 | 15.42 | 14.23 | 0.062 |
| 12 | 0.47 | 8.08 | 5.51 | 0.000 |
| 13 | 0.24 | 15.43 | 13.91 | 0.094 |
| 14 | 1.03 | 17.17 | 16.65 | 0.066 |
| 15 | 0.32 | 11.53 | 7.32 | 0.000 |
| 16 | 0.99 | 6.91 | 5.81 | 0.000 |
| 17 | 0.35 | 13.93 | 15.88 | 0.073 |
| 18 | 0.80 | 11.37 | 12.94 | 0.016 |
| 19 | 0.17 | 4.42 | 5.22 | 0.000 |
| 7-2 | 0.36 | 18.27 | 18.58 | 0.176 |
| 13-2 | 0.41 | 17.71 | 19.28 | 0.017 |

Test #7 resulted in about 21% arsenic extracted at 10 gpl sulfuric acid, 10 grams of solids, 10 gpl $Cu^{2+}$, and 75° C. for 2 hours. This test also shows an apparent copper and arsenic separation with a 7% copper gain in the solid indicating the possibility of a copper-arsenic metathesis reaction occurring.

8.2.4 Stat-Ease Modeling

Stat-Ease Design Expert software was used for modeling of the atmospheric leach results to determine significant factors and to perform some optimization. Initial acid content was determined to be the most significant effect on PLS arsenic content. Temperature also had a slight positive effect. A 3-D surface plot of these effects on the arsenic response is shown in FIG. 45.

This modeling resulted in the following Final Equation in Terms of Actual Factors with an R-squared of 0.72935 and standard deviation of 2.73061:

$$\begin{aligned}\text{As Extraction} = & \\ & +4.75269 \\ & +0.85291 \ *\text{Initial Acid} \\ & +0.055236 \ *\text{Temperature}\end{aligned} \tag{8.1}$$

Additional statistical data, including the 95% confidence intervals, for this model are shown in Appendix D.

8.3 Leach Residue Characterization

MLA was performed at Montana Tech/CAMP on the #7 leach residue sample. The sample was dried overnight and prepared by cold-mounting in epoxy resin.

The major phase in the residue sample was pyrite at 77% with the minor phase as enargite at 23%. Combined, the remaining minerals were less than 1% of the residue mineralogy as shown below.

TABLE 8.8

| Phase/Mineral Concentrations for Leach Residue #7 | | |
|---|---|---|
| Mineral | Formula | Wt % |
| Pyrite | $FeS_2$ | 76.7 |
| Enargite | $Cu_3AsS_4$ | 23.0 |

TABLE 8.8-continued

| Phase/Mineral Concentrations for Leach Residue #7 | | |
|---|---|---|
| Mineral | Formula | Wt % |
| Quartz | $SiO_2$ | 0.14 |
| Chalcocite | $Cu_2S$ | 0.10 |
| Sphalerite | ZnS | 0.03 |
| Chalcopyrite | $CuFeS_2$ | 0.03 |
| Rutile | $TiO_2$ | 0.01 |
| FeO | $Fe_{2.5}O_{3.5}$ | P |
| Molybdenite | $MoS_2$ | P |

P—mineral present, found at less than 0.01%

ND—mineral not detected

Copper was 18%, arsenic 6.8% and iron was 30% according to the MLA-calculated bulk elemental analysis shown in the table below.

TABLE 8.9

| MLA-Calculated Bulk Elemental Analysis | |
|---|---|
| Element | Residue #7 |
| Sulfur | 45.8 |
| Iron | 29.7 |
| Copper | 17.5 |
| Arsenic | 6.83 |
| Oxygen | 0.08 |
| Silicon | 0.06 |
| Zinc | 0.02 |
| Titanium | P |
| Molybdenum | P |

P—element present at less than 0.01%

ND—element not detected

The elemental distribution for arsenic, copper and iron is due to the distribution of essentially two minerals. Copper and arsenic in the sample are due to the enargite while the iron can be attributed to the pyrite.

FIG. 46 is a classified MLA image from the residue. Pyrite is shown as the green phase, the light blue is enargite, and the grayish-blue fines are a fine-grained mixture of pyrite and enargite that is composed of approximately 92% pyrite and 8% enargite by weight.

The backscatter electron image (BSE) image in FIG. 47 is from the same analytical frame as the MLA image shown in the above figure. Enargite (En) is the brightest phase and pyrite (Py) is slightly darker. It can be seen from the BSE image that much of the fine grained material is relatively bright and is classified as enargite. It is more difficult to discern the gray level of the fine particles as the background between the fine particles makes them appear darker.

Chapter 9—Autoclave Leaching

Before starting pressure oxidation experiments another Design of Experiments (DOE) matrix was generated using Stat-Ease Design Expert 8.0 software. This DOE matrix is shown below where −1 is the low, 0 is a center point, and 1 is the high.

TABLE 9.1

| ½ Factorial DOE for Pressure Oxidation Leach Tests | | | | | | | |
|---|---|---|---|---|---|---|---|
| Std | Run | Factor 1 Time hr | Factor 2 Temp deg C. | Factor 3 Cu g/L | Factor 4 Acid g/L | Factor 5 Solids g | Factor 6 O2 press psi |
| 1 | 5 | −1 | −1 | −1 | −1 | −1 | −1 |
| 2 | 8 | 1 | −1 | −1 | −1 | −1 | 1 |
| 3 | 25 | −1 | 1 | −1 | −1 | −1 | 1 |
| 4 | 35 | 1 | 1 | −1 | −1 | −1 | −1 |
| 5 | 6 | −1 | −1 | 1 | −1 | −1 | 1 |
| 6 | 21 | 1 | −1 | 1 | −1 | −1 | −1 |
| 7 | 24 | −1 | 1 | 1 | −1 | −1 | −1 |
| 8 | 16 | 1 | 1 | 1 | −1 | −1 | 1 |
| 9 | 26 | −1 | −1 | −1 | 1 | −1 | 1 |
| 10 | 2 | 1 | −1 | −1 | 1 | −1 | −1 |
| 11 | 11 | −1 | 1 | −1 | 1 | −1 | −1 |
| 12 | 12 | 1 | 1 | −1 | 1 | −1 | 1 |
| 13 | 23 | −1 | −1 | 1 | 1 | −1 | −1 |
| 14 | 32 | 1 | −1 | 1 | 1 | −1 | 1 |
| 15 | 28 | −1 | 1 | 1 | 1 | −1 | 1 |
| 16 | 17 | 1 | 1 | 1 | 1 | −1 | −1 |
| 17 | 34 | −1 | −1 | −1 | −1 | 1 | 1 |
| 18 | 22 | 1 | −1 | −1 | −1 | 1 | −1 |
| 19 | 4 | −1 | 1 | −1 | −1 | 1 | −1 |
| 20 | 30 | 1 | 1 | −1 | −1 | 1 | 1 |
| 21 | 7 | −1 | −1 | 1 | −1 | 1 | −1 |
| 22 | 10 | 1 | −1 | 1 | −1 | 1 | 1 |
| 23 | 33 | −1 | 1 | 1 | −1 | 1 | 1 |
| 24 | 9 | 1 | 1 | 1 | −1 | 1 | −1 |
| 25 | 1 | −1 | −1 | −1 | 1 | 1 | −1 |
| 26 | 20 | 1 | −1 | −1 | 1 | 1 | 1 |
| 27 | 29 | −1 | 1 | −1 | 1 | 1 | 1 |
| 28 | 13 | 1 | 1 | −1 | 1 | 1 | −1 |
| 29 | 27 | −1 | −1 | 1 | 1 | 1 | 1 |
| 30 | 15 | 1 | −1 | 1 | 1 | 1 | −1 |
| 31 | 3 | −1 | 1 | 1 | 1 | 1 | −1 |
| 32 | 31 | 1 | 1 | 1 | 1 | 1 | 1 |
| 33 | 14 | 0 | 0 | 0 | 0 | 0 | 0 |
| 34 | 19 | 0 | 0 | 0 | 0 | 0 | 0 |
| 35 | 18 | 0 | 0 | 0 | 0 | 0 | 0 |

The experimental equipment setup can be seen in the FIG. 48.

The equipment consisted of a 2-liter titanium Grade 2 autoclave from Autoclave Engineers with a Universal Reactor Controller which monitors Magnedrive agitation, reactor temperature, heating jacket over-temperature, and process pressure.

9.1 Autoclave/Pressure Oxidation Leaching Tests

Based on the results from the atmospheric pressure leach tests, it was decided to keep the initial leach solution copper concentration the same. The amount of solids was cut in half to conserve sample since the previous leach tests showed no effect of solids. The initial acid concentration was increased as it was the largest effect based on Stat-Ease modeling of the previous tests. Based on the literature, complete dissolution of enargite was achieved at a sulfuric acid content below 0.2 molar (but at higher temperature); higher concentration had a negligible effect on dissolution (Padilla, Rivas, and Ruiz 2008). A stoichiometric amount of oxygen without continuous flow was required for chalcopyrite to convert to digenite (Bartlett et al. 1986; Bartlett 1992).

The actual order in which these tests were performed differed slightly from the DOE so the following table shows the experimental order and also shows the actual numerical values of the test variables.

TABLE 9.2

Experimental Order of Pressure Oxidation Leach Tests

| Test # | Factor 1 Time Ins | Factor 2 Temp deg C. | Factor 3 Cu 2+ g/L | Factor 4 Acid g/L | Factor 5 Solids g | Factor 6 O2 press psi |
|---|---|---|---|---|---|---|
| 1 | 0.5 | 100 | 10 | 30 | 15 | 0 |
| 2 | 0.5 | 100 | 10 | 10 | 5 | 0 |
| 3 | 0.5 | 100 | 40 | 30 | 5 | 0 |
| 4 | 0.5 | 100 | 40 | 10 | 15 | 0 |
| 5 | 0.5 | 160 | 40 | 10 | 5 | 0 |
| 6 | 0.5 | 160 | 10 | 30 | 5 | 0 |
| 7 | 1.0 | 100 | 10 | 10 | 15 | 0 |
| 8 | 1.0 | 100 | 40 | 30 | 15 | 0 |
| 9 | 1.0 | 100 | 40 | 10 | 5 | 0 |
| 10 | 1.0 | 100 | 10 | 30 | 5 | 0 |
| 11 | 0.5 | 160 | 10 | 10 | 15 | 0 |
| 12 | 0.5 | 160 | 40 | 30 | 15 | 0 |
| 13 | 1.0 | 160 | 10 | 10 | 5 | 0 |
| 14 | 1.0 | 160 | 40 | 30 | 5 | 0 |
| 15 | 1.0 | 160 | 40 | 10 | 15 | 0 |
| 16 | 1.0 | 160 | 10 | 30 | 15 | 0 |
| 17 | 0.75 | 130 | 25 | 20 | 10 | 50 |
| 18 | 0.75 | 130 | 25 | 20 | 10 | 50 |
| 19 | 0.75 | 130 | 25 | 20 | 10 | 50 |
| 20 | 0.5 | 100 | 40 | 10 | 5 | 100 |
| 21 | 0.5 | 100 | 10 | 30 | 5 | 100 |
| 22 | 0.5 | 100 | 10 | 10 | 15 | 100 |
| 23 | 0.5 | 100 | 40 | 30 | 15 | 100 |
| 24 | 0.5 | 160 | 10 | 10 | 5 | 100 |
| 25 | 0.5 | 160 | 40 | 30 | 5 | 100 |
| 26 | 0.5 | 160 | 40 | 10 | 15 | 100 |
| 27 | 0.5 | 160 | 10 | 30 | 15 | 100 |
| 28 | 1.0 | 100 | 10 | 30 | 15 | 100 |
| 29 | 1.0 | 100 | 10 | 10 | 5 | 100 |
| 30 | 1.0 | 100 | 40 | 30 | 5 | 100 |
| 31 | 1.0 | 100 | 40 | 10 | 15 | 100 |
| 32 | 1.0 | 160 | 40 | 10 | 5 | 100 |
| 33 | 1.0 | 160 | 10 | 30 | 5 | 100 |
| 34 | 1.0 | 160 | 10 | 10 | 15 | 100 |
| 35 | 1.0 | 160 | 40 | 30 | 15 | 100 |

9.1.1 Autoclave Leach Test Procedure

The procedure for the autoclave leach tests was consistent throughout all 35 designed experiments.

1. Mix 1 liter of leach feed solution according to acid and copper ion concentrations as specified in the DOE matrix
2. Split and weigh out solid feed sample according to solids weight as specified in the DOE matrix
3. Charge the autoclave with liter of leach solution and preheat to 90° C.
4. Once at this temperature, enargite concentrate sample is added and the autoclave is sealed
5. Turn on and set agitator at 500 rpm
6. The oxygen is admitted, if used, the pressure is then fixed to the desired value, and oxygen is turned off
7. Record leaching start time and the system is allowed to react to the temperature and time specified in the DOE
8. At the end of the experiment, the autoclave is rapidly cooled by circulating cold water through the cooling coil
9. Rinse the contents of autoclave into #40 Whatman filter paper in funnel with distilled water to drip filter (record weight of filter paper before filtering)
10. Collect solution and record final volume
11. Rinse solids with distilled water and allow to drip filter again
12. Place filter paper containing solids in drying oven overnight at 90° C.
13. Remove dry filter and solids from oven and record final weight 9.2 Analysis The following sections discuss the results of analysis performed on both solids and liquids from the leach tests outlined above.

9.2.1 Pregnant Leach Solution Analysis

Copper and Free Acid were analyzed by titration and the results are shown in the tables below.

TABLE 9.3

Copper Titration Results on Final PLS

| Test # | Total ml Added | Copper (g/l) |
|---|---|---|
| 1 | 3.3 | 10.48 |
| 2 | 2.8 | 8.90 |
| 3 | 11.0 | 34.95 |
| 4 | 9.9 | 31.45 |
| 5 | 10.8 | 36.85 |
| 6 | 2.5 | 7.94 |
| 7 | 2.4 | 7.62 |
| 8 | 9.5 | 30.18 |
| 9 | 11.5 | 36.54 |
| 10 | 2.4 | 7.62 |
| 11 | 1.8 | 5.72 |
| 12 | 10.1 | 32.09 |
| 13 | 2.2 | 6.99 |
| 14 | 8.1 | 25.73 |
| 15 | 7.7 | 24.46 |
| 16 | 1.9 | 6.04 |
| 17 | 5.4 | 17.16 |
| 18 | 6.2 | 19.70 |
| 19 | 5.3 | 16.84 |
| 20 | 23.5 | 37.33 |
| 21 | 6.0 | 9.53 |
| 22 | 4.3 | 6.83 |
| 23 | 20.2 | 32.09 |
| 24 | 2.5 | 7.94 |
| 25 | 23.5 | 37.33 |
| 26 | 2.2 | 6.99 |
| 27 | 5.4 | 8.58 |
| 28 | 2.3 | 7.31 |
| 29 | 2.6 | 8.26 |
| 30 | 10.1 | 32.09 |
| 31 | 7.9 | 25.10 |
| 32 | 9.5 | 30.18 |
| 33 | 2.5 | 7.94 |
| 34 | 3.2 | 10.17 |
| 35 | 6.8 | 21.60 |

TABLE 9.4

Free Acid Titration Results on Final PLS

| Test # | Total ml Added | Free Acid (g/l) |
|---|---|---|
| 1 | 3.3 | 31.85 |
| 2 | 0.9 | 8.82 |
| 3 | 2.8 | 27.44 |
| 4 | 0.8 | 7.84 |
| 5 | 0.9 | 9.02 |
| 6 | 2.4 | 23.52 |
| 7 | 0.9 | 8.82 |
| 8 | 2.2 | 21.56 |
| 9 | 0.9 | 8.82 |
| 10 | 2.3 | 22.54 |
| 11 | 0.8 | 7.64 |
| 12 | 2.4 | 23.52 |
| 13 | 0.7 | 6.86 |
| 14 | 0.9 | 8.82 |
| 15 | 1.5 | 14.70 |
| 16 | 2.3 | 22.54 |
| 17 | 1.5 | 14.21 |
| 18 | 1.5 | 14.70 |
| 19 | 1.6 | 15.68 |
| 20 | 4.6 | 45.08 |

TABLE 9.4-continued

| Free Acid Titration Results on Final PLS | | |
|---|---|---|
| Test # | Total ml Added | Free Acid (g/l) |
| 21 | 3.5 | 34.30 |
| 22 | 0.9 | 8.82 |
| 23 | 3.1 | 30.38 |
| 24 | 1.0 | 9.80 |
| 25 | 3.8 | 37.24 |
| 26 | 0.7 | 6.86 |
| 27 | 2.9 | 28.42 |
| 28 | 2.1 | 20.58 |
| 29 | 0.9 | 8.33 |
| 30 | 2.4 | 23.52 |
| 31 | 0.7 | 6.86 |
| 32 | 0.8 | 7.84 |
| 33 | 2.5 | 24.50 |
| 34 | 0.8 | 7.84 |
| 35 | 2.1 | 20.58 |

ICP was performed by Montana Tech/CAMP and Hazen Research on leach solutions for copper, iron and arsenic. The results of this analysis are shown below. The copper numbers compare well to the copper titrations shown above.

TABLE 9.5

| ICP results on PLS | | | |
|---|---|---|---|
| | Arsenic g/L | Copper g/L | Iron g/L |
| 1 | 0.138 | 9.187 | 0.708 |
| 2 | 0.038 | 7.031 | 0.203 |
| 3 | 0.038 | 33.580 | 0.182 |
| 4 | 0.094 | 29.860 | 0.521 |
| 5 | 0.054 | 35.510 | 0.222 |
| 6 | 0.045 | 6.296 | 0.180 |
| 7 | 0.098 | 6.150 | 0.467 |
| 8 | 0.098 | 30.840 | 0.475 |
| 9 | 0.040 | 35.500 | 0.208 |
| 10 | 0.037 | 5.761 | 0.180 |
| 11 | 0.139 | 9.045 | 0.622 |
| 12 | 0.139 | 32.770 | 0.566 |
| 13 | 0.046 | 4.714 | 0.177 |
| 14 | 0.046 | 25.560 | 0.166 |
| 15 | 0.141 | 25.590 | 0.518 |
| 16 | 0.131 | 8.296 | 0.536 |
| 17 | 0.043 | 19.780 | 0.114 |
| 18 | 0.037 | 20.260 | 0.088 |
| 19 | 0.037 | 20.600 | 0.071 |
| 20 | 0.012 | 40.50 | 0.106 |
| 21 | 0.013 | 9.77 | 0.056 |
| 22 | 0.012 | 7.10 | 0.169 |
| 23 | 0.012 | 33.70 | 0.18 |
| 24 | 0.064 | 6.800 | 0.071 |
| 25 | 0.011 | 38.90 | 0.223 |
| 26 | 0.134 | 8.565 | 0.185 |
| 27 | 0.025 | 9.12 | 0.298 |
| 28 | 0.056 | 5.848 | 0.215 |
| 29 | 0.015 | 7.090 | 0.068 |
| 30 | 0.032 | 31.860 | 0.095 |
| 31 | 0.029 | 26.800 | 0.233 |
| 32 | 0.069 | 25.540 | 0.298 |
| 33 | 0.112 | 7.471 | 0.099 |
| 34 | 0.249 | 7.846 | 0.264 |
| 35 | 0.172 | 28.500 | 0.165 |

9.2.2 Solid Leach Residue Analysis

Solid leach residues were sent to Chris Christopherson, Inc. and Hazen Research for copper, iron and arsenic.

TABLE 9.6

| Solid Leach Residue Assays | | | |
|---|---|---|---|
| | Arsenic % | Copper % | Iron % |
| 1 | 5.77 | 17.76 | 30.67 |
| 2 | 6.24 | 17.60 | 30.34 |
| 3 | 5.90 | 16.56 | 30.35 |
| 4 | 6.26 | 17.43 | 30.64 |
| 5 | 3.16 | 11.61 | 16.15 |
| 6 | 5.89 | 17.66 | 31.82 |
| 7 | 6.28 | 17.59 | 31.02 |
| 8 | 6.16 | 17.01 | 30.45 |
| 9 | 5.64 | 16.03 | 28.98 |
| 10 | 6.02 | 16.69 | 30.47 |
| 11 | 5.58 | 19.59 | 29.03 |
| 12 | 5.67 | 19.93 | 29.35 |
| 13 | 5.37 | 20.95 | 28.01 |
| 14 | 5.72 | 22.05 | 29.11 |
| 15 | 4.94 | 25.71 | 26.86 |
| 16 | 5.72 | 19.70 | 30.60 |
| 17 | 5.52 | 14.46 | 31.60 |
| 18 | 4.83 | 12.94 | 30.52 |
| 19 | 5.12 | 14.14 | 30.80 |
| 20 | 3.06 | 19.10 | 28.10 |
| 21 | 2.75 | 17.90 | 29.10 |
| 22 | 2.79 | 18.20 | 28.10 |
| 23 | 3.05 | 18.00 | 28.60 |
| 24 | 4.01 | 10.90 | 34.02 |
| 25 | 3.56 | 19.70 | 26.70 |
| 26 | 4.80 | 13.18 | 32.90 |
| 27 | 2.62 | 18.10 | 28.30 |
| 28 | 5.65 | 15.12 | 31.43 |
| 29 | 5.30 | 15.11 | 29.93 |
| 30 | 5.95 | 15.99 | 29.24 |
| 31 | 6.25 | 16.38 | 29.40 |
| 32 | 5.77 | 14.99 | 29.11 |
| 33 | 4.39 | 11.53 | 34.15 |
| 34 | 4.85 | 12.87 | 33.80 |
| 35 | 4.67 | 12.38 | 32.81 |

Hazen also analyzed the sulfur species on the #33 composite solid residue as shown below.

TABLE 9.7

| Sulfur Analysis on #33 POX Residue | |
|---|---|
| Total Sulfur, % | 44.2 |
| SO4, % | <0.02 |
| Elemental S, % | 0.50 |
| Sulfide, % | 43.68 |

Most of the sulfur species are in the sulfide form in the solid residues and very little as elemental sulfur, which indicates the lack of a sulfur product layer surrounding the solid particles.

9.2.3 Pressure Oxidation Leach Results Summary

The PDX Leach summary shown in the table below is the result of the mass balances performed based on the assays from above. The mass balance calculations are shown in Appendix C.

TABLE 9.8

| POX Leach Results Summary | | | | |
|---|---|---|---|---|
| Test ID | Cu grams Diff Solids | Fe Extraction % | As Extraction % | Acid Consump. g acid/g solid |
| 1 | 0.54 | 17.36 | 22.84 | −0.059 |
| 2 | 0.17 | 16.87 | 19.63 | 0.108 |
| 3 | 0.20 | 15.49 | 20.99 | −0.166 |
| 4 | 0.53 | 15.52 | 18.50 | 0.068 |
| 5 | 0.35 | 31.72 | 36.46 | 0.141 |

TABLE 9.8-continued

| POX Leach Results Summary | | | | |
|---|---|---|---|---|
| Test ID | Cu grams Diff Solids | Fe Extraction % | As Extraction % | Acid Consump. g acid/g solid |
| 6 | 0.21 | 16.99 | 25.47 | 0.467 |
| 7 | 0.49 | 13.86 | 18.43 | −0.027 |
| 8 | 0.55 | 14.62 | 19.05 | 0.328 |
| 9 | 0.20 | 16.74 | 21.32 | 0.160 |
| 10 | 0.24 | 18.22 | 22.67 | 0.702 |
| 11 | 0.51 | 21.54 | 27.08 | 0.139 |
| 12 | 0.23 | 17.55 | 24.65 | 0.176 |
| 13 | 0.13 | 23.64 | 30.94 | 0.188 |
| 14 | 0.05 | 19.25 | 26.94 | 4.668 |
| 15 | −0.52 | 19.34 | 28.54 | −0.689 |
| 16 | 0.40 | 18.66 | 26.40 | 0.093 |
| 17 | 0.42 | 3.80 | 16.14 | 0.295 |
| 18 | 0.55 | 4.12 | 18.47 | 0.263 |
| 19 | 0.50 | 4.62 | 17.97 | 0.169 |
| 20 | 0.04 | 10.41 | 24.95 | −7.883 |
| 21 | 0.06 | 6.01 | 26.60 | −1.203 |
| 22 | 0.16 | 7.58 | 23.37 | −0.035 |
| 23 | 0.11 | 6.22 | 21.71 | −0.438 |
| 24 | 0.46 | 9.82 | 39.93 | −0.450 |
| 25 | 0.05 | 19.06 | 22.98 | −1.725 |
| 26 | 0.95 | 6.07 | 28.70 | 0.092 |
| 27 | 0.17 | 9.63 | 25.91 | −0.154 |
| 28 | 0.67 | 7.57 | 17.09 | 0.100 |
| 29 | 0.24 | 9.15 | 17.62 | −0.023 |
| 30 | 0.18 | 10.19 | 17.98 | 0.507 |
| 31 | 0.39 | 7.87 | 9.85 | 0.068 |
| 32 | 0.46 | 35.73 | 39.90 | 0.169 |
| 33 | 0.44 | 10.62 | 47.19 | 0.443 |
| 34 | 1.15 | 10.21 | 39.96 | 0.018 |
| 35 | 1.07 | 6.61 | 34.65 | 0.031 |

Test #33 resulted in about 47% arsenic extracted at 30 gpl sulfuric acid, 5 grams of solids, 10 gpl $Cu^{2+}$, and 160° C. for 1 hour.

9.2.4 Stat-Ease Modeling

Stat-Ease Design Expert software was used for modeling of the PDX leach results to determine significant factors and to perform some optimization. Time appeared to have the most significant effect on PLS arsenic content. A 3-D surface plot of these effects on the arsenic response is shown in FIG. 49.

This modeling resulted in the following Final Equation in Terms of Actual Factors with an R-squared of 0.6049 and standard deviation of 0.018 after excluding points from Tests 12, 16, 17 and 18:

$$1/(\text{As Extraction}) = \tag{9.1}$$

$$\begin{aligned}
&-0.021622 \\
&+0.021050 && *\text{Time} \\
&+5.56403E\text{-}004 && *\text{Temperature} \\
&-5.28853E\text{-}004 && *\text{Cu2+} \\
&+8.36188E\text{-}004 && *\text{Acid} \\
&+6.52218E\text{-}003 && *\text{Solids} \\
&-2.60371E\text{-}003 && *\text{Time}*\text{Solids} \\
&-1.33188E\text{-}005 && *\text{Temperature}*\text{Acid} \\
&-3.75247E\text{-}005 && *\text{Temperature}*\text{Solids} \\
&+1.81562E\text{-}005 && *\text{Cu2+}*\text{Acid}
\end{aligned}$$

Additional statistical data, including the 95% confidence intervals, for this model are shown in Appendix D.

9.3 Verification Tests

Four pressure oxidation tests were performed at the test conditions that resulted in the highest arsenic extraction from above, which was Marca Punta PDX Test #33. The results of these tests are as follows.

Copper and Free Acid were analyzed by titration and the results are shown in the tables below.

TABLE 9.9

| Copper Titration Results on Final PLS | | |
|---|---|---|
| Test # | Total ml Added | Copper (g/l) |
| 33-2 | 6.3 | 10.01 |
| 33-3 | 6.1 | 9.69 |
| 33-4 | 5.9 | 9.37 |
| 33-5 | 5.9 | 9.37 |

TABLE 9.10

| Free Acid Titration Results on Final PLS | | |
|---|---|---|
| Test # | Total ml Added | Free Acid |
| 33-2 | 4.6 | 45.08 |
| 33-3 | 3.8 | 37.24 |
| 33-4 | 3.5 | 34.30 |
| 33-5 | 2.6 | 25.48 |

ICP was performed by Hazen Research on leach solutions for copper, iron and arsenic. The results of this analysis are shown below. The copper numbers compare well to the copper titrations shown above.

TABLE 9.11

| ICP results on PLS | | | |
|---|---|---|---|
| | Arsenic g/L | Copper g/L | Iron g/L |
| 33-2 | 0.043 | 10.70 | 0.263 |
| 33-3 | 0.055 | 10.60 | 0.253 |
| 33-4 | 0.066 | 9.63 | 0.228 |
| 33-5 | 0.066 | 9.57 | 0.275 |

A composite solid leach residue was sent to Hazen Research for copper, iron and arsenic and results are shown below.

TABLE 9.12

| Solid Leach Residue Assays | | | |
|---|---|---|---|
| | Arsenic % | Copper % | Iron % |
| 33 Comp | 2.38 | 14.4 | 30.9 |

The PDX Verification Leach summary shown in the table below is the result of the mass balances performed based on the assays from above.

TABLE 9.13

| POX Verification Leach Results Summary | | | | |
|---|---|---|---|---|
| Test ID | Cu grams Diff Solids | Fe Extraction % | As Extraction % | Acid Consump. g acid/g solid |
| 33-2 | 0.43 | 26.66 | 44.32 | 0.906 |
| 33-3 | 0.40 | 24.55 | 46.67 | 2.337 |
| 33-4 | 0.40 | 22.91 | 49.39 | 0.749 |
| 33-5 | 0.39 | 24.87 | 49.31 | 2.681 |

9.4 Leach Residue Characterization

MLA was performed at Montana Tech/CAMP on the Test 33 composite sample. The sample was disaggregated by passing the sample though a 200 mesh sieve prior to cold-mounting in epoxy resin.

Pyrite was the most abundant phase. The enargite content was inversely related to the pyrite concentration. Covellite was present at minor levels. Quartz was present at trace levels and the sulfides sphalerite and chalcopyrite were found in the sample. The leach residue modal mineralogy as determined by MLA is shown below compared to the head sample.

TABLE 9.14

| Mineral Grade for POX Head Sample & Leach Residue #33 Composite | | | |
|---|---|---|---|
| Mineral | Formula | Head Wt % | Residue Wt % |
| Pyrite | $FeS_2$ | 61.4 | 67.8 |
| Enargite | $Cu_3AsS_4$ | 38.0 | 31.2 |
| Covellite | CuS | | 0.46 |
| Quartz | $SiO_2$ | 0.27 | 0.32 |
| Chalcocite | $Cu_2S$ | 0.20 | |
| Chalcopyrite | $CuFeS_2$ | 0.04 | 0.08 |
| Sphalerite | ZnS | 0.02 | 0.03 |
| Galena | PbS | 0.01 | |
| Zircon | $ZrSiO_4$ | | 0.03 |
| Chromferide | $Fe_3Cu_{0.4}$ | | 0.02 |
| K_Feldspar | $KAlSi_3O_8$ | | 0.01 |
| Sulfur | S | | 0.01 |
| Rutile | $TiO_2$ | | 0.01 |
| Almandine | $Fe_3Al_2(SiO_4)_3$ | | P |
| Alunite | $KAl_3(SO_4)_2(OH)_6$ | | P |
| Calcite | $CaCO_3$ | | P |
| Albite | $NaAlSi_3O_8$ | | P |
| FeO | $Fe_{2.5}O_{3.5}$ | 0.03 | P |
| Andradite | $Ca_3Fe_2(SiO_4)_3$ | | ND |
| Copper | Cu | | ND |
| Pyroxene | $CaMgSi_2O_6$ | | ND |

P—mineral present, found at less than 0.01%
ND—mineral not detected

The MLA-calculated elemental values show in the table below are based on the MLA-determined modal mineralogy and assigned chemical formulas as presented above as well as the estimated mineral phase density. Enargite was identified as a mineral containing arsenic as shown in Table 9.16. Copper behaved similarly to arsenic as enargite was the main mineral source of copper with minor contribution from covellite. The primary source of iron in the samples was from the mineral pyrite, so the iron content was directly related to it.

Based on enargite being the source of arsenic, the MLA-based arsenic extraction comes out to 0.1559 grams of arsenic leached compared to the 0.13 grams of arsenic calculated in the mass balance, as seen in Appendix C.

Referring back to the postulated enargite metathesis reaction 5.9 from the Eh-pH thermodynamic study, the MLA mineralogical results of PDX Test #33 qualitatively confirm this has occurred. As seen, while the enargite mineral phase is decreasing the covellite phase is created in Table 9.14. As well, the overall test mass balance points to a gain of copper mass in the leached solids. However, more focused testing on a larger scale would be necessary to confirm this as the mass of sample treated in PDX Test #33 was 5 grams.

TABLE 9.15

| MLA-Calculated Bulk Elemental Analysis | |
|---|---|
| Element | wt % |
| Sulfur | 46.6 |
| Iron | 31.6 |
| Copper | 15.4 |
| Arsenic | 5.94 |
| Oxygen | 0.19 |
| Silicon | 0.16 |
| Zinc | 0.02 |
| Zirconium | 0.02 |
| Titanium | 0.01 |
| Aluminum | P |
| Chromium | P |
| Potassium | P |
| Calcium | P |
| Carbon | P |
| Sodium | P |
| Hydrogen | P |
| Magnesium | ND |

P—element present at less than 0.01%
ND—element not detected

TABLE 9.16

| Arsenic Distribution for #33 Composite | |
|---|---|
| Mineral | wt % |
| Enargite | 100.0 |
| Total | 100.0 |

TABLE 9.17

| Copper Distribution for #33 Composite | |
|---|---|
| Mineral | wt % |
| Enargite | 97.8 |
| Covellite | 1.99 |
| Chalcopyrite | 0.17 |
| Copper | 0.00 |
| Total | 100.0 |

TABLE 9.18

| Iron Distribution for #33 Composite | |
|---|---|
| Mineral | wt % |
| Pyrite | 99.9 |
| Chalcopyrite | 0.07 |
| Chromferide | 0.05 |
| Almandine | 0.00 |
| FeO | 0.00 |
| Andradite | 0.00 |
| Total | 100.0 |

FIG. 50 is a classified MLA image from a selected frame obtained during analysis of the #33 composite leach residue with an enargite particle highlighted. Note the appearance of a covellite phase after leaching.

The backscatter electron image (BSE) image in FIG. 51 is from the same analytical frame as the MLA image shown in the above figure with the particle highlighted in the MLA image, circled in the BSE image. Enargite (En) particles appear slightly brighter than the pyrite (Py) particles in the BSE image.

The particle size distribution and grain size distributions for pyrite and enargite are shown in FIG. 52. The particle size distribution P80 is 40 μm and the grain size P80's for both pyrite and enargite are near 40 also. This is because the grind size is smaller than the "true" grain size for the minerals and they are the major constituents of the samples. It follows that liberation should be good for both minerals as seen in FIG. 53 is 72 to 87% liberated, with enargite being less liberated, which is due to it being less abundant than pyrite.

9.5 Kinetic Tests

Based on the maximum arsenic extraction coupled with the evidence of a metathesis reaction, kinetic tests were performed using the same autoclave in 15 minute increments for PDX Test #33. The following table shows the experimental conditions at which the tests were performed.

TABLE 9.19

Leach Conditions for Kinetic Tests

| Test ID | Time hrs | Temp deg C. | Cu 2+ g/L | Acid g/L | Solids g | O2 press psi |
|---|---|---|---|---|---|---|
| K-1 | 0.25 | 145 | 10 | 30 | 5 | 100 |
| K-2 | 0.50 | 145 | 10 | 30 | 5 | 100 |
| K-3 | 0.75 | 145 | 10 | 30 | 5 | 100 |
| K-4 | 1.00 | 145 | 10 | 30 | 5 | 100 |
| K-5 | 1.50 | 145 | 10 | 30 | 5 | 100 |

9.5.1 Kinetic Analysis

The kinetic leach tests were analyzed and the results are as follows. Copper and Free Acid were analyzed by titration and the results are shown in the tables below.

TABLE 9.20

Copper Titrations

| Test # | Total ml Added | Copper (g/l) |
|---|---|---|
| K-1 | 5.6 | 8.90 |
| K-2 | 5.9 | 9.37 |
| K-3 | 5.4 | 8.58 |
| K-4 | 5.8 | 9.21 |
| K-5 | 6.0 | 9.53 |

TABLE 9.21

Free Acid Titrations

| Test # | Total ml Added | Free Acid (g/l) |
|---|---|---|
| K-1 | 4.2 | 41.16 |
| K-2 | 4.3 | 42.14 |
| K-3 | 4.0 | 39.20 |
| K-4 | 5.1 | 49.98 |
| K-5 | 4.2 | 41.16 |

ICP was performed by Hazen Research on leach solutions for copper, iron and arsenic. The results of this analysis are shown below. The copper numbers compare well to the copper titrations shown above.

TABLE 9.22

ICP Results on PLS Performed by Hazen Research

| | Arsenic g/L | Copper g/L | Iron g/L |
|---|---|---|---|
| K-1 | 0.016 | 9.30 | 0.105 |
| K-2 | 0.031 | 9.33 | 0.185 |
| K-3 | 0.05 | 8.83 | 0.168 |
| K-4 | 0.083 | 9.70 | 0.404 |
| K-5 | 0.076 | 8.50 | 0.245 |

Solid leach residues were sent to Hazen Research for copper, iron and arsenic and results are shown below.

TABLE 9.23

Solid Leach Residue Assays Performed by Hazen Research

| | Arsenic % | Copper % | Iron % |
|---|---|---|---|
| K-1 | 3.16 | 18.3 | 28.3 |
| K-2 | 2.62 | 17.3 | 28.2 |
| K-3 | 2.41 | 15.1 | 30.9 |
| K-4 | 2.47 | 13.1 | 30.3 |
| K-5 | 2.27 | 12.7 | 31.5 |

TABLE 9.24

Kinetic Leach Results Summary

| Test ID | Cu grams Diff Solids | Fe Extraction % | As Extraction % | Acid Consump. g acid/g solid |
|---|---|---|---|---|
| K-1 | 0.08 | 10.82 | 26.19 | 1.459 |
| K-2 | 0.17 | 16.88 | 34.91 | 2.040 |
| K-3 | 0.31 | 17.02 | 44.39 | −5.220 |
| K-4 | 0.50 | 36.93 | 55.45 | −2.891 |
| K-5 | 0.47 | 25.86 | 54.33 | −2.173 |

In general, the arsenic extraction increased as expected as time progressed, with the exception of Test K-5. These tests actually exceeded the recovery for Test #33 at about 47% by about 8% at the 1 hour point. These tests were all performed at 30 gpl sulfuric acid, 5 grams of solids, 10 gpl $Cu^{2+}$, and 160° C.

9.5.2 Kinetic Leach Residue Characterization

MLA was performed on the solid residues from each kinetic test at Montana Tech/CAMP. The sample was disaggregated by passing the sample though a 200 mesh sieve prior to cold-mounting in epoxy resin.

Pyrite was the most abundant phase. The enargite content was inversely related to the pyrite concentration. Covellite was present at minor levels. Quartz was present at trace levels and the sulfides sphalerite and chalcopyrite were found in the sample. The modal mineralogy was determined by MLA is shown below.

TABLE 9.25

Phase/Mineral Concentrations for K-1 through K-5 Leach Residues in wt %

| Mineral | Formula | Feed | K-1 | K-2 | K-3 | K-4 | K-5 |
|---|---|---|---|---|---|---|---|
| Pyrite | $FeS_2$ | 61.4 | 62.4 | 64.1 | 67.7 | 73.9 | 69.4 |
| Enargite | $Cu_3AsS_4$ | 38.0 | 35.3 | 33.8 | 31.0 | 25.2 | 29.2 |
| Covellite | CuS | | 1.73 | 1.33 | 0.76 | 0.24 | 0.56 |
| Quartz | $SiO_2$ | 0.27 | 0.26 | 0.49 | 0.27 | 0.41 | 0.58 |
| Chalcocite | $Cu_2S$ | 0.20 | ND | ND | ND | ND | ND |
| Chalcopyrite | $CuFeS_2$ | 0.04 | 0.09 | 0.13 | 0.12 | 0.07 | 0.14 |
| Sphalerite | ZnS | 0.02 | 0.20 | 0.13 | 0.07 | 0.03 | 0.02 |
| Galena | PbS | 0.01 | ND | ND | ND | ND | ND |
| Zircon | $ZrSiO_4$ | ND | P | ND | ND | ND | ND |
| Chromferide | $Fe_3Cu_{0.4}$ | ND | 0.02 | 0.02 | 0.02 | 0.01 | 0.02 |
| K_Feldspar | $KAlSi_3O_8$ | ND | P | 0.01 | 0.01 | 0.01 | 0.01 |
| Sulfur | S | ND | ND | ND | ND | 0.06 | 0.05 |
| Rutile | $TiO_2$ | ND | 0.02 | 0.02 | 0.02 | 0.03 | 0.03 |
| Almandine | $Fe_3Al_2(SiO_4)_3$ | ND | P | P | P | P | ND |
| Alunite | $KAl_3(SO_4)_2(OH)_6$ | ND | P | P | P | P | P |
| Calcite | $CaCO_3$ | ND | ND | ND | P | P | P |
| Albite | $NaAlSi_3O_8$ | ND | ND | 0.01 | ND | P | P |
| FeO | $Fe_{2.5}O_{3.5}$ | 0.03 | ND | ND | P | P | P |
| Andradite | $Ca_3Fe_2(SiO_4)_3$ | ND | ND | P | ND | 0.01 | ND |
| Copper | Cu | ND | ND | P | 0.01 | P | ND |
| Pyroxene | $CaMgSi_2O_6$ | ND | P | 0.01 | P | ND | ND |

P—mineral present, found at less than 0.01%
ND—mineral not detected

The MLA-calculated elemental values show in the table below are based on the MLA-determined modal mineralogy and assigned chemical formulas as presented above as well as the estimated mineral phase density. Enargite was identified as a mineral containing arsenic as shown in Table 9.27. Copper behaved similarly to arsenic as enargite was the main mineral source of copper with minor contribution from covellite. The primary source of iron in the samples was from the mineral pyrite, so the iron content was directly related to it. This deportment was not provided for the feed sample.

TABLE 9.2

MLA-Calculated Bulk Elemental Analysis

| Element | Feed | K-1 | K-2 | K-3 | K-4 | K-5 |
|---|---|---|---|---|---|---|
| Sulfur | 45.3 | 45.5 | 45.8 | 46.6 | 47.9 | 46.9 |
| Iron | 28.6 | 29.1 | 29.9 | 31.6 | 34.5 | 32.4 |
| Copper | 18.6 | 18.3 | 17.3 | 15.6 | 12.4 | 14.5 |
| Arsenic | 7.23 | 6.71 | 6.43 | 5.9 | 4.79 | 5.55 |
| Oxygen | 0.15 | 0.15 | 0.28 | 0.16 | 0.24 | 0.33 |
| Silicon | 0.12 | 0.13 | 0.23 | 0.13 | 0.19 | 0.27 |
| Zinc | 0.01 | 0.14 | 0.08 | 0.05 | 0.02 | 0.01 |
| Lead | 0.01 | ND | ND | ND | ND | ND |
| Zirconium | ND | P | ND | ND | ND | ND |
| Titanium | ND | 0.01 | 0.01 | 0.01 | 0.02 | 0.02 |
| Aluminum | ND | P | P | P | P | P |
| Chromium | ND | P | P | P | P | P |
| Potassium | ND | P | P | P | P | P |
| Calcium | ND | P | P | P | P | P |
| Carbon | ND | ND | ND | P | P | P |
| Sodium | ND | ND | P | ND | P | P |
| Hydrogen | ND | P | P | P | P | P |
| Magnesium | ND | P | P | P | ND | ND |

P—element present at less than 0.01%
ND—element not detected

TABLE 9.27

Arsenic Distribution for #33 Composite

| Mineral | K-1 | K-2 | K-3 | K-4 | K-5 |
|---|---|---|---|---|---|
| Enargite | 100.0 | 100.0 | 100.0 | 100.0 | 100.0 |
| Total | 100.0 | 100.0 | 100.0 | 100.0 | 100.0 |

TABLE 9.28

Copper Distribution for #33 Composite

| Mineral | K-1 | K-2 | K-3 | K-4 | K-5 |
|---|---|---|---|---|---|
| Enargite | 93.5 | 94.6 | 96.4 | 98.5 | 97.1 |
| Covellite | 6.31 | 5.13 | 3.25 | 1.29 | 2.55 |
| Chalcopyrite | 0.17 | 0.26 | 0.27 | 0.21 | 0.33 |
| Copper | 0.00 | 0.01 | 0.04 | 0.02 | 0.00 |
| Total | 100.0 | 100.0 | 100.0 | 100.0 | 100.0 |

TABLE 9.29

Iron Distribution for #33 Composite

| Mineral | K-1 | K-2 | K-3 | K-4 | K-5 |
|---|---|---|---|---|---|
| Pyrite | 99.8 | 99.8 | 99.8 | 99.9 | 99.8 |
| Chalcopyrite | 0.09 | 0.13 | 0.12 | 0.07 | 0.13 |
| Chromferide | 0.07 | 0.05 | 0.04 | 0.03 | 0.04 |
| Almandine | 0.00 | 0.00 | 0.00 | 0.00 | 0.00 |
| FeO | 0.00 | 0.00 | 0.00 | 0.01 | 0.00 |
| Andradite | 0.00 | 0.00 | 0.00 | 0.01 | 0.00 |
| Total | 100.0 | 100.0 | 100.0 | 100.0 | 100.0 |

A pyrite particle is highlighted in the classified MLA image from the K-1 leach residue in FIG. 54.

The BSE image of the K-1 leach residue shows the circled pyrite particle that displays its crystalline form in FIG. 55.

The particle and grain size distributions and locking for pyrite and enargite are shown in FIG. 56 and FIG. 57, respectively. The particle and grain size is similar to the previous sample with a P80 of 38 μm. Liberation is 73 to 83% with pyrite being slightly more liberated than enargite, which is also similar to what was observed with the previous sample.

The highlighted particle in FIG. 58 shows the association between pyrite and enargite in the MLA image from the K-2 sample.

The contrast between enargite (En) and pyrite (Py) can be seen in the BSE image in FIG. 59.

The particle size, grain size and liberation data in FIG. 60 and FIG. 61 are similar to the previous samples. The particle size P80 was about 45 μm with the grain size P80's around 40 to 45 μm and liberation was 73 to 83%.

Covellite is highlighted in the leach residue from sample K-3 in FIG. 62.

The BSE image from the K-3 leach residue in FIG. 63 has a particle of covellite (Cov) circled. The mottled appearance is caused by the presence of some attached silicate.

Particle size and grain size data for the K-3 leach residue is shown in FIG. 64 with the P80's all being around 40 μm. Pyrite liberation was about 84% and the enargite, which was slightly less than seen in previous samples, at about 62% as seen in FIG. 65.

The MLA image in FIG. 66 highlights a pyrite particle with a quartz inclusion.

The BSE image shows the pyrite particle with a quartz inclusion in FIG. 67.

The particle size distribution for the K-4 residue P80 was 50 μm while the grain size P80 was 45 μm for enargite and about 50 μm for pyrite as seen in FIG. 68. Overall liberation was slightly lower in this sample than in the others with about 53% liberation for enargite and 77% liberation for pyrite as seen by the locking data in FIG. 69.

A classified MLA image from the K-5 leach residue is shown in FIG. 70.

Particles of quartz (Qtz), enargite (En), and pyrite (Py) are identified in the BSE image from the K-5 residue in FIG. 71.

Particle size and pyrite and enargite grain size P80's were all near 50 μm for the K-5 leach residue as seen in FIG. 72. Enargite liberation was 63% and pyrite liberation was 78% according to the liberation data in FIG. 73.

9.5.3 Kinetic Modeling

The Shrinking Core Model for spherical particles of unchanging size in a heterogeneous system can be applied to the system. The model suggests five steps that occur in succession during the reaction:

1. Diffusion of reactant A through the film around the particle to the solid surface.
2. Penetration and diffusion of A though the ash layer of the particle to the surface of the unreacted core.
3. Reaction of A with the solid at this reaction surface.
4. Diffusion of products through the ash back to the exterior surface of the solid.
5. Diffusion of products through the film back into the main fluid.

The step with the highest resistance, being the slowest, is considered the rate-controlling step. FIG. 74 below shows the shrinking core model and its associated concentration profile where the fluid is a gas, rather than a liquid.

When diffusion through the fluid film is controlling, the rate is controlled by the concentration gradient in the fluid as shown in the equation and FIG. 75. The gradient can be minimized by increasing agitation in the system.

$$-\frac{1}{S_{ex}}\frac{dN_B}{dt} = -\frac{1}{4\pi R^2}\frac{dN_B}{dt} = \frac{b}{4\pi R^2}\frac{dN_B}{dt} = bk_g(C_{Ag} - C_{As}) = bk_g C_{Ag} = \text{constant} \tag{9.2}$$

When diffusion through the ash layer controls, particle size and surface area will determine the rate as shown in the equation and FIG. 76.

$$-\frac{dN_A}{dt} = 4\pi r^2 Q_A = 4\pi r^2 Q_{As} = 4\pi r_c^2 Q_{As} = \text{constant} \tag{9.3}$$

When the chemical reaction controls, the rate is as shown in Equation 9.4 and FIG. 77 below. Increasing the temperature will increase the rate of reaction according to the Arrhenius relationship as seen in Equation 9.5.

$$-\frac{1}{4\pi r_c^2}\frac{dN_A}{dt} = -\frac{b}{4\pi r_c^2}\frac{dN_A}{dt} = bk'' C_{Ag} \tag{9.4}$$

$$k = Ae^{-E_a/(RT)} \tag{9.5}$$

The chemical step is usually much more temperature-sensitive than the physical steps so tests at varying temperatures with derivation of the activation energy should distinguish between ash or film diffusion as compared to chemical reaction as the controlling step. Physical processes tend to have low activation energy values vs. those of chemical reactions, i.e. $E_a$<5 kcal vs. 10-25 kcal, respectively (L. G. Twidwell, Huang, and Miller 1983).

Assuming the Shrinking-Core Model, the following are conversion-time expressions for spherical particles for the various controlling mechanisms, where $X_B$ is conversion (Levenspiel 1999).

TABLE 9.30

Conversion-Time Expressions for Spherical Particles, Shrinking-Core Model (Levenspiel 1999)

| | Film Diffusion Controls | Ash Diffusion Controls | Reaction Controls |
|---|---|---|---|
| Sphere $X_B = 1 - \left(\frac{r_C}{R}\right)^3$ | $\frac{t}{\tau} = X_B$ | $\frac{t}{\tau} = 1 - 3(1 - X_B)^{2/3} + 2(1 - X_B)$ | $\frac{t}{\tau} = 1 - (1 - X_B)^{1/3}$ |

TABLE 9.30-continued

| Conversion-Time Expressions for Spherical Particles, Shrinking-Core Model (Levenspiel 1999) | | |
|---|---|---|
| Film Diffusion Controls | Ash Diffusion Controls | Reaction Controls |
| $\tau = \frac{\rho_B R}{3bk_g C_{Ag}}$ | $\tau = \frac{\rho_B R^2}{6bD_e C_{Ag}}$ | $\tau = \frac{\rho_B R}{bk'' C_{Ag}}$ |

FIGS. 78 and 79 show the conversion of spherical particles when chemical reaction, film diffusion, and ash diffusion control. By comparing the results of kinetic runs to these curves, the rate-controlling step could be determined. Unfortunately, there is not a considerable difference between ash diffusion and chemical reaction as controlling steps and may disappear in the scatter in experimental data (Levenspiel 1999).

The calculated arsenic extractions from each kinetic test were converted to a fractional conversion value, $X_B$, and substituted into the t/τ expressions in Table 9.30 for each of the possible controlling mechanisms as shown in Table 9.31 below.

TABLE 9.31

Kinetic Calculations

| Test ID | Time | % As Extraction | Fractional Conversion | Control Mechanism: Fluid Film | Chemical | Pore Diffusion |
|---|---|---|---|---|---|---|
| K-1 | 0.25 | 26.19 | 0.2619 | 0.26 | 0.10 | 0.026 |
| K-2 | 0.50 | 34.91 | 0.3491 | 0.35 | 0.13 | 0.049 |
| K-3 | 0.75 | 44.39 | 0.4439 | 0.44 | 0.18 | 0.083 |
| K-4 | 1.00 | 55.45 | 0.5545 | 0.55 | 0.24 | 0.141 |
| K-5 | 1.50 | 54.33 | 0.5433 | 0.54 | 0.23 | 0.134 |

The data from Table 9.31 was plotted in FIG. 80, like FIG. 79, to compare mechanisms.

The K-5 point appears to be where no additional leaching occurs so to compare the mechanisms graphically another way, this point was excluded. The graphical comparisons are shown in FIGS. 81-83.

Based on these kinetic results, it cannot be determined as of yet what the controlling mechanism is. There is also the possibility of a mechanism change as the process progresses. Additional studies at varying temperatures would need to be performed in order to calculate a rate constant, activation energies, etc.

9.6 High Grade Enargite Leaching

Leach tests were performed using the same autoclave on a prepared high grade enargite specimen sample to test reproducibility based on the pressure oxidation leach tests with the three highest recoveries, #24, 32 and 33 from section 9.1 above. The following table shows the experimental conditions at which the tests were performed.

TABLE 9.32

Leach Conditions for High Grade Enargite Tests

| Test ID | Time hrs | Temp deg C. | Cu 2+ g/L | Acid g/L | Solids g | O2 press psi |
|---|---|---|---|---|---|---|
| HG-1 | 1.0 | 145 | 40 | 10 | 5 | 100 |
| HG-2 | 1.0 | 145 | 10 | 30 | 5 | 100 |
| HG-4 | 0.5 | 145 | 10 | 10 | 5 | 100 |

9.6.1 High Grade Leach Analysis

The high grade tests were analyzed and the results are as follows. Copper and Free Acid were analyzed by titration and the results are shown in the tables below.

TABLE 9.33

Copper Titrations

| Test # | Total ml Added | Copper (g/l) |
|---|---|---|
| HG-1 | 22.7 | 36.06 |
| HG-2 | 5.8 | 9.21 |
| HG-4 | 5.6 | 8.90 |

TABLE 9.34

Free Acid Titrations

| Test # | Total ml Added | Free Acid (g/l) |
|---|---|---|
| HG-1 | 1.6 | 15.68 |
| HG-2 | 4.2 | 41.16 |
| HG-4 | 1.4 | 13.72 |

ICP was performed by Hazen Research on leach solutions for copper, iron and arsenic. The results of this analysis are shown below. The copper numbers compare well to the copper titrations shown above.

TABLE 9.35

ICP Results on PLS Performed by Hazen Research

| | Arsenic g/L | Copper g/L | Iron g/L |
|---|---|---|---|
| HG-1 | 0.079 | 40.20 | 0.184 |
| HG-2 | 0.094 | 8.15 | 0.055 |
| HG-4 | 0.059 | 8.82 | 0.058 |

Solid leach residues were sent to Hazen Research for copper, iron and arsenic and results are shown below.

TABLE 9.36

| Solid Leach Residue Assays Performed by Hazen Research | | | |
|---|---|---|---|
| | Arsenic % | Copper % | Iron % |
| HG-1 | 3.41 | 25.9 | 17.9 |
| HG-2 | 3.33 | 20.8 | 20.7 |
| HG-4 | 4.14 | 27.9 | 16.8 |

The high grade leach summary shown in the table below is the result of the mass balances performed based on the assays from above.

TABLE 9.37

| High Grade Leach Results Summary | | | | |
|---|---|---|---|---|
| Test ID | Cu grams Diff Solids | Fe Extraction % | As Extraction % | Acid Consump. g acid/g solid |
| HG-1 | −0.03 | 32.27 | 45.24 | 0.689 |
| HG-2 | 0.23 | 23.43 | 52.18 | −4.592 |
| HG-4 | −0.32 | 20.96 | 32.36 | −3.646 |

The summary leach results for the Marca Punta PDX tests compared to their corresponding high grade test are shown in the table below.

TABLE 9.38

| Comparative Leach Summary for High Grade vs. POX tests | | | | | | |
|---|---|---|---|---|---|---|
| | Compare | | Compare | | Compare | |
| | HG-1 | POX 32 | HG-2 | POX 33 | HG-4 | POX 24 |
| Cu Difference in Solids (g) | −0.03 | 0.46 | 0.23 | 0.44 | −0.32 | 0.46 |
| Fe Extraction (%) | 32.27 | 35.73 | 23.43 | 10.62 | 20.96 | 9.82 |
| As Extraction (%) | 45.24 | 39.90 | 52.18 | 47.19 | 32.36 | 39.93 |
| Acid Consumption (g/g) | 0.69 | 0.17 | −4.59 | 0.44 | −3.65 | −0.45 |

This data shows some reproducibility but the copper increase is not as apparent. The arsenic extractions and acid consumptions have a reasonable correlation. The copper gain in the solids and iron extraction do not correlate well, which may be due to mineralogical effects or due to using a concentrate sample versus a high grade specimen.

Chapter 10—Proposed Process & Economic Evaluation

In an attempt to determine the preliminary scoping level economic feasibility of enargite pressure oxidation, a process flowsheet based on this research was developed as shown in FIG. 10.1 below. In some embodiments, the disclosed process entails pressure oxidation and leaching of the arsenic from the concentrate, performing solid/liquid separation by filtering, followed by arsenic precipitation by ferrihydrite or scorodite resulting in an upgraded copper concentrate to send to a smelting or copper concentrate leach operation.

In some embodiments the concentrate may be treated in a standard copper smelter used in the recovery of copper and precious metals. An apparent separation of arsenic from copper was achieved. For PDX Test #33 with the highest arsenic extraction, the copper gain in the solids was 0.44 grams, or about 12.5%, which would increase the amount paid for copper from the concentrate sent to the smelter.

Some assumptions used in the preliminary economics are as follows:

Used Freeport Miami smelter schedule
Used updated Bagdad capital costs
Low severity pressure oxidation
Operating costs do not include arsenic fixation
157 tons/day concentrate feed as per Bagdad
Operating 350 days/year
Approximately 50% arsenic removal
0.44 g acid/g concentrate acid consumption
10 year cash flows used
8% discount rate
No by-product credits were accounted for

10.1 Smelter Treatment

A Freeport Miami smelter schedule is shown in Table 10.1 below showing the smelter limits and penalties. It should be noted that an iron content above 15% results in an unknown increased treatment charge for more flux being needed in the process. A reduction in arsenic content from 5.89 wt % to 4.39% results in a penalty savings of approximately $2920/day for a plant treating 157 tons/day of concentrate.

TABLE 10.1

| FMI Miami Smelter Limits & Penalties | | | |
|---|---|---|---|
| Element | Symbol | Penalty Formula | |
| Alumina | Al2O3 | $0.50 ea 0.1% > 5% | |
| Iron | Fe | >15% = increased treatment charge for more flux needed | |
| Arsenic | As | $0.50/lb > 1% (20 lb) OR 2$/dt ea 0.1% > 0.1% Max 0.2% | |
| Barium | Ba | 0.5 to 1% limit | |
| Beryllium | Be | <10 ppm limit | |
| Bismuth | Bi | ($1.10 to $7.50)/dt ea 0.1% > (0.1% to 0.4%) Max 0.4% | |
| Cyanide | CN | <10 ppm ! | |
| Cadmium | Cd | ($2.20 to $7.50)/dt ea 0.1% > (0.05% to 0.2%) Max 0.4% | |
| Chloride | Cl | BAD PLAYER, DO NOT WANT ANY | 5$/dt ea 0.1% > 2% |
| Cobalt | Co | 0.5% limit | |
| Chromium | Cr | $0.50 dt ea 0.1% > 3% no hex chrome, 5% max on tri v Cr | NO Cu CHROMATE! |

TABLE 10.1-continued

| FMI Miami Smelter Limits & Penalties | | | |
|---|---|---|---|
| Fluoride | F | $5 dt ea 0.1% > 0.2% 0.5% max | |
| Mercury | Hg | ($1.85 to $2)/dt ea 10 ppm > 10 ppm | |
| Magnesium Ox | MgO | Normally 10% limit, desirable element in feed??? | |
| Manganese | Mn | 2.0% limit | |
| Sodium | Na | 5.0% limit | |
| Nickel | Ni | $2 dt ea 0.1% > 2% | |
| Phosphorus | P | 3.0% limit | |
| Lead | Pb | $1 dt ea 0.1& > 1% OR $1/lb > 0.5% (more severe) | |
| Antimony | Sb | BAD PLAYER, DO NOT WANT ANY | ($2 to $2.20) dt ea 0.1% > 0.3% |
| Selenium | Se | 0.1% limit | |
| Tin | Sn | ($1.10 to $3) dt ea 0.1% > (0.2 to 3%) Max 3% | |
| Tellurium | Te | 0.01% limit | |
| Thallium | Tl | 0.01% limit | |
| Zinc | Zn | $0.50 dt ea 0.1% > 3% 4.0% limit | |
| Moisture | H2O | $2.50 wt ea 1% > (15% to 50%)what is the material? | |
| Manifest | | $30 ea | |
| Bag containers | | $20 ea | |
| Liners | | ? # & size? | |

| | | |
|---|---|---|
| Refining Fees Cu = 12¢ to 14¢ per pound paid | Recovery Rates | Cu = 96.5% |
| Au = $6.50 to $7.50 per oz paid | | Au = 90%+ |
| As = 50¢ per oz paid | | As = 90%+ |
| 10,000 g or ppm = 1% | | |
| 1,000 = 0.1% | ppm = opt | gmt = # ÷ 31.103481 = opt |
| 100 = 0.01% | 31.103481 | |
| 10 = 0.001% | 453 gr = 1 lb. | |
| 31.1035 gr = 1 troy oz | 14.583 troy oz = 1 pound | Kg/Mt = # × 32.151 = opt |

10.2 Capital Costs

Capital costs were estimated based on a 1999 Bagdad demonstration plant cost of $40 million brought to 2013 using Marshall & Swift Economic Indicators as $57 million (McElroy and Young 1999; "Economic Indicators" 2011; "Economic Indicators" 2013). Table 10.2 shows the Marshall & Swift Indices and Table 10.3 shows FMI's 2003 capital cost drivers updated using the Index to $US in 2013.

TABLE 10.2

| Marshall & Swift Economic Indicators ("Economic Indicators" 2011; "Economic Indicators" 2013) | | |
|---|---|---|
| Annual Index | | Capital Cost |
| 2003 | 402.0 | $40,000,000 |
| Prelim. '13 | 571.4 | $57,000,000 |

TABLE 10.3

| FMI Pressure Oxidation Process Capital Costs (John O. Marsden and Brewer 2003) | | |
|---|---|---|
| Parameter | 2003 Cost | 2013 Cost |
| Concentrate Leaching (including SX/EW) | $0.90 per annual lb Cu | $1.28 per annual lb Cu |
| Concentrate Leaching (excluding SX/EW) | <$0.45 per annual lb Cu | <$0.64 per annual lb Cu |
| Smelting & Refining (Greenfield) | $1.70-2.00 per annual lb Cu | $2.42-2.84 per annual lb Cu |
| Smelting & Refining (Expansion) | <$1.00 per annual lb Cu | <$1.42 per annual lb Cu |

10.3 Operating Costs

Shown below are the operating costs for the PDX process. The rate of inflation was considered using the Consumer Price Index from the Bureau of Labor Statistics ("Inflation Calculator: Bureau of Labor Statistics" 2013). Table 10.4 shows 1999 $US updated using the CPI to $US in 2013 by McElroy and Young.

TABLE 10.4

Pressure Oxidation Process Operating Costs (McElroy and Young 1999)

| | 1999 $US/lb Copper | 2013 $US/lb Copper |
|---|---|---|
| Oxygen | 0.012 | 0.02 |
| Neutralization (mill tailing) | 0.006 | 0.01 |
| Grinding & Autoclave Agitation | 0.018 | 0.03 |
| Maintenance Supplies | 0.019 | 0.03 |
| Salaries/Labor | 0.006 | 0.01 |
| Total Leach | 0.061 | 0.09 |
| TOTAL | 0.122 | 0.19 |

Oxygen costs shown above are based on chalcopyrite oxidation oxygen consumption. Equations 5.1 and 5.4 for enargite oxidation compared to Equations 2.18 and 2.19 for chalcopyrite oxidation show that the oxygen required would be lower for the enargite process, thus lowering oxygen costs. For chalcopyrite oxidation at lower temperatures (below 200° C.), five moles of oxygen are required vs 2.75 moles of oxygen for enargite. Table 10.5 shows 2003 operating costs by FMI updated using the CPI to SUS in 2013.

TABLE 10.5

FMI Pressure Oxidation Process Operating Costs (John O. Marsden and Brewer 2003)

| Parameter | 2003 Cost | 2013 Cost |
|---|---|---|
| Smelting Cost (long term) | $80-90 per metric ton concentrate | $101-114 per metric ton concentrate |
| Refining Cost (long term) | $0.08-$0.09 per pound Cu | $0.10-$0.11 per pound Cu |
| Acid cost (delivered) | $10-50 per metric ton | $13-63 per metric ton |
| Freight rates (concentrate, acid, cathode) | Depends on local situation $0.02-0.06 per ton-km by truck $25-30 per ton by sea | Depends on local situation $0.03-0.08 per ton-km by truck $32-38 per ton by sea |
| Gold and silver credits | Depends on grade in concentrate | Depends on grade in concentrate |

TABLE 10.6

Operating Cost Assumptions

| | |
|---|---|
| Copper in con | 21% |
| Acid Consumption (g/g) | 0.44 |
| Tons of acid needed/ton con/day | 69.08 |
| Appx distance Miami to Bagdad (km) | 320 |

The information in Table 10.5 was converted to dollars per ton of concentrate using the additional assumptions from Table 10.6 to calculate an average (midpoint) operating cost to be used in the NPV analysis in Section 10.4.

TABLE 10.7

FMI 2013 Estimated Pressure Oxidation Operating Costs

| | Operating Costs per Ton of Concentrate | |
|---|---|---|
| Parameter | Low | High |
| Smelting Cost (long term) | $ 101.00 | $ 114.00 |
| Refining Cost (long term) | $ 46.28 | $ 46.28 |
| Acid cost (delivered) | $ 898.04 | $4,352.04 |
| Freight rates (concentrate, acid, 320 km by truck) | $ 9.60 | $ 25.60 |
| TOTAL | $1,054.92 | $4,537.92 |

10.4 NPV Analysis

Table 10.8 shows an NPV analysis for a project based on a pressure oxidation plant similar to Bagdad expected to process 157 tons per day (John O. Marsden and Brewer 2003). Operating costs were assumed to be at the low side, taken from Table 10.7 above. Table 10.9 shows the NPV sensitivity for each factor assuming $3/1b copper. The operating cost should be carefully monitored to keep the project feasible.

TABLE 10.8

| Scoping Preliminary Economic Analysis | | | | | |
|---|---|---|---|---|---|
| Year 0 | Year 1 | Year 2 | Year 3 | Year 4 | Year 5 |
| −$57,000,000 | $18,328,072 | $18,328,072 | $18,328,072 | $18,328,072 | $18,328,072 |
| Year 6 | Year 7 | Year 8 | Year 9 | Year 10 | |
| $18,328,072 | $18,328,072 | $18,328,072 | $18,328,072 | $18,328,072 | |

| | |
|---|---|
| Plant Life, years | 10 |
| Discount Rate | 8.0% |
| IRR | 29.8% |
| NPV | $65,982,856 |
| Payback Period, months | 37.32 |
| Profitability Index | 1.16 |

| Con | Days per year | Per Ton | Annual | |
|---|---|---|---|---|
| 157.0 | 350.0 | $1,388 | $76,290,868 | Revenue |
| 157.0 | 350.0 | $1,055 | $57,962,796 | Cost |
| | | | $18,328,072 | Before Tax Profit |

TABLE 10.9

| NPV Sensitivity<br>NPV, Sensitivity | | | | | |
|---|---|---|---|---|---|
| | −20% | −10% | 0 | 10% | 20% |
| CAPEX | $77,382,856 | $ 71,682,856 | $65,982,856 | $ 60,282,856 | $54,582,856 |
| OPEX | $143,769,872 | $104,876,364 | $65,982,856 | $ 27,089,348 | ($11,804,160) |
| Discount Rate | $75,376,195 | $ 70,546,991 | $65,982,856 | $ 61,665,883 | $57,579,553 |
| Revenue | ($36,400,731) | $ 14,791,063 | $65,982,856 | $117,174,650 | $168,366,444 |

Chapter 11—Results

- A comprehensive survey of copper processing, arsenic chemistry and enargite technology was completed.
- The thermodynamic study illustrated a region where a potential metathesis reaction of selective dissolution of arsenic could occur.
- In one case, arsenic extraction during the atmospheric pressure leaching was Test #7 resulted in about 21% arsenic extracted at 10 gpl sulfuric acid, 10 grams of solids, 10 gpl $Cu^{2+}$, and 75° C. for 2 hours. This test also shows an apparent copper and arsenic separation with a 7% copper gain in the solid indicating the possibility of a copper-arsenic metathesis reaction occurring.
- With regard to mineralogy, the #7 atmospheric leach residue had an increase in pyrite content from 61.4 wt % to 76.7% and enargite decreased from 38% to 23%. Iron content went from 28.6% to 29.7%, copper decreased from 18.6% to 17.5% and arsenic from 7.23% to 6.83%. Mineralogical analysis did not show new copper phases appearing after leaching.
- Atmospheric leach modeling using Stat-Ease Design Expert showed initial acid content as a factor on PLS arsenic content with temperature also showing a positive effect.
- Pressure oxidation arsenic extraction for Test #33 resulted in about 47% arsenic extracted at 30 gpl sulfuric acid, 5 grams of solids, 10 gpl $Cu^{2\pm}$, and 160° C. for 1 hour.
- Mineralogically, the #33 pressure oxidation composite sample increased in pyrite content from 61.4 wt % to 67.8%, enargite from 38% to 31.2%, and covellite, which was not detected in the feed appeared at 0.46% in the residue. Iron content increased from 28.6% to 31.6%, copper decreased from 18.6% to 15.4% and arsenic from 7.23% to 5.94%.
- Stat-Ease was also used for modeling of the PDX leach results. Time had an effect on PLS arsenic content.
- The preliminary kinetic results did not define what the controlling mechanism was and additional testing needs to be performed to derive this information.
- High grade enargite mineral tests did show reproducibility to PDX work on enargite concentrates.
- A scoping level preliminary assessment based on updated published cost data indicates positive economics for the proposed process.

Chapter 12—Conclusions

From the literature survey, the world's next major copper and gold orebodies will contain and increasing amount of enargite. There are limited industrial metallurgical technologies available to treat enargite on an industrial scale. The use of hydrometallurgical technologies for arsenic removal can also more directly produce stable forms of arsenic compounds such as ferrihydrite and scorodite.

The concentrate and pure mineral specimen characterizations performed were comprehensive and definitive.

Atmospheric leach testing was undertaken but did not confirm a desirable degree of arsenic from copper separation via a metathesis-like reaction.

Qualitatively, a pressure oxidation leach separation of arsenic from copper solids was achieved via a presumed metathesis-like reaction. Thermodynamically, a proposed metathesis reaction pathway was shown to be possible. Moreover, both the pressure oxidation positive mass balances along with the MLA mineralogical analysis showing the disappearance of enargite and the appearance of covellite confirmed that an apparent metathesis-like event was happening.

Both atmospheric and pressure oxidation testing were successfully modeled using Design-of-Experimentation testing coupled with Stat Ease software.

Focused kinetic and mineralogical testing of one embodiment of a pressure oxidation test confirmed testing reproducibility and a perceived metathesis arsenic separation reaction. Testing of a higher purity enargite sample showed good correlation with previous pressure oxidation work done on the complex enargite concentrate. Initial kinetic modeling was undertaken but additional work is needed for better definition now that a region of presumed metathesis-like arsenic separation has been found.

A preliminary scoping-level economic assessment was positive.

Chapter 13—Suggestions for Further Work

With the severe delays that equipment shipment, downtime, and malfunctioning components caused, there was a significant amount of research time that was lost. In outlining a thoroughly-researched pressure oxidation process, there are many areas for process design and optimization. Areas where further investigation should be conducted include:

1. Sample. A complex enargite concentrate was examined initially. While some tests were performed with a high grade mineral sample, the focus of those tests was to determine if the same arsenic extractions could be achieved. Starting a new experimental program with a pure enargite sample could prove more valuable in determining the chemical reaction of enargite alone in this system before adding competing effects such as the role iron plays in leaching.
2. System Chemistry. The actual chemical reactions occurring can be delineated further and stoichiometric oxygen requirements can be properly determined if work is done on a larger scale.
3. Kinetics. Further kinetic evaluation at different temperatures would enable generation of an Arrhenius plot, determine k and activation energies to delineate controlling mechanisms.
4. Separation. An apparent separation of arsenic from copper via a metathesis-like reaction was qualitatively achieved but not definitively confirmed or fully evaluated. More work needs to be performed on a larger scale to better define this positive separation phenomena.

APPENDIX A

Eh-pH Diagrams by Temperature

FIGS. 85-105 are HSC 7.1 Eh-pH stability diagrams for the various systems at varying temperatures.

APPENDIX B

Eh-pH Diagrams by Molality

FIGS. 106-117 are Eh-pH stability diagram at 25° C. for the various system.

APPENDIX C

Mass Balances

Mass balance calculations for the atmospheric pressure and pressure oxidation tests are shown below.

C.1 Atmospheric Pressure Leach Mass Balance

Tables C.1-C.8 show the mass balance calculations for the atmospheric pressure tests.

TABLE C.1

Atmospheric Pressure Final Volumes and Solid Weights

| | VOLUME | | | SOLIDS | | |
|---|---|---|---|---|---|---|
| Test ID | ml Initial Volume | ml Sample Vol | ml Final Volume | grams Initial Solids | grams Final Solids | % Difference Solids |
| MP Leach Test #1 | 1000 | 80 | 978 | 20.03 | 16.347 | 18.39 |
| MP Leach Test #2 | 1000 | 80 | 975 | 20.02 | 16.050 | 19.82 |
| MP Leach Test #3 | 1000 | 40 | 1038 | 10.08 | 8.560 | 15.08 |
| MP Leach Test #4 | 1000 | 40 | 1053 | 29.99 | 25.480 | 15.05 |
| MP Leach Test #5 | 1000 | 40 | 1046 | 10.02 | 8.499 | 15.14 |
| MP Leach Test #6 | 1000 | 40 | 954 | 30.05 | 23.665 | 21.24 |
| MP Leach Test #7 | 1000 | 40 | 939 | 10.03 | 7.497 | 25.27 |
| MP Leach Test #8 | 1000 | 80 | 924 | 20.09 | 15.892 | 20.89 |
| MP Leach Test #9 | 1000 | 40 | 975 | 30.08 | 24.787 | 17.58 |
| MP Leach Test #10 | 1000 | 40 | 989 | 10.04 | 8.531 | 15.07 |
| MP Leach Test #11 | 1000 | 40 | 990 | 30.03 | 23.885 | 20.45 |
| MP Leach Test #12 | 1000 | 60 | 981 | 30.04 | 25.995 | 13.46 |
| MP Leach Test #13 | 1000 | 60 | 971 | 10.03 | 8.230 | 17.92 |
| MP Leach Test #14 | 1000 | 60 | 980 | 30.05 | 22.940 | 23.67 |
| MP Leach Test #15 | 1000 | 60 | 980 | 10.00 | 8.037 | 19.65 |

TABLE C.1-continued

| Atmospheric Pressure Final Volumes and Solid Weights | | | | | | |
|---|---|---|---|---|---|---|
| | VOLUME | | | SOLIDS | | |
| Test ID | ml Initial Volume | ml Sample Vol | ml Final Volume | grams Initial Solids | grams Final Solids | % Difference Solids |
| MP Leach Test #16 | 1000 | 60 | 1045 | 30.02 | 25.195 | 16.08 |
| MP Leach Test #17 | 1000 | 60 | 992 | 10.08 | 7.817 | 22.42 |
| MP Leach Test #18 | 1000 | 60 | 1012 | 30.00 | 24.961 | 16.80 |
| MP Leach Test #19 | 1000 | 60 | 979 | 10.00 | 9.055 | 9.50 |
| MP Leach Test #7-2 | 1000 | 0 | 1291 | 10.00 | 7.462 | 25.37 |
| MP Leach Test #13-2 | 1000 | 0 | 1303 | 10.01 | 7.455 | 25.51 |

TABLE C.2

| Atmospheric Pressure Copper Mass Balance Calculations | | | | | | | |
|---|---|---|---|---|---|---|---|
| | COPPER | | | | | | |
| Test ID | grams Cu In Solid | grams Cu In Soln | grams Cu Out Solid | grams Cu Out Soln | grams Diff Solids | grams Cu In | grams Cu Out |
| MP Leach Test #1 | 3.35 | 25.00 | 2.83 | 22.37 | 0.51 | 28.34 | 25.20 |
| MP Leach Test #2 | 3.34 | 25.00 | 2.79 | 22.46 | 0.55 | 28.34 | 25.25 |
| MP Leach Test #3 | 1.68 | 10.00 | 1.42 | 10.06 | 0.26 | 11.69 | 11.48 |
| MP Leach Test #4 | 5.01 | 40.00 | 4.24 | 36.97 | 0.76 | 45.01 | 41.21 |
| MP Leach Test #5 | 1.67 | 40.00 | 1.46 | 37.39 | 0.21 | 41.67 | 38.85 |
| MP Leach Test #6 | 5.02 | 10.00 | 4.01 | 10.15 | 1.00 | 15.02 | 14.17 |
| MP Leach Test #7 | 1.68 | 10.00 | 1.31 | 9.40 | 0.36 | 11.68 | 10.71 |
| MP Leach Test #8 | 3.35 | 25.00 | 2.70 | 21.87 | 0.66 | 28.35 | 24.57 |
| MP Leach Test #9 | 5.02 | 10.00 | 4.24 | 9.76 | 0.78 | 15.02 | 14.00 |
| MP Leach Test #10 | 1.68 | 40.00 | 1.51 | 38.49 | 0.16 | 41.68 | 40.00 |
| MP Leach Test #11 | 5.01 | 40.00 | 4.24 | 37.43 | 0.77 | 45.01 | 41.67 |
| MP Leach Test #12 | 5.02 | 40.00 | 4.55 | 35.69 | 0.47 | 45.02 | 40.23 |
| MP Leach Test #13 | 1.67 | 40.00 | 1.44 | 37.02 | 0.24 | 41.67 | 38.46 |
| MP Leach Test #14 | 5.02 | 10.00 | 3.99 | 9.65 | 1.03 | 15.02 | 13.64 |
| MP Leach Test #15 | 1.67 | 10.00 | 1.36 | 9.34 | 0.32 | 11.67 | 10.70 |
| MP Leach Test #16 | 5.01 | 10.00 | 4.03 | 9.96 | 0.99 | 15.02 | 13.99 |
| MP Leach Test #17 | 1.68 | 10.00 | 1.33 | 9.61 | 0.35 | 11.68 | 10.95 |
| MP Leach Test #18 | 5.01 | 40.00 | 4.21 | 36.81 | 0.80 | 45.01 | 41.03 |
| MP Leach Test #19 | 1.67 | 40.00 | 1.50 | 36.55 | 0.17 | 41.67 | 38.05 |
| MP Leach Test #7-2 | 1.67 | 10.00 | 1.31 | 9.64 | 0.36 | 11.67 | 10.95 |
| MP Leach Test #13-2 | 1.67 | 40.00 | 1.26 | 38.71 | 0.41 | 41.67 | 39.97 |
| | Solid assay × initial solids | g CuSO45H2O added × 63.55/249.68 | Solid assay × final solids | Cu titration × final vol | | Total | Total |

TABLE C.3

| Atmospheric Pressure Copper Mass Balance Calculations Continued | | | | |
|---|---|---|---|---|
| | COPPER | | | |
| Test ID | % Copper Lost in soln | % Cu Gain/ Initial Solid | % Cu Gain/ Final Solid | Average Gain |
| MP Leach Test #1 | 10.50 | 13.11 | 16.06 | 14.59 |
| MP Leach Test #2 | 10.17 | 12.70 | 15.84 | 14.27 |
| MP Leach Test #3 | −0.56 | −0.55 | −0.65 | −0.60 |
| MP Leach Test #4 | 7.58 | 10.11 | 11.90 | 11.00 |
| MP Leach Test #5 | 6.54 | 26.13 | 30.79 | 28.46 |
| MP Leach Test #6 | −1.53 | −0.51 | −0.65 | −0.58 |
| MP Leach Test #7 | 6.03 | 6.01 | 8.04 | 7.03 |
| MP Leach Test #8 | 12.52 | 15.58 | 19.69 | 17.64 |
| MP Leach Test #9 | 2.45 | 0.81 | 0.99 | 0.90 |
| MP Leach Test #10 | 3.77 | 15.03 | 17.69 | 16.36 |
| MP Leach Test #11 | 6.43 | 8.56 | 10.76 | 9.66 |
| MP Leach Test #12 | 10.79 | 14.37 | 16.60 | 15.48 |
| MP Leach Test #13 | 7.45 | 29.73 | 36.22 | 32.98 |
| MP Leach Test #14 | 3.49 | 1.16 | 1.52 | 1.34 |

TABLE C.3-continued

| Atmospheric Pressure Copper Mass Balance Calculations Continued | | | | |
|---|---|---|---|---|
| | COPPER | | | |
| Test ID | % Copper Lost in soln | % Cu Gain/ Initial Solid | % Cu Gain/ Final Solid | Average Gain |
| MP Leach Test #15 | 6.61 | 6.61 | 8.22 | 7.41 |
| MP Leach Test #16 | 0.41 | 0.14 | 0.16 | 0.15 |
| MP Leach Test #17 | 3.89 | 3.86 | 4.97 | 4.41 |
| MP Leach Test #18 | 7.97 | 10.62 | 12.76 | 11.69 |
| MP Leach Test #19 | 8.63 | 34.51 | 38.13 | 36.32 |
| MP Leach Test #7-2 | 3.63 | 3.63 | 4.86 | 4.25 |
| MP Leach Test #13-2 | 3.23 | 12.93 | 17.35 | 15.14 |

TABLE C.4

Atmospheric Pressure Iron Mass Balance Calculations

| Test ID | IRON grams Fe In | grams Fe Out Solid | grams Fe Out Soln | grams Fe In | grams Fe Out |
|---|---|---|---|---|---|
| MP Leach Test #1 | 5.52 | 4.82 | 0.59 | 5.52 | 5.41 |
| MP Leach Test #2 | 5.52 | 4.72 | 0.61 | 5.52 | 5.33 |
| MP Leach Test #3 | 2.78 | 2.62 | 0.10 | 2.78 | 2.73 |
| MP Leach Test #4 | 8.26 | 7.90 | 0.37 | 8.26 | 8.27 |
| MP Leach Test #5 | 2.76 | 2.51 | 0.26 | 2.76 | 2.78 |
| MP Leach Test #6 | 8.28 | 7.06 | 0.87 | 8.28 | 7.93 |
| MP Leach Test #7 | 2.76 | 2.16 | 0.36 | 2.76 | 2.53 |
| MP Leach Test #8 | 5.53 | 4.53 | 0.60 | 5.53 | 5.12 |
| MP Leach Test #9 | 8.29 | 7.29 | 0.55 | 8.29 | 7.84 |
| MP Leach Test #10 | 2.77 | 2.52 | 0.18 | 2.77 | 2.70 |
| MP Leach Test #11 | 8.27 | 6.96 | 1.25 | 8.27 | 8.20 |
| MP Leach Test #12 | 8.28 | 7.47 | 0.59 | 8.28 | 8.06 |
| MP Leach Test #13 | 2.76 | 2.33 | 0.42 | 2.76 | 2.75 |
| MP Leach Test #14 | 8.28 | 6.52 | 1.21 | 8.28 | 7.74 |
| MP Leach Test #15 | 2.76 | 2.27 | 0.22 | 2.76 | 2.49 |
| MP Leach Test #16 | 8.27 | 7.33 | 0.37 | 8.27 | 7.70 |
| MP Leach Test #17 | 2.78 | 2.28 | 0.32 | 2.78 | 2.59 |
| MP Leach Test #18 | 8.27 | 7.19 | 0.86 | 8.27 | 8.06 |
| MP Leach Test #19 | 2.76 | 2.65 | 0.13 | 2.76 | 2.78 |
| MP Leach Test #7-2 | 2.75 | 2.13 | 0.43 | 2.75 | 2.56 |
| MP Leach Test #13-2 | 2.76 | 2.18 | 0.43 | 2.76 | 2.61 |
| | Solid assay × initial solids | Solid assay × final solids | CAMP ICP × final vol | Total | Total |

TABLE C.5

Atmospheric Pressure Iron Mass Balance Calculations Continued

| Test ID | IRON Solid Fe Extr % | Liquid Fe Extr % | Final Liquid Fe Extr % | Average Extraction % | Calculated Head |
|---|---|---|---|---|---|
| MP Leach Test #1 | 12.67 | 10.78 | 10.98 | 11.48 | 27.03 |
| MP Leach Test #2 | 14.44 | 11.10 | 11.49 | 12.34 | 26.63 |
| MP Leach Test #3 | 5.52 | 3.76 | 3.83 | 4.37 | 27.07 |
| MP Leach Test #4 | 4.35 | 4.43 | 4.43 | 4.40 | 27.57 |
| MP Leach Test #5 | 8.95 | 9.54 | 9.49 | 9.32 | 27.71 |
| MP Leach Test #6 | 14.75 | 10.52 | 10.98 | 12.08 | 26.38 |
| MP Leach Test #7 | 21.72 | 13.20 | 14.43 | 16.45 | 25.20 |
| MP Leach Test #8 | 18.22 | 10.81 | 11.68 | 13.57 | 25.51 |
| MP Leach Test #9 | 11.99 | 6.59 | 6.97 | 8.52 | 26.06 |
| MP Leach Test #10 | 8.99 | 6.46 | 6.63 | 7.36 | 26.85 |
| MP Leach Test #11 | 15.92 | 15.10 | 15.23 | 15.42 | 27.33 |
| MP Leach Test #12 | 9.76 | 7.14 | 7.33 | 8.08 | 26.83 |
| MP Leach Test #13 | 15.74 | 15.24 | 15.32 | 15.43 | 27.41 |
| MP Leach Test #14 | 21.21 | 14.64 | 15.67 | 17.17 | 25.74 |
| MP Leach Test #15 | 17.61 | 8.06 | 8.92 | 11.53 | 24.92 |
| MP Leach Test #16 | 11.39 | 4.51 | 4.84 | 6.91 | 25.65 |

TABLE C.5-continued

Atmospheric Pressure Iron Mass Balance Calculations Continued

| Test ID | IRON Solid Fe Extr % | Liquid Fe Extr % | Final Liquid Fe Extr % | Average Extraction % | Calculated Head |
|---|---|---|---|---|---|
| MP Leach Test #17 | 18.03 | 11.48 | 12.29 | 13.93 | 25.75 |
| MP Leach Test #18 | 12.97 | 10.43 | 10.70 | 11.37 | 26.85 |
| MP Leach Test #19 | 3.81 | 4.75 | 4.71 | 4.42 | 27.81 |
| MP Leach Test #7-2 | 22.64 | 15.48 | 16.68 | 18.27 | 25.58 |
| MP Leach Test #13-2 | 20.91 | 15.68 | 16.55 | 17.71 | 26.11 |
| | (Mass in − Solid mass out)/ Mass in | 1 − (Mass in − Soln mass out)/ Mass in | Soln mass out/ Mass out | | Total g out/ g initial solids |

TABLE C.6

Atmospheric Pressure Arsenic Mass Balance Calculations

| Test ID | ARSENIC grams As In | grams As Out Solid | grams As Out Soln | grams As In | grams As Out |
|---|---|---|---|---|---|
| MP Leach Test #1 | 1.36 | 1.11 | 0.11 | 1.36 | 1.22 |
| MP Leach Test #2 | 1.36 | 1.04 | 0.11 | 1.36 | 1.15 |
| MP Leach Test #3 | 0.69 | 0.59 | 0.00 | 0.69 | 0.59 |
| MP Leach Test #4 | 2.04 | 1.77 | 0.00 | 2.04 | 1.78 |
| MP Leach Test #5 | 0.68 | 0.54 | 0.06 | 0.68 | 0.60 |
| MP Leach Test #6 | 2.04 | 1.42 | 0.17 | 2.04 | 1.59 |
| MP Leach Test #7 | 0.68 | 0.43 | 0.07 | 0.68 | 0.50 |
| MP Leach Test #8 | 1.37 | 0.90 | 0.12 | 1.37 | 1.01 |
| MP Leach Test #9 | 2.05 | 1.44 | 0.02 | 2.05 | 1.45 |
| MP Leach Test #10 | 0.68 | 0.46 | 0.01 | 0.68 | 0.47 |
| MP Leach Test #11 | 2.04 | 1.60 | 0.20 | 2.04 | 1.80 |
| MP Leach Test #12 | 2.04 | 1.74 | 0.01 | 2.04 | 1.75 |
| MP Leach Test #13 | 0.68 | 0.55 | 0.07 | 0.68 | 0.62 |
| MP Leach Test #14 | 2.04 | 1.50 | 0.22 | 2.04 | 1.72 |
| MP Leach Test #15 | 0.68 | 0.54 | 0.00 | 0.68 | 0.54 |
| MP Leach Test #16 | 2.04 | 1.69 | 0.00 | 2.04 | 1.70 |
| MP Leach Test #17 | 0.69 | 0.50 | 0.06 | 0.69 | 0.56 |
| MP Leach Test #18 | 2.04 | 1.60 | 0.16 | 2.04 | 1.76 |
| MP Leach Test #19 | 0.68 | 0.59 | 0.01 | 0.68 | 0.60 |
| MP Leach Test #7-2 | 0.68 | 0.48 | 0.08 | 0.68 | 0.56 |
| MP Leach Test #13-2 | 0.68 | 0.47 | 0.08 | 0.68 | 0.54 |
| | Solid assay × initial solids | Solid assay × final solids | CAMP ICP × final vol | Total | Total |

TABLE C.7

Atmospheric Pressure Arsenic Mass Balance Calculations Continued

| Test ID | ARSENIC Solid As Extr % | Liquid As Extr % | Final Liquid As Extr % | Average Extraction % | Calculated Head |
|---|---|---|---|---|---|
| MP Leach Test #1 | 18.63 | 8.39 | 9.35 | 12.12 | 6.10 |
| MP Leach Test #2 | 23.95 | 8.08 | 9.60 | 13.88 | 5.72 |

TABLE C.7-continued

| Atmospheric Pressure Arsenic Mass Balance Calculations Continued | | | | | |
|---|---|---|---|---|---|
| | ARSENIC | | | | |
| Test ID | Solid As Extr % | Liquid As Extr % | Final Liquid As Extr % | Average Extraction % | Calculated Head |
| MP Leach Test #3 | 14.58 | 0.27 | 0.31 | 5.05 | 5.83 |
| MP Leach Test #4 | 13.18 | 0.21 | 0.24 | 4.54 | 5.92 |
| MP Leach Test #5 | 20.88 | 8.46 | 9.66 | 13.00 | 5.96 |
| MP Leach Test #6 | 30.51 | 8.15 | 10.50 | 16.39 | 5.28 |
| MP Leach Test #7 | 37.69 | 10.67 | 14.62 | 20.99 | 4.96 |
| MP Leach Test #8 | 34.27 | 8.46 | 11.41 | 18.05 | 5.05 |
| MP Leach Test #9 | 29.70 | 0.80 | 1.12 | 10.54 | 4.83 |
| MP Leach Test #10 | 32.80 | 1.00 | 1.47 | 11.76 | 4.64 |
| MP Leach Test #11 | 21.62 | 9.88 | 11.20 | 14.23 | 6.00 |
| MP Leach Test #12 | 14.99 | 0.71 | 0.83 | 5.51 | 5.83 |
| MP Leach Test #13 | 19.85 | 10.40 | 11.48 | 13.91 | 6.16 |
| MP Leach Test #14 | 26.48 | 10.74 | 12.74 | 16.65 | 5.73 |
| MP Leach Test #15 | 20.95 | 0.45 | 0.56 | 7.32 | 5.41 |
| MP Leach Test #16 | 17.07 | 0.16 | 0.20 | 5.81 | 5.65 |
| MP Leach Test #17 | 27.10 | 9.26 | 11.28 | 15.88 | 5.59 |
| MP Leach Test #18 | 21.70 | 7.93 | 9.19 | 12.94 | 5.86 |
| MP Leach Test #19 | 13.49 | 1.01 | 1.16 | 5.22 | 5.95 |
| MP Leach Test #7-2 | 29.21 | 12.02 | 14.52 | 18.58 | 5.63 |
| MP Leach Test #13-2 | 31.64 (Mass in − Solid mass out)/ Mass in | 11.64 1 − (Mass in − Soln mass out)/ Mass in | 14.55 Soln mass out/ Mass out | 19.28 | 5.44 Total g out/ g initial solids |

TABLE C.8

| Atmospheric Pressure Acid Consumption Mass Balance Calculations | | | | | |
|---|---|---|---|---|---|
| | ACID | | | | |
| Test ID | grams Acid In | grams Acid Out | g Acid Consump/ g Initial Solids | g Acid Consump/ g Final Solids | Average Consumption |
| MP Leach Test #1 | 5.19 | 4.79 | 0.020 | 0.024 | 0.022 |
| MP Leach Test #2 | 5.20 | 5.73 | −0.027 | −0.034 | −0.030 |
| MP Leach Test #3 | 0.00 | 0.00 | 0.000 | 0.000 | 0.000 |
| MP Leach Test #4 | 0.00 | 0.00 | 0.000 | 0.000 | 0.000 |
| MP Leach Test #5 | 10.37 | 10.25 | 0.012 | 0.014 | 0.013 |

TABLE C.8-continued

| Atmospheric Pressure Acid Consumption Mass Balance Calculations | | | | | |
|---|---|---|---|---|---|
| | ACID | | | | |
| Test ID | grams Acid In | grams Acid Out | g Acid Consump/ g Initial Solids | g Acid Consump/ g Final Solids | Average Consumption |
| MP Leach Test #6 | 10.37 | 9.35 | 0.034 | 0.043 | 0.039 |
| MP Leach Test #7 | 10.36 | 9.20 | 0.116 | 0.155 | 0.135 |
| MP Leach Test #8 | 5.18 | 4.53 | 0.033 | 0.041 | 0.037 |
| MP Leach Test #9 | 0.00 | 0.00 | 0.000 | 0.000 | 0.000 |
| MP Leach Test #10 | 0.00 | 0.00 | 0.000 | 0.000 | 0.000 |
| MP Leach Test #11 | 10.37 | 8.73 | 0.055 | 0.069 | 0.062 |
| MP Leach Test #12 | 0.00 | 0.00 | 0.000 | 0.000 | 0.000 |
| MP Leach Test #13 | 10.37 | 9.52 | 0.085 | 0.103 | 0.094 |
| MP Leach Test #14 | 10.37 | 8.64 | 0.057 | 0.075 | 0.066 |
| MP Leach Test #15 | 0.00 | 0.00 | 0.000 | 0.000 | 0.000 |
| MP Leach Test #16 | 0.00 | 0.00 | 0.000 | 0.000 | 0.000 |
| MP Leach Test #17 | 10.37 | 9.72 | 0.064 | 0.083 | 0.073 |
| MP Leach Test #18 | 10.35 | 9.92 | 0.015 | 0.017 | 0.016 |
| MP Leach Test #19 | 0.00 | 0.00 | 0.000 | 0.000 | 0.000 |
| MP Leach Test #7-2 | 10.36 | 8.86 | 0.150 | 0.202 | 0.176 |
| MP Leach Test #13-2 | 10.36 g of 96.5% H2SO4 added | 10.22 g free acid × final vol | 0.015 | 0.020 | 0.017 |

C.2 Pressure Oxidation Leach Mass Balance

Tables C.9-C.17 show the mass balance calculations for the pressure oxidation tests.

TABLE C.9

| Pressure Oxidation Final Volumes | | |
|---|---|---|
| | VOLUME | |
| Test ID | ml Initial Volume | ml Final Volume |
| MP POX Test #1 | 1000 | 1000 |
| MP POX Test #2 | 1000 | 1123 |
| MP POX Test #3 | 1000 | 1159.5 |
| MP POX Test #4 | 1000 | 1210.5 |
| MP POX Test #5 | 1000 | 1080 |
| MP POX Test #6 | 1000 | 1240 |
| MP POX Test #7 | 1000 | 1215 |
| MP POX Test #8 | 1000 | 1244 |
| MP POX Test #9 | 1000 | 1095 |
| MP POX Test #10 | 1000 | 1250 |
| MP POX Test #11 | 1000 | 1135 |
| MP POX Test #12 | 1000 | 1226 |
| MP POX Test #13 | 1000 | 1404 |
| MP POX Test #14 | 1000 | 1321 |
| MP POX Test #15 | 1000 | 1324 |
| MP POX Test #16 | 1000 | 1328 |
| MP POX Test #17 | 1000 | 1267 |
| MP POX Test #18 | 1000 | 1245 |
| MP POX Test #19 | 1000 | 1225 |

TABLE C.9-continued

| Pressure Oxidation Final Volumes | | |
|---|---|---|
| | VOLUME | |
| Test ID | ml Initial Volume | ml Final Volume |
| MP POX Test #20 | 1000 | 1026 |
| MP POX Test #21 | 1000 | 1069 |
| MP POX Test #22 | 1000 | 1230 |
| MP POX Test #23 | 1000 | 1227 |
| MP POX Test #24 | 1000 | 1244 |
| MP POX Test #25 | 1000 | 1041 |
| MP POX Test #26 | 1000 | 1333 |
| MP POX Test #27 | 1000 | 1169 |
| MP POX Test #28 | 1000 | 1446 |
| MP POX Test #29 | 1000 | 1257 |
| MP POX Test #30 | 1000 | 1225 |
| MP POX Test #31 | 1000 | 1372 |
| MP POX Test #32 | 1000 | 1250 |
| MP POX Test #33 | 1000 | 1195 |
| MP POX Test #34 | 1000 | 1293 |
| MP POX Test #35 | 1000 | 1491 |

TABLE C.10

| Pressure Oxidation Final Solid Weights | | | |
|---|---|---|---|
| | SOLIDS | | |
| Test ID | grams Initial Solids | grams Final Solids | % Difference Solids |
| MP POX Test #1 | 15.01 | 11.090 | 26.09 |
| MP POX Test #2 | 5.00 | 3.753 | 24.97 |
| MP POX Test #3 | 5.00 | 3.824 | 23.52 |
| MP POX Test #4 | 15.00 | 11.338 | 24.41 |

TABLE C.10-continued

| Pressure Oxidation Final Solid Weights | | | |
|---|---|---|---|
| | SOLIDS | | |
| Test ID | grams Initial Solids | grams Final Solids | % Difference Solids |
| MP POX Test #5 | 5.00 | 4.149 | 17.10 |
| MP POX Test #6 | 5.00 | 3.536 | 29.22 |
| MP POX Test #7 | 15.02 | 11.459 | 23.70 |
| MP POX Test #8 | 15.01 | 11.524 | 23.22 |
| MP POX Test #9 | 5.00 | 3.945 | 21.12 |
| MP POX Test #10 | 5.00 | 3.564 | 28.78 |
| MP POX Test #11 | 15.01 | 10.214 | 31.95 |
| MP POX Test #12 | 15.05 | 11.468 | 23.79 |
| MP POX Test #13 | 5.00 | 3.345 | 33.08 |
| MP POX Test #14 | 5.00 | 3.575 | 28.53 |
| MP POX Test #15 | 15.00 | 11.752 | 21.64 |
| MP POX Test #16 | 15.00 | 10.686 | 28.77 |
| MP POX Test #17 | 10.01 | 8.626 | 13.78 |
| MP POX Test #18 | 10.01 | 8.643 | 13.67 |
| MP POX Test #19 | 10.00 | 8.286 | 17.15 |
| MP POX Test #20 | 5.00 | 4.177 | 16.52 |
| MP POX Test #21 | 5.00 | 4.305 | 13.95 |
| MP POX Test #22 | 15.00 | 12.900 | 14.01 |
| MP POX Test #23 | 15.00 | 13.319 | 11.23 |
| MP POX Test #24 | 5.01 | 3.409 | 31.94 |
| MP POX Test #25 | 5.00 | 4.001 | 20.03 |
| MP POX Test #26 | 15.00 | 11.774 | 21.53 |
| MP POX Test #27 | 15.00 | 12.890 | 14.08 |
| MP POX Test #28 | 15.01 | 12.151 | 19.06 |
| MP POX Test #29 | 5.00 | 3.940 | 21.25 |
| MP POX Test #30 | 5.01 | 4.090 | 18.29 |
| MP POX Test #31 | 15.02 | 12.935 | 13.90 |
| MP POX Test #32 | 5.01 | 2.530 | 49.48 |
| MP POX Test #33 | 5.00 | 3.461 | 30.80 |
| MP POX Test #34 | 15.01 | 10.559 | 29.65 |
| MP POX Test #35 | 15.00 | 11.613 | 22.59 |

TABLE C.11

| Pressure Oxidation Copper Mass Balance Calculations | | | | | | | |
|---|---|---|---|---|---|---|---|
| Test ID | grams Cu In Solid | grams Cu In Soln | grams Cu Out Solid | grams Cu Out Soln | grams Diff Solids | grams Cu In | grams Cu Out |
| MP PDX Test #1 | 2.51 | 10.00 | 1.97 | 10.48 | 0.54 | 12.51 | 12.45 |
| MP PDX Test #2 | 0.84 | 10.00 | 0.66 | 9.99 | 0.17 | 10.84 | 10.65 |
| MP PDX Test #3 | 0.84 | 40.00 | 0.63 | 40.52 | 0.20 | 40.83 | 41.15 |
| MP PDX Test #4 | 2.50 | 40.00 | 1.98 | 38.07 | 0.53 | 42.50 | 40.05 |
| MP PDX Test #5 | 0.84 | 39.97 | 0.48 | 39.80 | 0.35 | 40.81 | 40.28 |
| MP PDX Test #6 | 0.83 | 10.00 | 0.62 | 9.85 | 0.21 | 10.84 | 10.47 |
| MP PDX Test #7 | 2.51 | 10.00 | 2.02 | 9.26 | 0.49 | 12.51 | 11.28 |
| MP PDX Test #8 | 2.51 | 40.00 | 1.96 | 37.55 | 0.55 | 42.51 | 39.51 |
| MP PDX Test #9 | 0.84 | 40.00 | 0.63 | 40.01 | 0.20 | 40.83 | 40.64 |
| MP PDX Test #10 | 0.84 | 10.00 | 0.59 | 9.53 | 0.24 | 10.84 | 10.13 |
| MP PDX Test #11 | 2.51 | 10.00 | 2.00 | 6.49 | 0.51 | 12.51 | 8.49 |
| MP PDX Test #12 | 2.51 | 40.00 | 2.29 | 39.34 | 0.23 | 42.51 | 41.63 |
| MP PDX Test #13 | 0.83 | 10.00 | 0.70 | 9.81 | 0.13 | 10.84 | 10.51 |
| MP PDX Test #14 | 0.84 | 40.01 | 0.79 | 33.99 | 0.05 | 40.84 | 34.78 |
| MP PDX Test #15 | 2.50 | 40.00 | 3.02 | 32.39 | −0.52 | 42.51 | 35.41 |
| MP PDX Test #16 | 2.51 | 10.00 | 2.11 | 8.02 | 0.40 | 12.50 | 10.12 |
| MP PDX Test #17 | 1.67 | 25.00 | 1.25 | 21.74 | 0.42 | 26.67 | 22.98 |
| MP PDX Test #18 | 1.67 | 25.00 | 1.12 | 24.52 | 0.55 | 26.67 | 25.64 |
| MP PDX Test #19 | 1.67 | 25.00 | 1.17 | 20.63 | 0.50 | 26.67 | 21.80 |

TABLE C.12

Pressure Oxidation Copper Mass Balance Calculations

| Test ID | grams Cu In Solid | grams Cu In Soln | grams Cu Out Solid | grams Cu Out Soln | grams Diff Solids | grams Cu In | grams Cu Out |
|---|---|---|---|---|---|---|---|
| MP PDX Test #20 | 0.84 | 40.00 | 0.80 | 38.30 | 0.04 | 40.83 | 39.10 |
| MP PDX Test #21 | 0.84 | 10.00 | 0.77 | 10.19 | 0.06 | 10.84 | 10.96 |
| MP PDX Test #22 | 2.51 | 10.00 | 2.35 | 8.40 | 0.16 | 12.51 | 10.75 |
| MP PDX Test #23 | 2.51 | 40.00 | 2.40 | 39.37 | 0.11 | 42.50 | 41.77 |
| MP PDX Test #24 | 0.84 | 10.00 | 0.37 | 9.88 | 0.46 | 10.84 | 10.25 |
| MP PDX Test #25 | 0.84 | 40.00 | 0.79 | 38.86 | 0.05 | 40.84 | 39.65 |
| MP PDX Test #26 | 2.51 | 10.00 | 1.55 | 9.32 | 0.95 | 12.51 | 10.87 |
| MP PDX Test #27 | 2.51 | 10.00 | 2.33 | 10.03 | 0.17 | 12.51 | 12.36 |
| MP PDX Test #28 | 2.51 | 10.00 | 1.84 | 10.57 | 0.67 | 12.51 | 12.40 |
| MP PDX Test #29 | 0.84 | 10.00 | 0.60 | 10.38 | 0.24 | 10.84 | 10.98 |
| MP PDX Test #30 | 0.84 | 40.00 | 0.65 | 39.31 | 0.18 | 40.84 | 39.96 |
| MP PDX Test #31 | 2.51 | 40.00 | 2.12 | 34.43 | 0.39 | 42.51 | 36.55 |
| MP PDX Test #32 | 0.84 | 40.00 | 0.38 | 37.73 | 0.46 | 40.84 | 38.11 |
| MP PDX Test #33 | 0.84 | 10.00 | 0.40 | 9.49 | 0.44 | 10.84 | 9.89 |
| MP PDX Test #34 | 2.51 | 10.00 | 1.36 | 13.15 | 1.15 | 12.51 | 14.50 |
| MP PDX Test #35 | 2.51 | 40.00 | 1.44 | 32.21 | 1.07 | 42.51 | 33.65 |
| | Feed assay × initial solids | g CuSO45H2O added × 63.55/249.68 | Residue assay × final solids | Cu titration × final vol | | Total | Total |

TABLE C.13

Pressure Oxidation Copper Mass Balance Calculations Continued

| Test ID | COPPER % Copper Lost in soln | % Cu Gain/ Initial Solid | % Cu Gain/ Final Solid | Average Gain |
|---|---|---|---|---|
| MP POX Test #1 | −4.84 | −3.22 | −4.36 | −3.79 |
| MP POX Test #2 | 0.11 | 0.21 | 0.28 | 0.25 |
| MP POX Test #3 | −1.31 | −10.45 | −13.66 | −12.05 |
| MP POX Test #4 | 4.82 | 12.84 | 16.99 | 14.92 |
| MP POX Test #5 | 0.43 | 3.44 | 4.15 | 3.80 |
| MP POX Test #6 | 1.54 | 3.08 | 4.35 | 3.71 |
| MP POX Test #7 | 7.36 | 4.90 | 6.43 | 5.66 |
| MP POX Test #8 | 6.13 | 16.34 | 21.29 | 18.82 |
| MP POX Test #9 | −0.02 | −0.15 | −0.19 | −0.17 |
| MP POX Test #10 | 4.70 | 9.40 | 13.20 | 11.30 |
| MP POX Test #11 | 35.10 | 23.38 | 34.36 | 28.87 |
| MP POX Test #12 | 1.65 | 4.38 | 5.75 | 5.07 |
| MP POX Test #13 | 1.87 | 3.75 | 5.60 | 4.68 |
| MP POX Test #14 | 15.03 | 120.21 | 168.19 | 144.20 |
| MP POX Test #15 | 19.03 | 50.76 | 64.78 | 57.77 |
| MP POX Test #16 | 19.82 | 13.21 | 18.54 | 15.87 |
| MP POX Test #17 | 13.05 | 32.62 | 37.83 | 35.22 |
| MP POX Test #18 | 1.91 | 4.76 | 5.51 | 5.13 |
| MP POX Test #19 | 17.49 | 43.73 | 52.78 | 48.25 |
| MP POX Test #20 | 4.25 | 33.95 | 40.67 | 37.31 |
| MP POX Test #21 | −1.87 | −3.74 | −4.35 | −4.05 |
| MP POX Test #22 | 15.99 | 10.66 | 12.40 | 11.53 |
| MP POX Test #23 | 1.56 | 4.17 | 4.70 | 4.43 |
| MP POX Test #24 | 1.21 | 2.41 | 3.54 | 2.97 |
| MP POX Test #25 | 2.85 | 22.79 | 28.50 | 25.64 |
| MP POX Test #26 | 6.84 | 4.56 | 5.81 | 5.19 |
| MP POX Test #27 | −0.27 | −0.18 | −0.21 | −0.20 |
| MP POX Test #28 | −5.64 | −3.76 | −4.64 | −4.20 |
| MP POX Test #29 | −3.82 | −7.64 | −9.70 | −8.67 |
| MP POX Test #30 | 1.73 | 13.85 | 16.95 | 15.40 |
| MP POX Test #31 | 13.92 | 37.06 | 43.04 | 40.05 |
| MP POX Test #32 | 5.68 | 45.39 | 89.85 | 67.62 |
| MP POX Test #33 | 5.09 | 10.19 | 14.72 | 12.45 |

TABLE C.13-continued

Pressure Oxidation Copper Mass Balance Calculations Continued

| Test ID | COPPER % Copper Lost in soln | % Cu Gain/ Initial Solid | % Cu Gain/ Final Solid | Average Gain |
|---|---|---|---|---|
| MP POX Test #34 | −31.43 | −20.94 | −29.77 | −25.36 |
| MP POX Test #35 | 19.47 | 51.93 | 67.08 | 59.50 |

TABLE C.14

Pressure Oxidation Iron Mass Balance Calculations

| Test ID | IRON grams Fe In | grams Fe Out Solid | grams Fe Out Soln | grams Fe In | grams Fe Out |
|---|---|---|---|---|---|
| MP POX Test #1 | 4.13 | 3.40 | 0.71 | 4.13 | 4.11 |
| MP POX Test #2 | 1.38 | 1.14 | 0.23 | 1.38 | 1.37 |
| MP POX Test #3 | 1.38 | 1.16 | 0.21 | 1.38 | 1.37 |
| MP POX Test #4 | 4.13 | 3.47 | 0.63 | 4.13 | 4.10 |
| MP POX Test #5 | 1.38 | 0.67 | 0.24 | 1.38 | 0.91 |
| MP POX Test #6 | 1.38 | 1.13 | 0.22 | 1.38 | 1.35 |
| MP POX Test #7 | 4.14 | 3.55 | 0.57 | 4.14 | 4.12 |
| MP POX Test #8 | 4.13 | 3.51 | 0.59 | 4.13 | 4.10 |
| MP POX Test #9 | 1.38 | 1.14 | 0.23 | 1.38 | 1.37 |
| MP POX Test #10 | 1.38 | 1.09 | 0.22 | 1.38 | 1.31 |
| MP POX Test #11 | 4.14 | 2.97 | 0.71 | 4.14 | 3.67 |
| MP POX Test #12 | 4.15 | 3.37 | 0.69 | 4.15 | 4.06 |
| MP POX Test #13 | 1.38 | 0.94 | 0.25 | 1.38 | 1.19 |
| MP POX Test #14 | 1.38 | 1.04 | 0.22 | 1.38 | 1.26 |
| MP POX Test #15 | 4.13 | 3.16 | 0.69 | 4.13 | 3.84 |
| MP POX Test #16 | 4.13 | 3.27 | 0.71 | 4.13 | 3.98 |
| MP POX Test #17 | 2.76 | 2.73 | 0.14 | 2.76 | 2.87 |
| MP POX Test #18 | 2.76 | 2.64 | 0.11 | 2.76 | 2.75 |
| MP POX Test #19 | 2.76 | 2.55 | 0.09 | 2.76 | 2.64 |

TABLE C.15

Pressure Oxidation Iron Mass Balance Calculations

| Test ID | IRON grams Fe In | grams Fe Out Solid | grams Fe Out Soln | grams Fe In | grams Fe Out |
|---|---|---|---|---|---|
| MP POX Test #20 | 1.38 | 1.17 | 0.11 | 1.38 | 1.28 |
| MP POX Test #21 | 1.38 | 1.25 | 0.06 | 1.38 | 1.31 |
| MP POX Test #22 | 4.13 | 3.62 | 0.21 | 4.13 | 3.83 |
| MP POX Test #23 | 4.13 | 3.81 | 0.22 | 4.13 | 4.03 |
| MP POX Test #24 | 1.38 | 1.16 | 0.09 | 1.38 | 1.25 |
| MP POX Test #25 | 1.38 | 1.07 | 0.23 | 1.38 | 1.30 |
| MP POX Test #26 | 4.13 | 3.87 | 0.25 | 4.13 | 4.12 |
| MP POX Test #27 | 4.13 | 3.65 | 0.35 | 4.13 | 4.00 |
| MP POX Test #28 | 4.14 | 3.82 | 0.31 | 4.14 | 4.13 |
| MP POX Test #29 | 1.38 | 1.18 | 0.09 | 1.38 | 1.26 |
| MP POX Test #30 | 1.38 | 1.20 | 0.12 | 1.38 | 1.31 |
| MP POX Test #31 | 4.14 | 3.80 | 0.32 | 4.14 | 4.12 |
| MP POX Test #32 | 1.38 | 0.74 | 0.37 | 1.38 | 1.11 |
| MP POX Test #33 | 1.38 | 1.18 | 0.12 | 1.38 | 1.30 |
| MP POX Test #34 | 4.13 | 3.57 | 0.34 | 4.13 | 3.91 |
| MP POX Test #35 | 4.13 | 3.81 | 0.25 | 4.13 | 4.06 |
| | Feed assay × initial solids | Residue assay × final solids | ICP × final vol | Total | Total |

TABLE C.16

Pressure Oxidation Iron Mass Balance Calculations Continued

| Test ID | IRON Solid Fe Extr % | Liquid Fe Extr % | Final Liquid Fe Extr % | Average Extraction % | Calculated Head |
|---|---|---|---|---|---|
| MP POX Test #1 | 17.72 | 17.13 | 17.23 | 17.36 | 27.39 |
| MP POX Test #2 | 17.37 | 16.56 | 16.69 | 16.87 | 27.33 |
| MP POX Test #3 | 15.75 | 15.33 | 15.39 | 15.49 | 27.43 |
| MP POX Test #4 | 15.93 | 15.26 | 15.36 | 15.52 | 27.37 |
| MP POX Test #5 | 51.40 | 17.40 | 26.36 | 31.72 | 18.18 |
| MP POX Test #6 | 18.25 | 16.19 | 16.53 | 16.99 | 26.98 |
| MP POX Test #7 | 14.09 | 13.72 | 13.77 | 13.86 | 27.45 |
| MP POX Test #8 | 15.14 | 14.29 | 14.42 | 14.62 | 27.32 |
| MP POX Test #9 | 17.03 | 16.55 | 16.63 | 16.74 | 27.42 |
| MP POX Test #10 | 21.23 | 16.30 | 17.14 | 18.22 | 26.19 |

TABLE C.16-continued

Pressure Oxidation Iron Mass Balance Calculations Continued

| Test ID | IRON Solid Fe Extr % | Liquid Fe Extr % | Final Liquid Fe Extr % | Average Extraction % | Calculated Head |
|---|---|---|---|---|---|
| MP POX Test #11 | 28.30 | 17.08 | 19.24 | 21.54 | 24.46 |
| MP POX Test #12 | 18.81 | 16.74 | 17.10 | 17.55 | 26.98 |
| MP POX Test #13 | 31.97 | 18.01 | 20.94 | 23.64 | 23.71 |
| MP POX Test #14 | 24.48 | 15.88 | 17.38 | 19.25 | 25.18 |
| MP POX Test #15 | 23.61 | 16.59 | 17.84 | 19.34 | 25.62 |
| MP POX Test #16 | 20.88 | 17.23 | 17.88 | 18.66 | 26.54 |
| MP POX Test #17 | 1.11 | 5.24 | 5.04 | 3.80 | 28.69 |
| MP POX Test #18 | 4.37 | 3.99 | 4.01 | 4.12 | 27.45 |
| MP POX Test #19 | 7.38 | 3.17 | 3.31 | 4.62 | 26.39 |

TABLE C.17

Pressure Oxidation Iron Mass Balance Calculations Continued

| Test ID | IRON Solid Fe Extr % | Liquid Fe Extr % | Final Liquid Fe Extr % | Average Extraction % | Calculated Head |
|---|---|---|---|---|---|
| MP POX Test #20 | 14.85 | 7.89 | 8.48 | 10.41 | 25.63 |
| MP POX Test #21 | 9.11 | 4.34 | 4.56 | 6.01 | 26.24 |
| MP POX Test #22 | 12.29 | 5.03 | 5.42 | 7.58 | 25.55 |
| MP POX Test #23 | 7.85 | 5.34 | 5.48 | 6.22 | 26.86 |
| MP POX Test #24 | 15.96 | 6.42 | 7.10 | 9.82 | 24.92 |
| MP POX Test #25 | 22.50 | 16.84 | 17.85 | 19.06 | 25.99 |
| MP POX Test #26 | 6.29 | 5.95 | 5.97 | 6.07 | 27.46 |
| MP POX Test #27 | 11.74 | 8.43 | 8.72 | 9.63 | 26.64 |
| MP POX Test #28 | 7.66 | 7.52 | 7.53 | 7.57 | 27.51 |
| MP POX Test #29 | 14.44 | 6.23 | 6.79 | 9.15 | 25.29 |
| MP POX Test #30 | 13.28 | 8.43 | 8.86 | 10.19 | 26.21 |
| MP POX Test #31 | 8.11 | 7.73 | 7.76 | 7.87 | 27.44 |
| MP POX Test #32 | 46.62 | 26.98 | 33.58 | 35.73 | 22.14 |
| MP POX Test #33 | 14.22 | 8.56 | 9.07 | 10.62 | 25.99 |

TABLE C.17-continued

| Pressure Oxidation Iron Mass Balance Calculations Continued | | | | | |
|---|---|---|---|---|---|
| | IRON | | | | |
| Test ID | Solid Fe Extr % | Liquid Fe Extr % | Final Liquid Fe Extr % | Average Extraction % | Calculated Head |
| MP POX Test #34 | 13.69 | 8.24 | 8.71 | 10.21 | 26.05 |
| MP POX Test #35 | 7.81 | 5.95 | 6.07 | 6.61 | 27.04 |
| | (Mass in-Solid mass out)/Mass in | 1-(Mass in-Soln mass out)/Mass in | Soln mass out/Mass out | | Total g out/g initial solids |

TABLE C.18

| Pressure Oxidation Arsenic Mass Balance Calculations | | | | | |
|---|---|---|---|---|---|
| | ARSENIC | | | | |
| Test ID | grams As In | grams As Out Solid | grams As Out Soln | grams As In | grams As Out |
| MP POX Test #1 | 1.02 | 0.64 | 0.14 | 1.02 | 0.78 |
| MP POX Test #2 | 0.34 | 0.23 | 0.04 | 0.34 | 0.28 |
| MP POX Test #3 | 0.34 | 0.23 | 0.04 | 0.34 | 0.27 |
| MP POX Test #4 | 1.02 | 0.71 | 0.11 | 1.02 | 0.82 |
| MP POX Test #5 | 0.34 | 0.13 | 0.06 | 0.34 | 0.19 |
| MP POX Test #6 | 0.34 | 0.21 | 0.06 | 0.34 | 0.26 |
| MP POX Test #7 | 1.02 | 0.72 | 0.12 | 1.02 | 0.84 |
| MP POX Test #8 | 1.02 | 0.71 | 0.12 | 1.02 | 0.83 |
| MP POX Test #9 | 0.34 | 0.22 | 0.04 | 0.34 | 0.27 |
| MP POX Test #10 | 0.34 | 0.21 | 0.05 | 0.34 | 0.26 |

TABLE C.18-continued

| Pressure Oxidation Arsenic Mass Balance Calculations | | | | | |
|---|---|---|---|---|---|
| | ARSENIC | | | | |
| Test ID | grams As In | grams As Out Solid | grams As Out Soln | grams As In | grams As Out |
| MP POX Test #11 | 1.02 | 0.57 | 0.16 | 1.02 | 0.73 |
| MP POX Test #12 | 1.02 | 0.65 | 0.17 | 1.02 | 0.82 |
| MP POX Test #13 | 0.34 | 0.18 | 0.06 | 0.34 | 0.24 |
| MP POX Test #14 | 0.34 | 0.20 | 0.06 | 0.34 | 0.27 |
| MP POX Test #15 | 1.02 | 0.58 | 0.19 | 1.02 | 0.77 |
| MP POX Test #16 | 1.02 | 0.61 | 0.17 | 1.02 | 0.78 |
| MP POX Test #17 | 0.68 | 0.48 | 0.05 | 0.68 | 0.53 |
| MP POX Test #18 | 0.68 | 0.42 | 0.05 | 0.68 | 0.46 |
| MP POX Test #19 | 0.68 | 0.42 | 0.05 | 0.68 | 0.47 |

TABLE C.19

| Pressure Oxidation Arsenic Mass Balance Calculations | | | | | |
|---|---|---|---|---|---|
| | ARSENIC | | | | |
| Test ID | grams As In | grams As Out Solid | grams As Out Soln | grams As In | grams As Out |
| MP POX Test #20 | 0.34 | 0.13 | 0.01 | 0.34 | 0.14 |
| MP POX Test #21 | 0.34 | 0.12 | 0.01 | 0.34 | 0.13 |
| MP POX Test #22 | 1.02 | 0.36 | 0.01 | 1.02 | 0.37 |
| MP POX Test #23 | 1.02 | 0.41 | 0.01 | 1.02 | 0.42 |
| MP POX Test #24 | 0.34 | 0.14 | 0.08 | 0.34 | 0.22 |
| MP POX Test #25 | 0.34 | 0.14 | 0.01 | 0.34 | 0.15 |
| MP POX Test #26 | 1.02 | 0.57 | 0.18 | 1.02 | 0.74 |
| MP POX Test #27 | 1.02 | 0.34 | 0.03 | 1.02 | 0.37 |
| MP POX Test #28 | 1.02 | 0.69 | 0.08 | 1.02 | 0.77 |
| MP POX Test #29 | 0.34 | 0.21 | 0.02 | 0.34 | 0.23 |
| MP POX Test #30 | 0.34 | 0.24 | 0.04 | 0.34 | 0.28 |
| MP POX Test #31 | 1.02 | 0.81 | 0.04 | 1.02 | 0.85 |
| MP POX Test #32 | 0.34 | 0.15 | 0.09 | 0.34 | 0.23 |
| MP POX Test #33 | 0.34 | 0.15 | 0.13 | 0.34 | 0.29 |
| MP POX Test #34 | 1.02 | 0.51 | 0.32 | 1.02 | 0.83 |
| MP POX Test #35 | 1.02 | 0.54 | 0.26 | 1.02 | 0.80 |
| | Feed assay × initial solids | Residue assay × final solids | ICP × final vol | Total | Total |

TABLE C.20

Pressure Oxidation Arsenic Mass Balance Calculations Continued

| Test ID | ARSENIC Solid As Extr % | Liquid As Extr % | Final Liquid As Extr % | Average Extraction % | Calculated Head |
|---|---|---|---|---|---|
| MP POX Test #1 | 37.29 | 13.51 | 17.73 | 22.84 | 5.18 |
| MP POX Test #2 | 31.15 | 12.44 | 15.31 | 19.63 | 5.53 |
| MP POX Test #3 | 33.64 | 12.97 | 16.35 | 20.99 | 5.39 |
| MP POX Test #4 | 30.41 | 11.21 | 13.87 | 18.50 | 5.49 |
| MP POX Test #5 | 61.48 | 17.13 | 30.78 | 36.46 | 3.78 |
| MP POX Test #6 | 38.69 | 16.51 | 21.21 | 25.47 | 5.29 |
| MP POX Test #7 | 29.54 | 11.62 | 14.15 | 18.43 | 5.58 |
| MP POX Test #8 | 30.44 | 12.00 | 14.71 | 19.05 | 5.55 |
| MP POX Test #9 | 34.58 | 12.90 | 16.47 | 21.32 | 5.33 |
| MP POX Test #10 | 36.95 | 13.46 | 17.59 | 22.67 | 5.20 |

TABLE C.20-continued

Pressure Oxidation Arsenic Mass Balance Calculations Continued

| Test ID | ARSENIC Solid As Extr % | Liquid As Extr % | Final Liquid As Extr % | Average Extraction % | Calculated Head |
|---|---|---|---|---|---|
| MP POX Test #11 | 44.16 | 15.42 | 21.64 | 27.08 | 4.85 |
| MP POX Test #12 | 36.45 | 16.69 | 20.80 | 24.65 | 5.46 |
| MP POX Test #13 | 47.15 | 19.11 | 26.56 | 30.94 | 4.89 |
| MP POX Test #14 | 39.88 | 17.95 | 22.99 | 26.94 | 5.31 |
| MP POX Test #15 | 43.08 | 18.25 | 24.28 | 28.54 | 5.11 |
| MP POX Test #16 | 40.08 | 17.00 | 22.10 | 26.40 | 5.23 |
| MP POX Test #17 | 30.01 | 8.07 | 10.34 | 16.14 | 5.31 |
| MP POX Test #18 | 38.68 | 6.77 | 9.95 | 18.47 | 4.63 |
| MP POX Test #19 | 37.62 | 6.65 | 9.63 | 17.97 | 4.69 |

TABLE C.21

Pressure Oxidation Arsenic Mass Balance Calculations Continued

| Test ID | ARSENIC Solid As Extr % | Liquid As Extr % | Final Liquid As Extr % | Average Extraction % | Calculated Head |
|---|---|---|---|---|---|
| MP POX Test #20 | 62.43 | 3.62 | 8.79 | 24.95 | 2.80 |
| MP POX Test #21 | 65.20 | 4.08 | 10.50 | 26.60 | 2.64 |
| MP POX Test #22 | 64.72 | 1.45 | 3.94 | 23.37 | 2.50 |
| MP POX Test #23 | 60.19 | 1.44 | 3.50 | 21.71 | 2.81 |
| MP POX Test #24 | 59.86 | 23.25 | 36.68 | 39.93 | 4.31 |
| MP POX Test #25 | 58.13 | 3.37 | 7.44 | 22.98 | 3.08 |
| MP POX Test #26 | 44.61 | 17.49 | 24.00 | 28.70 | 4.96 |
| MP POX Test #27 | 66.90 | 2.86 | 7.96 | 25.91 | 2.45 |
| MP POX Test #28 | 32.75 | 7.95 | 10.58 | 17.09 | 5.11 |
| MP POX Test #29 | 38.62 | 5.72 | 8.52 | 17.62 | 4.56 |
| MP POX Test #30 | 28.50 | 11.54 | 13.90 | 17.98 | 5.65 |
| MP POX Test #31 | 20.86 | 3.95 | 4.75 | 9.85 | 5.65 |
| MP POX Test #32 | 57.13 | 25.38 | 37.19 | 39.90 | 4.64 |
| MP POX Test #33 | 55.32 | 39.39 | 46.86 | 47.19 | 5.72 |
| MP POX Test #34 | 49.82 | 31.50 | 38.56 | 39.96 | 5.55 |
| MP POX Test #35 | 46.84 | 25.07 | 32.04 | 34.65 | 5.32 |
| | (Mass in-Solid mass out)/Mass in | 1-(Mass in-Soln mass out)/Mass in | Soln mass out/Mass out | | Total g out/g initial solids |

TABLE C.22

Pressure Oxidation Acid Consumption Mass Balance Calculations

| Test ID | ACID grams Acid In | grams Acid Out | g Acid Consump/g Initial Solids | g Acid Consump/g Final Solids | Average Consumption |
|---|---|---|---|---|---|
| MP POX Test #1 | 31.09 | 31.85 | −0.050 | −0.068 | −0.059 |
| MP POX Test #2 | 10.37 | 9.90 | 0.092 | 0.123 | 0.108 |
| MP POX Test #3 | 31.10 | 31.82 | −0.144 | −0.188 | −0.166 |
| MP POX Test #4 | 10.37 | 9.49 | 0.059 | 0.078 | 0.068 |
| MP POX Test #5 | 10.38 | 9.74 | 0.128 | 0.154 | 0.141 |
| MP POX Test #6 | 31.10 | 29.16 | 0.387 | 0.547 | 0.467 |
| MP POX Test #7 | 10.37 | 10.72 | −0.023 | −0.030 | −0.027 |
| MP POX Test #8 | 31.10 | 26.82 | 0.285 | 0.371 | 0.328 |
| MP POX Test #9 | 10.36 | 9.66 | 0.141 | 0.179 | 0.160 |
| MP POX Test #10 | 31.10 | 28.18 | 0.584 | 0.820 | 0.702 |
| MP POX Test #11 | 10.36 | 8.68 | 0.112 | 0.165 | 0.139 |
| MP POX Test #12 | 31.12 | 28.84 | 0.152 | 0.200 | 0.176 |
| MP POX Test #13 | 10.39 | 9.63 | 0.151 | 0.226 | 0.188 |
| MP POX Test #14 | 31.12 | 11.65 | 3.892 | 5.445 | 4.668 |
| MP POX Test #15 | 10.38 | 19.46 | −0.605 | −0.773 | −0.689 |
| MP POX Test #16 | 31.10 | 29.93 | 0.077 | 0.109 | 0.093 |

TABLE C.22-continued

| Pressure Oxidation Acid Consumption Mass Balance Calculations | | | | | |
|---|---|---|---|---|---|
| | ACID | | | | |
| Test ID | grams Acid In | grams Acid Out | g Acid Consump/ g Initial Solids | g Acid Consump/ g Final Solids | Average Consumption |
| MP POX Test #17 | 20.74 | 18.00 | 0.273 | 0.317 | 0.295 |
| MP POX Test #18 | 20.74 | 18.30 | 0.243 | 0.282 | 0.263 |
| MP POX Test #19 | 20.74 | 19.21 | 0.153 | 0.185 | 0.169 |

TABLE C.23

| Pressure Oxidation Acid Consumption Mass Balance Calculations | | | | | |
|---|---|---|---|---|---|
| | ACID | | | | |
| Test ID | grams Acid In | grams Acid Out | g Acid Consump/ g Initial Solids | g Acid Consump/ g Final Solids | Average Consumption |
| MP POX Test #20 | 10.36 | 46.25 | −7.173 | −8.593 | −7.883 |
| MP POX Test #21 | 31.10 | 36.67 | −1.113 | −1.294 | −1.203 |
| MP POX Test #22 | 10.36 | 10.85 | −0.032 | −0.038 | −0.035 |
| MP POX Test #23 | 31.09 | 37.28 | −0.412 | −0.464 | −0.438 |
| MP POX Test #24 | 10.37 | 12.19 | −0.364 | −0.535 | −0.450 |
| MP POX Test #25 | 31.10 | 38.77 | −1.533 | −1.917 | −1.725 |
| MP POX Test #26 | 10.36 | 9.14 | 0.081 | 0.103 | 0.092 |
| MP POX Test #27 | 31.09 | 33.22 | −0.142 | −0.165 | −0.154 |
| MP POX Test #28 | 31.10 | 29.76 | 0.089 | 0.110 | 0.100 |
| MP POX Test #29 | 10.37 | 10.47 | −0.020 | −0.026 | −0.023 |
| MP POX Test #30 | 31.09 | 28.81 | 0.456 | 0.558 | 0.507 |
| MP POX Test #31 | 10.36 | 9.41 | 0.063 | 0.074 | 0.068 |
| MP POX Test #32 | 10.37 | 9.80 | 0.114 | 0.225 | 0.169 |
| MP POX Test #33 | 31.09 | 29.28 | 0.363 | 0.524 | 0.443 |
| MP POX Test #34 | 10.36 | 10.14 | 0.015 | 0.021 | 0.018 |
| MP POX Test #35 | 31.09 | 30.68 | 0.027 | 0.035 | 0.031 |
| | g of 96.5% H2SO4 added | g free acid × final vol | | | |

TABLE C.24

| Pressure Oxidation Oxygen Mass Balance Calculations | | | | | |
|---|---|---|---|---|---|
| | OXYGEN | | | | |
| Test ID | Steam Pressure | Oxygen In | Final Pressure | Oxygen Out | Oxygen Consumed |
| MP POX Test #1 | 0 | 0 | NM | | |
| MP POX Test #2 | 0 | 0 | NM | | |
| MP POX Test #3 | 0 | 0 | NM | | |
| MP POX Test #4 | 0 | 0 | NM | | |
| MP POX Test #5 | 46 | 0 | 25 | −21 | −25 |
| MP POX Test #6 | 46 | 0 | NM | | |
| MP POX Test #7 | 0 | 0 | NM | | |
| MP POX Test #8 | 0 | 0 | NM | | |
| MP POX Test #9 | 0 | 0 | NM | | |
| MP POX Test #10 | 0 | 0 | NM | | |
| MP POX Test #11 | 46 | 0 | NM | | |
| MP POX Test #12 | 46 | 0 | 20 | −26 | −20 |
| MP POX Test #13 | 46 | 0 | 55 | 9 | −55 |
| MP POX Test #14 | 46 | 0 | 50 | 4 | −50 |
| MP POX Test #15 | 46 | 0 | 50 | 4 | −50 |
| MP POX Test #16 | 46 | 0 | 35 | −11 | −35 |
| MP POX Test #17 | 16 | 50 | 60 | 44 | −10 |
| MP POX Test #18 | 16 | 50 | 60 | 44 | −10 |
| MP POX Test #19 | 16 | 50 | 60 | 44 | −10 |

TABLE C.25

| Pressure Oxidation Oxygen Mass Balance Calculations | | | | | |
|---|---|---|---|---|---|
| | OXYGEN | | | | |
| Test ID | Steam Pressure | Oxygen In | Final Pressure | Oxygen Out | Oxygen Consumed |
| MP POX Test #20 | 0 | 100 | 65 | 65 | 35 |
| MP POX Test #21 | 0 | 100 | 65 | 65 | 35 |
| MP POX Test #22 | 0 | 100 | 60 | 60 | 40 |
| MP POX Test #23 | 0 | 100 | 65 | 65 | 35 |
| MP POX Test #24 | 46 | 100 | 130 | 84 | −30 |
| MP POX Test #25 | 46 | 100 | 110 | 64 | −10 |
| MP POX Test #26 | 46 | 100 | 130 | 84 | −30 |
| MP POX Test #27 | 46 | 100 | 90 | 44 | 10 |
| MP POX Test #28 | 0 | 100 | 90 | 90 | 10 |
| MP POX Test #29 | 0 | 100 | 85 | 85 | 15 |
| MP POX Test #30 | 0 | 100 | 90 | 90 | 10 |
| MP POX Test #31 | 0 | 100 | 85 | 85 | 15 |
| MP POX Test #32 | 46 | 100 | 80 | 34 | 20 |
| MP POX Test #33 | 46 | 100 | 125 | 79 | −25 |
| MP POX Test #34 | 46 | 100 | 110 | 64 | −10 |
| MP POX Test #35 | 46 | 100 | 125 | 79 | −25 |
| | psig | psig | psig | psig | psig |

NM—not measured

APPENDIX D

Stat-Ease Statistical Data

Statistical data from Stat-Ease Design Expert 8.0 for the atmospheric pressure and pressure oxidation tests are shown below.

D.1 Atmospheric Leach Model ANOVA

A description of the Response Surface Model for the 0.5 Factorial, 3 center points DOE is shown in the following sections.

D.1.1 Response 1: Arsenic Extraction ANOVA & Diagnostic Data

The Analysis Of Variance and associated statistical data for Response Surface Reduced 2F1 Model for Response 1 Arsenic Extraction is shown below and in FIGS. 118-128, which are State Ease graphs for arsenic extraction model.

TABLE D.1

Backward Elimination Regression with Alpha to Exit = 0.100; Forced Terms: Intercept

| Coefficient Removed | t for H0 Estimate | Coeff = 0 | Prob > \|t\| | R-Squared | MSE |
|---|---|---|---|---|---|
| AB | −0.039226989 | −0.039007751 | 0.971334891 | 0.889820951 | 12.14142277 |
| CE | 0.08508036 | 0.0976685 | 0.926893835 | 0.889558198 | 9.736301949 |
| CD | −0.16687118 | −0.213916513 | 0.839061942 | 0.888547428 | 8.187840932 |
| AE | 0.174861055 | 0.244437812 | 0.815036263 | 0.887437549 | 7.088038259 |
| BE | 0.22966789 | 0.345062087 | 0.740183783 | 0.885522897 | 6.307528156 |
| B-Solids | −0.407428387 | −0.648905831 | 0.534579778 | 0.879497412 | 5.901799055 |
| BC | −0.425438699 | −0.700494572 | 0.501324643 | 0.872927441 | 5.601216088 |
| AD | −0.43264109 | −0.731217525 | 0.481428873 | 0.866133138 | 5.36427399 |
| BD | −0.47299657 | −0.816887982 | 0.431329047 | 0.858012214 | 5.215552164 |
| E-Time | −0.828512307 | −1.451138314 | 0.172376894 | 0.833095696 | 5.65919602 |
| AC | −0.883415018 | −1.485413617 | 0.161276689 | 0.804767496 | 6.146878699 |
| DE | −0.93725219 | −1.512130014 | 0.152742388 | 0.772881326 | 6.674091231 |
| C-Initial [Cu2+] | −1.095108465 | −1.695590825 | 0.110614156 | 0.729349819 | 7.456223079 |

TABLE D.2

Analysis of Variance Table [Partial sum of squares-Type III]

| Source | Sum of Squares | df | Mean Square | F Value | p- value Prob > F | |
|---|---|---|---|---|---|---|
| Model | 321.489 | 2 | 160.745 | 21.5585 | <0.0001 | significant |
| A-Initial Acid | 290.979 | 1 | 290.979 | 39.025 | <0.0001 | |
| D-Temperature | 30.5098 | 1 | 30.5098 | 4.09186 | 0.0601 | |
| Residual | 119.3 | 16 | 7.45622 | | | |
| Lack of Fit | 100.799 | 14 | 7.19992 | 0.77834 | 0.6926 | not significant |
| Pure Error | 18.5007 | 2 | 9.25036 | | | |
| Cor Total | 440.789 | 18 | | | | |

The Model F-value of 21.56 implies the model is significant. There is a 0.01% chance that a "Model F-Value" this large could occur due to noise.

Values of "Prob>F" less than 0.0500 indicate model terms are significant. In this case A are significant model terms. Values greater than 0.1000 indicate the model terms are not significant.

If there are many insignificant model terms (not counting those required to support hierarchy), model reduction may improve your model.

The "Lack of Fit F-value" of 0.78 implies the Lack of Fit is not significant relative to the pure error. There is a 69.26% chance that a "Lack of Fit F-value" this large could occur due to noise. Non-significant lack of fit is good—we want the model to fit.

TABLE D.3

Trend Data

| | | | |
|---|---|---|---|
| Std. Dev. | 2.73061 | R-Squared | 0.72935 |
| Mean | 11.779 | Adj R-Squared | 0.69552 |
| C.V. % | 23.182 | Pred R-Squared | 0.63601 |
| PRESS | 160.441 | Adeq Precision | 10.406 |

The "Pred R-Squared" of 0.6360 is in reasonable agreement with the "Adj R-Squared" of 0.6955. "Adeq Precision" measures the signal to noise ratio. A ratio greater than 4 is desirable. Your ratio of 10.406 indicates an adequate signal. This model can be used to navigate the design pace.

TABLE D.4

| Coefficient Factor | Standard Estimate | 95% CI df | 95% CI Error | Confidence Intervals Low | High | VIF |
|---|---|---|---|---|---|---|
| Intercept | 11.779 | 1 | 0.62644 | 10.451 | 13.107 | |
| A-Initial Acid | 4.26453 | 1 | 0.68265 | 2.81737 | 5.71169 | 1 |
| D-Temperature | 1.38089 | 1 | 0.68265 | −0.0663 | 2.82805 | 1 |

Final Equation in Terms of Coded Factors:

$$\text{As Extraction} = +11.78 + 4.26 * A + 1.38 * D \quad \text{(D.1)}$$

Final Equation in Terms of Actual Factors:

$$\text{As Extraction} = +4.75269 + 0.85291 * \text{Initial Acid} + 0.055236 * \text{Temperature} \quad \text{(D.2)}$$

The Diagnostics Case Statistics Report for this response is shown below. Proceed to Diagnostic Plots (the next icon in progression). Be sure to look at the:

1) Normal probability plot of the studentized residuals to check for normality of residuals.

2) Studentized residuals versus predicted values to check for constant error.

3) Externally Studentized Residuals to look for outliers, i.e., influential values.

4) Box-Cox plot for power transformations.

TABLE D.5

Diagnostics Case Statistics

| Standard Order | Actual Value | Predicted Value | Residual | Leverage | Internally Studentized Residual | Externally Studentized Residual | Influence on Fitted Value DFFITS | Cook's Distance | Run Order |
|---|---|---|---|---|---|---|---|---|---|
| 1 | 7.3224844 | 8.89537 | −1.5729 | 0.17763 | −0.6351897 | −0.6229239 | −0.2895089 | 0.0290495 | 15 |
| 2 | 20.992571 | 17.4244 | 3.56815 | 0.17763 | 1.44095326 | 1.49561192 | 0.69509761 | 0.1494969 | 7 |
| 3 | 10.542378 | 8.89537 | 1.64701 | 0.17763 | 0.66512605 | 0.65309775 | 0.3035324 | 0.0318523 | 9 |
| 4 | 16.652177 | 17.4244 | −0.7722 | 0.17763 | −0.3118634 | −0.3028825 | −0.140767 | 0.0070026 | 14 |
| 5 | 11.756819 | 8.89537 | 2.86145 | 0.17763 | 1.15556395 | 1.16870107 | 0.54316317 | 0.0961436 | 10 |
| 6 | 13.911516 | 17.4244 | −3.5129 | 0.17763 | −1.4186467 | −1.4690979 | −0.682775 | 0.1449042 | 13 |
| 7 | 5.5124557 | 8.89537 | −3.3829 | 0.17763 | −1.3661483 | −1.4073966 | −0.6540988 | 0.134378 | 12 |
| 8 | 14.232981 | 17.4244 | −3.1914 | 0.17763 | −1.2888269 | −1.3182019 | −0.6126449 | 0.1195974 | 11 |
| 9 | 5.051925 | 6.13358 | −1.0817 | 0.17763 | −0.4368141 | −0.4254881 | −0.197749 | 0.0137381 | 3 |
| 10 | 15.879534 | 14.6626 | 1.21689 | 0.17763 | 0.49142788 | 0.47945517 | 0.22283062 | 0.0173881 | 17 |
| 11 | 5.8099897 | 6.13358 | −0.3236 | 0.17763 | −0.1306786 | −0.1265966 | −0.0588368 | 0.0012295 | 16 |
| 12 | 16.386052 | 14.6626 | 1.72341 | 0.17763 | 0.69597943 | 0.68431737 | 0.31804198 | 0.0348759 | 6 |
| 13 | 5.2215797 | 6.13358 | −0.912 | 0.17763 | −0.368301 | −0.3581272 | −0.1664425 | 0.0097665 | 19 |
| 14 | 12.99924 | 14.6626 | −1.6634 | 0.17763 | −0.6717444 | −0.6597841 | −0.3066399 | 0.0324893 | 5 |
| 15 | 4.5423743 | 6.13358 | −1.5912 | 0.17763 | −0.6425901 | −0.6303725 | −0.2929707 | 0.0297304 | 4 |
| 16 | 12.938408 | 14.6626 | −1.7242 | 0.17763 | −0.6963109 | −0.6846535 | −0.3181982 | 0.0349091 | 18 |
| 17 | 12.124663 | 11.779 | 0.34566 | 0.05263 | 0.13005567 | 0.12599247 | 0.02969671 | 0.0003132 | 1 |

TABLE D.5-continued

| Diagnostics Case Statistics | | | | | | | | | |
|---|---|---|---|---|---|---|---|---|---|
| 18 | 13.878192 | 11.779 | 2.09919 | 0.05263 | 0.78982818 | 0.78010695 | 0.18387297 | 0.0115524 | 2 |
| 19 | 18.045724 | 11.779 | 6.26672 | 0.05263 | 2.35787842 | 2.82623503 | 0.66614998 | 0.1029554 | 8 |

Current Transform: None

| Box-Cox Power Transformation | | | | |
|---|---|---|---|---|
| Constant k | 95% CI Low | 95% CI High | Best Lambda | Rec. Transform |
| 0 | −0.35 | 1.54 | 0.6 | None |

FIGS. 118-128 are State Ease graphs for arsenic extraction model.

D.1.2 Response 2: Copper Difference ANOVA & Diagnostic Data

The Analysis of Variance and associated statistical data for Response Surface Reduced 2F1 Model for Response 2 Copper Difference is shown below and in FIGS. 129-139, which are State Ease graphs for copper difference model.

TABLE D.6

| Backward Elimination Regression with Alpha to Exit = 0.100; Forced Terms: Intercept | | | | | |
|---|---|---|---|---|---|
| Coefficient Removed | t for H0 Estimate | Coeff = 0 | Prob > \|t\| | R-Squared | MSE |
| E-Time | 0.00164 | 0.095629314 | 0.9298449 | 0.99102907 | 0.00353 |
| AC | 0.00303 | 0.203889035 | 0.8483933 | 0.99093583 | 0.00286 |

TABLE D.6-continued

| Backward Elimination Regression with Alpha to Exit = 0.100; Forced Terms: Intercept | | | | | |
|---|---|---|---|---|---|
| Coefficient Removed | t for H0 Estimate | Coeff = 0 | Prob > \|t\| | R-Squared | MSE |
| DE | −0.0054 | −0.407325764 | 0.7006215 | 0.99063506 | 0.00246 |
| AE | 0.00576 | 0.464536345 | 0.658642 | 0.99029824 | 0.00218 |
| BE | −0.0067 | −0.573817966 | 0.5840488 | 0.98984189 | 0.002 |
| CD | −0.0118 | −1.058701184 | 0.3206523 | 0.98841868 | 0.00203 |

Hierarchical Terms Added after Backward Elimination Regression

E-Time

Transform: None

Constant: 0

TABLE D.7

| Analysis of Variance Table [Partial sum of squares-Type III] | | | | | | |
|---|---|---|---|---|---|---|
| Source | Sum of Squares | df | Mean Square | F Value | p-value Prob > F | |
| Model | 1.557659848 | 10 | 0.155766 | 68.4397299 | <0.0001 | significant |
| A-Initial Acid | 0.045734577 | 1 | 0.0457346 | 20.0946445 | 0.002 | |
| B-Solids | 1.283374317 | 1 | 1.2833743 | 563.883006 | <0.0001 | |
| C-Initial [Cu2+] | 0.141436193 | 1 | 0.1414362 | 62.1435729 | <0.0001 | |
| D-Temperature | 0.010770229 | 1 | 0.0107702 | 4.73217296 | 0.0613 | |
| E-Time | 4.30E−05 | 1 | 4.30E−05 | 0.01887696 | 0.8941 | |
| AB | 0.007664206 | 1 | 0.0076642 | 3.36746291 | 0.1038 | |
| AD | 0.014381894 | 1 | 0.0143819 | 6.31904937 | 0.0362 | |
| BC | 0.015081931 | 1 | 0.0150819 | 6.62662847 | 0.0329 | |
| BD | 0.022385915 | 1 | 0.0223859 | 9.83581885 | 0.0139 | |
| CE | 0.016787622 | 1 | 0.0167876 | 7.37606673 | 0.0264 | |
| Residual | 0.018207668 | 8 | 0.002276 | | | |
| Lack of Fit | 0.006773126 | 6 | 0.0011289 | 0.19744635 | 0.9485 | not significant |
| Pure Error | 0.011434542 | 2 | 0.0057173 | | | |
| Cor Total | 1.575867516 | 18 | | | | |

The Model F-value of 68.44 implies the model is significant. There is a 0.01% chance that a "Model F-Value" this large could occur due to noise.

Values of "Prob>F" less than 0.0500 indicate model terms are significant. In this case A, B, C, AD, BC, BD, CE are significant model terms. Values greater than 0.1000 indicate the model terms are not significant.

If there are many insignificant model terms (not counting those required to support hierarchy), model reduction may improve your model.

The "Lack of Fit F-value" of 0.20 implies the Lack of Fit is not significant relative to the pure error. There is a 94.85% chance that a "Lack of Fit F-value" this large could occur due to noise. Non-significant lack of fit is good—we want the model to fit.

TABLE D.8

| Trend Data | | | |
|---|---|---|---|
| Std. Dev. | 0.047707007 | R-Squared | 0.9884459 |
| Mean | 0.546196201 | Adj R-Squared | 0.9740034 |
| C.V. % | 8.734408392 | Pred R-Squared | 0.9626489 |
| PRESS | 0.058860446 | Adeq Precision | 24.085464 |

The "Pred R-Squared" of 0.9626 is in reasonable agreement with the "Adj R-Squared" of 0.9740. "Adeq Precision" measures the signal to noise ratio. A ratio greater than 4 is desirable. Your ratio of 24.085 indicates an adequate signal. This model can be used to navigate the design space.

TABLE D.9

| Confidence Intervals | | | | | | |
|---|---|---|---|---|---|---|
| Coefficient Factor | Standard Estimate | 95% CI df | 95% CI Error | Low | High | VIF |
| Intercept | 0.546196201 | 1 | 0.0109447 | 0.52095759 | 0.57143 | |
| A-Initial Acid | 0.05346411 | 1 | 0.0119268 | 0.02596097 | 0.08097 | 1 |
| B-Solids | 0.28321528 | 1 | 0.0119268 | 0.25571214 | 0.31072 | 1 |
| C-Initial [Cu2+] | −0.09402001 | 1 | 0.0119268 | −0.1215231 | −0.0665 | 1 |
| D-Temperature | −0.02594493 | 1 | 0.0119268 | −0.0534481 | 0.00156 | 1 |
| E-Time | 0.001638658 | 1 | 0.0119268 | −0.0258645 | 0.02914 | 1 |
| AB | 0.021886363 | 1 | 0.0119268 | −0.0056168 | 0.04939 | 1 |
| AD | 0.029981134 | 1 | 0.0119268 | 0.002478 | 0.05748 | 1 |
| BC | −0.03070213 | 1 | 0.0119268 | −0.0582053 | −0.0032 | 1 |
| BD | −0.03740481 | 1 | 0.0119268 | −0.0649079 | −0.0099 | 1 |
| CE | −0.03239176 | 1 | 0.0119268 | −0.0598949 | −0.0049 | 1 |

Final Equation in Terms of Coded Factors:

$$\begin{aligned}\text{Cu Difference} = & \\ & +0.546196201 \\ & +0.05346411 * A \\ & +0.28321528 * B \\ & -0.094020009 * C \\ & -0.025944929 * D \\ & +0.001638658 * E \\ & +0.021886363 * A * B \\ & +0.029981134 * A * D \\ & -0.030702129 * B * C \end{aligned} \tag{D.3}$$

-continued $$\begin{aligned} & -0.037404809 * B * D \\ & -0.032391764 * C * E \end{aligned}$$

Final Equation in Terms of Actual Factors:

$$\begin{aligned}\text{Cu Difference} = & \\ & -0.12458313 \\ & -0.010054177 * \text{Initial Acid} \\ & +0.038730875 * \text{Solids} \\ & +0.002144518 * \text{Initial[Cu2 +]} \\ & +0.000755342 * \text{Temperature} \\ & +0.027812465 * \text{Time} \\ & +0.000437727 * \text{Initial Acid} * \text{Solids} \end{aligned} \tag{D.4}$$

-continued $$+0.029981 * \text{Initial Acid} * \text{Temperature}$$

$$-0.000204681 * \text{Solids} * \text{Initial}[Cu2+]$$

$$-0.000149619 * \text{Solids} * \text{Temperature}$$

$$-0.001079725 * \text{Initial}[Cu2+] * \text{Time}$$

The Diagnostics Case Statistics Report for this response is shown below. Proceed to Diagnostic Plots (the next icon in progression). Be sure to look at the:

1) Normal probability plot of the studentized residuals to check for normality of residuals.

2) Studentized residuals versus predicted values to check for constant error.

3) Externally Studentized Residuals to look for outliers, i.e., influential values.

4) Box-Cox plot for power transformations.

TABLE D.10

Diagnostics Case Statistics

| Standard Order | Actual Value | Predicted Value | Residual | Leverage | Internally Studentized Residual | Externally Studentized Residual | Influence on Fitted Value DFFITS | Cook's Distance | Run Order |
|---|---|---|---|---|---|---|---|---|---|
| 1 | 0.31547886 | 0.310230221 | 0.00525 | 0.67763 | 0.193770798 | 0.18168284 | 0.263411349 | 0.00718 | 15 |
| 2 | 0.36195228 | 0.365287141 | −0.0033 | 0.67763 | −0.12311735 | −0.115274995 | −0.16713049 | 0.0029 | 7 |
| 3 | 0.77907536 | 0.751421853 | 0.02765 | 0.67763 | 1.020920209 | 1.024017284 | 1.48466291 | 0.19917 | 9 |
| 4 | 1.0274448 | 1.030145908 | −0.0027 | 0.67763 | −0.099720291 | −0.093337819 | −0.135325058 | 0.0019 | 14 |
| 5 | 0.16482252 | 0.180317146 | −0.0155 | 0.67763 | −0.572035089 | −0.546380805 | −0.79216565 | 0.06253 | 10 |
| 6 | 0.23501757 | 0.241928696 | −0.0069 | 0.67763 | −0.255146941 | −0.239645157 | −0.34744753 | 0.01244 | 13 |
| 7 | 0.4673554 | 0.505254893 | −0.0379 | 0.67763 | −1.3991845 | −1.50599484 | * −2.18 | 0.37411 | 12 |
| 8 | 0.76987944 | 0.777424318 | −0.0075 | 0.67763 | −0.278544 | −0.261826791 | −0.379607387 | 0.01483 | 11 |
| 9 | 0.25889226 | 0.279211886 | −0.0203 | 0.67763 | −0.750165842 | −0.727779938 | −1.055165667 | 0.10754 | 3 |
| 10 | 0.34837983 | 0.350465956 | −0.0021 | 0.67763 | −0.077016189 | −0.07206877 | −0.104488304 | 0.00113 | 17 |
| 11 | 0.98519106 | 1.006144438 | −0.021 | 0.67763 | −0.773562901 | −0.752284017 | −1.090692702 | 0.11435 | 16 |
| 12 | 1.00433128 | 1.028822273 | −0.0245 | 0.67763 | −0.9041656 | −0.892605686 | −1.294136902 | 0.15622 | 6 |
| 13 | 0.16592708 | 0.155853441 | 0.01007 | 0.67763 | 0.37190155 | 0.350928849 | 0.508791263 | 0.02643 | 19 |
| 14 | 0.21239302 | 0.220552881 | −0.0082 | 0.67763 | −0.301248103 | −0.28340382 | −0.410890663 | 0.01734 | 5 |
| 15 | 0.76413024 | 0.753422848 | 0.01071 | 0.67763 | 0.395298609 | 0.373433039 | 0.541418775 | 0.02986 | 4 |
| 16 | 0.79690032 | 0.782655313 | 0.01425 | 0.67763 | 0.525901308 | 0.500666145 | 0.725886631 | 0.05285 | 18 |
| 17 | 0.5121584 | 0.546196201 | −0.034 | 0.05263 | −0.733026825 | −0.709940121 | −0.167334491 | 0.00271 | 1 |
| 18 | 0.5504083 | 0.546196201 | 0.00421 | 0.05263 | 0.090710382 | 0.084895464 | 0.020010053 | 4.16E−05 | 2 |
| 19 | 0.65798979 | 0.546196201 | 0.11179 | 0.05263 | 2.407549802 | 4.290892899 | 1.011373155 | 0.02927 | 8 |

* Exceeds limits

FIGS. 129-139 are State Ease graphs for copper difference model.

D.1.3 Response 3: Iron Extraction ANOVA & Diagnostic Data

The Analysis of Variance and associated statistical data for Response Surface Reduced 2F1 Model Response 3 of Iron Extraction is shown below and in FIGS. 140-150, which are State Ease graphs for iron extraction model.

TABLE D.11

Backward Elimination Regression with Alpha to Exit = 0.100; Forced Term: Intercept

| Coefficient Removed | t for H0 Estimate | Coeff = 0 | Prob > \|t\| | R-Squared | MSE |
|---|---|---|---|---|---|
| CD | 0.02472212 | 0.047993986 | 0.964737418 | 0.957889633 | 3.186488378 |
| AB | 0.041817972 | 0.093705868 | 0.929848867 | 0.957797192 | 2.55478668 |
| AC | −0.064286059 | −0.160879042 | 0.87848683 | 0.957578733 | 2.140009426 |
| B-Solids | 0.070438539 | 0.192602753 | 0.853623854 | 0.957316458 | 1.845634566 |
| AE | −0.104189542 | −0.306768853 | 0.767943502 | 0.956742626 | 1.636641166 |
| DE | −0.123969776 | −0.38761366 | 0.7084111 | 0.955930229 | 1.482113936 |
| AD | 0.149740642 | 0.491992958 | 0.634501455 | 0.954744962 | 1.369778158 |
| BD | −0.269078348 | −0.919631048 | 0.379414635 | 0.950917647 | 1.350566554 |
| BC | 0.270045443 | 0.92947743 | 0.372589722 | 0.947062771 | 1.335252063 |

TABLE D.11-continued

| Backward Elimination Regression with Alpha to Exit = 0.100; Forced Term: Intercept | | | | | |
|---|---|---|---|---|---|
| Coefficient Removed | t for H0 Estimate | Coeff = 0 | Prob > \|t\| | R-Squared | MSE |
| BE | −0.294185332 | −1.018355417 | 0.328601854 | 0.942487902 | 1.3390573 |
| CE | −0.333041366 | −1.1512207 | 0.270375734 | 0.936624724 | 1.370172124 |

TABLE D.12

| Analysis of Variance Table [Partial sum of squares-Type III] | | | | | | |
|---|---|---|---|---|---|---|
| Source | Sum of Squares | df | Mean Square | F Value | p-value Prob > F | |
| Model | 283.497 | 4 | 70.8743 | 51.7266 | <0.0001 | significant |
| A-Initial Acid | 193.04 | 1 | 193.04 | 140.887 | <0.0001 | |
| C-Initial [Cu2+] | 14.3795 | 1 | 14.3795 | 10.4947 | 0.0059 | |
| D-Temperature | 68.6212 | 1 | 68.6212 | 50.0822 | <0.0001 | |
| E-Time | 7.45676 | 1 | 7.45676 | 5.44221 | 0.0351 | |
| Residual | 19.1824 | 14 | 1.37017 | | | |
| Lack of Fit | 16.9661 | 12 | 1.41384 | 1.27587 | 0.5213 | not significant |
| Pure Error | 2.21628 | 2 | 1.10814 | | | |
| Cor Total | 302.68 | 18 | | | | |

The Model F-value of 51.73 implies the model is significant. There is a 0.01% chance that a "Model F-Value" this large could occur due to noise.

Values of "Prob>F" less than 0.0500 indicate model terms are significant. In this case A, C, D, E are significant model terms. Values greater than 0.1000 indicate the model terms are not significant.

If there are many insignificant model terms (not counting those required to support hierarchy), model reduction may improve your model.

The "Lack of Fit F-value" of 1.28 implies the Lack of Fit is not significant relative to the pure error. There is a 52.13% chance that a "Lack of Fit F-value" this large could occur due to noise. Non-significant lack of fit is good—we want the model to fit.

TABLE D.13

| Trend Data | | | |
|---|---|---|---|
| Std. Dev. | 1.1705435 | R-Squared | 0.93662 |
| Mean | 10.74605 | Adj R-Squared | 0.91852 |
| C.V. % | 10.89278 | Pred R-Squared | 0.90415 |
| PRESS | 29.01045 | Adeq Precision | 23.898 |

The "Pred R-Squared" of 0.9042 is in reasonable agreement with the "Adj R-Squared" of 0.9185. "Adeq Precision" measures the signal to noise ratio. A ratio greater than 4 is desirable. Your ratio of 23.898 indicates an adequate signal. This model can be used to navigate the design space.

TABLE D.14

| Confidence Intervals | | | | | | |
|---|---|---|---|---|---|---|
| Coefficient Factor | Standard Estimate | 95% CI df | 95% CI Error | Low | High | VIF |
| Intercept | 10.74605 | 1 | 0.26854 | 10.1701 | 11.322 | |
| A-Initial Acid | 3.4734694 | 1 | 0.29264 | 2.84583 | 4.10111 | 1 |
| C-Initial [Cu2+] | −0.948009 | 1 | 0.29264 | −1.5757 | −0.3204 | 1 |
| D-Temperature | 2.0709474 | 1 | 0.29264 | 1.44331 | 2.69859 | 1 |
| E-Time | 0.6826768 | 1 | 0.29264 | 0.05504 | 1.31032 | 1 |

Final Equation in Terms of Coded Factors:

$$\text{Fe Extraction} = +10.75 + 3.47 * A - 0.95 * C + 2.07 * D + 0.68 * E \quad \text{(D.5)}$$

Final Equation in Terms of Actual Factors:

$$\text{Fe Extraction} = +3.34535 \quad \text{(D.6)}$$

-continued $$+ 0.69469 * \text{Initial Acid} - 0.063201 * \text{Initial[Cu2 +]} + 0.082838 * \text{Temperature} + 0.34134 * \text{Time}$$

The Diagnostics Case Statistics Report for this response is shown below. Proceed to Diagnostic Plots (the next icon in progression). Be sure to look at the:

1) Normal probability plot of the studentized residuals to check for normality of residuals.

2) Studentized residuals versus predicted values to check for constant error.

3) Externally Studentized Residuals to look for outliers, i.e., influential values.

4) Box-Cox plot for power transformations.

TABLE D.15

Diagnostics Case Statistics

| Standard Order | Actual Value | Predicted Value | Residual | Leverage | Internally Studentized Residual | Externally Studentized Residual | Influence on Fitted Value DFFITS | Cook's Distance | Run Order |
|---|---|---|---|---|---|---|---|---|---|
| 1 | 11.531211 | 10.97421 | 0.556998 | 0.30263 | 0.569816 | 0.555569 | 0.3659856 | 0.02818 | 15 |
| 2 | 16.4507 | 16.5558 | −0.1051 | 0.30263 | −0.10752 | −0.1036489 | −0.06828 | 0.001 | 7 |
| 3 | 8.5183291 | 9.60886 | −1.09053 | 0.30263 | −1.11563 | −1.1262745 | −0.741942 | 0.10802 | 9 |
| 4 | 17.172083 | 17.92115 | −0.74907 | 0.30263 | −0.76631 | −0.7544239 | −0.496983 | 0.05097 | 14 |
| 5 | 7.3589555 | 7.712842 | −0.35389 | 0.30263 | −0.36203 | −0.3505062 | −0.230899 | 0.01138 | 10 |
| 6 | 15.43287 | 16.02513 | −0.59227 | 0.30263 | −0.6059 | −0.591664 | −0.389763 | 0.03186 | 13 |
| 7 | 8.0778413 | 9.078196 | −1.00035 | 0.30263 | −1.02338 | −1.0252429 | −0.675387 | 0.0909 | 12 |
| 8 | 15.416364 | 14.65978 | 0.756583 | 0.30263 | 0.773995 | 0.7623288 | 0.5021903 | 0.05199 | 11 |
| 9 | 4.3718993 | 5.466965 | −1.09507 | 0.30263 | −1.12027 | −1.1314183 | −0.745331 | 0.10892 | 3 |
| 10 | 13.93204 | 13.77926 | 0.152782 | 0.30263 | 0.156298 | 0.1507443 | 0.099304 | 0.00212 | 17 |
| 11 | 6.9149613 | 6.832319 | 0.082643 | 0.30263 | 0.084545 | 0.0814899 | 0.0536822 | 0.00062 | 16 |
| 12 | 12.083622 | 12.4139 | −0.33028 | 0.30263 | −0.33788 | −0.326928 | −0.215366 | 0.00991 | 6 |
| 13 | 4.4249617 | 4.936301 | −0.51134 | 0.30263 | −0.52311 | −0.5090783 | −0.335359 | 0.02375 | 19 |
| 14 | 9.32463 | 10.51789 | −1.19326 | 0.30263 | −1.22072 | −1.2444018 | −0.81976 | 0.12933 | 5 |
| 15 | 4.4048609 | 3.570947 | 0.833913 | 0.30263 | 0.853105 | 0.8443107 | 0.5561965 | 0.06317 | 4 |
| 16 | 11.366222 | 11.88324 | −0.51702 | 0.30263 | −0.52892 | −0.5148463 | −0.339159 | 0.02428 | 18 |
| 17 | 11.477072 | 10.74605 | 0.731022 | 0.05263 | 0.641628 | 0.6275849 | 0.1479232 | 0.00457 | 1 |
| 18 | 12.344213 | 10.74605 | 1.598163 | 0.05263 | 1.40273 | 1.458044 | 0.3436643 | 0.02186 | 2 |
| 19 | 13.572111 | 10.74605 | 2.826061 | 0.05263 | 2.480473 | 3.1926206 | 0.7525079 | 0.06836 | 8 |

Current Transform: None

Box-Cox Power Transformation

| Constant k | 95% CI Low | 95% CI High | Best Lambda | Rec. Transform |
|---|---|---|---|---|
| 0 | 0.41 | 1.84 | 1.1 | None |

FIGS. 140-150 are State Ease graphs for iron extraction model.

D.1.4 Response 4: Acid Consumption ANOVA & Diagnostic Data

The Analysis of Variance and associated statistical data for Response Surface Reduced 2F1 Model for Response 4 Acid Consumption is shown below and in FIGS. 151-161, which are State Ease graphs for acid consumption model.

TABLE D.16

Backward Elimination Regression with Alpha to Exit = 0.100; Forced Terms: Intercept

| Coefficient Removed | t for H0 Estimate | Coeff = 0 | Prob > \|t\| | R-Squared | MSE |
|---|---|---|---|---|---|
| E-Time | 0.015819091 | −0.063562872 | 0.955099591 | 0.931536532 | 0.662004853 |
| AE | 0.015819091 | −0.077769789 | 0.942907722 | 0.931398507 | 0.497504614 |
| BD | −0.01950291 | 0.110601455 | 0.917259631 | 0.931188712 | 0.399220855 |
| CE | 0.01950291 | −0.123467538 | 0.906546545 | 0.930978917 | 0.333698348 |
| BC | 0.031442378 | −0.217720012 | 0.834862706 | 0.930433627 | 0.288286866 |
| DE | −0.031442378 | 0.234241019 | 0.8215015 | 0.929888338 | 0.254228254 |
| B-Solids | −0.04221945 | 0.334935094 | 0.746287085 | 0.928905184 | 0.229149527 |
| AB | −0.04221945 | 0.352787412 | 0.732369054 | 0.927922029 | 0.209086545 |
| BE | −0.059193051 | 0.517806711 | 0.615854159 | 0.925989448 | 0.195175139 |
| CD | 0.059193051 | −0.535942835 | 0.602666491 | 0.924056866 | 0.1835823 |
| C-Initial [Cu2+] | −0.082885378 | 0.773788924 | 0.454030355 | 0.920267624 | 0.177915952 |
| AC | −0.082885378 | 0.786014338 | 0.445950269 | 0.916478383 | 0.173059082 |
| D-Temperature | 0.121688317 | −1.170069547 | 0.261506763 | 0.908310787 | 0.17731706 |
| AD | 0.121688317 | −1.155935533 | 0.265787809 | 0.900143192 | 0.18104279 |

Transform: Base 10 Log

Constant: 0.00013528

These Rows Were Ignored for this Analysis: 2

TABLE D.17

Analysis of Variance Table [Partial sum of squares-Type III]

| Source | Sum of Squares | df | Mean Square | F Value | p-value Prob >F | |
|---|---|---|---|---|---|---|
| Model | 26.1117 | 1 | 26.1117 | 144.229 | <0.0001 | significant |
| A-Initial Acid | 26.1117 | 1 | 26.1117 | 144.229 | <0.0001 | |
| Residual | 2.89668 | 16 | 0.18104 | | | |
| Lack of Fit | 2.87155 | 15 | 0.19144 | 7.61774 | 0.2778 | not significant |
| Pure Error | 0.02513 | 1 | 0.02513 | | | |
| Cor Total | 29.0084 | 17 | | | | |

The Model F-value of 144.23 implies the model is significant. There is a 0.01% chance that a "Model F-Value" this large could occur due to noise.

Values of "Prob>F" less than 0.0500 indicate model terms are significant. In this case A are significant model terms. Values greater than 0.1000 indicate the model terms are not significant.

If there are many insignificant model terms (not counting those required to support hierarchy), model reduction may improve your model.

The "Lack of Fit F-value" of 7.62 implies the Lack of Fit is not significant relative to the pure error. There is a 27.78% chance that a "Lack of Fit F-value" this large could occur due to noise. Non-significant lack of fit is good—we want the model to fit.

TABLE D.18

Trend Data

| | | | |
|---|---|---|---|
| Std. Dev. | 0.42549 | R-Squared | 0.90014 |
| Mean | −2.4747 | Adj R-Squared | 0.8939 |
| C.V. % | 17.1936 | Pred R-Squared | 0.88163 |
| PRESS | 3.43376 | Adeq Precision | 18.0143 |

The "Pred R-Squared" of 0.8816 is in reasonable agreement with the "Adj R-Squared" of 0.8939. "Adeq Precision" measures the signal to noise ratio. A ratio greater than 4 is desirable. Your ratio of 18.014 indicates an adequate signal. This model can be used to navigate the design space.

TABLE D.19

| Confidence Intervals | | | | | | |
|---|---|---|---|---|---|---|
| Co-efficient Factor | Standard Estimate | 95% CI df | 95% CI Error | Low | High | VIF |
| Intercept | −2.4747 | 1 | 0.10029 | −2.6873 | −2.2621 | |
| A-Initial Acid | 1.27749 | 1 | 0.10637 | 1.05199 | 1.50299 | 1 |

Final Equation in Terms of Coded Factors:

$$\text{Log10(Acid Consumption}+0.00) = -2.47 + 1.28 * A \quad \text{(D.7)}$$

Final Equation in Terms of Actual Factors:

$$\text{Log10(Acid Consumption}+0.00) = -3.75219 + 0.25550 * \text{Initial Acid} \quad \text{(D.8)}$$

The Diagnostics Case Statistics Report for this response is shown below. Proceed to Diagnostic Plots (the next icon in progression). Be sure to look at the:

1) Normal probability plot of the studentized residuals to check for normality of residuals.

2) Studentized residuals versus predicted values to check for constant error.

3) Externally Studentized Residuals to look for outliers, i.e., influential values.

4) Box-Cox plot for power transformations.

TABLE D.20

Diagnostics Case Statistics

| Standard Order | Actual Value | Predicted Value | Residual | Leverage | Internally Studentized Residual | Externally Studentized Residual | Influence on Fitted Value DFFITS | Cook's Distance | Run Order |
|---|---|---|---|---|---|---|---|---|---|
| 1 | −3.868766 | −3.7521926 | −0.1166 | 0.118056 | −0.291736 | −0.283226 | −0.103623 | 0.0057 | 15 |
| 2 | −0.868333 | −1.1972122 | 0.32888 | 0.118056 | 0.823047 | 0.814337 | 0.2979386 | 0.04534 | 7 |
| 3 | −3.868766 | −3.7521926 | −0.1166 | 0.118056 | −0.291736 | −0.283226 | −0.103623 | 0.0057 | 9 |
| 4 | −1.177716 | −1.1972122 | 0.0195 | 0.118056 | 0.0487909 | 0.047245 | 0.0172854 | 0.00016 | 14 |
| 5 | −3.868766 | −3.7521926 | −0.1166 | 0.118056 | −0.291736 | −0.283226 | −0.103623 | 0.0057 | 10 |
| 6 | −1.025596 | −1.1972122 | 0.17162 | 0.118056 | 0.4294844 | 0.418264 | 0.1530289 | 0.01235 | 13 |
| 7 | −3.868766 | −3.7521926 | −0.1166 | 0.118056 | −0.291736 | −0.283226 | −0.103623 | 0.0057 | 12 |
| 8 | −1.209992 | −1.1972122 | −0.0128 | 0.118056 | −0.031983 | −0.030968 | −0.01133 | 6.85E−05 | 11 |
| 9 | −3.868766 | −3.7521926 | −0.1166 | 0.118056 | −0.291736 | −0.283226 | −0.103623 | 0.0057 | 3 |
| 10 | −1.13305 | −1.1972122 | 0.06416 | 0.118056 | 0.160572 | 0.155599 | 0.0569283 | 0.00173 | 17 |
| 11 | −3.868766 | −3.7521926 | −0.1166 | 0.118056 | −0.291736 | −0.283226 | −0.103623 | 0.0057 | 16 |
| 12 | −1.412962 | −1.1972122 | −0.2157 | 0.118056 | −0.539932 | −0.527615 | −0.193037 | 0.01951 | 6 |
| 13 | −3.868766 | −3.7521926 | −0.1166 | 0.118056 | −0.291736 | −0.283226 | −0.103623 | 0.0057 | 19 |
| 14 | −1.890409 | −1.1972122 | −0.6932 | 0.118056 | −1.734784 | −1.864137 | −0.682025 | 0.20142 | 5 |
| 15 | −3.868766 | −3.7521926 | −0.1166 | 0.118056 | −0.291736 | −0.283226 | −0.103623 | 0.0057 | 4 |
| 16 | −1.79223 | −1.1972122 | −0.595 | 0.118056 | −1.489081 | −1.553452 | −0.568356 | 0.14841 | 18 |
| 17 | −1.654207 | −2.4747024 | 0.8205 | 0.055556 | 1.9842548 | 2.212688 | 0.5366557 | 0.1158 | 1 |
| 19 | −1.430018 | −2.4747024 | 1.04468 | 0.055556 | 2.5264254 | 3.155211 | 0.765251 | 0.18773 | 8 |

Current Transform: Base 10 Log Constant: 0.000135

Box-Cox Power Transformation

| Constant k | 95% CI Low | 95% CI High | Best Lambda | Rec. Transform |
|---|---|---|---|---|
| 0.00014 | −0.24 | 0.17 | −0.04 | Log |

FIGS. 151-161 are State Ease graphs for acid consumption model.

D.1.5 Model Graphs

The graphs in FIGS. 162-167 show the preceding statistical data by varying the effects and their corresponding responses.

D.2 Pressure Oxidation Leach Model Fit Summaries & ANOVA

A description of the Response Surface Model for the 0.5 Factorial, 3 center points DOE is shown in the following sections.

D.2.1 Response 1: Arsenic Extraction ANOVA & Diagnostic Data

The Analysis of Variance and associated statistical data for Response Surface Reduced 2F1 Model for Response 1 Arsenic Extraction is shown below.

TABLE D.21

Backward Elimination Regression with Alpha to Exit = 0.100; Forced Terms: Intercept

| Coefficient Removed | t for H0 Estimate | Coeff = 0 | Prob > \|t\| | R-Squared | MSE |
|---|---|---|---|---|---|
| AF | 0.003873909 | 0.130343511 | 0.898290003 | 0.427632743 | 0.02628 |
| B-Temperature | −0.004108757 | −0.143373345 | 0.888038516 | 0.426792348 | 0.02457 |
| CF | 0.00433793 | 0.156564857 | 0.8776756 | 0.425855629 | 0.02307 |
| BD | 0.005637224 | 0.209960149 | 0.836349045 | 0.424273744 | 0.02177 |
| D-Acid | 0.007986792 | 0.306204071 | 0.763167557 | 0.421098412 | 0.02067 |
| AD | 0.008648594 | 0.340252673 | 0.737604828 | 0.41737505 | 0.01971 |
| BC | −0.009676432 | −0.389869865 | 0.700968707 | 0.412714096 | 0.01888 |
| CE | −0.010208882 | −0.420330149 | 0.678725908 | 0.407526088 | 0.01814 |
| A-Time | 0.017856587 | 0.750059325 | 0.461540393 | 0.39165374 | 0.01778 |
| EF | 0.017928752 | 0.760690731 | 0.454918151 | 0.37565284 | 0.01745 |
| AC | 0.018971721 | 0.812418313 | 0.424881162 | 0.357736153 | 0.0172 |
| BE | 0.019718299 | 0.850433696 | 0.403488944 | 0.338381599 | 0.01701 |
| E-Solids | −0.020081704 | −0.870941371 | 0.392072997 | 0.318307068 | 0.01685 |
| F-O2 Pressure | 0.022017182 | 0.959347947 | 0.346220495 | 0.294176489 | 0.0168 |
| BF | 0.023497317 | 1.025354967 | 0.314294952 | 0.266692433 | 0.01684 |
| C-Cu2+ | 0.024916987 | 1.08630955 | 0.286605984 | 0.235786964 | 0.01694 |
| DE | −0.026517577 | −1.152518103 | 0.258520426 | 0.200783425 | 0.01713 |
| DF | 0.026864937 | 1.161278396 | 0.254685606 | 0.164856842 | 0.01732 |
| AB | 0.027074105 | 1.163795386 | 0.253386353 | 0.128368637 | 0.01751 |
| CD | −0.02997355 | −1.281353288 | 0.209277401 | 0.083646696 | 0.01785 |

Hierarchical Terms Added after Backward Elimination Regression
A-Time,
E-Solids

TABLE D.22

Analysis of Variance Table [Partial sum of squares-Type III]

| Source | Sum of Squares | df | Mean Square | F Value | p-value Prob > F | |
|---|---|---|---|---|---|---|
| Model | 0.076880031 | 3 | 0.025626677 | 1.403670206 | 0.2603 | not significant |
| A-Time | 0.010203446 | 1 | 0.010203446 | 0.558881402 | 0.4603 | |
| E-Solids | 0.012904795 | 1 | 0.012904795 | 0.706844524 | 0.4069 | |
| AE | 0.05377179 | 1 | 0.05377179 | 2.945284691 | 0.0961 | |
| Residual | 0.565964127 | 31 | 0.018256907 | | | |
| Lack of Fit | 0.556946929 | 29 | 0.019205067 | 4.259652755 | 0.2078 | not significant |
| Pure Error | 0.009017198 | 2 | 0.004508599 | | | |
| Cor Total | 0.642844157 | 34 | | | | |

The "Model F-value" of 1.40 implies the model is not significant relative to the noise. There is a 26.03% chance that a "Model F-value" this large could occur due to noise.

Values of "Prob>F" less than 0.0500 indicate model terms are significant. In this case there are no significant model terms. Values greater than 0.1000 indicate the model terms are not significant.

If there are many insignificant model terms (not counting those required to support hierarchy), model reduction may improve your model.

The "Lack of Fit F-value" of 4.26 implies the Lack of Fit is not significant relative to the pure error. There is a 20.78% chance that a "Lack of Fit F-value" this large could occur due to noise. Non-significant lack of fit is good—we want the model to fit.

TABLE D.23

| Trend Data | | | |
|---|---|---|---|
| Std. Dev. | 0.135118124 | R-Squared | 0.119593574 |
| Mean | 1.379820144 | Adj R-Squared | 0.034392953 |
| C.V. % | 9.792444629 | Pred R-Squared | −0.083106026 |
| PRESS | 0.69626838 | Adeq Precision | 2.674094748 |

A negative "Pred R-Squared" implies that the overall mean is a better predictor of your response than the current model. "Adeq Precision" measures the signal to noise ratio. A ratio of 2.67 indicates an inadequate signal and we should not use this model to navigate the design space.

TABLE D.24

| Confidence Intervals | | | | | | |
|---|---|---|---|---|---|---|
| Coefficient Factor | Standard Estimate | 95% CI df | 95% CI Error | Low | High | VIF |
| Intercept | 1.379820144 | 1 | 0.022839131 | 1.333239428 | 1.4264 | |
| A-Time | 0.017856587 | 1 | 0.023885735 | −0.030858692 | 0.06657 | 1 |
| E-Solids | −0.020081704 | 1 | 0.023885735 | −0.068796983 | 0.02863 | 1 |
| AE | 0.040992297 | 1 | 0.023885735 | −0.007722981 | 0.08971 | 1 |

Final Equation in Terms of Coded Factors:

$$\begin{aligned}\text{Log10(As Extraction)} = \\ +1.38 \\ +0.018*A \\ -0.020*E \\ +0.041*A*E\end{aligned} \tag{D.9}$$

Final Equation in Terms of Actual Factors:

$$\begin{aligned}\text{Log10(As Extraction)} = \\ +1.61237\end{aligned} \tag{D.10}$$

-continued $$\begin{aligned}-0.25651*\text{Time} \\ -0.028612*\text{Solids} \\ +0.032794*\text{Time}*\text{Solids}\end{aligned}$$

The Diagnostics Case Statistics Report for this response is shown below. Proceed to Diagnostic Plots (the next icon in progression). Be sure to look at the:

1) Normal probability plot of the studentized residuals to check for normality of residuals.

2) Studentized residuals versus predicted values to check for constant error.

3) Externally Studentized Residuals to look for outliers, i.e., influential values.

4) Box-Cox plot for power transformations.

TABLE D.25

| Diagnostics Case Statistics | | | | | | | | | |
|---|---|---|---|---|---|---|---|---|---|
| Standard Order | Actual Value | Predicted Value | Residual | Leverage | Internally Studentized Residual | Externally Studentized Residual | Influence on Fitted Value DFFITS | Cook's Distance | Run Order |
| 1 | 1.35877 | 1.42303756 | −0.0643 | 0.12232 | −0.5076769 | −0.501511 | −0.1872249 | 0.00898 | 2 |
| 2 | 1.29297 | 1.37676614 | −0.0838 | 0.12232 | −0.6619887 | −0.655876 | −0.244853 | 0.01527 | 29 |
| 3 | 1.32194 | 1.42303756 | −0.1011 | 0.12232 | −0.7986868 | −0.79391 | −0.296384 | 0.02223 | 24 |
| 4 | 1.26712 | 1.37676614 | −0.1096 | 0.12232 | −0.8661892 | −0.862607 | −0.3220299 | 0.02614 | 13 |
| 5 | 1.56185 | 1.42303756 | 0.13881 | 0.12232 | 1.09656343 | 1.1002823 | 0.41075952 | 0.0419 | 20 |
| 6 | 1.40603 | 1.37676614 | 0.02927 | 0.12232 | 0.23121213 | 0.2276487 | 0.08498626 | 0.00186 | 9 |
| 7 | 1.26562 | 1.42303756 | −0.1574 | 0.12232 | −1.2435424 | −1.255024 | −0.468528 | 0.05388 | 5 |
| 8 | 1.27995 | 1.37676614 | −0.0968 | 0.12232 | −0.7648292 | −0.759593 | −0.2835727 | 0.02038 | 32 |
| 9 | 1.32871 | 1.42303756 | −0.0943 | 0.12232 | −0.7452087 | −0.739747 | −0.2761636 | 0.01935 | 21 |
| 10 | 1.35541 | 1.37676614 | −0.0214 | 0.12232 | −0.168688 | −0.166021 | −0.0619794 | 0.00099 | 10 |
| 11 | 1.43258 | 1.42303756 | 0.00954 | 0.12232 | 0.07537159 | 0.0741528 | 0.02768285 | 0.0002 | 6 |
| 12 | 1.39179 | 1.37676614 | 0.01502 | 0.12232 | 0.11865101 | 0.1167481 | 0.04358463 | 0.00049 | 33 |
| 13 | 1.49051 | 1.42303756 | 0.06748 | 0.12232 | 0.53304361 | 0.5267954 | 0.1966643 | 0.0099 | 3 |
| 14 | 1.43041 | 1.37676614 | 0.05364 | 0.12232 | 0.42374652 | 0.4180684 | 0.15607412 | 0.00626 | 30 |
| 15 | 1.4554 | 1.42303756 | 0.03236 | 0.12232 | 0.25563226 | 0.2517408 | 0.09398038 | 0.00228 | 25 |
| 16 | 1.42152 | 1.37676614 | 0.04476 | 0.12232 | 0.35358161 | 0.3485354 | 0.13011593 | 0.00436 | 14 |
| 17 | 1.20799 | 1.30088956 | −0.0929 | 0.12232 | −0.7339039 | −0.728325 | −0.2718996 | 0.01877 | 22 |
| 18 | 1.26639 | 1.41858732 | −0.1522 | 0.12232 | −1.2023099 | −1.211339 | −0.4522193 | 0.05037 | 7 |
| 19 | 1.25443 | 1.30088956 | −0.0465 | 0.12232 | −0.3670042 | −0.361823 | −0.1350765 | 0.00469 | 11 |

TABLE D.25-continued

| Diagnostics Case Statistics | | | | | | | | | |
|---|---|---|---|---|---|---|---|---|---|
| 20 | 1.397 | 1.41858732 | −0.0216 | 0.12232 | −0.1705143 | −0.16782 | −0.062651 | 0.00101 | 34 |
| 21 | 1.42483 | 1.30088956 | 0.12394 | 0.12232 | 0.97914458 | 0.9784717 | 0.36528496 | 0.0334 | 4 |
| 22 | 1.36862 | 1.41858732 | −0.05 | 0.12232 | −0.3946995 | −0.38926 | −0.1453195 | 0.00543 | 31 |
| 23 | 1.33664 | 1.30088956 | 0.03575 | 0.12232 | 0.28242737 | 0.2781929 | 0.10385551 | 0.00278 | 26 |
| 24 | 1.60131 | 1.41858732 | 0.18272 | 0.12232 | 1.44347878 | 1.470277 | 0.54888666 | 0.0726 | 15 |
| 25 | 1.36136 | 1.30088956 | 0.06047 | 0.12232 | 0.47774281 | 0.4717138 | 0.17610112 | 0.00795 | 1 |
| 26 | 1.4579 | 1.41858732 | 0.03932 | 0.12232 | 0.31060282 | 0.3060286 | 0.11424719 | 0.00336 | 28 |
| 27 | 1.41344 | 1.30088956 | 0.11255 | 0.12232 | 0.88912862 | 0.886041 | 0.33077855 | 0.02754 | 27 |
| 28 | 1.23279 | 1.41858732 | −0.1858 | 0.12232 | −1.46778 | −1.496862 | −0.5588113 | 0.07506 | 16 |
| 29 | 1.24597 | 1.30088956 | −0.0549 | 0.12232 | −0.4338237 | −0.428071 | −0.1598081 | 0.00656 | 23 |
| 30 | 1.25477 | 1.41858732 | −0.1638 | 0.12232 | −1.2940944 | −1.308896 | −0.4886397 | 0.05835 | 8 |
| 31 | 0.99351 | 1.30088956 | −0.3074 | 0.12232 | −2.4282155 | −2.654473 | −0.9909732 | 0.20544 | 12 |
| 32 | 1.60097 | 1.41858732 | 0.18238 | 0.12232 | 1.44081255 | 1.4673661 | 0.54779998 | 0.07233 | 35 |
| 33 | 1.67385 | 1.37982014 | 0.29403 | 0.02857 | 2.20784805 | 2.3659103 | 0.40575027 | 0.03584 | 17 |
| 34 | 1.60164 | 1.37982014 | 0.22182 | 0.02857 | 1.66562289 | 1.7171765 | 0.29449335 | 0.0204 | 18 |
| 35 | 1.53969 | 1.37982014 | 0.15987 | 0.02857 | 1.20043182 | 1.2093542 | 0.20740254 | 0.0106 | 19 |

Current Transform Base 10 Log Constant: 0
Box-Cox Power Transformation

| Constant k | 95% CI Low | 95% CI High | Best Lambda | Rec. Transform |
|---|---|---|---|---|
| 0 | −0.81 | 0.88 | 0 | Log |

FIGS. 168-178 are State Ease graphs for arsenic extraction model.

D.2.2 Response 2: Copper Difference ANOVA & Diagnostic Data

The Analysis of Variance and associated statistical data for Response Surface Reduced 2F1 Model for Response 2 Copper Difference is shown below. Row 15 was ignored for this analysis.

TABLE D.26

Backward Elimination Regression with Alpha to Exit = 0.100; Forced Terms: Intercept

| Coefficient Removed | t for H0 Estimate | Coeff = 0 | Prob > \|t\| | R- Squared | MSE |
|---|---|---|---|---|---|
| EF | −0.002106926 | −0.099402147 | 0.922460256 | 0.904978602 | 0.012083987 |
| AC | −0.003551447 | −0.175035889 | 0.863748201 | 0.904754662 | 0.01124729 |
| DE | −0.006018066 | −0.30849684 | 0.762246949 | 0.904107195 | 0.010568831 |
| F-O2 Pressure | 0.008071341 | 0.428076144 | 0.674678496 | 0.90293571 | 0.010029325 |
| AB | −0.007931878 | −0.432937913 | 0.670839332 | 0.901798631 | 0.009549944 |
| C-Cu2+ | −0.009015318 | −0.505384405 | 0.619778219 | 0.900323222 | 0.009154902 |
| DF | −0.008937036 | −0.512682256 | 0.61440767 | 0.898867703 | 0.008799712 |
| CF | −0.011478949 | −0.672812924 | 0.509167367 | 0.896458214 | 0.008558898 |
| BE | 0.013827771 | 0.823065287 | 0.420176999 | 0.892951065 | 0.008427432 |
| BC | 0.013377098 | 0.803529837 | 0.430670459 | 0.889659768 | 0.008291697 |
| CD | −0.025913672 | −1.571208047 | 0.130406568 | 0.877278116 | 0.008821174 |
| CE | 0.025941668 | 1.526686736 | 0.140474597 | 0.864841734 | 0.009310298 |

Hierarchical Terms Added after Backward Elimination Regression
F-O2 Pressure

TABLE D.27

Analysis of Variance Table [Partial sum of squares-Type III]

| Source | Sum of Squares | df | Mean Square | F Value | p-value Prob > F | |
|---|---|---|---|---|---|---|
| Model | 1.433346663 | 10 | 0.143334666 | 14.99322002 | <0.0001 | significant |
| A-Time | 0.134010727 | 1 | 0.134010727 | 14.01790904 | 0.0011 | |
| B-Temperature | 0.087173494 | 1 | 0.087173494 | 9.118599181 | 0.0061 | |
| D-Acid | 0.065834797 | 1 | 0.065834797 | 6.886509886 | 0.0152 | |
| E-Solids | 0.500426584 | 1 | 0.500426584 | 52.34606587 | <0.0001 | |
| F-O2 Pressure | 0.003567935 | 1 | 0.003567935 | 0.373216337 | 0.5472 | |
| AD | 0.046619622 | 1 | 0.046619622 | 4.876547128 | 0.0375 | |
| AE | 0.036296523 | 1 | 0.036296523 | 3.79672116 | 0.0637 | |

TABLE D.27-continued

| Analysis of Variance Table [Partial sum of squares-Type III] | | | | | | |
|---|---|---|---|---|---|---|
| Source | Sum of Squares | df | Mean Square | F Value | p-value Prob > F | |
| AF | 0.193808582 | 1 | 0.193808582 | 20.27293732 | 0.0002 | |
| BD | 0.114632531 | 1 | 0.114632531 | 11.99089377 | 0.0021 | |
| BF | 0.216533349 | 1 | 0.216533349 | 22.65001357 | <0.0001 | |
| Residual | 0.219879207 | 23 | 0.009559966 | | | |
| Lack of Fit | 0.215478137 | 21 | 0.010260864 | 4.662895358 | 0.1913 | not significant |
| Pure Error | 0.00440107 | 2 | 0.002200535 | | | |
| Cor Total | 1.65322587 | 33 | | | | |

The "Model F-value" of 14.99 implies the model is significant. There is a 0.01% chance that a "Model F-value" this large could occur due to noise.

Values of "Prob>F" less than 0.0500 indicate model terms are significant. In this case A, B, D, E, AD, AF, BD, BF are significant model terms. Values greater than 0.1000 indicate the model terms are not significant.

If there are many insignificant model terms (not counting those required to support hierarchy), model reduction may improve your model.

The "Lack of Fit F-value" of 4.66 implies the Lack of Fit is not significant relative to the pure error. There is a 19.13% chance that a "Lack of Fit F-value" this large could occur due to noise. Non-significant lack of fit is good—we want the model to fit.

TABLE D.28

| Trend Data | | | |
|---|---|---|---|
| Std. Dev. | 0.097775076 | R-Squared | 0.8669999 |
| Mean | 0.574503525 | Adj R-Squared | 0.809173769 |
| C.V. % | 17.01905592 | Pred R-Squared | 0.724451032 |
| PRESS | 0.455544682 | Adeq Precision | 16.46633067 |

The "Pred R-Squared" of 0.7245 is in reasonable agreement with the "Adj R-Squared" of "Adeq Precision" measures the signal to noise ratio. A ratio greater than 4 is desirable. Your ratio of 16.466 indicates an adequate signal. This model can be used to navigate the design space.

TABLE D.29

| Confidence Intervals | | | | | | |
|---|---|---|---|---|---|---|
| Coefficient Factor | Standard Estimate | 95% CI df | 95% CI Error | Low | High | VIF |
| Intercept | 0.579577132 | 1 | 0.016880022 | 0.544658145 | 0.614496119 | |
| A-Time | 0.066229971 | 1 | 0.017689394 | 0.029636672 | 0.10282327 | 1.013722346 |
| B-Temperature | 0.053410911 | 1 | 0.017687478 | 0.016821574 | 0.090000248 | 1.013675389 |
| D-Acid | −0.046420791 | 1 | 0.017689394 | −0.083014089 | −0.009827492 | 1.013722346 |
| E-Solids | 0.127983791 | 1 | 0.017689394 | 0.091390492 | 0.164577089 | 1.013722346 |
| F-O2 Pressure | 0.010806704 | 1 | 0.017689394 | −0.025786594 | 0.047400003 | 1.013722346 |
| AD | 0.039063321 | 1 | 0.017689394 | 0.002470022 | 0.075656619 | 1.013722346 |
| AE | 0.034468096 | 1 | 0.017689394 | −0.002125202 | 0.071061395 | 1.013722346 |
| AF | 0.079647342 | 1 | 0.017689394 | 0.043054043 | 0.11624064 | 1.013722346 |
| BD | −0.061254602 | 1 | 0.017689394 | −0.097847901 | −0.024661303 | 1.013722346 |
| BF | 0.084187416 | 1 | 0.017689394 | 0.047594117 | 0.120780715 | 1.013722346 |

Final Equation in Terms of Coded Factors:

$$
\begin{aligned}
Sqrt(\text{Cu Difference}) = \quad & (D.11)\\
& +0.579577132\\
& +0.06622997 * A\\
& +0.053410911 * B\\
& -0.046420791 * D\\
& +0.127983791 * E\\
& +0.010806704 * F\\
& +0.039063321 * A * D\\
& +0.034468096 * A * E\\
& +0.079647342 * A * F\\
& -0.061254602 * B * D\\
& +0.084187416 * B * F
\end{aligned}
$$

Final Equation in Terms of Actual Factors:

$$
\begin{aligned}
Sqrt(\text{Cu Difference}) = \quad & (D.12)\\
& +0.387651454\\
& -0.641920818 * \text{Time}\\
& 0.004077009 * \text{Temperature}\\
& 0.016988653 * \text{Acid}\\
& 0.0049159 * \text{Solids}\\
& -0.013729781 * \text{O2 Pressure}\\
& 0.015625328 * \text{Time} * \text{Acid}\\
& 0.027574477 * \text{Time} * \text{Solids}\\
& 0.006371787 * \text{Time} * \text{O2 Pressure}\\
& -0.000272243 * \text{Temperature} * \text{Acid}\\
& 7.48E\text{-}05 * \text{Temperature} * \text{O2 Pressure}
\end{aligned}
$$

The Diagnostics Case Statistics Report for this response is shown below. Proceed to Diagnostic Plots (the next icon in progression). Be sure to look at the:

1) Normal probability plot of the studentized residuals to check for normality of residuals.

2) Studentized residuals versus predicted values to check for constant error.

3) Externally Studentized Residuals to look for outliers, i.e., influential values.

4) Box-Cox plot for power transformations.

TABLE D.30

Diagnostics Case Statistics

| Standard Order | Actual Value | Predicted Value | Residual | Leverage | Internally Studentized Residual | Externally Studentized Residual | Influence on Fitted Value DFFITS | Cook's Distance | Run Order |
|---|---|---|---|---|---|---|---|---|---|
| 1 | 0.41808 | 0.5436781 | −0.1256 | 0.35529777 | −1.599887 | −1.6598026 | −1.232177 | 0.12824 | 2 |
| 2 | 0.49004 | 0.3823138 | 0.10773 | 0.34293579 | 1.359259 | 1.3862245 | 1.001465699 | 0.08766 | 29 |
| 3 | 0.68185 | 0.6353279 | 0.04652 | 0.34217942 | 0.5866785 | 0.5781249 | 0.416960491 | 0.01628 | 24 |
| 4 | 0.36607 | 0.4307367 | −0.0647 | 0.41171211 | −0.862333 | −0.8573513 | −0.71723368 | 0.04731 | 13 |
| 5 | 0.19433 | 0.237622 | −0.0433 | 0.34293579 | −0.546183 | −0.5376759 | −0.3884392 | 0.01415 | 20 |
| 6 | 0.45039 | 0.3697805 | 0.08061 | 0.34242803 | 1.016635 | 1.017411 | 0.734191648 | 0.04893 | 9 |
| 7 | 0.59506 | 0.6046343 | −0.0096 | 0.35350278 | −0.121827 | −0.1191878 | −0.08813426 | 0.00074 | 5 |
| 8 | 0.67605 | 0.7800197 | −0.104 | 0.34217942 | −1.311126 | −1.3330929 | −0.9614653 | 0.08129 | 32 |
| 9 | 0.25483 | 0.189163 | 0.06566 | 0.34242803 | 0.8281607 | 0.8223104 | 0.593401676 | 0.03247 | 21 |
| 10 | 0.49075 | 0.4775748 | 0.01318 | 0.34293579 | 0.1662461 | 0.1626896 | 0.117533694 | 0.00131 | 10 |
| 11 | 0.45807 | 0.3111569 | 0.14691 | 0.34217942 | 1.8525478 | 1.9642955 | 1.41670694 | 0.16229 | 6 |
| 12 | 0.66041 | 0.6427955 | 0.01762 | 0.37933457 | 0.2287283 | 0.2239556 | 0.175083129 | 0.00291 | 33 |
| 13 | 0.44918 | 0.4952191 | −0.046 | 0.34293579 | −0.58089 | −0.572336 | −0.41347909 | 0.01601 | 3 |
| 14 | 0.42655 | 0.4901081 | −0.0636 | 0.35529777 | −0.809586 | −0.8033193 | −0.59635498 | 0.03284 | 30 |
| 15 | 0.21759 | 0.3418504 | −0.1243 | 0.34271026 | −1.567539 | −1.6221822 | −1.17134482 | 0.11647 | 25 |
| 16 | 0.21692 | 0.2935126 | −0.0766 | 0.34217942 | −0.965891 | −0.9644226 | −0.69556961 | 0.04412 | 14 |
| 17 | 0.3968 | 0.4246534 | −0.0279 | 0.34293579 | −0.351479 | −0.3446806 | −0.2490115 | 0.00586 | 22 |
| 18 | 0.70175 | 0.6946843 | 0.00707 | 0.37697512 | 0.0915625 | 0.0895662 | 0.069670298 | 0.00046 | 7 |
| 19 | 0.71113 | 0.7916657 | −0.0805 | 0.35350278 | −1.024468 | −1.0256236 | −0.7584048 | 0.05217 | 11 |
| 20 | 1.07123 | 1.1049234 | −0.0337 | 0.37668034 | −0.436537 | −0.4287214 | −0.33327764 | 0.01047 | 34 |
| 21 | 0.72711 | 0.7307095 | −0.0036 | 0.35529777 | −0.045878 | −0.0448719 | −0.03331129 | 0.00011 | 4 |
| 22 | 0.62449 | 0.7072176 | −0.0827 | 0.35377447 | −1.052529 | −1.0551173 | −0.780678 | 0.05513 | 31 |
| 23 | 0.97663 | 0.8223593 | 0.15427 | 0.34217942 | 1.9453978 | 2.0815878 | 1.501301611 | 0.17897 | 26 |
| 25 | 0.73238 | 0.6822505 | 0.05013 | 0.34293579 | 0.6325004 | 0.6240487 | 0.450838463 | 0.01898 | 1 |
| 26 | 0.81838 | 0.8150118 | 0.00336 | 0.34242803 | 0.0424313 | 0.0415003 | 0.029947724 | 8.52E−05 | 28 |
| 27 | 0.41516 | 0.5288818 | −0.1137 | 0.34271026 | −1.43466 | −1.4704617 | −1.06179051 | 0.09756 | 27 |
| 28 | 0.63258 | 0.6184164 | 0.01416 | 0.37668034 | 0.1834313 | 0.1795307 | 0.139562826 | 0.00185 | 16 |
| 29 | 0.32919 | 0.3761944 | −0.047 | 0.34242803 | −0.592789 | −0.5842392 | −0.42160299 | 0.01664 | 23 |
| 30 | 0.73907 | 0.8024786 | −0.0634 | 0.35377447 | −0.806753 | −0.8004262 | −0.59223281 | 0.03239 | 8 |
| 31 | 0.47684 | 0.4981883 | −0.0213 | 0.34217942 | −0.269198 | −0.2636967 | −0.19018574 | 0.00343 | 12 |
| 32 | 1.03328 | 0.9676993 | 0.06558 | 0.34271026 | 0.8272742 | 0.8214031 | 0.593118513 | 0.03244 | 35 |

TABLE D.30-continued

| Diagnostics Case Statistics | | | | | | | | | |
|---|---|---|---|---|---|---|---|---|---|
| 33 | 0.65077 | 0.580764 | 0.07001 | 0.02987852 | 0.7269804 | 0.7193132 | 0.12623638 | 0.00148 | 17 |
| 34 | 0.74405 | 0.580764 | 0.16329 | 0.02987852 | 1.6955547 | 1.7727773 | 0.311114812 | 0.00805 | 18 |
| 35 | 0.70614 | 0.580764 | 0.12538 | 0.02987852 | 1.301892 | 1.322954 | 0.232172756 | 0.00475 | 19 |

Current Transform Square Root Constant: 0
Box-Cox Power Transformation

| Constant k | 95% CI Low | 95% CI High | Best Lambda | Rec. Transform |
|---|---|---|---|---|
| 0 | 0.16 | 0.79 | 0.48 | Square Root |

FIGS. 179-189 are State Ease graphs for copper difference model

D.2.3 Response 3: Iron Extraction ANOVA & Diagnostic Data

The Analysis of Variance and associated statistical data for Response Surface Reduced 2F1 Model for Response 3 Iron Extraction is shown below and FIGS. 190-200, which are State Ease graphs for iron extraction model.

TABLE D.31

Backward Elimination Regression with Alpha to Exit = 0.100; Forced Terms: Intercept

| Coefficient Removed | t for H0 Estimate | Coeff = 0 | Prob > \|t\| | R-Squared | MSE |
|---|---|---|---|---|---|
| CD | −0.003519684 | −0.116338704 | 0.909162125 | 0.812027313 | 0.027225518 |
| BD | 0.005196502 | 0.178154999 | 0.861153432 | 0.811601163 | 0.025468091 |
| BC | −0.006632222 | −0.235090909 | 0.81731736 | 0.810907005 | 0.023964309 |
| EF | 0.011154147 | 0.407595035 | 0.688972666 | 0.808943585 | 0.022788836 |
| B-Temperature | 0.01147767 | 0.430107322 | 0.672520313 | 0.806864528 | 0.021756999 |
| A-Time | 0.011668143 | 0.447483704 | 0.659864302 | 0.804715985 | 0.020841191 |
| DF | −0.015074657 | −0.590692082 | 0.561688065 | 0.801129778 | 0.020162724 |
| AD | −0.015095588 | −0.601381986 | 0.554341585 | 0.797533605 | 0.019549835 |
| F-O2 Pressure | 0.01624186 | 0.657111718 | 0.518246722 | 0.79337055 | 0.019044912 |
| CE | 0.022402954 | 0.918313124 | 0.368413826 | 0.785450077 | 0.018915158 |
| AF | 0.027934622 | 1.148980891 | 0.262372816 | 0.773135312 | 0.019167484 |
| AC | 0.028972922 | 1.183817425 | 0.248078306 | 0.759888081 | 0.019475255 |
| CF | 0.029649586 | 1.20185492 | 0.240681256 | 0.746014844 | 0.019808173 |
| AE | 0.037695277 | 1.515094467 | 0.141812415 | 0.723590775 | 0.020758607 |
| BF | 0.037836069 | 1.485531603 | 0.148986666 | 0.700998886 | 0.021653306 |
| C-Cu2+ | 0.043902786 | 1.687737726 | 0.102571805 | 0.670581303 | 0.023033487 |
| BE | 0.044128549 | 1.644806399 | 0.110807959 | 0.639850082 | 0.024342855 |

Hierarchical Terms Added after Backward Elimination Regression
A-Time,
B-Temperature

TABLE D.32

Analysis of Variance Table [Partial sum of squares−Type III]

| Source | Sum of Squares | df | Mean Square | F Value | p-value Prob > F | |
|---|---|---|---|---|---|---|
| Model | 1.306013583 | 6 | 0.21766893 | 8.444808578 | <0.0001 | significant |
| A-Time | 0.004356658 | 1 | 0.004356658 | 0.169023386 | 0.6841 | |
| B-Temperature | 0.004215759 | 1 | 0.004215759 | 0.163557018 | 0.689 | |
| D-Acid | 0.182248848 | 1 | 0.182248848 | 7.070630755 | 0.0128 | |
| E-Solids | 0.944579783 | 1 | 0.944579783 | 36.6464586 | <0.0001 | |
| AB | 0.087409324 | 1 | 0.087409324 | 3.391182234 | 0.0762 | |
| DE | 0.083203211 | 1 | 0.083203211 | 3.227999468 | 0.0832 | |
| Residual | 0.721713227 | 28 | 0.025775472 | | | |
| Lack of Fit | 0.695596471 | 26 | 0.02675371 | 2.048777397 | 0.3807 | not significant |
| Pure Error | 0.026116757 | 2 | 0.013058378 | | | |
| Cor Total | 2.02772681 | 34 | | | | |

The Model F-value of 8.44 implies the model is significant. There is a 0.01% chance that a "Model F-Value" this large could occur due to noise.

Values of "Prob>F" less than 0.0500 indicate model terms are significant. In this case D, E are significant model terms. Values greater than 0.1000 indicate the model terms are not significant.

If there are many insignificant model terms (not counting those required to support hierarchy), model reduction may improve your model.

The "Lack of Fit F-value" of 2.05 implies the Lack of Fit is not significant relative to the pure error. There is a 38.07% chance that a "Lack of Fit F-value" this large could occur due to noise. Non-significant lack of fit is good—we want the model to fit.

TABLE D.33

| Trend Data | | | |
|---|---|---|---|
| Std. Dev. | 0.160547415 | R-Squared | 0.644077682 |
| Mean | 1.076681654 | Adj R-Squared | 0.567808613 |
| C.V. % | 14.91131703 | Pred R-Squared | 0.441320042 |
| PRESS | 1.132850329 | Adeq Precision | 8.6688612 |

The "Pred R-Squared" of 0.4413 is in reasonable agreement with the "Adj R-Squared" of 0.5678. "Adeq Precision" measures the signal to noise ratio. A ratio greater than 4 is desirable. Your ratio of 8.669 indicates an adequate signal. This model can be used to navigate the design space.

TABLE D.34

| Confidence Intervals | | | | | | |
|---|---|---|---|---|---|---|
| Coefficient Factor | Standard Estimate | 95% CI df | 95% CI Error | Low | High | VIF |
| Intercept | 1.076659792 | 1 | 0.02713752 | 1.021071102 | 1.1322485 | |
| A-Time | 0.011668143 | 1 | 0.028381041 | −0.046467785 | 0.0698041 | 1 |
| B-Temperature | 0.01147767 | 1 | 0.028380441 | −0.046657028 | 0.0696124 | 1 |
| D-Acid | 0.075467056 | 1 | 0.028381041 | 0.017331128 | 0.133603 | 1 |
| E-Solids | −0.171808376 | 1 | 0.028381041 | −0.229944304 | −0.113672 | 1 |
| AB | 0.05226415 | 1 | 0.028381041 | −0.005871778 | 0.1104001 | 1 |
| DE | 0.050991179 | 1 | 0.028381041 | −0.007144749 | 0.1091271 | 1 |

Final Equation in Terms of Coded Factors:

$$\begin{aligned}\text{Log10(Fe Extraction)} = \quad & (D.13)\\ &+1.08\\ &+0.012*A\\ &+0.011*B\\ &+0.075*D\\ &-0.17*E\\ &+0.052*A*B\\ &+0.051*D*E\end{aligned}$$

Final Equation in Terms of Actual Factors:

$$\begin{aligned}\text{Log10(Fe Extraction)} = \quad & (D.14)\\ &+2.22946\\ &-1.09152*\text{Time}\end{aligned}$$

-continued $$\begin{aligned}&-6.45843E\text{-}003*\text{Temperature}\\ &-2.65153E\text{-}003*\text{Acid}\\ &-0.054758*\text{Solids}\\ &+9.29140E\text{-}003*\text{Time}*\text{Temperature}\\ &+1.0198E\text{-}003*\text{Acid}*\text{Solids}\end{aligned}$$

The Diagnostics Case Statistics Report for this response is shown below. Proceed to Diagnostic Plots (the next icon in progression). Be sure to look at the:

1) Normal probability plot of the studentized residuals to check for normality of residuals.

2) Studentized residuals versus predicted values to check for constant error.

3) Externally Studentized Residuals to look for outliers, i.e., influential values.

4) Box-Cox plot for power transformations.

TABLE D.35

Diagnostics Case Statistics

| Standard Order | Actual Value | Predicted Value | Residual | Leverage | Internally Studentized Residual | Externally Studentized Residual | Influence on Fitted Value DFFITS | Cook's Distance | Run Order |
|---|---|---|---|---|---|---|---|---|---|
| 1 | 1.239615 | 1.25311063 | −0.0135 | 0.21619 | −0.094949 | −0.093253 | −0.0489748 | 0.00036 | 2 |
| 2 | 1.227217 | 1.17191861 | 0.0553 | 0.21619 | 0.3890455 | 0.3830719 | 0.2011832 | 0.00596 | 29 |
| 3 | 1.190011 | 1.17153767 | 0.01847 | 0.21595 | 0.12995 | 0.1276468 | 0.066991 | 0.00066 | 24 |
| 4 | 1.190878 | 1.29940225 | −0.1085 | 0.21595 | −0.763403 | −0.757572 | −0.3975852 | 0.02293 | 13 |
| 5 | 1.501347 | 1.25311063 | 0.24824 | 0.21619 | 1.746448 | 1.8167827 | 0.9541451 | 0.12018 | 20 |
| 6 | 1.2302 | 1.17191861 | 0.05828 | 0.21619 | 0.4100354 | 0.4038611 | 0.2121014 | 0.00662 | 9 |
| 7 | 1.141721 | 1.17153767 | −0.0298 | 0.21595 | −0.209739 | −0.206122 | −0.1081759 | 0.00173 | 5 |
| 8 | 1.164804 | 1.29940225 | −0.1346 | 0.21595 | −0.946813 | −0.945002 | −0.4959513 | 0.03527 | 32 |
| 9 | 1.223741 | 1.30206238 | −0.0783 | 0.21619 | −0.551026 | −0.544055 | −0.2857289 | 0.01196 | 21 |
| 10 | 1.260612 | 1.22087037 | 0.03974 | 0.21619 | 0.2795997 | 0.2749456 | 0.144397 | 0.00308 | 10 |
| 11 | 1.333241 | 1.22048942 | 0.11275 | 0.21595 | 0.7931368 | 0.7877441 | 0.4134199 | 0.02475 | 6 |
| 12 | 1.244286 | 1.34835401 | −0.1041 | 0.21595 | −0.732049 | −0.725838 | −0.3809305 | 0.02109 | 33 |
| 13 | 1.373618 | 1.30206238 | 0.07156 | 0.21619 | 0.5034222 | 0.4966033 | 0.2608081 | 0.00999 | 3 |
| 14 | 1.284372 | 1.22087037 | 0.0635 | 0.21619 | 0.4467634 | 0.440285 | 0.2312306 | 0.00786 | 30 |
| 15 | 1.286523 | 1.22048942 | 0.06603 | 0.21595 | 0.4645041 | 0.4579017 | 0.2403137 | 0.00849 | 25 |
| 16 | 1.271013 | 1.34835401 | −0.0773 | 0.21595 | −0.544044 | −0.537087 | −0.2818712 | 0.01165 | 14 |
| 17 | 0.579323 | 0.80751152 | −0.2282 | 0.21619 | −1.605405 | −1.654458 | −0.8688948 | 0.10155 | 22 |
| 18 | 0.615056 | 0.7263195 | −0.1113 | 0.21619 | −0.782787 | −0.777233 | −0.4081905 | 0.02414 | 7 |
| 19 | 0.664586 | 0.72593856 | −0.0614 | 0.21595 | −0.431575 | −0.425215 | −0.2231591 | 0.00733 | 11 |
| 20 | 1.01733 | 0.85380314 | 0.16353 | 0.21595 | 1.150311 | 1.1572586 | 0.6073467 | 0.05206 | 34 |
| 21 | 0.778545 | 0.80751152 | −0.029 | 0.21619 | −0.203791 | −0.200267 | −0.105177 | 0.00164 | 4 |
| 22 | 0.879758 | 0.7263195 | 0.15344 | 0.21619 | 1.0795099 | 1.0828305 | 0.5686852 | 0.04592 | 31 |
| 23 | 0.794137 | 0.72593856 | 0.0682 | 0.21595 | 0.4797362 | 0.4730397 | 0.2482583 | 0.00906 | 26 |
| 24 | 0.992263 | 0.85380314 | 0.13846 | 0.21595 | 0.9739743 | 0.973049 | 0.5106707 | 0.03733 | 15 |
| 25 | 1.280237 | 1.06042799 | 0.21981 | 0.21619 | 1.5464491 | 1.5879086 | 0.8339441 | 0.09423 | 1 |
| 26 | 0.783145 | 0.97923597 | −0.1961 | 0.21619 | −1.379584 | −1.403256 | −0.7369675 | 0.07499 | 28 |
| 27 | 0.983594 | 0.97885503 | 0.00474 | 0.21595 | 0.0333375 | 0.0327374 | 0.0171811 | 4.37E−05 | 27 |
| 28 | 0.878948 | 1.10671961 | −0.2278 | 0.21595 | −1.602233 | −1.650859 | −0.8663954 | 0.10101 | 16 |
| 29 | 0.961569 | 1.06042799 | −0.0989 | 0.21619 | −0.695519 | −0.688963 | −0.3618325 | 0.01906 | 23 |
| 30 | 1.008097 | 0.97923597 | 0.02886 | 0.21619 | 0.2030481 | 0.1995362 | 0.1047932 | 0.00162 | 8 |
| 31 | 0.895766 | 0.97885503 | −0.0831 | 0.21595 | −0.584476 | −0.577477 | −0.3030687 | 0.01344 | 12 |
| 32 | 1.552976 | 1.10671961 | 0.44626 | 0.21595 | *3.139 | **3.83 | *2.01 | 0.38773 | 35 |
| 33 | 1.025921 | 1.07691485 | −0.051 | 0.02858 | −0.322263 | −0.317044 | −0.0543853 | 0.00044 | 17 |
| 34 | 1.00923 | 1.07691485 | −0.0677 | 0.02858 | −0.427745 | −0.421416 | −0.072289 | 0.00077 | 18 |
| 35 | 0.820177 | 1.07691485 | −0.2567 | 0.02858 | −1.622497 | −1.67389 | −0.2871364 | 0.01107 | 19 |

Current Transform: Base 10 Log Constant: 0
Box-Cox Power Transformation

| Constant k | 95% CI Low | 95% CI High | Best Lambda | Rec. Transform |
|---|---|---|---|---|
| 0 | −0.62 | 0.39 | −0.12 | Log |

**Case(s) with |External Stud. Residuals| > 3.54
*Exceeds limits

FIGS. 190-200 are State Ease graphs for iron extraction models.

D.2.4 Response 4: Acid Consumption ANOVA & Diagnostic Data

The Analysis of Variance and associated statistical data for Response Surface Reduced 2F1 Model for Response 4 Acid Consumption is shown below and in FIGS. 201-211, which are State Ease plots for acid consumption models.

TABLE D.36

Backward Elimination Regression with Alpha to Exit = 0.100; Forced Terms: Intercept

| Coefficient Removed | t for H0 Estimate | Coeff = 0 | Prob > \|t\| | R-Squared | MSE |
|---|---|---|---|---|---|
| DE | −0.138029101 | −0.070693961 | 0.944717286 | 0.771446227 | 113.3206104 |
| BD | −0.188863213 | −0.100361677 | 0.92148026 | 0.771281792 | 105.8419975 |
| CE | −0.283739077 | −0.156014559 | 0.878101838 | 0.77091065 | 99.38788843 |
| AF | −0.467499546 | −0.265270802 | 0.794188232 | 0.769903107 | 93.95294125 |
| F-O2 Pressure | 0.469619972 | 0.274073066 | 0.787330876 | 0.768886402 | 89.1254097 |
| BC | −0.777547625 | −0.465909128 | 0.646868836 | 0.766099284 | 85.45283919 |
| CD | 1.156152343 | 0.707500587 | 0.487843753 | 0.759937144 | 83.31889841 |
| BE | 1.28498068 | 0.796342378 | 0.435184461 | 0.752325217 | 81.86740854 |

TABLE D.36-continued

| Backward Elimination Regression with Alpha to Exit = 0.100; Forced Terms: Intercept | | | | | |
|---|---|---|---|---|---|
| Coefficient Removed | t for H0 Estimate | Coeff = 0 | Prob > \|t\| | R-Squared | MSE |
| A-Time | 2.236661589 | 1.39836243 | 0.176598571 | 0.72926295 | 85.42275188 |
| EF | −2.306647554 | −1.411787887 | 0.172000621 | 0.70473485 | 89.11132502 |

Hierarchical Terms Added after Backward Elimination Regression
A-Time,
F-O2 Pressure
Transform: Power
Lambda: 1.82
Constant: 8.67128

TABLE D.37

| Analysis of Variance Table [Partial sum of squares-Type III] | | | | | | |
|---|---|---|---|---|---|---|
| Source | Sum of Squares | df | Mean Square | F Value | p-value Prob > F | |
| Model | 5059.005436 | 13 | 389.1542643 | 4.34135189 | 0.0014 | significant |
| A-Time | 160.0849621 | 1 | 160.0849621 | 1.785886001 | 0.1957 | |
| B-Temperature | 438.2434011 | 1 | 438.2434011 | 4.888983604 | 0.0383 | |
| C-Cu2+ | 306.979975 | 1 | 306.979975 | 3.424626728 | 0.0784 | |
| D-Acid | 418.0938965 | 1 | 418.0938965 | 4.66419848 | 0.0425 | |
| E-Solids | 719.3726862 | 1 | 719.3726862 | 8.025223562 | 0.01 | |
| F-O2 Pressure | 7.057373393 | 1 | 7.057373393 | 0.078731095 | 0.7818 | |
| AB | 601.6384995 | 1 | 601.6384995 | 6.711797034 | 0.0171 | |
| AC | 405.2154028 | 1 | 405.2154028 | 4.520527761 | 0.0455 | |
| AD | 526.9094815 | 1 | 526.9094815 | 5.878130303 | 0.0244 | |
| AE | 301.7023474 | 1 | 301.7023474 | 3.365750234 | 0.0808 | |
| BF | 569.8209578 | 1 | 569.8209578 | 6.356844879 | 0.0198 | |
| CF | 317.6219748 | 1 | 317.6219748 | 3.543347426 | 0.0737 | |
| DF | 286.2644781 | 1 | 286.2644781 | 3.19352747 | 0.0884 | |
| Residual | 1882.41814 | 21 | 89.63895905 | | | |
| Lack of Fit | 1868.444761 | 19 | 98.33919794 | 14.07522076 | 0.0683 | not significant |
| Pure Error | 13.97337912 | 2 | 6.986689561 | | | |
| Cor Total | 6941.423576 | 34 | | | | |

The Model F-value of 4.34 implies the model is significant. There is a 0.14% chance that a "Model F-Value" this large could occur due to noise.

Values of "Prob>F" less than 0.0500 indicate model terms are significant. In this case B, D, E, AB, AC, AD, BF are significant model terms. Values greater than 0.1000 indicate the model terms are not significant.

If there are many insignificant model terms (not counting those required to support hierarchy), model reduction may improve your model.

The "Lack of Fit F-value" of 14.08 implies there is a 6.83% chance that a "Lack of Fit F-value" this large could occur due to noise. Lack of fit is bad—we want the model to fit. This relatively low probability (<10%) is troubling.

TABLE D.38

| Trend Data | | | |
|---|---|---|---|
| Std. Dev. | 9.46778533 | R-Squared | 0.72881382 |
| Mean | 51.292547 | Adj R-Squared | 0.560936662 |

TABLE D.38-continued

| Trend Data | | | |
|---|---|---|---|
| C.V. % | 18.45840358 | Pred R-Squared | 0.157267501 |
| PRESS | 5849.763238 | Adeq Precision | 13.53986235 |

The "Pred R-Squared" of 0.1573 is not as close to the "Adj R-Squared" of 0.5609 as one might normally expect. This may indicate a large block effect or a possible problem with your model and/or data. Things to consider are model reduction, response transformation, outliers, etc. "Adeq Precision" measures the signal to noise ratio. A ratio greater than 4 is desirable. Your ratio of 13.540 indicates an adequate signal. This model can be used to navigate the design space.

TABLE D.39

| Confidence Intervals | | | | | | |
|---|---|---|---|---|---|---|
| Coefficient Factor | Standard Estimate | 95% CI df | 95% CI Error | Low | High | VIF |
| Intercept | 51.29959579 | 1 | 1.600350986 | 47.97148372 | 54.627708 | |
| A-Time | 2.236661589 | 1 | 1.673683802 | −1.243954418 | 5.7172776 | 1 |
| B-Temperature | −3.700611655 | 1 | 1.673648382 | −7.181154 | −0.220069 | 1 |
| C-Cu2+ | 3.097276904 | 1 | 1.673683802 | −0.383339103 | 6.5778929 | 1 |
| D-Acid | 3.614613986 | 1 | 1.673683802 | 0.133997979 | 7.09523 | 1 |
| E-Solids | −4.741349644 | 1 | 1.673683802 | −8.221965651 | −1.260734 | 1 |
| F-O2 Pressure | 0.469619972 | 1 | 1.673683802 | −3.010996034 | 3.950236 | 1 |
| AB | −4.336035414 | 1 | 1.673683802 | −7.81665142 | −0.855419 | 1 |
| AC | 3.558508302 | 1 | 1.673683802 | 0.077892296 | 7.0391243 | 1 |
| AD | 4.057822236 | 1 | 1.673683802 | 0.577206229 | 7.5384382 | 1 |
| AE | −3.070537145 | 1 | 1.673683802 | −6.551153151 | 0.4100789 | 1 |
| BF | −4.219822855 | 1 | 1.673683802 | −7.700438862 | −0.739207 | 1 |
| CF | 3.150505787 | 1 | 1.673683802 | −0.33011022 | 6.6311218 | 1 |
| DF | 2.990947164 | 1 | 1.673683802 | −0.489668842 | 6.4715632 | 1 |

Final Equation in Terms of Coded Factors:

$$(\text{Acid } Consump + 8.67)\text{^}1.82 = \tag{D.15}$$

$$+51.30$$
$$+2.24*A$$
$$-3.70*B$$
$$+3.10*C$$
$$+3.61*D$$
$$-4.74*E$$
$$+0.47*F$$
$$-4.34*A*B$$
$$+3.56*A*C$$
$$+4.06*A*D$$
$$-3.07*A*E$$
$$-4.22*B*F$$
$$+3.15*C*F$$
$$+2.99*D*F$$

Final Equation in Terms of Actual Factors:

$$(\text{Acid } Consump + 8.67)\text{^}1.82 = \tag{D.16}$$

$$+2.51160$$

-continued $$+71.75419*\text{Time}$$
$$+0.60121*\text{Temperature}$$
$$-0.71525*\text{Cu2}+$$
$$-1.15498*\text{Acid}$$
$$+0.89405*\text{Solids}$$
$$+0.24423*\text{O2 Pressure}$$
$$-0.77085*\text{Time}*\text{Temperature}$$
$$+0.94894*\text{Time}*\text{Cu2}+$$
$$+1.62313*\text{Time}*\text{Acid}$$
$$-2.45643*\text{Time}*\text{Solids}$$
$$-3.75095E\text{-}003*\text{Temperature}*\text{O2 Pressure}$$
$$+4.20067E\text{-}003*\text{Cu2}+*\text{O2 Pressure}$$
$$+5.98189E\text{-}003*\text{Acid}*\text{O2 Pressure}$$

The Diagnostics Case Statistics Report for this response is shown below. Proceed to Diagnostic Plots (the next icon in progression). Be sure to look at the:

1) Normal probability plot of the studentized residuals to check for normality of residuals.

2) Studentized residuals versus predicted values to check for constant error.

3) Externally Studentized Residuals to look for outliers, i.e., influential values.

4) Box-Cox plot for power transformations.

TABLE D.40

| Diagnostics Case Statistics | | | | | | | | | |
|---|---|---|---|---|---|---|---|---|---|
| Standard Order | Actual Value | Predicted Value | Residual | Leverage | Internally Studentized Residual | Externally Studentized Residual | Influence on Fitted Value DFFITS | Cook's Distance | Run Order |
| 1 | 50.33589 | 52.4548 | −2.1189 | 0.43494 | −0.2977226 | −0.2911626 | −0.2554479 | 0.00487 | 2 |
| 2 | 52.1268 | 53.6046 | −1.4778 | 0.43494 | −0.2076386 | −0.2028428 | −0.1779616 | 0.00237 | 29 |
| 3 | 49.20739 | 42.382 | 6.82543 | 0.4347 | 0.9588322 | 0.95690504 | 0.8391222 | 0.0505 | 24 |
| 4 | 51.70001 | 48.8749 | 2.82508 | 0.4347 | 0.3968656 | 0.38876176 | 0.34091013 | 0.00865 | 13 |
| 5 | 52.48795 | 54.9293 | −2.4414 | 0.43494 | −0.3430316 | −0.3357064 | −0.2945278 | 0.00647 | 20 |
| 6 | 56.07582 | 63.5191 | −7.4433 | 0.43494 | −1.045853 | −1.0483144 | −0.9197256 | 0.06014 | 9 |
| 7 | 50.68302 | 54.9418 | −4.2588 | 0.4347 | −0.5982695 | −0.5888914 | −0.5164064 | 0.01966 | 5 |
| 8 | 54.53317 | 48.7042 | 5.82897 | 0.4347 | 0.8188498 | 0.81218706 | 0.71221716 | 0.03683 | 32 |

TABLE D.40-continued

| Diagnostics Case Statistics | | | | | | | | | |
|---|---|---|---|---|---|---|---|---|---|
| 9 | 52.6948 | 54.6462 | −1.9514 | 0.43494 | −0.2741934 | −0.2680657 | −0.2351841 | 0.00413 | 21 |
| 10 | 58.73106 | 65.8716 | −7.1405 | 0.43494 | −1.0033041 | −1.0034702 | −0.8803821 | 0.05534 | 10 |
| 11 | 52.46141 | 55.297 | −2.8356 | 0.4347 | −0.3983363 | −0.3902134 | −0.3421831 | 0.00872 | 6 |
| 12 | 52.86571 | 50.4184 | 2.44733 | 0.4347 | 0.3437991 | 0.33646175 | 0.29504759 | 0.00649 | 33 |
| 13 | 53.00348 | 38.363 | 14.6405 | 0.43494 | 2.0571199 | 2.24662517 | 1.97104873 | 0.23266 | 3 |
| 14 | 111.6258 | 94.5439 | 17.0819 | 0.43494 | 2.4001636 | 2.74963178 | *2.41 | 0.31673 | 30 |
| 15 | 43.83968 | 52.856 | −9.0163 | 0.4347 | −1.2666049 | −1.2861846 | −1.1278716 | 0.08812 | 25 |
| 16 | 51.97037 | 65.2485 | −13.278 | 0.4347 | −1.8652989 | −1.9929123 | −1.7476102 | 0.19111 | 14 |
| 17 | 54.17289 | 46.2091 | 7.96377 | 0.43494 | 1.1189806 | 1.12610083 | 0.98797059 | 0.06884 | 22 |
| 18 | 53.81337 | 40.8848 | 12.9286 | 0.43494 | 1.8165791 | 1.93099961 | 1.69413855 | 0.18143 | 7 |
| 19 | 52.78954 | 58.8236 | −6.0341 | 0.4347 | −0.8476663 | −0.8417639 | −0.7381535 | 0.03947 | 11 |
| 20 | 0.648594 | 13.4678 | −12.819 | 0.4347 | −1.8008405 | −1.9111984 | −1.6759542 | 0.17813 | 34 |
| 21 | 38.83523 | 41.8897 | −3.0544 | 0.43494 | −0.4291765 | −0.4206824 | −0.3690805 | 0.01013 | 4 |
| 22 | 50.59521 | 57.5934 | −6.9982 | 0.43494 | −0.9833035 | −0.9824905 | −0.8619758 | 0.05316 | 31 |
| 23 | 46.38086 | 44.4189 | 1.96198 | 0.4347 | 0.2756173 | 0.26946281 | 0.23629536 | 0.00417 | 26 |
| 24 | 46.26122 | 40.2617 | 5.9995 | 0.4347 | 0.8428058 | 0.83676774 | 0.73377227 | 0.03902 | 15 |
| 25 | 34.03686 | 42.2448 | −8.208 | 0.43494 | −1.1532949 | −1.1629316 | −1.0202836 | 0.07313 | 1 |
| 26 | 51.96072 | 59.3076 | −7.3468 | 0.43494 | −1.0322957 | −1.0339937 | −0.9071615 | 0.05859 | 28 |
| 27 | 49.33818 | 44.1358 | 5.20237 | 0.4347 | 0.7308263 | 0.72246001 | 0.63353436 | 0.02934 | 27 |
| 28 | 52.04113 | 42.6141 | 9.427 | 0.4347 | 1.3242985 | 1.34998209 | 1.18381646 | 0.09633 | 16 |
| 29 | 50.72231 | 56.6832 | −5.9608 | 0.43494 | −0.8375517 | −0.8313704 | −0.7293925 | 0.03857 | 23 |
| 30 | 56.52374 | 57.2583 | −0.7346 | 0.43494 | −0.1032181 | −0.1007561 | −0.0883971 | 0.00059 | 8 |
| 31 | 51.70473 | 44.7319 | 6.97287 | 0.4347 | 0.9795445 | 0.9785544 | 0.8581068 | 0.0527 | 12 |
| 32 | 52.7946 | 54.4072 | −1.6126 | 0.4347 | −0.226536 | −0.2213472 | −0.1941021 | 0.00282 | 35 |
| 33 | 55.81027 | 51.2174 | 4.59291 | 0.02858 | 0.4921948 | 0.48312767 | 0.08287496 | 0.00051 | 17 |
| 34 | 51.16378 | 51.2174 | −0.0536 | 0.02858 | −0.0057422 | −0.0056038 | −0.0009613 | 6.93E−08 | 18 |
| 35 | 51.30353 | 51.2174 | 0.08617 | 0.02858 | 0.0092343 | 0.00901178 | 0.00154587 | 1.79E−07 | 19 |

Current Transform: Power Lambda: 1.82 Constant: 8.67128
Box−Cox Power Transformation

| Constant k | 95% CI Low | 95% CI High | Best Lambda | Rec. Transform |
|---|---|---|---|---|
| 8.67128 | 1.3 | 2.45 | 1.82 | Power |

*Exceeds limits

FIGS. 201-211 are State Ease plots for acid consumption models.

D.2.5 Model Graphs

The model graphs in FIGS. 212-218 show the preceding statistical data by varying the effects and their corresponding responses.

We claim:

1. A method of leaching arsenic from an ore, the method comprising:

adding the ore to an airtight container, wherein the ore comprises arsenic and copper;

adding an acid-containing liquid of between 10 g and 30 g acid per liter to the container to form a solution;

pressurizing the container between 0 psi and 100 psi;

maintaining the solution at a temperature between 100 degrees Celsius and 160 degrees Celsius;

agitating the solution;

allowing the arsenic in the ore to dissolve;

filtering the solution to separate the dissolved arsenic from the ore.

2. The method of claim 1, wherein the temperature of the solution is about 160 degrees Celsius.

3. The method of claim 1, wherein the acid is sulfuric acid.

4. The method of claim 1, wherein the solution comprises solids at a concentration of between about 1 and 20 g/L.

5. The method of claim 4, wherein the solution comprises solids at a concentration of about 5 g/L.

6. The method of claim 1, wherein the concentration of arsenic in the ore is lowered by between about 15% and 90%.

7. The method of claim 1, wherein the concentration of arsenic in the ore is lowered by about 55%.

8. The method of claim 3, wherein the solution comprises solids at a concentration of between about 1 and 20 g/L.

9. The method of claim 3, wherein the solution comprises solids at a concentration of about 5 g/L.

10. The method of claim 3, wherein the concentration of arsenic in the ore is lowered by between about 15% and 90%.

11. The method of claim 3, wherein the concentration of arsenic in the ore is lowered by about 55%.

12. The method of claim 10, wherein the solution comprises solids at a concentration of between about 1 and 20 g/L.

13. The method of claim 10, wherein the solution comprises solids at a concentration of about 5 g/L.

14. The method of claim 10, wherein the sulfuric acid is at a concentration of about 30 g/L.

15. The method of claim 10, wherein the temperature is about 160 degrees Celsius.

16. The method of claim 15, wherein the sulfuric acid is at a concentration of about 30 g/L.

17. The method of claim 15, wherein the sulfuric acid is at a concentration of about 20 g/L.

18. The method of claim 15, wherein the sulfuric acid is at a concentration of about 10 g/L.

* * * * *